US006832991B1

(12) United States Patent
Inada et al.

(10) Patent No.: US 6,832,991 B1
(45) Date of Patent: Dec. 21, 2004

(54) MASSAGING APPARATUS HAVING PIVOTALLY SUPPORTED SUPPORTING ARM WITH THERAPEUTIC MEMBER

(75) Inventors: Nichimu Inada, Osaka (JP); Hideshi Kondo, Osaka (JP); Yasuo Fujii, Osaka (JP); Koji Goto, Osaka (JP)

(73) Assignee: Family Kabushiki Kaisha, Osaka (JP)

( * ) Notice: Subject to any disclaimer, the term of this patent is extended or adjusted under 35 U.S.C. 154(b) by 0 days.

(21) Appl. No.: 09/830,560

(22) PCT Filed: Aug. 28, 2000

(86) PCT No.: PCT/JP00/05808

§ 371 (c)(1),
(2), (4) Date: May 7, 2001

(87) PCT Pub. No.: WO01/19315

PCT Pub. Date: Mar. 22, 2001

(30) Foreign Application Priority Data

| | | |
|---|---|---|
| Sep. 9, 1999 | (JP) | 11-255930 |
| Oct. 26, 1999 | (JP) | 11-304069 |
| Oct. 26, 1999 | (JP) | 11-304070 |
| Jan. 17, 2000 | (JP) | 2000-008358 |
| Mar. 1, 2000 | (JP) | 2000-056185 |
| May 31, 2000 | (JP) | 2000-163289 |

(51) Int. Cl.[7] ..... A61H 15/00

(52) U.S. Cl. ..... 601/99; 601/100; 601/101; 601/102; 601/103; 601/116

(58) Field of Search ..... 601/97–103, 112, 601/115, 116, 113, 114

(56) References Cited

U.S. PATENT DOCUMENTS

| | | | | |
|---|---|---|---|---|
| 4,576,149 A | * | 3/1986 | Otuka et al. | 601/99 |
| 4,729,368 A | * | 3/1988 | Guitay | 601/123 |
| 5,083,552 A | * | 1/1992 | Lipowitz | 601/84 |
| 5,792,080 A | * | 8/1998 | Ookawa et al. | 601/115 |
| 6,009,346 A | * | 12/1999 | Ostrow | 604/20 |
| 6,190,339 B1 | * | 2/2001 | Imazaike et al. | 601/133 |
| 6,443,917 B1 | * | 9/2002 | Canto | 601/99 |

FOREIGN PATENT DOCUMENTS

| | | |
|---|---|---|
| JP | 4-343846 | 11/1992 |
| JP | 6-125952 | 5/1994 |
| JP | 6-190012 | 7/1994 |
| JP | 7-213572 | 8/1995 |
| JP | 7-323066 | 12/1995 |
| JP | 2511451 | 4/1996 |
| JP | 9-262263 | 10/1997 |
| JP | 9-299423 | 11/1997 |
| JP | 11-19150 | 1/1999 |
| JP | 11-123218 | 5/1999 |
| JP | 11-123219 | 5/1999 |
| JP | 2000-233004 | 8/2000 |
| WO | WO 98/57611 | * 12/1998 |

* cited by examiner

*Primary Examiner*—Nicholas D. Lucchesi
*Assistant Examiner*—Quang Thanh
(74) *Attorney, Agent, or Firm*—Oblon, Spivak, McClelland, Maier & Neustadt, P.C.

(57) ABSTRACT

A massaging apparatus in which a position of a specific portion such as a user's shoulder with respect to the massaging apparatus can be determined automatically and accurately in a simple construction. The massaging apparatus includes a supporting arm having a therapeutic member pivotally supported thereon and freely movable along the user's body. The position of the specific portion of the user with respect to the massaging apparatus is determined from the relation between the vertical position of the supporting arm and the pivotal position of the supporting arm. A pivotal movement detecting system detects that the supporting arm reaches a prescribed range of pivotal movement is provided. The position of the specific portion of the user with respect to the massaging apparatus is determined from the position of the supporting arm at the moment when the pivotal movement of the supporting arm reaches the prescribed range.

11 Claims, 66 Drawing Sheets

MASSAGING APPARATUS HAVING PIVOTALLY SUPPORTED SUPPORTING ARM WITH THERAPEUTIC MEMBER

TECHNICAL FIELD

The present invention relates to a massaging apparatus.

BACKGROUND ART

In general, in a chair type massaging apparatus having a seat portion and a seatback portion and comprising a massaging unit provided on the seatback portion so as to move upward and downward, the transmitting mechanism comprises a pair of right and left supporting arms, a pair of right and left driving arms for transmitting power to the supporting arms, the supporting arm being connected to the driving arm at the midsection thereof, a first therapeutic member (the upper therapeutic member) provided on one end portion (upper end portion) of the supporting arm, a second therapeutic member (lower therapeutic member) provided on the other end portion (lower end portion) of the supporting arm, so that a power is transmitted to the first therapeutic member and the second therapeutic member through the driving arm and the supporting arm to make the first therapeutic member and the second therapeutic member perform massage by the kneading action and the rapping action (for example, Japanese Patent Laid-Open No.262263/1997).

Since this type of the massaging apparatus of the related art is not generally constructed to recognize the position of the specific portion of the human body such as shoulders or the hip of the user with respect to the massaging apparatus automatically, for example, when the user makes the massaging apparatus automatically perform shoulder massage or hip massage successively by selecting an automatic operation course, the user had to change the sitting position so that the therapeutic member of the supporting arm is placed exactly on the desired location of the human body, or to operate the controller manually for fine adjustment of the moving position of the massaging unit (supporting arm).

In case of stimulating pressure points, which is well on its way to becoming a boom recent years, it is necessary to pinpoint the positions of the pressure points from the specific portion of the human body, such as shoulder, to some extent (for example about ±1 cm). However, there is a problem in that accurate positioning of the therapeutic member of the massaging unit with respect to the pressure points is difficult and thus the effective stimulation of the pressure points cannot be performed, since the position of the specific portion of the human body such as shoulders of the user with respect to the massaging apparatus cannot be recognized automatically. For example, when performing kneading, rapping, and acupressure automatically for recovering from fatigue, it is necessary to massage the specific position called "tenchu", points on the back of the head along the headline, a few centimeters away from the centerline, and to apply acupressure therapy to the positions called "haiyu", the third intercostal portions outsides of the columna vertebralis, and "kakuyu", the seventh intercostals portions outsides of the columna vertebralis, it could not place the massaging member exactly on these pressure points.

There is also a massaging apparatus with an automatic massaging function that performs massaging motion according to the preset program while successively changing operating modes, operating positions, and operating time periods of the therapeutic member, comprising a massaging unit that makes the therapeutic member perform rapping motion or kneading motion or the like by the rotating power of the motor and is provided in the seatback portion, wherein the vertical distribution of the pressure applied to the therapeutic member from the human body is obtained by moving the therapeutic member upward and downward while maintaining the extent of projection of the therapeutic member toward the human body to determine the position of shoulders therefrom (for example, Japanese Patent Laid-Open No.190012/1994).

However, the detection of the pressure in this case is performed by detecting the displacement of the spring that is compressed by a reaction force generated when the therapeutic member presses the human body from the back via an arm or the like, or by detecting the pressure applied to the therapeutic member from the human body by mechanical displacement, and thus it is difficult to detect a slight change in pressure applied to the therapeutic member from the human body. As a consequent, the positions of the shoulders and the hip of the user cannot be determined accurately, and it is difficult to place the position of the therapeutic member exactly on the pressure points of the body, and thus effective massaging cannot be performed in case where it is desired to apply acupressure therapy to the pressure points suitable to the symptom successively and automatically.

In addition, there is recognized another problem in that an arm for transmitting a reaction force applied when the therapeutic member presses the human body from the back, a spring for receiving a reaction force from the massaging member, and a spring holding mechanism for holding the spring are additionally required in order to detect the pressure that is applied to the therapeutic member by the human body by mechanical displacement thereof, whereby complicating the construction of the pressure detection mechanism.

With the problems described above in view, the present invention provides a massaging apparatus that can determine the specific portion of the user's body such as shoulders with respect to the massaging apparatus automatically and accurately in a simple construction.

In the related art, there is a known chair type massaging apparatus comprising a massaging mechanism that is movable upward and downward with respect to the seatback of the seat, in which the therapeutic members are provided in this massaging mechanism to perform massage such as kneading or rapping for the neck, shoulders, back, or hip of the user.

A massaging apparatus comprising an automatic therapeutic function having a program of motion or action of the therapeutic member stored in advance to automatically carry out a series of massaging motion according to the stored program (a series of action such as kneading or rapping), and comprising a mechanism that can automatically change the vertical position at which the therapeutic member performs massaging motion according to the seated height of the user prior to perform automatic therapy is also known.

For example, the chair type massaging apparatus as disclosed in the Japanese Patent Publication No.2511451 is operated in such a manner that the therapeutic member is moved once to the uppermost position and then moved downward to the position where it abuts to the shoulder of the user, where the shoulder position is recognized by a signal detected by the pressure sensor integrated in the therapeutic member and set as a point of origin of massaging motion prior to perform automatic therapy. Then, a series of massaging motion programmed upward or downward is performed successively with the point of origin regarded as a reference point.

Therefore, this massaging apparatus can detect the shoulder position of the user automatically and perform massaging motion according to the physique of the user without troublesome operation such as manually adjusting the position of the therapeutic member to match with the body of the user or entering data such as user's height or the seated height.

Normally, when using the chair type massaging machine, massaging motion is started by operating the switch provided on the armrest or the like immediately after sitting on the seat. However, immediately after sitting on the seat, the user is in many cases in an unstable state such that he/she is not a seated deep enough or the his/her back is not completely fitted with the seatback portion, or his/her back is bent and thus disturbed to take a proper posture due to action to operate the operating switch.

On the other hand, in the chair type massaging machine of the related art, since the therapeutic member may be kept in "stored" state in which it is saved to the uppermost position (higher position than the head of the user) when not in use, the massaging motion actually starts from this "stored" state in many cases, and thus the therapeutic member starts to move directly downward to detect the shoulder position without taking a process of upward movement when operating the switch.

Therefore, assuming that the shoulder position of the user is detected by moving the therapeutic member directly downward immediately after the user is seated, it cannot detect the accurate value because the seating state is not stable and thus the massaging motion is performed with the wrong shoulder position as a point of origin, whereby effective massage cannot be expected.

With such circumstances in view, it is an object of the present invention to provide a massaging apparatus that can perform an effective massage suitable to the physique of the user by recognizing the value detected accurately by the position detecting means for detecting the position of a specific portion of the body as a position of the specific portion from a control viewpoint.

In the related art, a chair type massaging apparatus that perform massaging motion such as kneading or rapping for the neck, shoulders, back and hip of the user by providing a massaging mechanism so as to move freely in the vertical direction with respect to the seatback portion of the seat is known.

As a chair type massaging apparatus of the related art, recently, a massaging apparatus provided with an automatic therapeutic function having a program stored in advance of movement or action of the therapeutic member provided with a massaging mechanism to automatically carry out a series of massaging motion according to the stored program (a series of action such as kneading and rapping) is used, and a massaging apparatus having such an automatic therapeutic function that can perform effective massage without requiring the user to perform troublesome operation by automatically detecting the position of the user's shoulders or the like and changing the vertical position at which massaging motion is to be performed according to the seated height of the user prior to performing automatic therapy as stated in Japanese Patent Laid-Open No.190012/1994 (hereinafter referred to as conventional example 1) and Japanese Patent Publication No.2511451 (hereinafter referred to as conventional example 2) has been developed.

However, in the massaging apparatus of both of the conventional examples 1 and 2, a sensor detects the pressure applied to the therapeutic member from the user's body, and the shoulder position or the like of the user is determined from a change in pressure. Therefore, since the pressure is detected also from portions of the body other than the shoulders, such as a back, complex control is required for determining the difference therebetween. In addition, the sensor is actuated frequently by the load to the therapeutic member generated by massaging motion for the back or the like of the body, which may impair durability of the sensor or may cause the sensor to malfunction.

The sensor described above is adapted to detect the shoulder position indirectly via the load applied to the therapeutic member, and thus the load should be applied sufficiently to the therapeutic member. Therefore, it is difficult to detect the accurate position of the shoulder stably, and thus it has a problem to be solved where the accuracy of detection is concerned.

In the massaging apparatus of the conventional example 1, a spring is compressed via the arm or the like by the load applied to the therapeutic member, and displacements of the spring is detected by the sensor. Since a number of members such as the arm or the like are interposed between the sensor and the therapeutic member, the pressure is absorbed by the deformation of these members or rattling or play at the connecting portion thereof, which also cause impairment of accuracy of detection.

The massaging apparatus of the conventional example 2 is formed in double-layer construction in the direction of radius around the outer peripheral portion of the therapeutic member, and is provided with a pressure sensor integrated between those layers. The problem is slightly alleviated where the accuracy of detection is concerned since there are fewer members interposed between the therapeutic member and the sensor in comparison with the conventional example 1. However, since the therapeutic member should have a complex and special construction, increase in cost is inevitable.

With these circumstanced in view, it is an object of the present invention to provide a massaging apparatus in which the shoulder position can be detected accurately with a simple construction.

For example, there is a chair type massaging apparatus having a seat portion and a seatback portion, in which a massaging unit having a therapeutic member that performs massaging motion is provided in the seatback portion so as to move freely in the vertical direction along the body of the user, and the therapeutic member is adapted to perform massaging motion such as kneading and rapping (for example, Japanese Patent Laid-Open No.262263/1997).

Since such a massaging apparatus of the related art is not generally constructed in such a manner that the position of the specific portion of the human body such as the shoulders or the hip of the user with respect to the massaging apparatus is recognized automatically, when the user makes the massaging apparatus automatically perform shoulder massage or hip massage successively for example by selecting an automatic operation course, the user has to change the sitting position by himself/herself so that the therapeutic member of the supporting arm is placed on the desired location of the human body, or to operate the controller manually for fine adjustment of the moving position of the massaging unit.

In case of stimulating pressure points, which is well on its way to becoming a boom recent years, it is necessary to pinpoint the positions of the pressure points from the specific portion of the human body, such as shoulder, to some extent (for example about ±1 cm). However, there is a problem in that accurate positioning of the therapeutic member on the massaging unit with respect to the pressure points is difficult and thus the effective stimulation of the pressure points cannot be performed, since the position of the specific portion of the human body such as shoulders of the user with respect to the massaging apparatus cannot be recognized automatically. For example, when performing kneading, rapping, and acupressure automatically for recovering from fatigue, though it is necessary to massage the specific position called "tenchu", points on the back of the head along the headline, a few centimeters away from the centerline, and to apply acupressure therapy to the positions called "haiyu", the third intercostal portions outsides of the columna vertebralis, and "kakuyu", the seventh intercostals portions outsides of the columna vertebralis, it could not place the massaging member exactly on these pressure points.

There is also a massaging apparatus with an automatic massaging function that performs massaging motion according to the preset program while successively changing operating modes, operating positions, and operating time periods of the therapeutic member, comprising a massaging unit that makes the therapeutic member perform rapping motion or kneading motion or the like by the rotating power of the motor and is provided in the seatback portion, wherein the vertical distribution of the pressure applied to the therapeutic member from the human body is obtained by moving the therapeutic member upward and downward while maintaining the extent of projection of the therapeutic member toward the human body to determine the position of shoulders therefrom (for example, Japanese Patent Laid-Open No.190012/1994).

However, the detection of the pressure in this case is performed by detecting the displacement of the spring that is compressed by a reaction force generated when the therapeutic member presses the human body from the back via an arm or the like, or by detecting the pressure applied to the therapeutic member from the human body by mechanical displacement, and thus it is difficult to detect a slight change in pressure applied to the therapeutic member from the human body. As a consequent, the positions of the shoulders and the hip of the user cannot be determined accurately, and it is difficult to place the therapeutic member exactly on the pressure points of the body, and thus effective massaging cannot be performed in case where it is desired to apply acupressure to the pressure points suitable to the symptom successively and automatically.

In addition, there is recognized another problem in that an arm for transmitting a reaction force applied when the therapeutic member presses the human body from the back, a spring for receiving a reaction force from the massaging member, and a spring holding mechanism for holding the spring are additionally required in order to detect the pressure that is applied to the therapeutic member by the human body by mechanical displacement thereof, whereby complicating the construction of the pressure detection mechanism.

With the problems described above in view, the present invention provides a massaging apparatus that can determine the specific portion of the user's body such as shoulders with respect to the massaging apparatus accurately in a simple construction.

In order to perform suitable massage according to the height of the user, various techniques to measure the shoulder position in advance for every user has been proposed.

For example, in the chair type massaging machine, there is a type in which the therapeutic member in the seatback portion is automatically moved downward from the upper portion to the lower portion, the load applied to the therapeutic member when the therapeutic member abuts to the shoulder is detected, and the position where the load is detected is regarded as the position of shoulders (related art 1).

Alternatively, there is a simple massaging apparatus in which the user selects the shoulder position that is suitable to the user manually from among several candidates for the shoulder position provided in advance instead of automatically detecting the shoulder position (related art 2)

The related art 1 seems to be convenient since the shoulder position can easily be obtained. However, there is an actual problem in that the shoulder position cannot be detected accurately.

In other words, when the user slouches, his/her shoulders are away from the seatback and thus even when the therapeutic member moves down to the shoulder position, it does not abut to the shoulder. In this case, the position where the therapeutic member abuts to the body is significantly lower than the actual position of the shoulder, and such lower position may be detected as the shoulder position by mistake.

The probability that the user is in the slouched posture is especially high at the time of detection of the shoulder position. Because the detection of the shoulder position has to be performed before massaging motion, it is to be performed immediately after the user sits on the massaging apparatus. It is rare that the user is seated as deep as the shoulder of the user comes into contact with the seatback of the seat at the moment immediately after seating, but it is normal that he/she is sitting on the front portion of the seat surface in a slouched posture.

At the moment immediately after seating, the user is holding the remote controller or operating the controller provided on the armrest for operating the massaging apparatus, and thus the user's line of sight is directed in the downward direction, and thus he/she is apt to take a slouched posture.

As described thus far, in the related art 1, since the shoulder position is detected automatically, the user is not much aware of the fact that the detection of the shoulder position is being performed. Therefore, it is almost impossible to expect the user always takes a proper posture so that the shoulder position is accurately detected, whereby the accurate detection of the shoulder position cannot be made after all.

On the other hand, the related art 2 does not have problems as in the related art 1, since the user selects a candidate for the shoulder position that matches with the position of his/her shoulder by manual operation, and thus the user is involved in setting of the shoulder position.

However, a method of selecting a shoulder position from among several preset candidates for the shoulder position have a problem in that there is not necessarily a candidate for the shoulder position that exactly matches with the position of the user's shoulders, and in this case, the user is obliged to select a candidate that is in the closest position to his/her actual shoulder position, and thus the accurate shoulder position cannot be obtained.

For example, in massaging apparatuses comprising a seat portion and the seatback portion as a general basic structure, there is a type having a massage drive comprising a massaging member such as a kneading ball and an air cell for advancing the massaging member toward the user by inflation and retracting the massage drive from the user by deflation provided within the seatback portion, and the massage drive is moved along the body of the user from the upper portion, or the neck, to the lower portion, or the position around the hip.

Since this type of the massaging apparatus of the related art is not constructed to recognize the position of the specific portion of the human body such as shoulders or the hip of the user with respect to be massaging apparatus automatically, for example, when the user makes the massaging apparatus automatically perform shoulder massage or hip massage successively by selecting an automatic operation course, the user has to change the sitting position so that the massaging member of the massage drive is placed on the desired location of the human body, or to operate the controller manually for fine adjustment of the moving position of the massage drive.

In case of stimulating pressure points, which is well on its way to becoming a boom recent years, it is necessary to pinpoint the positions of the pressure points from the specific portion of the human body, such as shoulder, to some extent (for example about ±1 cm). However, there is a problem in that accurate positioning of the massaging member on the massage drive with respect to the pressure points is difficult and thus the effective stimulation of the pressure points cannot be performed, since the position of the specific portion of the human body such as shoulders of the user with respect to the massaging apparatus cannot be recognized automatically. For example, when performing kneading, rapping, and acupressure automatically for recovering from fatigue, though it is necessary to massage the specific position called "tenchu", points on the back of the head along the headline, a few centimeters away from the centerline, and to apply acupressure therapy to the positions called "hai-yu", the third intercostal portions outsides of the columna vertebralis, and "kaku-yu", the seventh intercostals portions outsides of the columna vertebralis, it could not place the massaging member exactly on these pressure points.

There is also a massaging apparatus with an automatic massaging function that performs massaging motion according to the preset program while successively changing operating modes, operating positions, and operating time periods of the massaging member, comprising a mechanical massaging drive that makes the massage member perform rapping motion or kneading motion or the like by the rotating power of the motor and is provided in the seatback portion, wherein the vertical distribution of the pressure applied to the massaging member from the human body is obtained by moving the massaging member upward and downward while maintaining the extent of projection of the massaging member toward the human body to determine the position of shoulders therefrom (for example, Japanese Patent Laid-Open No.190012/1994).

However, the detection of the pressure in this case is performed by detecting the displacement of the spring that is compressed by a reaction force generated when the massaging member presses the human body from the back via an arm or the like, or by detecting the pressure applied to the massaging member from the human body by mechanical displacement, and thus it is difficult to detect a slight change in pressure applied to the massaging member from the human body. As a consequent, the position of the user's shoulder position cannot be determined accurately, and thus even when this method is applied to the massaging apparatus in which the massaging member performs the rapping or kneading action by inflation and deflation of the air cell, it is difficult to place the massaging member exactly on the pressure point of the body since the shoulder position as the reference cannot be determined accurately, whereby effective massage cannot be expected in case where it is desired to apply acupressure therapy to the pressure point suitable to the symptom successively and automatically.

In addition, there is recognized another problem in that an arm for transmitting a reaction force applied when the massaging member presses the human body from the back, a spring for receiving a reaction force from the massaging member, and a spring holding mechanism for holding the spring are additionally required in order to detect the pressure that is applied to the massaging member by the human body by mechanical displacement thereof, whereby complicating the construction of the pressure detection mechanism.

With the problems described above in view, the present invention provides a massaging apparatus that can determine the shoulder position of the user with respect to the massaging apparatus automatically and accurately in a simple construction.

Alternatively, as stated in Japanese Laid-Open No.190012/1994, there is a known chair type massaging apparatus comprising a massaging mechanism adapted to move upward and downward freely with respect to the seatback of the seat, in which the massaging mechanism comprises a pair of right and left arms projecting toward the user and a therapeutic member mounted on one end of each of the arms so as to rotate freely about a lateral axis thereof so that the therapeutic member performs massage such as kneading or rapping for the neck, shoulders, back and hip of the user.

This massaging apparatus comprises an automatic therapy mechanism having a program of movement or action of the therapeutic member stored in advance to automatically carry out a series of massaging motion according to the stored program (a series of action such as kneading or rapping).

It also comprises a mechanism for detecting the height of the user's shoulder automatically so that the vertical position at which the therapeutic member performs massaging motion can be changed automatically according to the seated height of the user prior to perform automatic therapy, and a mechanism for detecting the width and the shape of the body so that an adequate kneading action according to the width of the neck or the like can be performed, and thus comprises a pressure sensor for detecting the pressure applied to the therapeutic member from the body in the fore-and-aft directions (hereinafter, referred to as a first sensor) and a pressure sensor for detecting the pressure in the lateral direction (hereinafter, referred to as a second sensor).

More specifically, this massaging apparatus is operated in such a manner that, prior to the automatic therapy by moving the therapeutic member upward and downward while maintaining the extent of projection of the therapeutic member toward the human body, the pressure in the fore-and-aft directions applied to the therapeutic member from the shoulder or the back of the user is detected by the first sensor, the position of the shoulder is determined from the distribution of the detected pressure in the upper and the lower directions, the determined position is set as a point of origin of the massaging motion, and a series of massaging motion programmed from the point of origin as a reference point is performed successively and upwardly or downwardly.

The second sensor is adapted to detect a force that the left and the right therapeutic members pressurize toward each other with the user's body interposed therebetween so that massage of an adequate kneading force is performed by determining the width and the shape of the body from the distance between these left and right therapeutic members by moving these left and right therapeutic members upward and downward along the body while adjusting the distance therebetween to keep the pressure constant, and controlling the same with feedback of the determined data. The second sensor can detect the strength of kneading motion (kneading strength) since the second sensor is adapted to detect the pressure applied in the lateral direction.

As is described thus far, the massaging apparatus of the related art is effective in the respect that an adequate massaging motion can be performed by recognizing the shape or the like of the user's body by means of the first and the second sensors, but a following disadvantage exists in its pressure detecting mechanism.

The massaging apparatus of this type is constructed in such a manner that the arm is pivoted to the front and back, or is moved to the left and the right by the pressure in the fore-and-aft directions or in the lateral direction applied to the therapeutic member from the body, and the displacement of the spring compressed by the pivotal position or the movement in the left and the right directions is detected by the first and the second sensors, whereby the construction is disadvantageously complex because there are pluralities of members such as an arm, a spring, and the like interposed between the first and second sensors and the therapeutic member, and the pressure is absorbed by the deformation of the arm or the like or the rattling or the play at the connecting portion between those members, thereby impairing the accuracy of detection.

Therefore, the accurate determination of the shape of the body is impaired, and the accuracy is hindered when detecting the kneading force by the second sensor.

The massaging apparatus having a pressure sensor for the therapeutic member has been known in the related art (for example, see Japanese Patent Publication No.2511451), and it has an advantage in terms of the accuracy of detection because there are fewer members interposed between the sensor and the therapeutic member. However, disadvantageously, the construction of the therapeutic member have to be complex and special because a sensor is integrated, and the wiring construction of the pressure sensor is complex because the therapeutic member is adapted to rotate.

On the other hand, though massaging motion can be made with an adequate kneading force by providing the second sensor in the massaging apparatus of the related art described above, the second sensor is used strictly for detecting the width and shape of the human body and provided separately from the first sensor that detects the position of the shoulder of the user in the upper and the lower directions, and thus the two types of sensors are used thereby increasing the cost and impairing the miniaturization of the apparatus.

With these circumstances in view, it is an object of the present invention to provide a massaging apparatus in which the detecting structure of the load applied to the therapeutic member is simplified and the accurate detection is ensured.

It is another object of the present invention is to provide a miniaturized massaging apparatus at low cost in which the detection of the kneading strength or the like is enabled by providing a detector for detecting the load in the lateral direction with respect to the therapeutic member and simultaneously the level of the user's shoulder or the like is determined by means of the detector.

DISCLOSURE OF INVENTION

The technical means of the present invention to solve the above-described problems is, in a massaging apparatus comprising a supporting arm 26 with a therapeutic member mounted thereon pivotally supported and movable along the body of the user, that the position of specific portion of the user with respect to the massaging apparatus is determined from the relation between the vertical position of the supporting arm 26 and the pivotal position of the supporting arm 26.

In this case, in a massaging apparatus wherein the mid-section of the supporting arm 26 is pivotally connected to the driving arm 25 for transmitting a power to the supporting arm 26, a first therapeutic member 8 is mounted on one end of the supporting arm 26, a second therapeutic member 9 is mounted on the other end of the supporting arm 26, and the supporting arm 26 moves freely along the user's body with the driving arm 25, it may be constructed in such a manner that the position of the specific portion of the user with respect to the massaging apparatus can be determined from the relation between the vertical position of the supporting arm 26 and the pivotal position of the supporting arm 26 with respect to the driving arm 25.

In this case, the supporting arm 26 and the driving arm 25 may be moved along the user's body with the first therapeutic member 8 and the second therapeutic member 9 being kept into contact with the user to determine the position of the specific portion of the user with respect to the massaging apparatus from the relation between the vertical position of the supporting arm 26 and the pivotal position detected by a pivotal-position-detecting sensor 60.

Another technical means of the present invention is, in a massaging apparatus comprising a supporting arm 26 with a therapeutic member mounted thereon pivotally supported and movable along the body of the user, that a pivotal-position-detecting sensor 60 for detecting that the supporting arm 26 reached the prescribed range of pivotal movement is provided.

In this case, in a massaging apparatus wherein the mid-section of the supporting arm 26 is pivotally connected to the driving arm 25 for transmitting a power to the supporting arm 26, a first therapeutic member 8 is mounted on one end of the supporting arm 26, a second therapeutic member 9 is mounted on the other end of the supporting arm 26, and the supporting arm 26 moves freely along the user's body with the driving arm 25, there may be provided a pivotal-position-detecting sensor 60 for detecting that the supporting arm 26 reached the prescribed range of pivotal movement with respect to the driving arm 25.

Still another technical means of the present invention is, in a massaging apparatus comprising a supporting arm 26 with a therapeutic member mounted thereon pivotally supported and movable along the body of the user, that a pivotal-position-detecting sensor 60 for detecting the pivotal position of the supporting arm 26 is provided.

In this case, in a massaging apparatus wherein the mid-section of the supporting arm 26 is pivotally connected to the driving arm 25 for transmitting a power to the supporting arm 26, a first therapeutic member 8 is mounted on one end of the supporting arm 26, a second therapeutic member 9 is mounted on the other end of the supporting arm 26, and the supporting arm 26 moves freely along the user's body with the driving arm 25, there may be provided a pivotal-position-detecting sensor 60 for detecting the pivotal position of the supporting arm 26 with respect to the driving arm 25.

Further technical means of the present invention is, in a massaging apparatus comprising a supporting arm 26 with a therapeutic member mounted thereon pivotally supported and movable along the body of the user, that the position of the specific portion of the user with respect to the massaging apparatus is determined from the vertical position of the supporting arm 26 at the moment when the pivotal movement of the supporting arm 26 reached the prescribed range.

In this case, in a massaging apparatus wherein the mid-section of the supporting arm 26 is pivotally connected to the driving arm 25 for transmitting a power to the supporting arm 26, a first therapeutic member 8 is mounted on one end of the supporting arm 26, a second therapeutic member 9 is mounted on the other end of the supporting arm 26, and the supporting arm 26 moves freely along the user's body with the driving arm 25, it may be constructed in such a manner that a pivotal-position-detecting sensor 60 for detecting the pivotal position of the supporting arm 26 with respect to the driving arm 25 is provided, and the supporting arm 26 and the driving arm 25 are moved together along the user's body with the first therapeutic member 8 and the second therapeutic member 9 being kept into contact with the user to determine the position of the specific portion of the user with respect to the massaging apparatus from the vertical position of the supporting arm 26 at the moment when the pivotal-position-detecting sensor 60 detected that the supporting arm 26 reached the prescribed range of pivotal movement with respect to the driving arm 25.

Still further technical means of the present invention is characterized in that the pivotal-position-detecting sensor 60 comprises an optical sensor having a light emitting element 57 and a light receiving element 58, and the fact that the supporting arm 26 reached the prescribed range of pivotal movement is detected by determining whether or not light from the light emitting element 57 is received by the light receiving element 58.

Another technical means of the present invention is characterized in that the pivotal-position-detecting sensor 60 comprises a limit switch 63, and the fact that the supporting arm 26 reached the prescribed range of pivotal movement is detected by switching of the limit switch 63 between ON and OFF.

Still another technical means of the present invention is characterized in that the pivotal-position-detecting sensor 60 comprises a lead switch 66, and the lead switch 66 is switched between ON and OFF by the change of the magnetic field at the moment when the supporting arm 26 reached the prescribed range of pivotal movement.

Another technical means of the present invention is characterized in that the pivotal-position-detecting sensor 60 comprises a variable resistor 69 or an encoder of which the output varies according to the pivotal position of the supporting arm 26.

Another technical means of the present invention is characterized in that the pivotal-position-detecting sensor 60 comprises a magnetoelectric converting element, and the output of the magnetoelectric converting element varies with the variation in magnetic field due to the pivotal position of the supporting arm 26.

Another technical means of the present invention is characterized in that the position of the specific portion of the user to be determined is the position of the shoulder.

Another technical means of the present invention is characterized in that there are provided a pair of left and right supporting arms 26 and a pair of pivotal-position-detecting sensors 60 corresponding to the respective supporting arms 26.

In this case, the pivotal position can be detected more accurately while preventing erroneous detection by the pivotal-position-detecting sensor 60, for example, by taking the matched values or by averaging the values from the values detected by both of the pair of pivotal-position-detecting sensors 60.

In addition, in the present invention, the following technical means are instituted in order to achieve the above-described objects.

The present invention is a massaging apparatus comprising a therapeutic member for massaging the user's body provided so as to move freely along the user's body in the vertical direction, and characterized in that a position detecting means for detecting the position of the specific portion of the body is provided so that the detected value obtained by the position detecting means in the process of movement of the therapeutic member from the lower position to the upper position of the specific portion is recognized as the position of the specific portion.

In this case, when the therapeutic member is moved upward from the hip to the shoulder along the body, the back of the user is stretched by the "rubbing" effect of the therapeutic member, more specifically, the "rubbing" action on the hip portion corrects the posture of the user so that the back portion comes into intimate contact with the seatback portion. In addition, since the "rubbing" effect allows the user's body to fit with the massaging apparatus, the user leaves his/her body naturally to the massaging apparatus thereby stabilizing the posture.

Since the detected value obtained by the position detecting means in the process of the upward movement of the therapeutic member is considered to be a value that indicates the exact position of the specific portion of the body that is obtained in a state in which the posture of the user is corrected or stabilized, the physique of the user can be accurately determined by recognizing the detected value as the position of the specific portion of the body from the control viewpoint.

Therefore, recognition of the erroneously detected value caused by the improper posture of the user as the position of the specific portion of the body can be prevented as much as possible, thereby enabling effective massage corresponding to the physique of the user determined based on the accurately detected value.

The present invention is characterized in that the detected value obtained by the position detecting means in the process of reverse and upward movement of the therapeutic member after being moved downward to the position lower than the specific portion of the body once is recognized as the position of the specific portion of the body.

In this arrangement, since the posture of the user is positively corrected by the "rubbing" movement by the upward and downward reciprocal movement of the therapeutic member, and thus the posture of the user is further stabilized, the accuracy of the detected value obtained in the process of upward movement is increased.

The present invention is characterized in that the first value detected by the position detecting means in the process of downward movement of the therapeutic member from the upper position of the specific portion of the body and the second value detected by the position detecting means in the process of upward movement thereof from the lower position of the specific portion of the body are compared, and when these values are close agreement with each other, the second value is recognized as the position of the specific portion of the body.

In this arrangement, when recognizing the detected value obtained in the process of upward movement of the therapeutic member as the position of the specific portion of the body (second detected value), it is compared with the detected value obtained in the process of downward movement of the therapeutic member (first detected value), and when these detected values are close agreement with each other, the second detected value is recognized as the position of the specific portion of the body.

In other words, highly reliable recognition of the accurate position is realized by imposing prescribed condition to the second detected value, and the physique of the user can be determined more accurately in comparison with the case where the second detected value obtained simply in the process of upward movement is recognized as the position of the specific portion of the body.

The present invention is characterized in that the therapeutic member moves upward a plurality of time and the position of the specific portion is detected by the position detecting means in every process of upward movement, and when the detected values are in close agreement with each other, the value last detected is recognized as the position of the specific portion.

In this arrangement, comparing a plurality of detected values obtained in the process of the plurality of times of upward movements of the therapeutic member increases reliability of recognition of the accurate position, and when these detected values are in close agreement with each other, the value last detected in a state in which the posture is positively corrected and stabilized by "rubbing" effect of a plurality of times of upward movement of the therapeutic member is recognized as the position of the specific portion of the body, thereby determining the physique of the user more accurately.

In the present invention, the following technical means are instituted in order to achieve the above-described objects.

The present invention is a massaging apparatus comprising a therapeutic member 226 for massaging the user's body provided so as to move freely along the body, characterized in that the therapeutic member 226 is provided via a supporting body 225 projecting toward the user, and a detector 240 for directly detecting the shoulder S of the user is provided at the position of the supporting body 225 behind the therapeutic member 226.

In this case, for example, when the therapeutic member 226 is moved downward from the side of the user's head toward the shoulder S, the user's shoulder S is placed behind the therapeutic member 226, or under the supporting body 225 projecting toward the user, and the presence of the shoulder S thus placed is directly detected by the detector 240.

Since the detector 240 is provided behind the therapeutic member 226, the detector 240 cannot easily detect the back or the hip when the therapeutic member 226 is in contact with these portions, and thus complex control for determining the shoulder position is not necessary.

Therefore, the shoulder position can be detected accurately in the simple construction in comparison with the case where the load applied on the therapeutic member 226 is detected as in the related art, thereby ensuring massaging motion suitable to the physique of the user.

In addition, since the detector 240 is not actuated while massaging the back and the hip, durability of the detector 240 is prevented from being lowered, thereby simplifying the structure and reducing the cost in comparison with the case where the detector is integrated in the therapeutic member.

The massaging apparatus according to the present invention is a massaging apparatus comprising a therapeutic member 226 for massaging the users body provided so as to move a along the body, characterized in that the therapeutic member 226 is mounted via a supporting body 225 projecting toward the user, the supporting member 225 is provided with a pair of supporting portions 225*a* and 225*b* on which there are provided therapeutic member 226 respectively, there is provided between the supporting portions 225*a* and 225*b* a space X opening toward the user and being able to receive the user's shoulder S, and the supporting body 226 is provided with a detector 240 for directly detecting the shoulder S of the user within the space X as a range of detection.

In this arrangement, since the shoulder S is placed in the space X between a pair of supporting portions 225*a* and 225*b* when the therapeutic member 226 is moved downward as described above, providing a detector 240 for detecting the space X as a range of detection enables accurate detection of the shoulder S placed within the range of detection.

The detector 240 is preferably provided with a micro switch that is turned ON and OFF when it comes into contact with the user's shoulder S or a pressure sensor for detecting the load applied by the shoulder S when it comes into contact with the shoulder S. In this arrangement, the structure for detecting the shoulder position is simplified and thus implemented at low cost, and the accuracy of detection can be preferably maintained since it is adapted to come into contact with the shoulder S.

To come into contact with the user's shoulder S here includes not only a state in which the contact of the micro switch or the pressure sensor comes into contact directly with the shoulder S in itself, but also a state in which a cover covering the micro switch or the like in a operable state or a flexible covering member 215 provided on a medical treatment bed 204 so as to cover the front side of the therapeutic member is interposed between the shoulder S and the contact.

The detector 240 is not limited to the micro switch or the pressure sensor, but a sensor of non-contact type (an infrared sensor for detecting heat from the shoulder S, a reflecting-type ultrasound sensor for receiving reflected wave from the shoulder S, and the like) may be employed.

The technical means of the present invention for solving the problems described above is, in a massaging apparatus comprising a massaging unit 307 having a therapeutic member for performing massaging motion provided so as to move along the user's body, that equipment to be arranged on the specific portion of the user's body is provided so that the position of equipment with respect to the massaging apparatus is detected to determine the position of the specific portion of the user with respect to the massaging apparatus.

Another technical means of the present invention is, in a massaging apparatus comprising a massaging unit 307 having a therapeutic member for performing massaging motion provided so as to move along the user's body, that equipment to be arranged on the specific portion of the user's body and detecting means 359 for detecting the position of equipment with respect to the massaging apparatus so that the position of the specific portion of the user with respect to the massaging apparatus is determined from the position of equipment with respect to the massaging apparatus detected by the detecting means 359.

Still another technical means of the present invention is, in a massaging apparatus comprising a massaging unit 307 having a therapeutic member for performing massaging motion provided so as to move along the user's body, that a detecting means 359 is provided between equipment of the massaging apparatus to be arranged at the specific portion of the user's body and the massaging unit 307 for detecting that both of them are approaching with each other, so that the position of the specific portion of the user with respect to the massaging apparatus is determined from the position of the massaging unit 307 at the moment when detection is made by the detecting means 359.

Further technical means of the present invention is characterized in that the detecting means 359 comprises a magnetic body 357 mounted on one of equipment and the massaging unit 307 and a magnetic sensor 358 mounted on the other one of them.

Still further technical means of the present invention is characterized in that equipment of the massaging apparatus is a pillow 351 of the massaging apparatus having a seatback portion 304, and the pillow 351 is mounted on the front surface of the seatback portion 304 so as to be adjustable in the upward and downward direction, so that the position of the specific portion of the user with respect to the massaging apparatus is determined by detecting the position of the pillow 351 arranged at the user's head.

Another technical means of the present invention is characterized in that equipment of the massaging apparatus is a remote controller 363 for controlling the massaging apparatus, and the position of the specific portion of the user with respect to the massaging apparatus is determined by detecting the position of the remote controller 363 with respect to the massaging apparatus when the user arranged the remote controller 363 at the specific portion of the user.

Still another technical means of the present invention is characterized in that the position of the shoulder with respect to the massaging apparatus is determined as a position of the specific portion of the user.

With these problems in view, the present invention employs the following technical means in order to set the position of the shoulder more accurately.

In other words, the present invention is a massaging apparatus comprising a body of the massaging apparatus, a therapeutic member provided on the body of the massaging apparatus so as to move freely along the user's body in the vertical direction, and a position control element for positioning the therapeutic member manually to the arbitrary positions for giving a massage to the user, characterized in that a memory for storing the position of the therapeutic member determined by the manual operation of the position control element as a reference position (for example, the shoulder position) is provided.

In this arrangement, since the user can place the therapeutic member at the arbitrary places by manually operating the position control element, by positioning the therapeutic member at his/her shoulder position for example, that position is stored in the memory as a shoulder position. At this time, by positioning accurately by manual operation, the shoulder position can be set accurately.

The present invention can be applied not only to the setting of "the shoulder position", but also to the setting of other portions of the body. For example, by enabling the apparatus to set the hip position as a reference position for giving a massage accurately to the area around the hip, or by enabling the apparatus to set both of the shoulder position and the hip position as reference positions, the shape of the body can be determined more accurately, thereby realizing more suitable massage.

It is not necessary that the entire movement of the therapeutic member be performed by manual operation. For example, it is also possible to employ the construction in which an automatic shoulder position detecting means is used to move the therapeutic member automatically to the position that seems to be the shoulder position as in the case of related art 1, and then move the therapeutic member to the accurate shoulder position manually, and that position is set as a reference position. In this case, since it is not necessary to perform the entire movement manually, the operation is simplified.

Another aspect of the invention is a massaging apparatus comprising a body of the massaging apparatus, a positioning body provided on the body of the massaging apparatus so as to move freely along the user's body in the vertical direction, and a position control element for manually positioning the positioning body at the arbitrary positions, characterized in that a memory for storing the position of the positioning body determined by the manual operation of the position control element as a reference position is provided.

It purports that a positioning body for determining the reference position is preferably a therapeutic member for performing massage, but a separate positioning body for positioning other than the therapeutic member may be provided.

Another aspect of the present invention is a massaging apparatus comprising a positioning body provided on the main body of the massaging apparatus so as to move freely along the user's body in the vertical direction, of which the movement is controlled by instructions from the control element, characterized in that a reference-position-determining control element for performing determination of the reference position for the positioning body, and the control element detects the position of the positioning body at the moment when the reference-position-determining control element is operated as a reference position.

In this case, when the freely movable positioning body is situated at a certain position, the control element detects the position thereof as a reference position by operating the reference-position-determining control element. When the reference position is the shoulder position for example, by operating the determining control element at the moment when the therapeutic member is at the shoulder position, that position is detected as the shoulder position, and the control element can perform massage based on information of the shoulder position.

Though the reference-position-determining control element can be a special switch only for determining the reference position, it is also possible to share with the switch having other functions such as a massage start switch. When shared with the massage start switch, by operating the start switch, the reference position is detected and stored in the memory, and massaging motion starts.

In addition, the position control element or the reference-position-determining control element does not have to be a switch that physically exist, and it can be, for example, a switch that is operated by touching the panel according to the instructions shown on the touch-screen display.

In order to store the reference position into the memory, for example, a certain period of time for setting the shoulder position may be set in advance, so that the positioning body is moved within the preset time period and the position of the positioning body at the moment when the preset time has elapsed is stored automatically in the memory as a reference position. In this case, operation of the reference-position-determining switch is not necessary.

In the present invention, the following technical means are instituted in order to solve the above-described problems. The present invention is a massaging apparatus comprising a massaging member and a massage drive including an air cell that is inflated to advance the massaging member toward the user and is deflated to retract the same from the user, the massage drive being constructed to move along the user's body, characterized in that means for detecting inflation and deflation of the air cell is provided.

In this case, the massage drive is moved along the user's body with the air cell inflated and thus the massaging member advanced toward the user. When the massaging member is not in contact with the user, or when the massaging member is placed above the shoulder, no load is applied to the massaging member and thus the massaging member is maintained in an advanced state and the air cell is maintained in an inflated state.

On the other hand, when the massaging member moves to the position lower than the shoulder position and comes into contact with the user, the load is applied in the direction that pushes back the massaging member and thus the air cell is deflated. By detecting inflation and deflation of the air cell in association with the movement of the massage drive, the vertical position of the shoulders that varies from one user to another can be detected.

When detecting inflation and deflation of the air cell as is described above, more quantity of displacement can be expected than the case of detecting the pressure applied to the massaging member from the body by mechanical displacement. Therefore, occurrence of errors is reduced and detecting means of a simple structure can be employed.

For detecting the quantity of inflation or deflation of the air cell, detecting means may be provided directly on the air cell. However, it is more preferable to provide a base portion that advances toward and retracts from the user according to inflation and deflation of the air cell, and to mount a massaging member on the base portion, so that the detecting means detects the movement of the base portion.

The detecting means is preferably a limit switch that is turned ON and OFF according to inflation and deflation of the air cell. In this case, by constructing the limit switch so as to be switched between ON and OFF depending on whether it is above the shoulder position or below the shoulder position, the position where the limit switch is switched between ON and OFF can be determined to be the shoulder position.

In the present invention, the following technical means are instituted in order to achieve the above-described object.

A massaging apparatus according to the present invention comprises a therapeutic member for massaging the user's body, and a supporting body for supporting the therapeutic member via a supporting shaft, characterized in that a detector for detecting the load in the axial direction applied to the therapeutic member is provided between the supporting body and the therapeutic member in the direction of the axis of the supporting shaft.

In this arrangement, the load in the axial direction of the supporting shaft applied to the therapeutic member can be detected by a simple construction, and the member to be interposed between the detector and the therapeutic member can be eliminated or reduced, thereby enabling improvement of the accuracy of detection. Therefore, when the axial direction of the supporting shaft is oriented in the lateral direction (in the direction of the width of the body), the strength of kneading motion by the therapeutic member can be detected accurately, and thus suitable kneading motion can be performed by feedback control by the user of the detected value.

In the present invention, the following technical means are instituted in order to achieve the above-described object.

A massaging apparatus according to the present invention comprises a therapeutic member for massaging the user's body provided so as to move freely along the user's body in the vertical direction, characterized in that a detector for detecting the load applied to the therapeutic member in the lateral direction, and the load applied to the therapeutic member from the body in the lateral direction is detected by the detector while moving the therapeutic member in the vertical direction, and the position of the specific portion of the body in the vertical direction is determined based on the detected value.

In this case, when the therapeutic member performs the kneading motion, the load is applied to the therapeutic member in the lateral direction as a reaction force against a kneading force, and the detector detects the load to determine the strength of a kneading force.

On the other hand, when the therapeutic member presses the body by vertical movement thereof, the load is applied to the therapeutic member from the body as a reaction force. The load generally includes not only the components in the fore-and-aft directions (toward the front) and the vertical direction, but also the lateral components resulting from the construction of the therapeutic member, inclination of the supporting shaft and other factors, and there is a case where a lateral force is generated by the load. Therefore, when the lateral load is detected by the use of the detector, the position of the specific portion of the body in the vertical direction can thus be determined from the detected value.

For example, when determining the position (vertical position) of the user's shoulder, the therapeutic member is moved downward from the side of the user's head toward the shoulder, and brought into contact with the upper surface of the shoulder. At this time, the load having the components in the lateral direction is applied to the therapeutic member as a reaction force against a force applied to the shoulder by the therapeutic member. Therefore, the load is detected by the detector to determine the vertical position of the shoulder from the vertical position of the therapeutic member at the moment when the load is detected.

Therefore, a massaging apparatus according to the present invention is characterized in that the detector for detecting a kneading strength or the like is used also for determining the vertical position of the shoulder or the like, whereby the cost reduction and miniaturization can be realized in comparison with the case where the separate sensors are used for the respective functions.

In the case described above, preferably, the therapeutic member is supported on the supporting body via a supporting shaft having the axis in the lateral direction, and the detector is mounted between the supporting body and the therapeutic member in the direction of axis of the supporting shaft. In this arrangement, the accurate detection of the load is realized in a simple construction.

The present invention is characterized in that the therapeutic member is mounted rotatably about the axis of the supporting shaft, and the detector is provided on the side of the supporting body with the movement about the axis of the supporting shaft restrained. In this arrangement, wiring of the detector can be made easily in a simple construction.

The present invention is characterized in that the detector is provided with a pre-load applied, so as to prevent impairment of the accuracy of detection resulting from the rattling or play in the axial direction existing between the supporting body and the therapeutic member.

BEST MODE FOR CARRYING OUT THE INVENTION

Referring to FIG. 1 to FIG. 19, an embodiment of the present invention will now be described.

Figure 4:
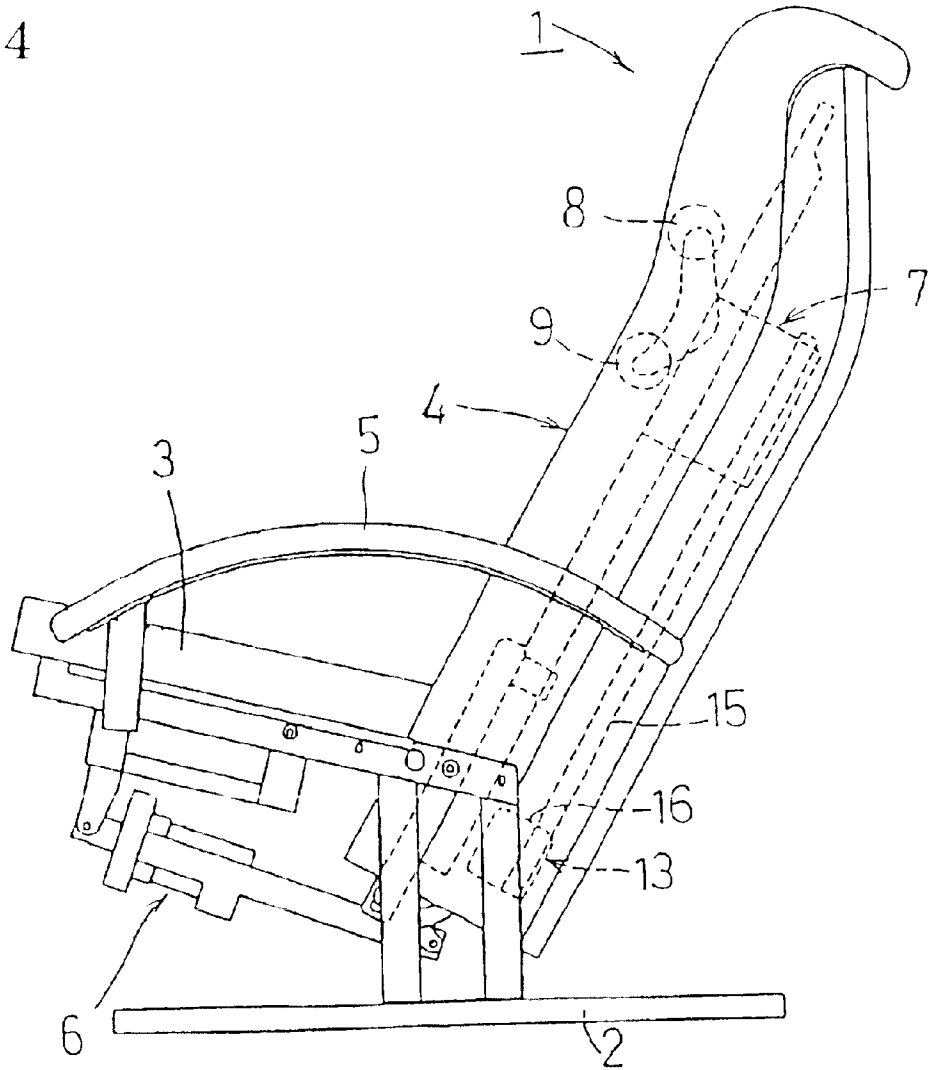
FIG. 4 is a general side view of the massaging apparatus.

FIG. 4 shows a general construction of a chair type massaging apparatus 1. In FIG. 4, the chair type massaging apparatus 1 comprises a seat portion 3 supported by a leg body 2, a seatback portion 4 provided on the back side of the seat portion 3, and arm rest portions 5 provided on both of the left and the right sides of the seat portion 3. The seatback portion 4 is adapted to be reclined by a reclining device 6 with the rear end side of the seat portion 3 as a fulcrum point.

A massaging unit 7 is integrated in the seatback portion 4. The massaging unit 7 comprises, as shown in FIG. 5 as well, a first therapeutic member (kneading ball, massaging roller) 8, a second therapeutic member (kneading ball, massaging roller) 9, a massage motor 10, a transmission mechanism 11 for transmitting the rotational power of the massage motor 10 to the therapeutic members 8, 9 to allow the respective therapeutic members 8, 9 to perform kneading motion or rapping motion, and a supporting frame 14, wherein the massaging unit 7 is constructed so as to move in the seatback portion 4 vertically by a hoist means 13.

The hoist means 13 employs a mechanism that moves the massaging unit 7 upward and downward by rotating a feed screw 15 engaged with the supporting frame 14 of the massaging unit 7 with the hoist motor 16.

The hoist means 13 may be replaced with means employing a wrapping drive mechanism, a rack-and-pinion engaging structure, or a hoist drive structure using a fluid pressure cylinder or the like.

Figure 5:
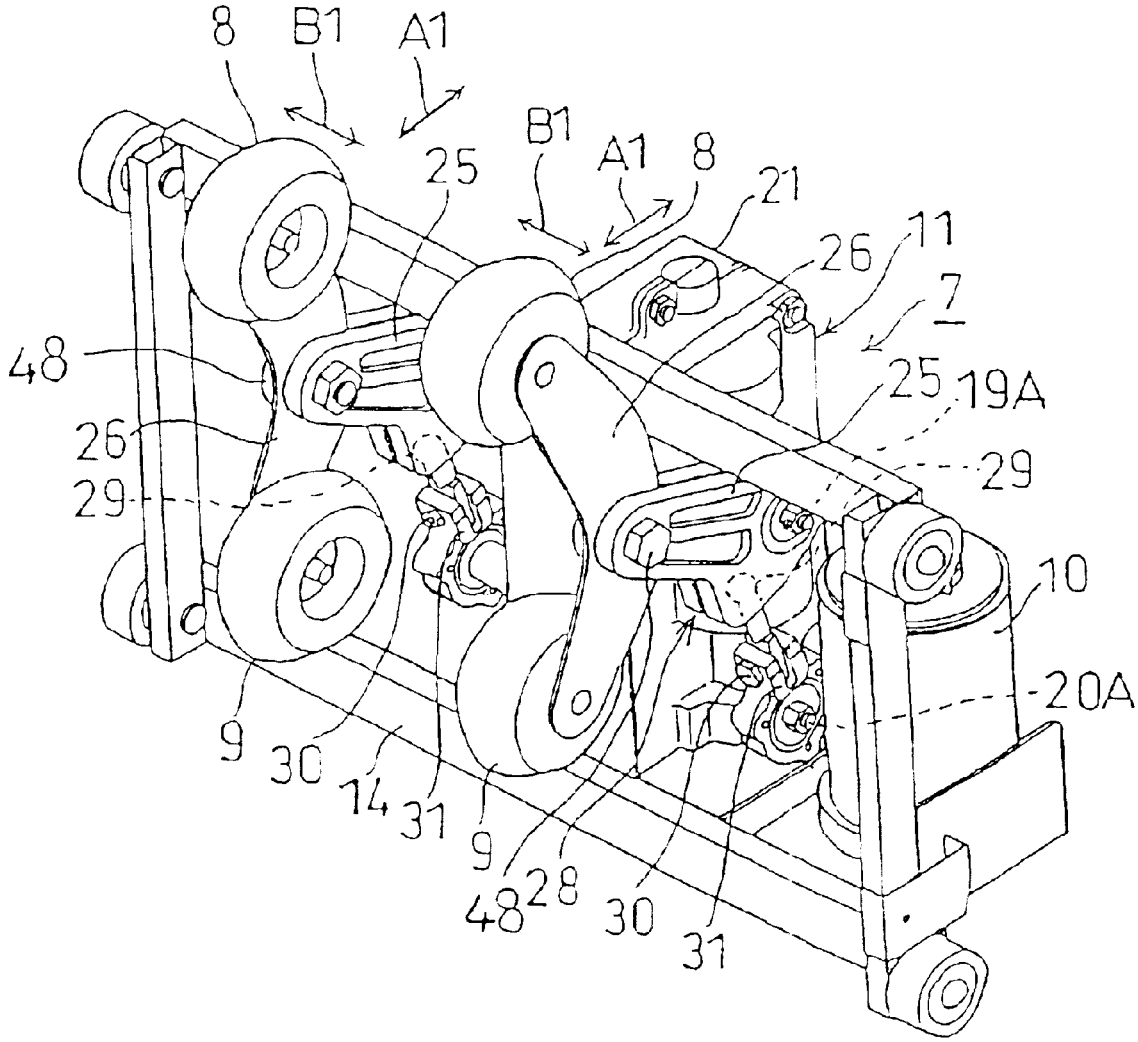
FIG. 5 is a perspective view of the massaging unit.
Figure 6:
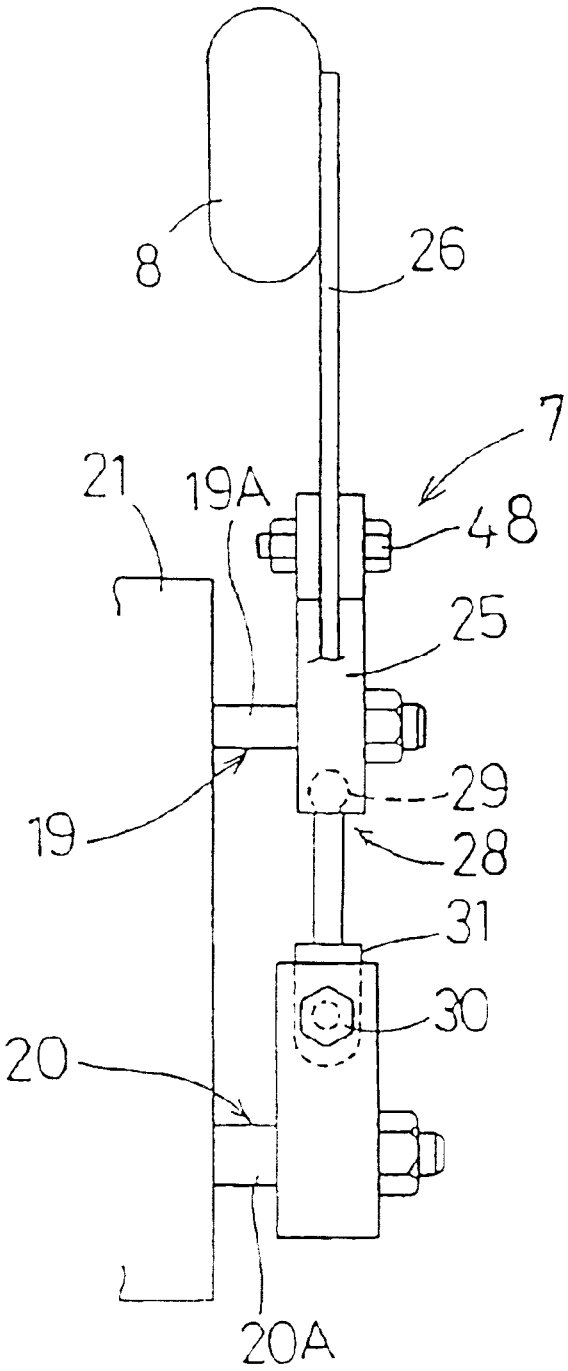
FIG. 6 is a front view showing a part of the massaging apparatus.
Figure 7:
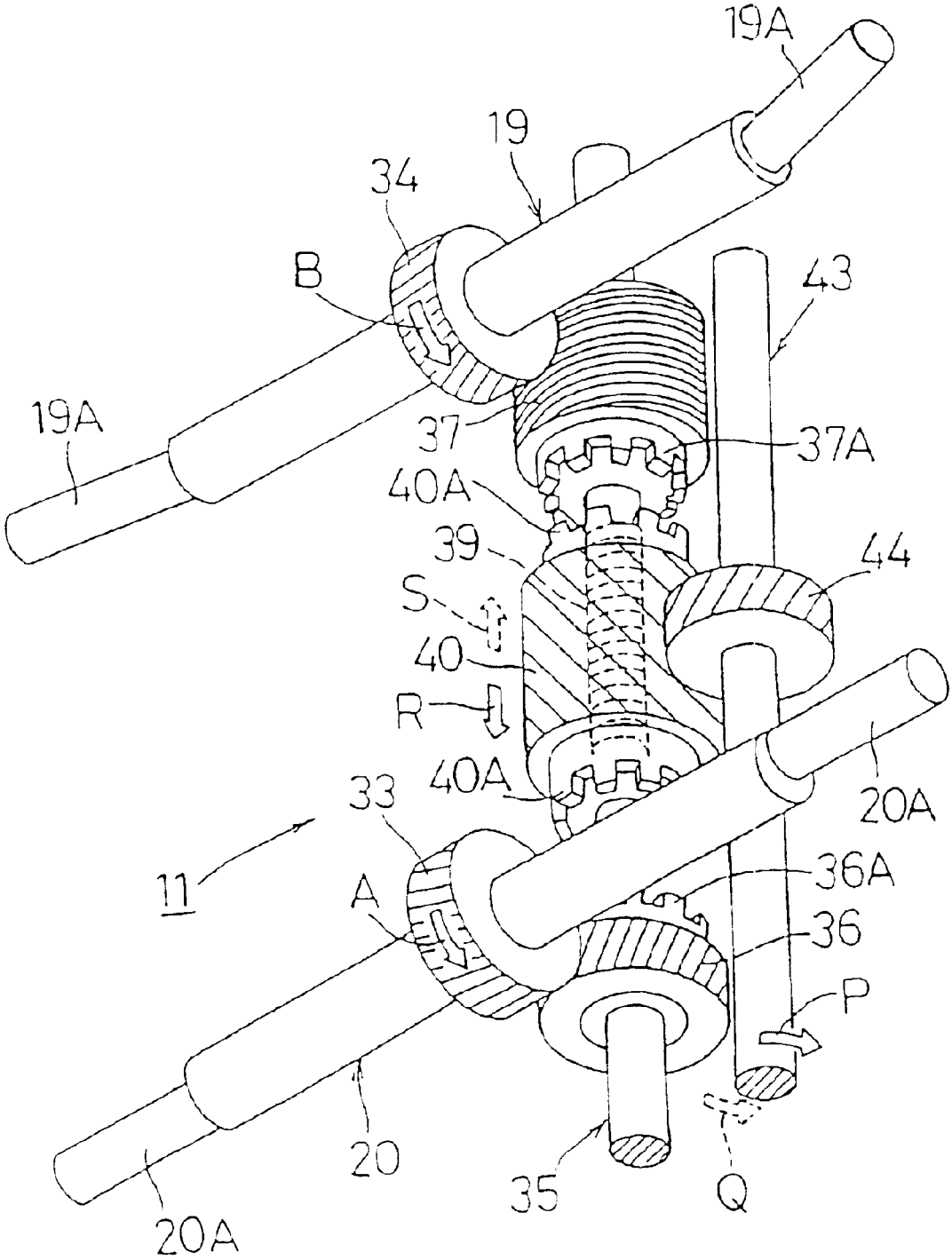
FIG. 7 is a perspective view of the transmission mechanism of the massaging unit.

The transmission mechanism 11 of the massaging unit 7 comprises, as shown in FIG. 5 to FIG. 7, a drive unit 21 having a kneading motion shaft 19 and a rapping motion shaft 20 projecting toward the left and the right sides, a pair of left and right drive arms 25 held by the motion shafts 19, 20, and a pair of left and right supporting arms 26 fixed on the tips of the respective drive arms 25.

The above-described drive unit 21 can be switched as desired between a state of allowing the drive arm 25 to take the components of lateral movement out from the rotating power of the massage motor 10 via the kneading motion shaft 19 to perform kneading motion, and a state of allowing the drive arm 25 to take components of fore-and-aft swinging motion out from the rotating power of the massage motor 10 via the rapping motion shaft 20 to perform rapping motion.

The motion shafts 19, 20 are laterally arranged in parallel with each other and rotatably supported on the case of the drive unit 21 via the bearings respectively. These motion shafts 19, 20 are adapted in such a manner that one of these two shafts 19, 20 is selected at a transmission mechanism 11 to receive rotational motion from the massage motor 10 to rotate in the directions shown by the arrows A or B in FIG. 7.

The rapping motion shaft 20 is provided with an eccentric shaft portions 20A, 20A that are off-centered in the opposite direction from each other on both ends, and the kneading motion shaft 19 is provided with a inclined shaft portions 19A, 19A on both ends. The eccentric shaft portion 20A of the rapping motion shaft 20 and the inclined shaft portion 19A of the kneading motion shaft 19 are connected by a linkage 28 as shown in FIG. 6. The linkage 28 comprises a plate-shape drive arm 25, a ball joint 29 connected to the drive arm 25, and a connecting arm 31 connected to the shaft portion of the ball joint 29 by a pin 30. The drive arm 25 is rotatably supported on the inclined shaft portion 19A, and the connecting arm 31 is pivotally mounted on the eccentric shaft portion 20A.

In this arrangement, when the rapping motion shaft 20 rotates in the direction A, the eccentric shaft portion 20A of the rapping motion shaft 20 allows the therapeutic members 8, 9 to reciprocate in the direction A1 (fore-and-aft direction as shown in FIG. 5) via the connecting arm 31, the ball joint 29, the drive arm 25, and the supporting arm 26, and the therapeutic members 8, 9 make a rapping movement. Since one of the eccentric shaft portions 20A is off-centered in the opposite direction from the other one, the therapeutic members 8, 9 on the left side and. the right side make rapping motion alternately.

On the other hand, when the kneading motion shaft 19 receives a rotational power, the inclined shaft portion 19A rotates along a conical surface, and thus the drive arm 25 reciprocates with the ball joint 29 as a fulcrum, and consequently, the therapeutic members 8, 9 on the left side and the right side make reciprocated pivotal movement in the direction of B1 (in the lateral direction as shown in FIG. 5) so as to move toward and away from each other.

The mechanism to select one of the kneading motion shaft 19 and the rapping motion shaft 20 is constructed for example as shown in FIG. 7.

In FIG. 7, a screw gear 33 is mounted on the rapping motion shaft 20, and a worm gear 34 is mounted on the kneading motion shaft 19. There is provided a guide shaft 35 vertically extending in front of, or behind the rapping motion shaft 20 and the kneading motion shaft 19, and a screw gear 36 to be engaged with the screw gear 33 and a worm 37 to be engaged with the worm gear 34 are provided on the guide shaft 35 rotatably with respect to the guide shaft 35.

On the end surfaces of the screw gear 36 and of the worm 37 on the guide shaft 35 facing toward each other, there are formed engagement tooth portions 36A, 37A that serve as clutches respectively. The guide shaft 35 is formed with a trapezoidal screw thread 39 on the portion between the screw gear 36 and the worm 37, on which a movable helical gear 40 is mounted in engagement with its inner surface. Both end surfaces of the movable helical gear 40 are formed with engagement tooth portions 40A, 40A to be engaged and disengaged with the engagement tooth portions 36A, 37A. A rotating drive shaft 43 is provided in parallel with the guide shaft 35 and adapted to be switched to rotate in the directions shown by the arrows P or Q by the massage motor 10 via a pulley or a belt.

A helical gear 44 is mounted on the rotating drive shaft 43 and engaged with the helical thread on the outer surface of the movable helical gear 40, so that when the rotating drive shaft 43 rotates in the direction P, the movable helical gear 40 in engagement with the helical gear 44 rotates and moves along the trapezoidal screw thread 39 of the guide shaft 35 in the direction R, and the engagement tooth portion 40A of the movable helical gear 40 engages with the engagement tooth portion 36A of the screw gear 36 to rotate the screw gear 36. As a consequent, the rapping motion shaft 20 provided with the screw gear 33 to be engaged with the screw gear 36 rotates in the direction A. In contrast to it, when the rotating drive shaft 43 is rotated in the direction Q, which is the opposite direction from the direction P, the movable helical gear 40 moves in the direction S, which is the opposite direction from the direction R, and engages with the worm 37 to rotate the kneading motion shaft 19 in the direction B.

Accordingly, when the rotating drive shaft 43 is rotated in the forward or reverse direction to move the movable helical gear 40 selectively in one of the directions R and S, one of the rapping motion shaft 20 and the kneading motion shaft 19 is rotated to perform rapping motion or kneading motion with a plurality of therapeutic members 8, 9. Since the screw gears 33, 36 have almost the same number of teeth, rapping motion is performed relatively many times per unit time, but kneading motion is performed slowly since the turning effort is transmitted from the worm 37 to the worm gear 34 with significant speed reduction.

Figure 1:
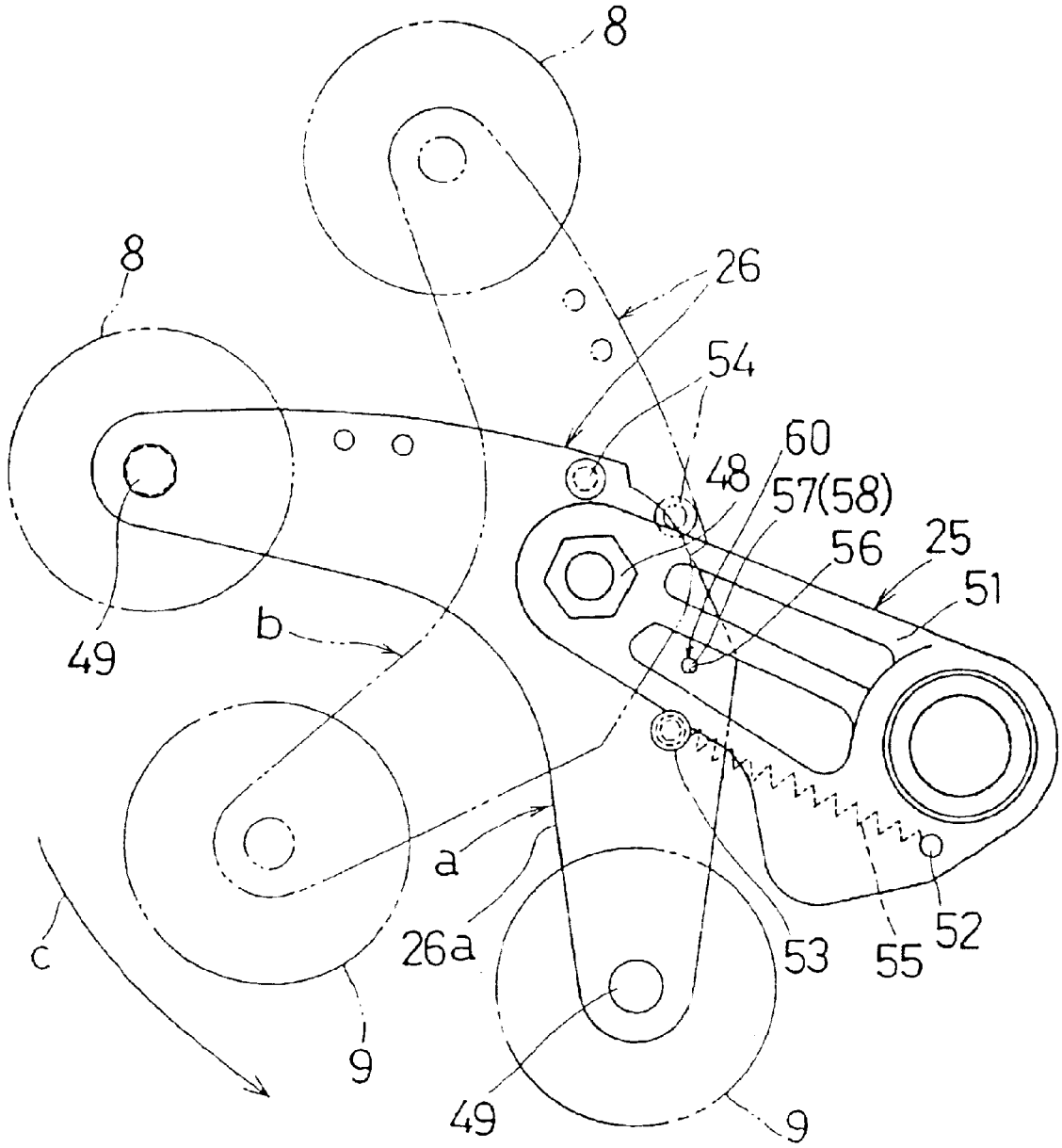
FIG. 1 is a side view showing an embodiment of the present invention in a state in which a supporting arm is mounted on a driving arm.
Figure 2:
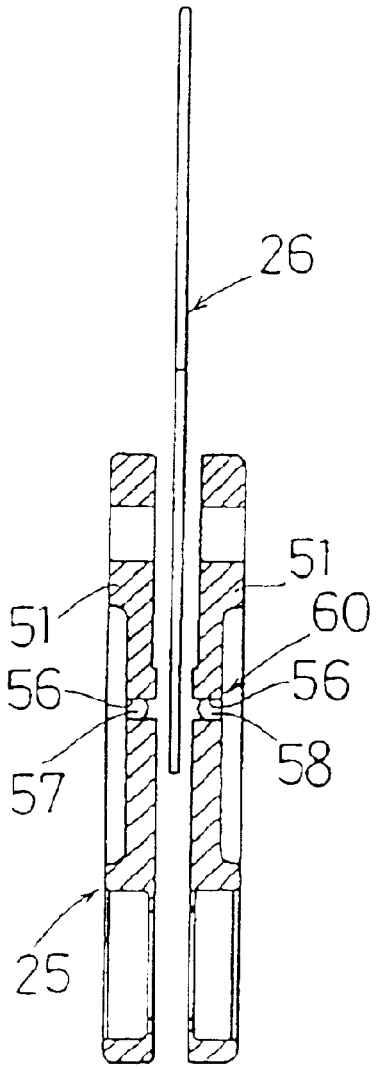
FIG. 2 is a schematic front view in cross-section showing a state in which the supporting arm is mounted on the driving arm.

As shown in FIG. 1, FIG. 2, and FIG. 5, each drive arm 25 comprises a pair of left and right clipping bodies 51, and the midsection of the supporting arm 26 is pivotally connected to the tip portion of the drive arm 25 about the lateral axis (corresponding to the center of connection O1 described later) by clipping the midsection of the supporting arm 26 between the tip portions of the left and the right clipping bodies 51 and tightening the bolt and nut 48 inserted through the supporting arm 26 and the pair of clipping bodies 51.

Figure 3:
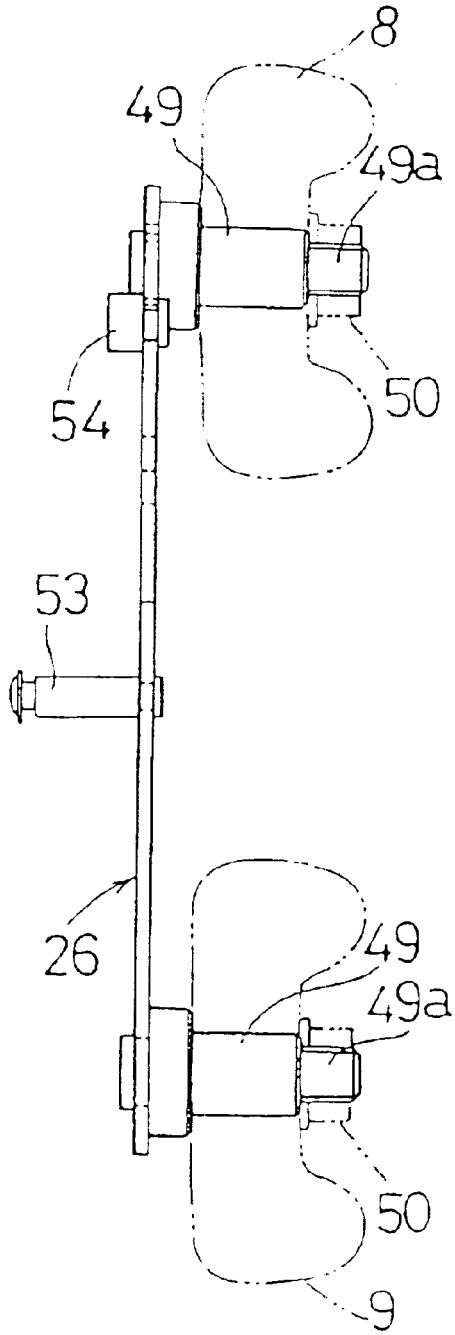
FIG. 3 is a front view of the supporting arm.

As shown in FIG. 3, lateral supporting shafts are fixed to the upper and the lower end portions of the supporting arm 26 by crimping or the like, and the first therapeutic member 8 or the second therapeutic member 9 is rotatably fitted with the supporting shafts 49 and being prevented from coming off by the nut 50 engaged with the external thread portion 49a of the supporting shaft 49. In this arrangement, the first therapeutic member 8 is mounted to one end portion (upper end portion) of the supporting arm 26 so as to rotate about the lateral axis (corresponding to the first center of mounting O2 described later) and the second therapeutic member 9 is mounted to the other end portion (lower end portion) of the supporting arm 26 so as to rotate about the lateral axis (corresponding to the second center of mounting O3 described later), so that the power is transmitted to the therapeutic members 8, 9 through the drive arm 25 and the supporting arm 26 to allow each therapeutic member 8, 9 to perform massaging motion by kneading motion or rapping motion.

Figure 8:
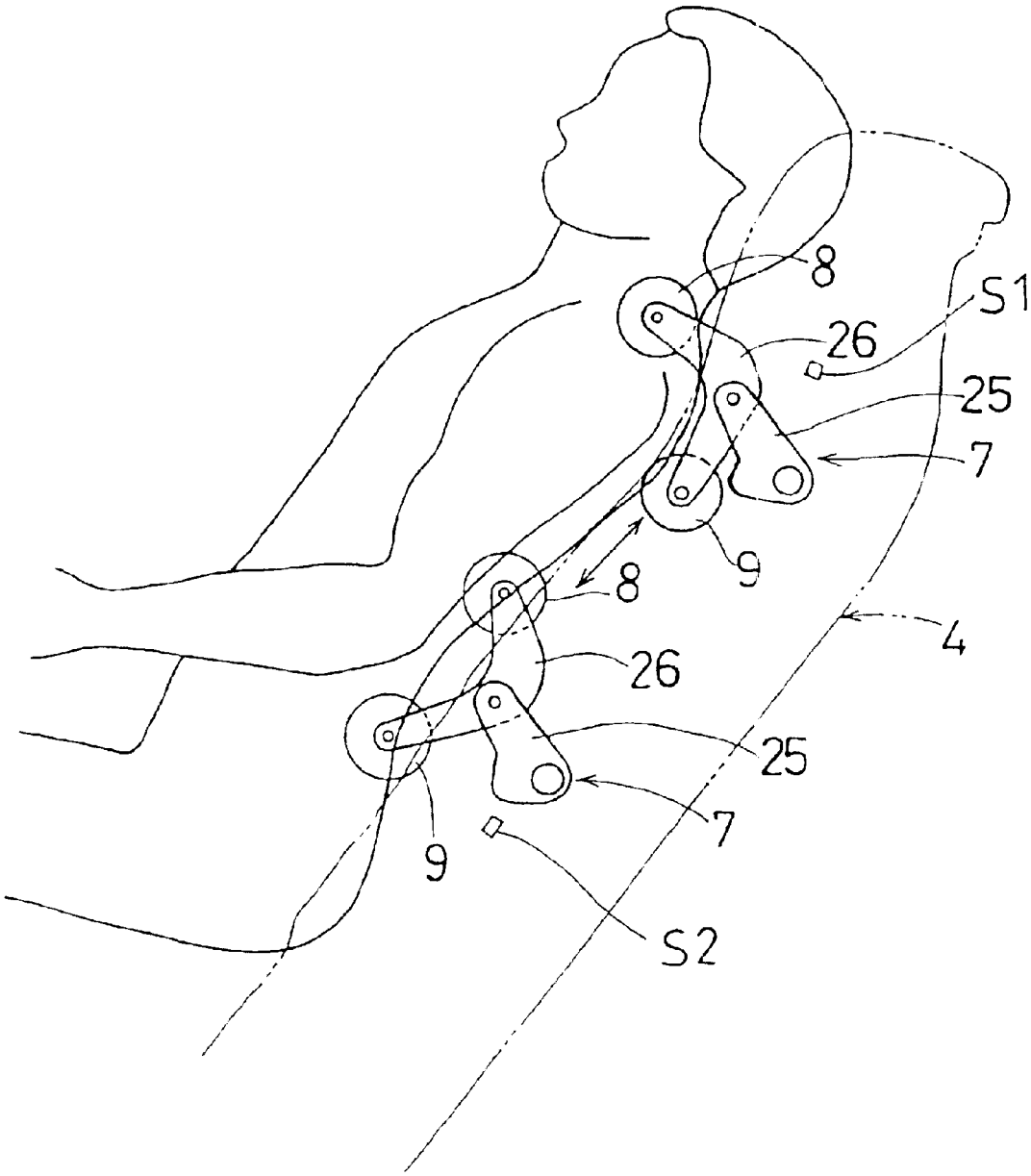
FIG. 8 is a schematic side view showing the massaging apparatus in use.

A pair of the right and left supporting arms 26 are leaf springs formed of spring steel in the shape of boomerang, and as shown in FIG. 5 and FIG. 8, arranged in the seatback portion 4 with the surfaces faced toward the left and the right sides to accommodate the resilient deformation in the left and the right directions.

As shown in FIG. 1, FIG. 2, and FIG. 9 through FIG. 12, a spring pin 53 and a stopper 54 are provided on each supporting arm 26 projecting therefrom, and the pivotal movement of the supporting arm 26 with respect to the drive arm 25 is limited to the range from the lower pivotal position a in which the spring pin 53 abuts against the drive arm 25 as shown by the supporting arm 26 in a solid line in FIG. 1 to the upper pivotal position b in which the stopper 54 abuts against the drive arm 25 as shown by the supporting arm 26 in the dashed lines in FIG. 1. A tension spring 55 is provided between the spring pin 53 of the supporting arm 26 and the spring pin 52 of the drive arm 25, and adapted to urge the supporting arm 26 in the direction shown by the arrow c shown in FIG. 1 (toward the lower pivotal position a).

As shown in FIG. 2 and FIG. 1, the pair of left and right clipping bodies 51 of the drive arm 25 are provided with through holes 56 so as to extend therethrough in the lateral direction. The through hole 56 formed on one of the clipping bodies 51 is provided with a light emitting element (light emitting diode) 57 and the through hole 56 formed on the other one of the clipping bodies 51 is provided with a light receiving element (light receiving transistor) 58. The light emitting element 57 illuminates light toward the light receiving element 58, so that the light receiving element 58 is turned on when it receives light from the light emitting element 57 and turned off when light from the light emitting element 57 is blocked by the supporting arm 26. The optical sensor having the light emitting element 57 and the light receiving element 58 constitutes a pivotal movement detecting sensor 60 for detecting that the supporting arm 26 reached a prescribed range of pivotal movement with respect to the drive arm 25.

When the supporting arm 26 is moved vertically along the user's body with the drive arm 25 with the first therapeutic member 8 and the second therapeutic member 9 abutted against the user by moving the massaging unit 7 upward and downward, and the first therapeutic member 8 reaches the position of the user's shoulder or the neck as shown in FIG. 8, the supporting arm 26 pivots significantly in the direction shown by the arrow c in FIG. 1 (toward the lower pivotal position a) with respect to the drive arm 25, and simultaneously, the supporting arm 26 being away from between the light emitting element 57 and the light receiving element 58 as shown by the dashed lines in FIG. 1 pivots toward the lower pivotal position a as shown by a solid line and blocks light between the light emitting element 57 and the light receiving element 58, so that the pivotal movement detecting sensor 60 detects that the supporting arm 26 reached the prescribed range of pivotal movement with respect to the drive arm 25.

Figure 12:
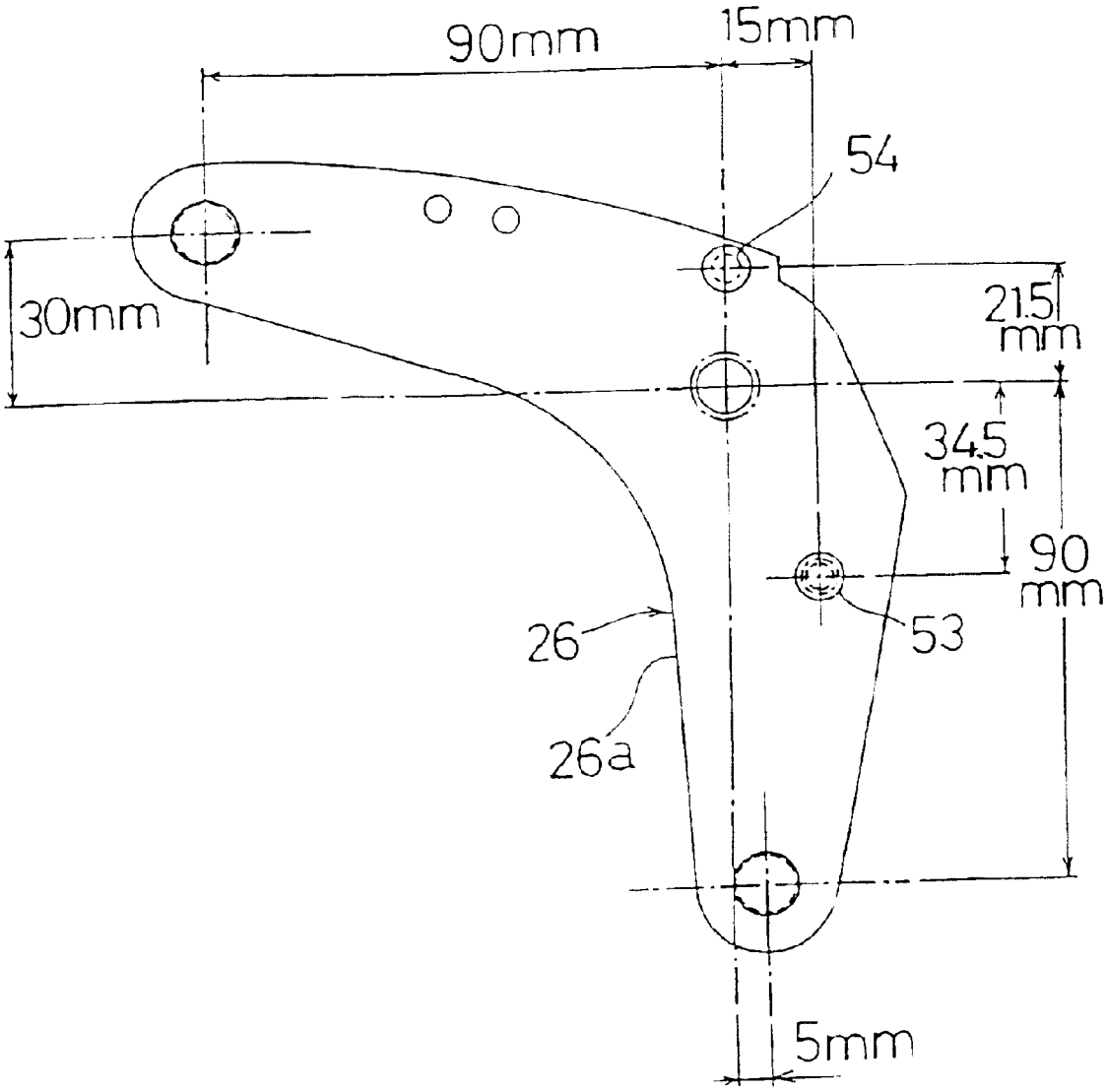
FIG. 12 is a side view of the supporting arm showing the actual dimensions of each part.

Each of the pair of left and right supporting arms 26 bent into the shape of boomerang is bent into a relatively steep angle as shown in FIG. 12, and in this embodiment the relative dimensions (mm) among the center of connection of the supporting arm 26 with respect to the drive arm 25, the center of mounting of the supporting arm 26 with respect to the first therapeutic member 8, the center of mounting the supporting arm 26 with respect to the second therapeutic member 9, the position of the spring pin 53 projected therefrom, and the position of the stopper 54 projected therefrom are determined as shown in FIG. 12. The diameters of the second therapeutic member 9 and the first therapeutic member 8 are respectively determined to approximately 70 mm.

Figure 9:
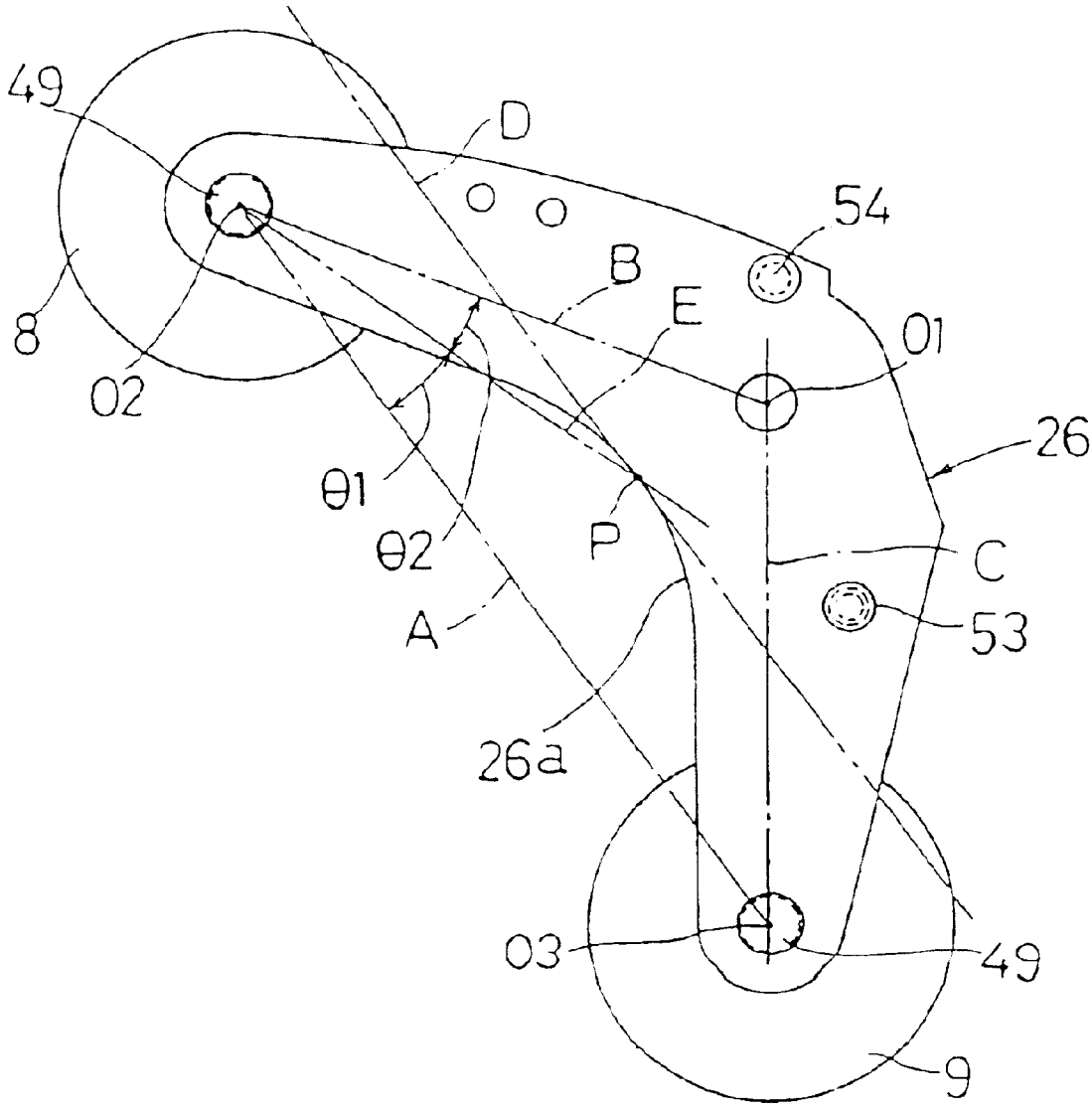
FIG. 9 is a side view of the supporting arm.
Figure 10:
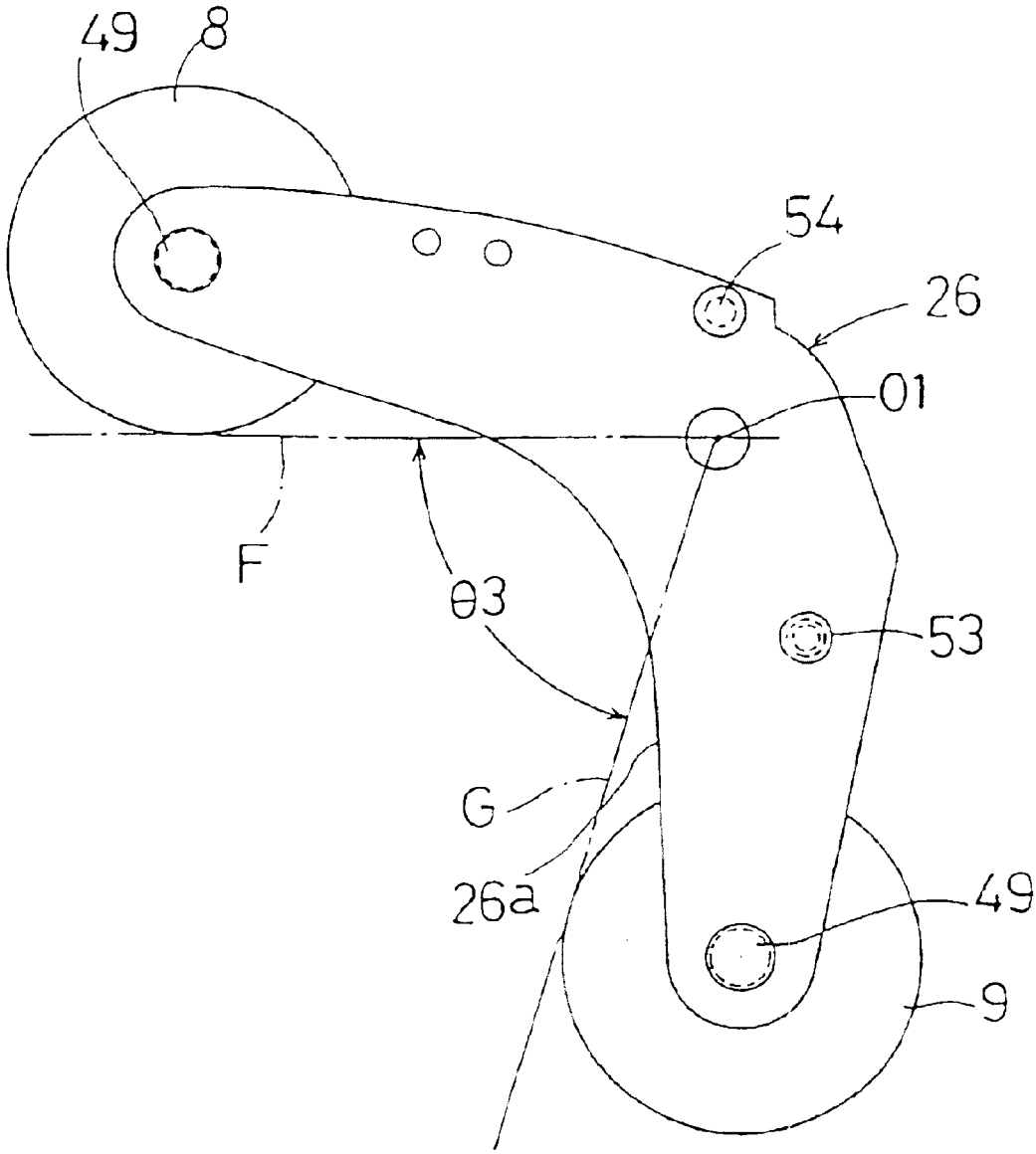
FIG. 10 is a side view of the supporting arm.
Figure 11:
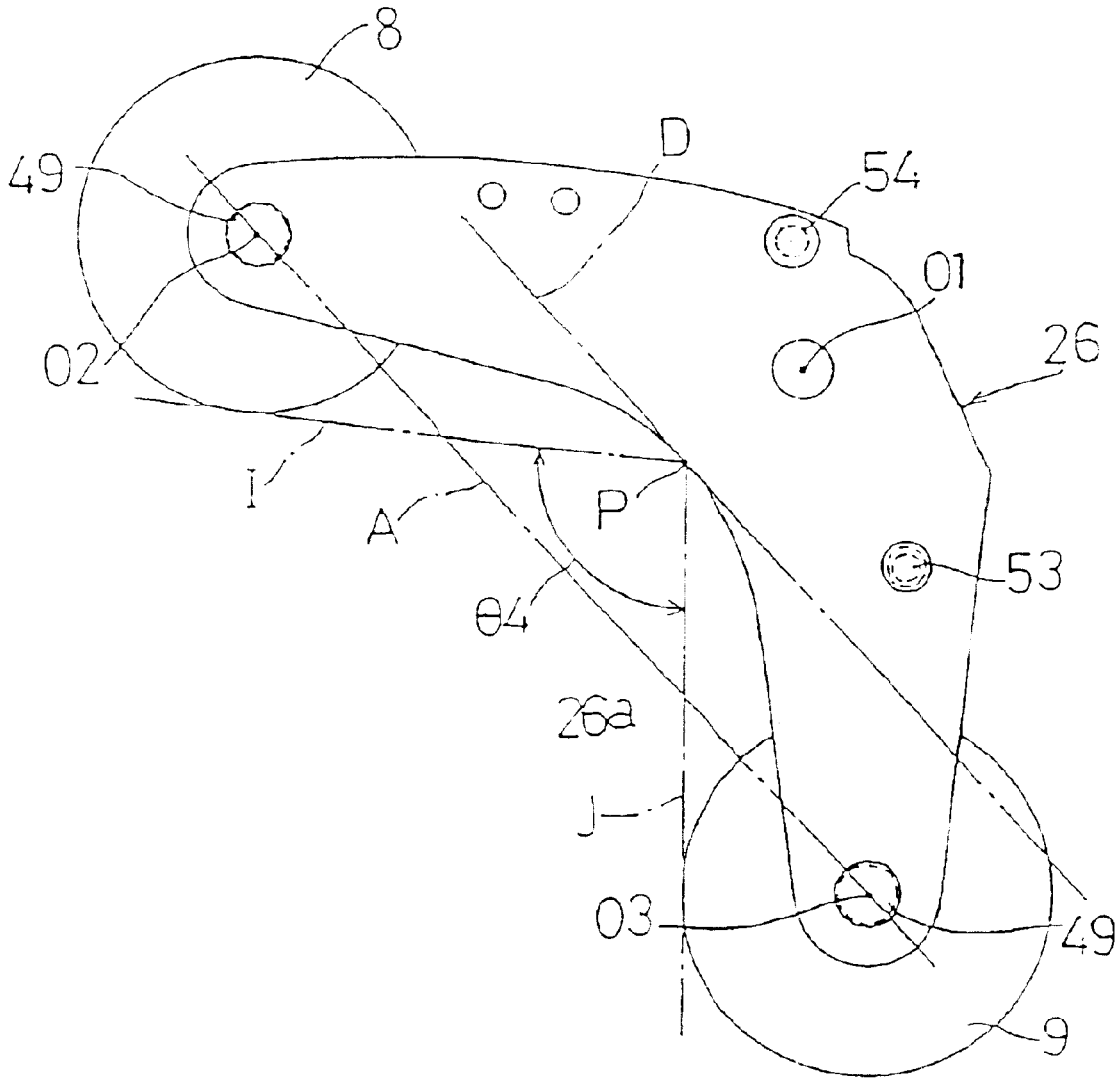
FIG. 11 is a side view of the supporting arm.

The bent form of each supporting arm 26 is determined as shown in FIG. 9, FIG. 10, and FIG. 11. The reason why the supporting arm 26 is formed into the shape of steeply bent boomerang is that this shape is found to be the shape to perform the most preferable massaging motion as a result of biotechnological verification. The shape of the arm, which may seem to be eccentric having a radical shape, is obtained by investigating a locus that thoroughly traces the shape of the back of the human assumed to be sitting on a chair type massaging apparatus.

In other words, as shown in FIG. 9, when the center of connection of the supporting arm 26 with respect to the drive arm 25 is designated as the center of connection O1, the center of mounting of the supporting arm 26 with respect to the first therapeutic member 8 as the first center of mounting O2, the center of mounting of the supporting arm 26 with respect to the second therapeutic member 9 as the second center of mounting O3, the line segment between the first center of mounting O2 and the second center of mounting O3 as the end-to-end connecting line A, the line segment between the first center of mounting O2 and the center of connection O1 as the first center-to-center connecting line B, the line segment between the second center of mounting O3 and the center of connection O1 as the second center-to-center connecting line C. the contact point at which the parallel line D in parallel with the end-to-end connecting line A touches the inner edge 26*a* of the supporting arm 26 as the inner contact point P, and the line segment connecting the first center of mounting O2 with the inner contact point P as the line segment E, the supporting arm 26 is bent so that the angle θ1 formed between the end-to-end connecting line A and the line segment E becomes larger than the angle θ2 formed between the first center-to-center connecting line B and the line segment E, and the distance between the center of connection O1 and the first center of mounting O2 is determined to be almost the same as the distance between the center of connection O1 and the second center of mounting O3.

As show in FIG. 10, when the center of connection of the supporting arm 26 with respect to the drive arm 25 is designated as the center of connection O1, the line segment of the tangent line passing through the center of connection O1 and touching the first therapeutic member 8 on the side of the inner edge 26*a* of the supporting arm 26 as the first inner tangent line F, and the line segment of the tangent line passing thorough the center of connection O1 and touching the second therapeutic member 9 on the side of the inner edge 26*a* of the supporting arm 26 as the second inner tangent line G, the supporting arm 26 is bent in such a manner that the angle θ3 between the first inner tangent line F and the second inner tangent line G forms an acute angle.

As shown in FIG. 11, when the center of mounting of the supporting arm 26 with respect to the first therapeutic member 8 is designated as the first center of mounting O2, the center of mounting of the supporting arm 26 with respect to the second therapeutic member 9 as the second center of mounting O3, the line segment connecting between the first center of mounting O2 and the second center of mounting O3 as the end-to-end connecting line A, the contact point at which the parallel line D in parallel with the end-to-end connecting line A touches the inner edge 26*a* of the supporting arm 26 as the inner contact point P, the line segment of the tangent line passing through the inner contact point P and touching the first therapeutic member 8 on the side of the inner edge 26*a* of the supporting arm 26 as the first tangent line I from the inner contact point P, and the line segment of the tangent line passing through the inner contact point P and touching the second therapeutic member 9 on the side of the inner edge 26*a* of the supporting arm 26 as the second tangent line J from the inner contact point P, the supporting arm 26 is bent in such a manner that the angle θ4 between the first tangent line I from the inner contact point P and the second tangent line J from the inner contact point P forms generally a right angle.

The construction of the control system of the massaging apparatus 1 will now be described. The pivotal movement detecting sensor 60 detects that the supporting arm 26 reached the prescribed range of pivotal movement with respect to the drive arm 25, and the detected signal obtained here is fed to the control element constructed of a microcomputer or the like, which is not shown in the figure. The pivotal movement detecting sensor 60 may be provided as one pair each for the left and right pairs of supporting arms 26 and the drive arms 25, or one for one of the left and right pairs of the supporting arms 26 and the drive arms 25.

As shown in FIG. 8, there are provided an upper limit switch S1 at the uppermost position of the vertical movement of the massaging unit 7 (supporting arm 26), and a lower limit switch S2 at the lowermost position thereof, so that the massaging unit 7 is controlled to move vertically between the uppermost position and the lowermost position by the control element, not shown. The vertical position of the massaging unit 7 or the supporting arm 26 is detected from the number of revolution of the hoist motor 16 and fed to the control element.

The control element constructed of a microcomputer or the like is adapted to control the massage motor 10 and the hoist motor 16 according to the procedure of the program of the automatic course.

The control element is adapted to reciprocate, as an initial action when the automatic course is selected, the massaging unit 7 vertically along the user's body with the first therapeutic member 8 and the second therapeutic member 9 abutted against the user (to perform a rolling motion with the massaging unit 7), and to determine the position of the specific portion of the user's body, or the position of the shoulder with respect to the massaging apparatus 1 from the relation between the vertical position of the massaging unit 7 and the pivotal position detected by the pivotal movement detecting sensor 60. In other words, the position of the specific portion of the user's body with respect to the massaging apparatus is determined from the vertical position of the supporting arm 26 at the moment when the pivotal movement of the supporting arm 26 reached the prescribed range.

More specifically, the massaging unit 7 is moved vertically with the first therapeutic member 8 and the second therapeutic member 9 abutted against the user to move the supporting arm 26 and the drive arm 25 vertically along the user's body. When the first therapeutic member B reaches the position of the shoulder or the neck of the user as shown in FIG. 8, the supporting arm 26 pivots significantly toward the lower pivotal position a with respect to the drive arm 25, and simultaneously, the supporting arm 26 that has been out of the position between the light emitting element 57 and the light receiving element 58 as shown by the dashed lines in FIG. 1 pivots toward the lower pivotal position a shown by a solid line to block between the light emitting element 57 and the light receiving element 58 and thus the pivotal movement detecting sensor 60 is turned from ON to OFF and detects that the supporting arm 26 reached the prescribed range of pivotal movement with respect to the drive arm 25. The signal detected by the pivotal movement detecting sensor 60 is fed to the control element, so that the control element determines the shoulder position of the user (the position of the specific portion of the user) with respect to the massaging apparatus from the vertical position of the supporting arm 26 (massaging unit 7) at this moment.

The term "rolling motion" here means the effective massaging motion that the therapeutic members 8 and 9 stimulate the vertical linear portion so called meridian along which the meridian points, or the pressure points, are aligned at intervals of about 70 mm on the back along the backbone of the human body. Therefore, it generally means a massaging motion that is considered to be preferable when it is made prior to the kneading and rapping motion.

According to the embodiment described thus far, since each of the pair of left and right supporting arms 26 is bent into the shape of boomerang at a relatively steep angle, the angle θ1 formed between the end-to-end connecting line A and the line segment E becomes larger than the angle θ2 formed between the first center-to-center connecting line B and the line segment E as shown in FIG. 9, the angle θ3 formed between the first inner tangent line F and the second inner tangent line G forms an acute angle as shown in FIG. 1, and the angle θ4 formed between the first tangent line I from the inner contact point and the second tangent line J from the inner contact point forms generally a right angle as shown in FIG. 11, when massaging the shoulder or the neck by the first therapeutic member 8, even when the second therapeutic member 9 abuts against the back, the first therapeutic member 9 approaches toward the shoulder or the neck to a large amount as shown in FIG. 8 and thus the first therapeutic member 8 can massage the shoulder or the neck of the user satisfactorily to a deeper position with a relatively strong force.

As shown in FIG. 8, when massaging the hip of the user by the second therapeutic member 9 with the massaging unit 7 moved downward to lower the supporting arm 26 to the lowermost position, the first therapeutic member 8 abuts against the upper portion of the user's hip and thus the amount of projection of the second therapeutic member 9 toward the body increases. Therefore, the second therapeutic member 9 can press the hip of the user with a sufficiently strong force, thereby realizing more effective massage on the user's hip by the second therapeutic member 9. As a consequent, this massaging apparatus can perform massaging motion on the upper half of the user's body including the shoulder, back, hip, and the like thoroughly and satisfactorily.

According to the embodiment described above, when the massaging unit 7 is moved vertically along the user's body, the first therapeutic member 8 and the second therapeutic member 9 of the pair of the left and the light supporting arms 26 move vertically in a state of being abutted against the shoulder, back, hip, and the like of the user. Then, when the first therapeutic member 8 reaches the position corresponding to the user's shoulder or the neck by the upward movement of the massaging unit 7, the first therapeutic member 8 advances through the side of the user's back above the shoulder or beside the neck as shown in FIG. 8, and the supporting arm 26 pivots significantly toward the lower pivotal position a with respect to the drive arm 25 as described above.

At this time, as shown by the dashed lines in FIG. 1, the supporting arm 26 having been out of the position between the light emitting element 57 and the light receiving element 58 blocks between the light emitting element 57 and the light receiving element 58 as shown by the solid line, and thus the light receiving element 58 is turned from ON to OFF, so that the pivotal movement detecting sensor 60 detects that the supporting arm 26 reached the prescribed range of pivotal movement with respect to the drive arm 25 easily and reliably. The vertical position of the supporting arm 26 (the vertical position of the massaging unit 7) at this moment is recorded in the control element or the like as the position of the user's shoulder with respect to the massaging apparatus, so that the control element, which is not shown in the figure, determines the position of the specific portion of the user, or the shoulder position, with respect to the massaging apparatus accurately from the relation between the vertical position of the supporting arm 26 (the vertical position of the massaging unit 7) and the pivotal position of the supporting arm 26.

As is described thus far, by determining the shoulder position of the user with respect to the massaging apparatus accurately, the position of the desired portion of the user's body can accurately be calculated for example from the user's shoulder position, whereby the first therapeutic member 8 or the second therapeutic member 9 can be moved accurately to the desired position to perform a massaging motion accurately thereon, and thus the automatic massaging course for example enables further effective massage. In case of stimulating pressure points, which is well on its way to becoming a boom recent years, the pressure points can be determined accurately to some extent from the shoulder position of the user, whereby massage by stimulating the pressure points can effectively be performed.

The embodiment described above is constructed in such a manner that when the supporting arm 26 is moved in the opposite direction from the direction shown by the arrow c in FIG. 1 with respect to the drive arm 25 (toward the upper pivotal position b), the supporting arm 26 is out of the position between the light emitting element 57 and the light receiving element 58 so as not to block between the light emitting element 57 and the light receiving element 58, and when the supporting arm 26 is moved in the direction shown by the arrow c in FIG. 1 with respect to the drive arm 25 (toward the lower pivotal position a), the supporting arm 26 blocks between the light emitting element 57 and the light receiving element 58 to turn the pivotal movement detecting sensor 60 from ON to OFF, so that the pivotal movement detecting sensor 60 detects that the supporting arm 26 reached the prescribed range of pivotal movement with respect to the drive arm 25. Alternatively, it is also possible to change the position to mount the light emitting element 57 and the light receiving element 58 with respect to the drive arm 25 to construct the massaging apparatus in such a manner that when the supporting arm 26 is rotated in the direction opposite from the direction shown by the arrow c in FIG. 1 with respect to the drive arm 25 (toward the upper pivotal position b), the supporting arm 26 blocks between the light emitting element 57 and the light receiving element 58, and when the supporting arm 26 is moved in the direction shown by the arrow c in FIG. 1 with respect to the drive arm 25 (toward the lower pivotal position a), the supporting arm 26 comes out of the position between the light emitting element 57 and the light receiving element 58 to turn the pivotal movement detecting sensor 60 from OFF to ON, so that the pivotal movement detecting sensor 60 detects that the supporting arm 26 reached the prescribed range of pivotal movement with respect to the drive arm 25.

Figure 13:
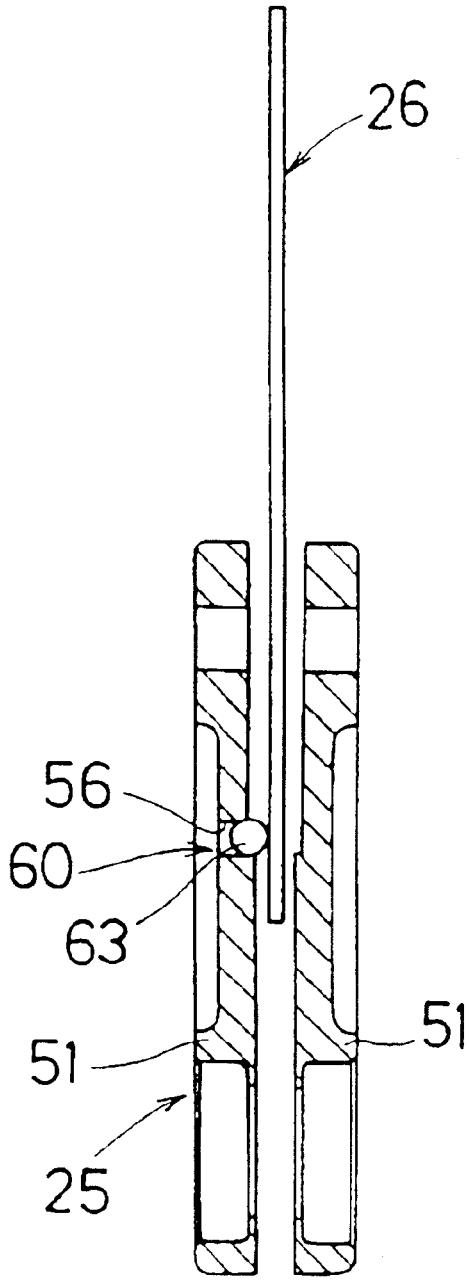
FIG. 13 is a front cross-sectional view of the supporting arm and the driving arm according to another embodiment.
Figure 14:
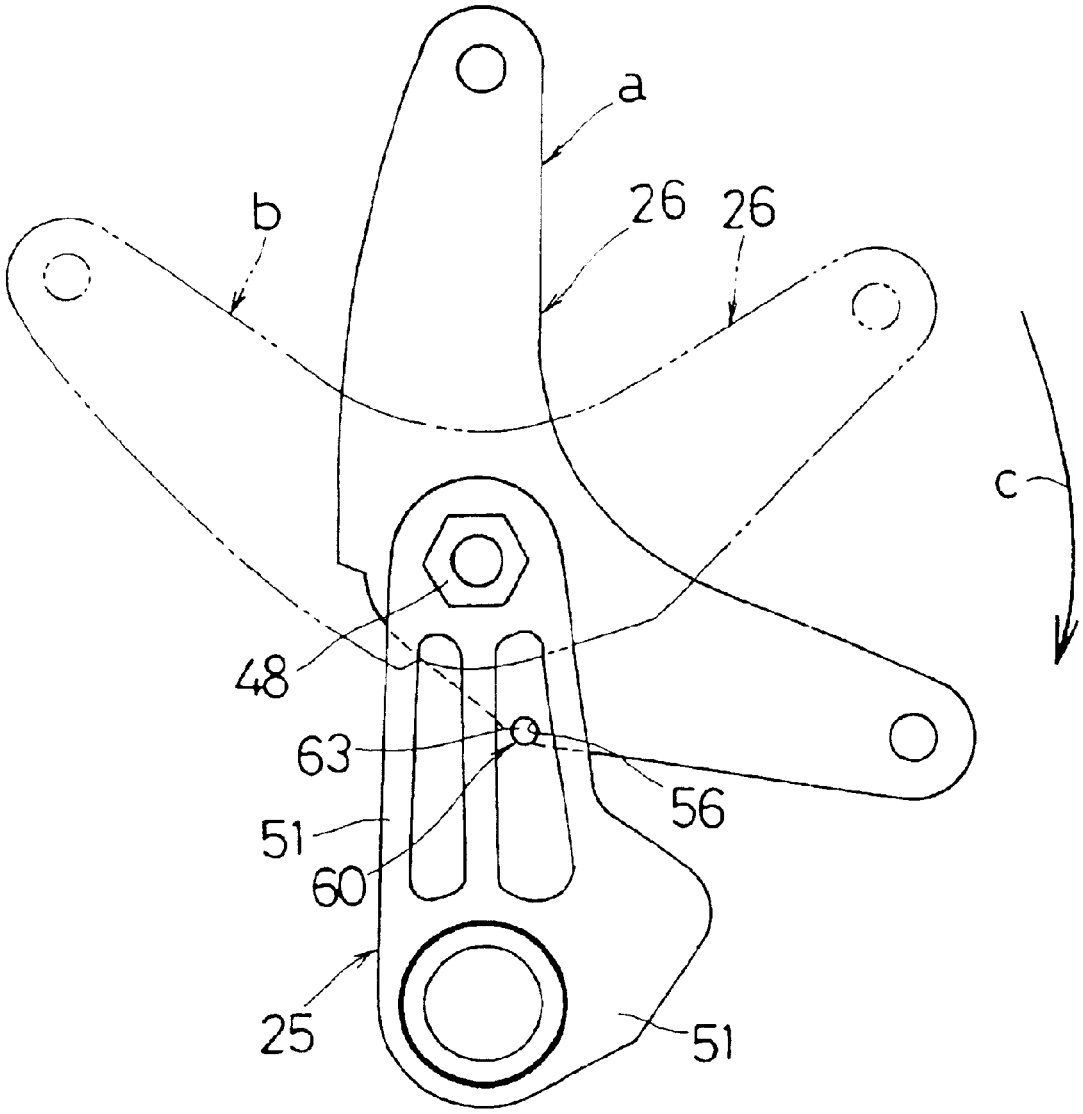
FIG. 14 is a side view of the supporting arm and the driving arm.

FIG. 13 and FIG. 14 show another embodiment, in which the clipping body 51 on one of the drive arms 25 is formed with a through hole 56 so as to extend therethrough in the lateral direction, and a limit switch 63 including a micro switch or the like integrated therein is mounted within the through hole 56, so that the limit switch 63 constitutes the pivotal movement detecting sensor 60. When the massaging unit 7 is moved vertically to move the supporting arm 26 vertically along the user's body together with the drive arm 25 with the first therapeutic member 8 and the second therapeutic member 9 abutted against the user, and the first therapeutic member 8 reaches the shoulder or the neck position of the user, the supporting arm 26 pivots significantly in the direction shown by the arrow c with respect to the drive arm 25 (toward the lower pivotal position a), and simultaneously, the supporting arm 26 having been away from the limit switch 63 as shown by the dashed lines in FIG. 14 presses the limit switch 63 as shown by a solid line to turn the limit switch 63 from OFF to ON, so that the pivotal movement detecting sensor 60 detects that the supporting arm 26 reached the prescribed range of pivotal movement with respect to the drive arm 25. Other features are the same as the embodiment described above.

Figure 15:
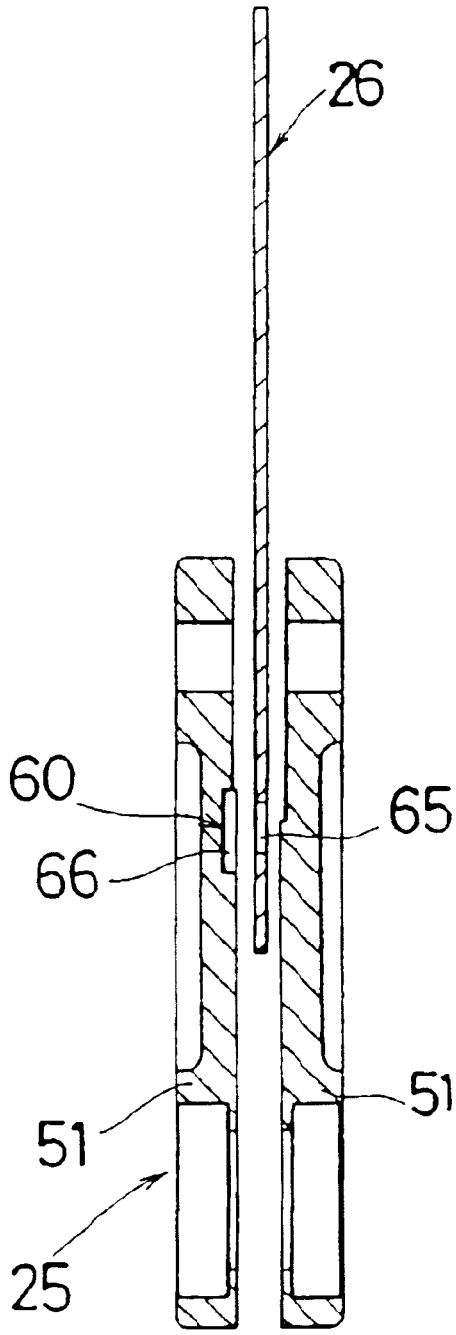
FIG. 15 is a front cross-sectional view of the supporting arm and the driving arm according to another embodiment.
Figure 16:
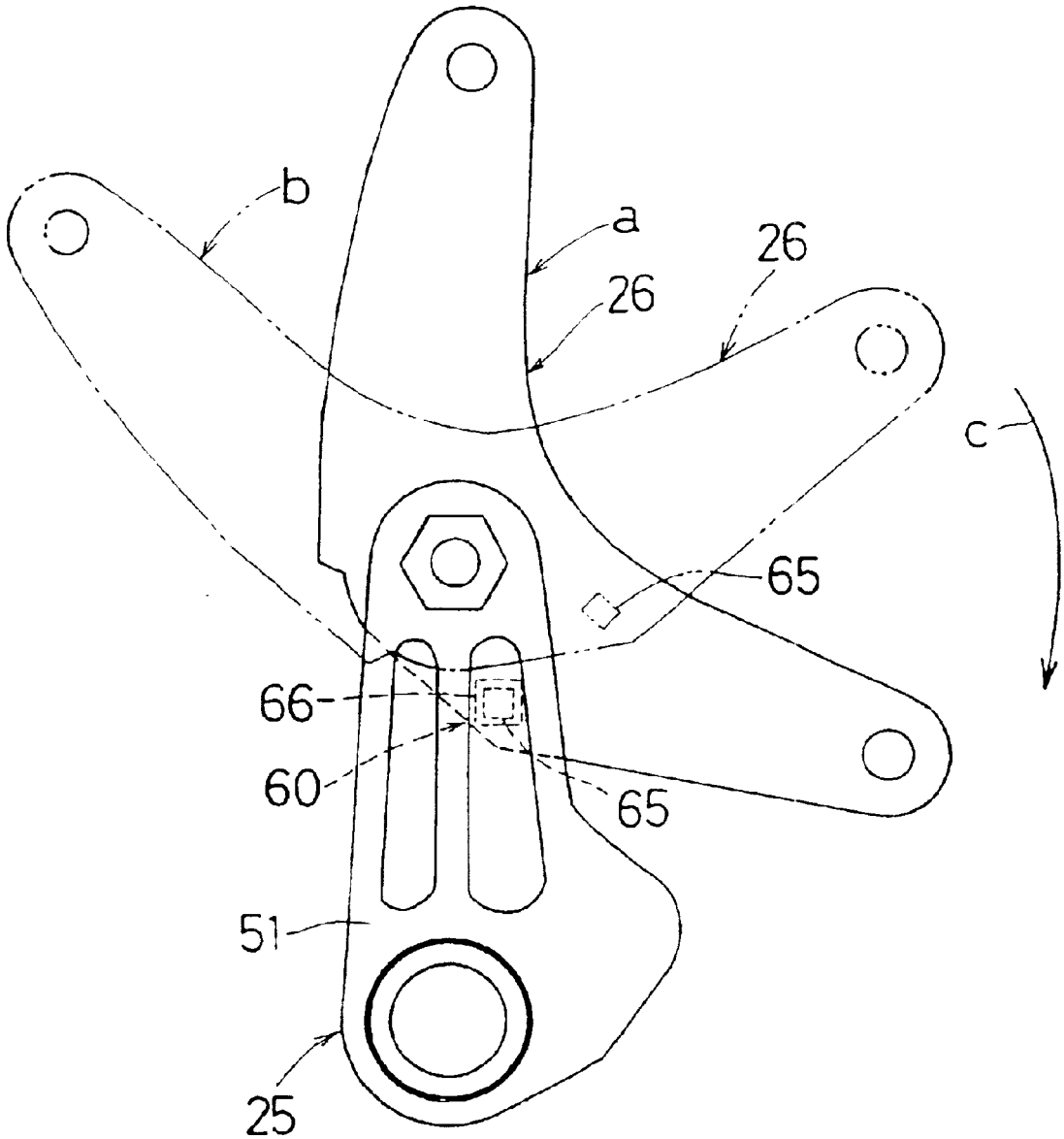
FIG. 16 is a side view of the supporting arm and the driving arm.

FIG. 15 and FIG. 16 show another embodiment, in which a magnet 65 is mounted on the supporting arm 26, and a lead switch 66 is mounted on the clipping body 51 of one of the drive arms 25 correspondingly, so that the lead switch 66 constitutes the pivotal movement detecting sensor 60. In this case, when the massaging unit 7 is moved vertically to move the supporting arm 26 vertically along the user's body together with the drive arm 25 with the first therapeutic member 8 and the second therapeutic member 9 abutted against the user, and the first therapeutic member 8 reaches the shoulder or the neck position of the user, the supporting arm 26 pivots significantly toward the lower pivotal position a with respect to the drive arm 25, and simultaneously, the magnet 65 on the supporting arm 26 being away from the lead switch 66 on the drive arm 25 as shown by the dashed lines in FIG. 16 approaches the lead switch 66 on the drive arm 25 as shown by a solid line to turn the lead switch 66 from OFF to ON, so that the pivotal movement detecting sensor 60 detects that the supporting arm 26 reached the prescribed ranges of pivotal movement with respect to the drive arm 25. Other features are the same as the embodiment described above.

While the pivotal movement detecting sensor 60 is constructed of the lead switch 66 in the embodiment shown in FIG. 15 and FIG. 16, it is also possible to construct the pivotal movement detecting sensor 60 in such a manner that a magnetoelectric converting element (magnetic sensor) such as a Hall element, a magnet resistance element, a magnetic diode, or a magnetic transistor is provided instead of the lead switch 66 on one of the clipping bodies 51 so as to correspond to the magnet 65, so that the magnetoelectric converting element is switched between ON and OFF or the detected signal (current value or voltage value) outgoing from the magnetoelectric converting element varies by the change of the magnetic field when the supporting arm 26 reached the prescribed range of pivotal movement with respect to the drive arm 25.

In the embodiment shown in FIG. 13 and FIG. 14 or the embodiment shown in FIG. 15 and the FIG. 16, the pivotal movement detecting sensor 60. is constructed of the limit switch 63 or the lead switch 66 so as to detect that the supporting arm 26 reached the prescribed range of pivotal movement when the limit switch 63 or the lead switch 66 is switched from OFF to ON. Alternatively, it is also possible to construct the pivotal movement detecting sensor 60 to detect that the supporting arm 26 reached the prescribed range of pivotal movement when the limit switch 63 or the lead switch 66 is switched from ON to OFF.

Figure 17:
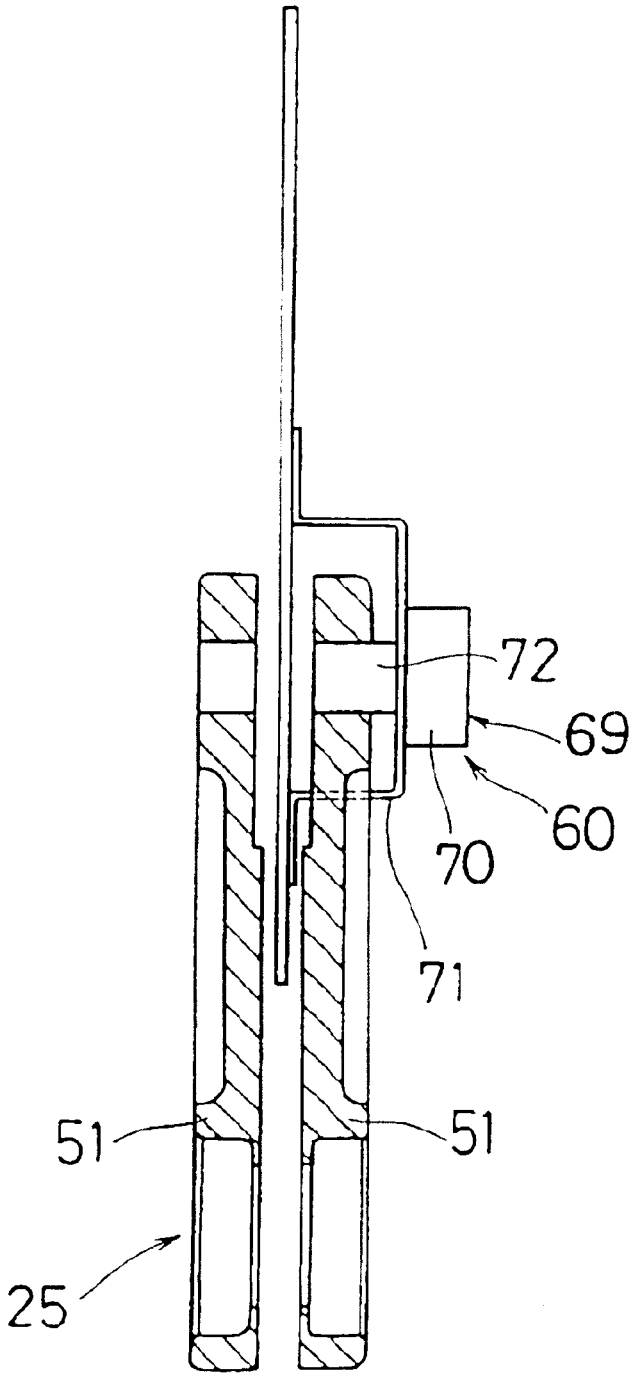
FIG. 17 is a front cross-sectional view of the supporting arm and the driving arm according to another embodiment.
Figure 18:
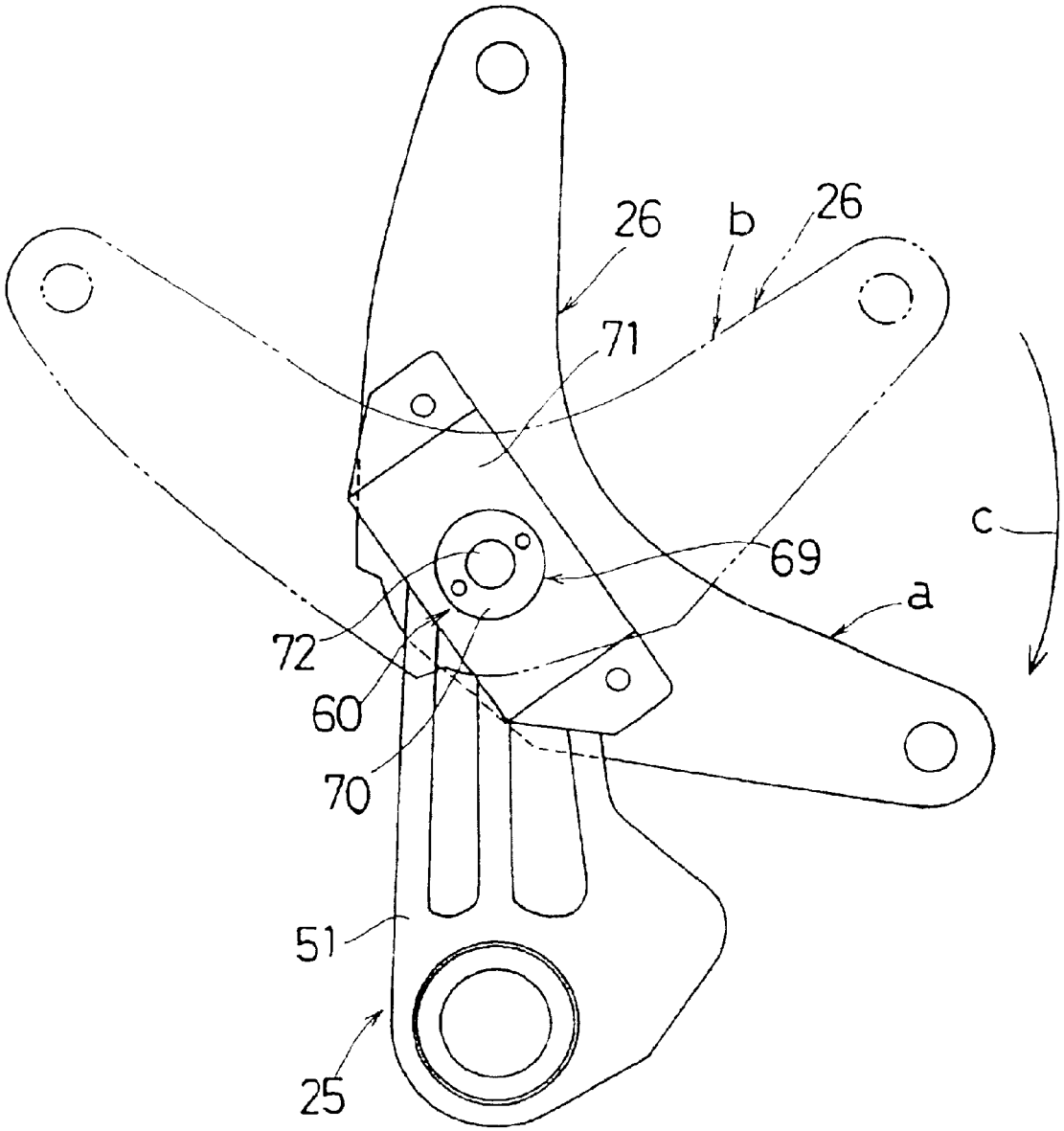
FIG. 18 is a side view of the supporting arm and the driving arm.

FIG. 17 and FIG. 18 show another embodiment, in which the pivotal movement detecting sensor 60 is constructed of a variable resistor 69 in which the resistance varies according to the pivotal position of the supporting arm 26 with respect to the drive arm 25.

In this embodiment, an outer cylindrical portion 70 of the variable resistor 69 is fixed to the supporting arm 26 via a bracket 71, and a shaft portion 72 of the variable resistor 69 is fixed to the tip portion of one of the clipping bodies 51, so that when the supporting arm 26 pivots with respect to the drive arm 25, the outer cylindrical portion 70 and the shaft portion 72 of the variable resistor 69 make relative rotation about the pivotal axis of the supporting arm 26 (corresponds to the center of connection O1 described above), and the resistance of the variable resistor 69 varies linearly according to the pivotal position of the supporting arm 26 with respect to the drive arm 25, so that the pivotal movement detecting sensor 60 constructed of the variable resistor 69 feeds the detected signal representing the voltage value or the current value corresponding (generally proportional) to the pivotal position of the supporting arm 26 to the control element constructed of a microcomputer or the like.

Then, during the rolling operation of the massaging unit 7, the control element determines and stores therein the vertical position of the supporting arm 26 (vertical position of the massaging unit 7) at the moment when the first therapeutic member 8 reached the user's shoulder or neck position and the supporting arm 26 pivoted significantly toward the lower pivotal position a with respect to the drive arm 25 as the shoulder position of the user with respect to the massaging apparatus from the voltage value or the current value represented by the detected signal fed from the pivotal movement detecting sensor 60, and then the specific portion of the user, or the shoulder position, with respect to the massaging apparatus is determined from the relation between the vertical position of the supporting arm 26 (vertical position of the massaging unit 7) and the pivotal position of the supporting arm 26.

While the pivotal movement detecting sensor 60 is constructed of the variable resistor 69 in the embodiment shown in FIG. 17 and FIG. 18, it is also possible to provide a incremental or absolute rotary encoder instead of the variable resistor 69 at the connecting portion between the supporting arm 26 and the drive arm 25, so that the encoder constitutes the pivotal movement detecting sensor 60. In this case, a detected digital signal corresponding (generally proportional) to the pivotal position of the supporting arm 26 with respect to the drive arm 25 is adapted to be fed from the encoder to the control element, so that the position of the specific portion, or the shoulder position, of the user with respect to the massaging apparatus is determined from the relation between the vertical position of the supporting arm 26 (vertical position of the massaging unit 7) and the pivotal position of the supporting arm 26, as in the case of the above-described variable resistor 69.

In the embodiments described above, the seatback 4 is provided with the pair of left and right supporting arms 26 bent in the boomerang shape, and the pair of left and right drive arms 25 to which the mid sections of the supporting arms 26 are connected. However, the number of the supporting arms 26 of the boomerang shape and of the drive arms 25 are not limited to the pair on the left and the right, but one or more than three supporting arms 26 and the drive arms 25 may be acceptable.

Though the embodiments described above is adapted to determine the shoulder position of the user with respect to the massaging apparatus as the position of the specific portion of the body, the portion of the user is not limited to the shoulder position, it may be other portions. For example, when the supporting arm 26 (therapeutic member) moves vertically on the hip of the user, the supporting arm 26 makes the pivotal movement, which is a bit different from the case where it moves on other portions. Therefore, it is also possible to construct so as to allow the pivotal movement detecting sensor 60 to detect this pivotal movement, and to allow the control element to determine the hip position of the user with respect to the massaging apparatus, thereby determining the hip position of the user with respect to the massaging apparatus accurately.

While the tension spring 55 is provided between the supporting arm 26 and the drive arm 25 so that the supporting arm 26 is urged in the direction shown by the arrow c (toward the lower pivotal position a) by the tension spring 55 in the embodiments described above, the tension spring 55 may be omitted or may be the tension spring 55 with a very small spring constant instead. In other words, since the supporting arm 26 is formed into a boomerang shape bent to a large extent as shown in FIG. 1 to FIG. 5, the weight balance between the side of the first therapeutic member 8 and the side of the second therapeutic member 9 of the supporting arm 26 with respect to the drive arm 25 is quite good and thus no noise is generated between the supporting arm 26 and the drive arm 25 during rapping motion or the like, whereby the tension spring 55 may be omitted.

Figure 19:
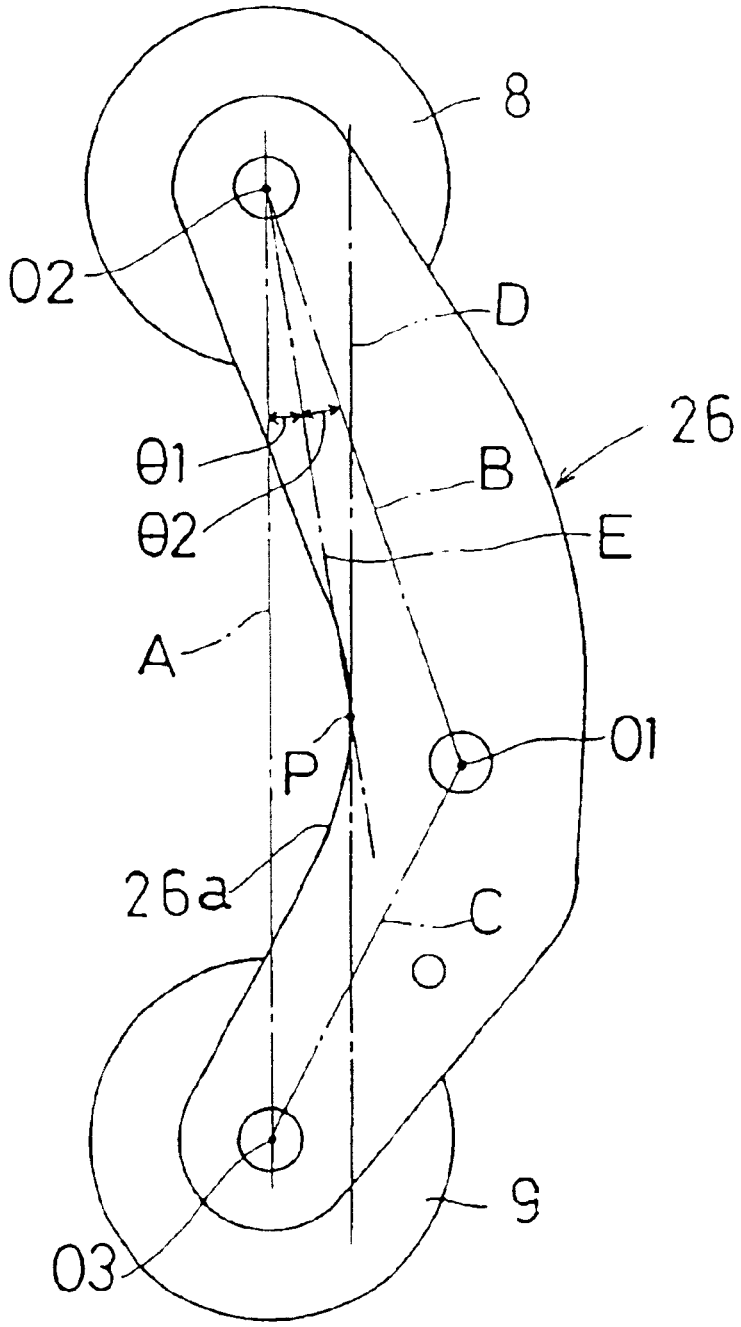
FIG. 19 is a side view of the supporting arm according to another embodiment.

While the embodiments described above employs the supporting arm 26 that is bent to a large extent in a boomerang shape, the shape of the supporting arm 26 is not limited thereto, and it may be a plate shaped supporting arm bent into an arch shape as shown in FIG. 19, or may be a rod shaped supporting arm.

While the midsection of the supporting arm 26 is connected to the tip portion of the drive arm 25 so as to pivot freely about the axis in lateral direction relative to the drive arm 25 in the embodiments described above, the midsection of the supporting arm 26 may be connected to the tip portion of the drive arm 25 so that the supporting arm 26 and the drive arm 25 pivot together about an axis in the lateral direction instead.

While the pivotal movement detecting sensor 60 is constructed of the optical sensor, the limit switch 63, the lead switch 66, or the variable resistor 69 in the embodiments described above, the pivotal movement detecting sensor 60 may be constructed of an ultrasonic sensor, an infrared sensor, or the like instead. The pivotal movement detecting sensor 60 may be constructed of a linear encoder instead of the rotary encoder.

Since it is proved by experiments that the best massaging motion by kneading motion and rapping motion could be performed for the entire upper half of the body including the back, the hip and the shoulder when the diameters of the first therapeutic member 8 and the second therapeutic member 9 are set to 70 mm, the diameters of the first therapeutic member 8 and the second therapeutic member 9 mounted on both ends of the supporting arm 26 are set to about 70 mm in this embodiment. However, the diameters of the first therapeutic member 8 and the second therapeutic member 9 is not limited to 70 mm, and it may be 60 mm, 75 mm, or other diameters, or the first therapeutic member 8 and the second therapeutic member 9 may be set to have different diameters from each other.

While the supporting arm 26 is provided with the first therapeutic member 8 and the second therapeutic member 9 in the embodiment described above, the number of therapeutic members to be mounted on the supporting arm 26 is not limited to two, and three or more therapeutic members may be mounted on one supporting arm 26. It is also possible to form a therapeutic member in a rod shape and provide only one therapeutic member on the supporting arm 26. The therapeutic member and the supporting arm 26 may be formed into a single unit.

While the present invention is applied to and implemented in the chair type massaging apparatus in the embodiment above, the massaging apparatus to which the present invention is applied is not limited to the chair type massaging apparatus. It may, of course, be applied to and implemented in a bed type or other types of massaging apparatus as far as it is a massaging apparatus having a supporting arm 26. The present invention may be applied to a massaging apparatus for massaging the leg portion of the human body in which the pivotal movement detecting sensor 60 detects the knee position or the ankle position of the user instead of the shoulder position.

According to the present invention, the position of the specific portion of the user such as the shoulder position with respect to the massaging apparatus can be automatically and accurately determined in a simple construction.

Referring now to FIG. 20 to FIG. 35, an embodiment of the present invention will be described.

Figure 23:
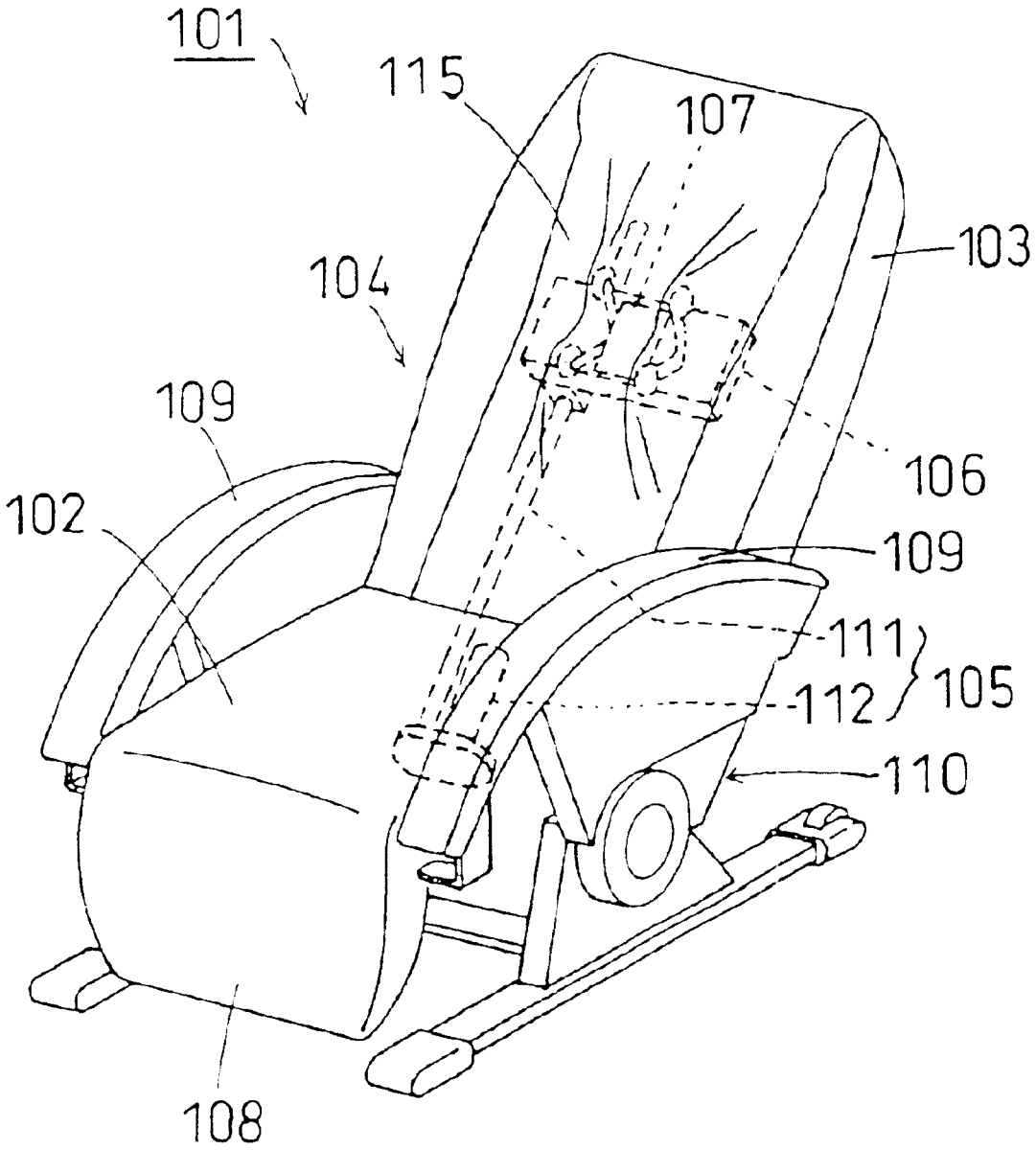
FIG. 23 is a general perspective view of the massaging apparatus.

FIG. 23 is a massaging apparatus 101 according to the present invention. The massaging apparatus 101 is a chair type massaging apparatus comprising a main body (therapeutic bed) 104 having a seat portion 102 on which the user sits and a seatback portion 103 for supporting the back of the user.

In the seatback portion 103 of the main body 104 of the chair, there are provided a moving frame 106 being movable vertically therein by a locomotive drive 105, and a massaging mechanism 107 on the moving frame 106. On the front side of the massaging mechanism 107 is covered with a flexible covering member 115 formed of cloth or leather.

The main body 104 of the chair comprises a seatback portion 103, a seat portion 102, a footrest 108, and a leg body 110 having arm rests 109 on both sides of the seat portion 102 formed in one piece. The seatback portion 103 and the footrest 108 are adapted to be angularly moved with respect to the seat portion 102 by means of a suitable electric driving mechanism, a fluid pressure driving mechanism, a manual structure, or the like for reclining operation.

Figure 21:
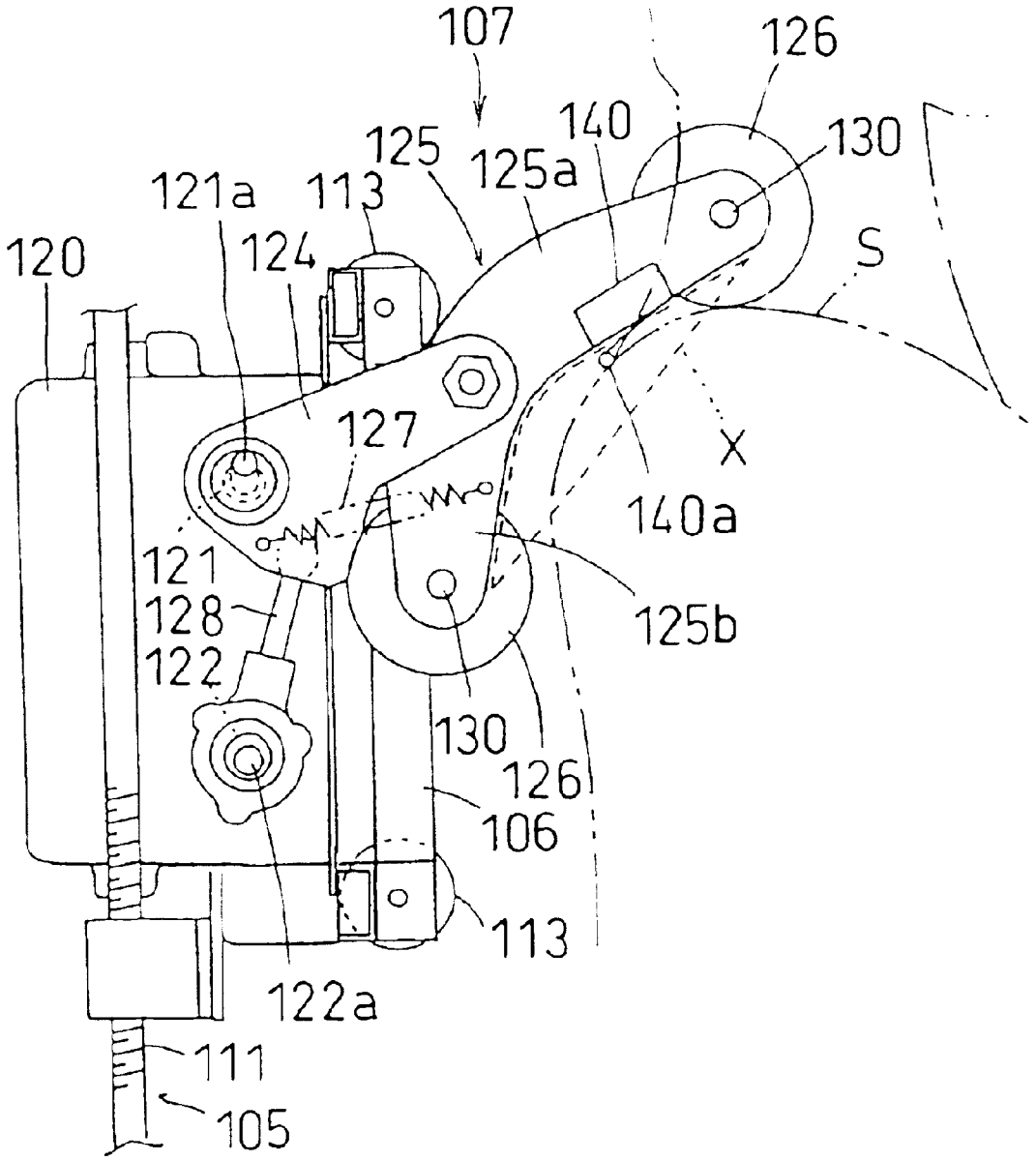
FIG. 21 is a side view of the massaging mechanism.
Figure 22:
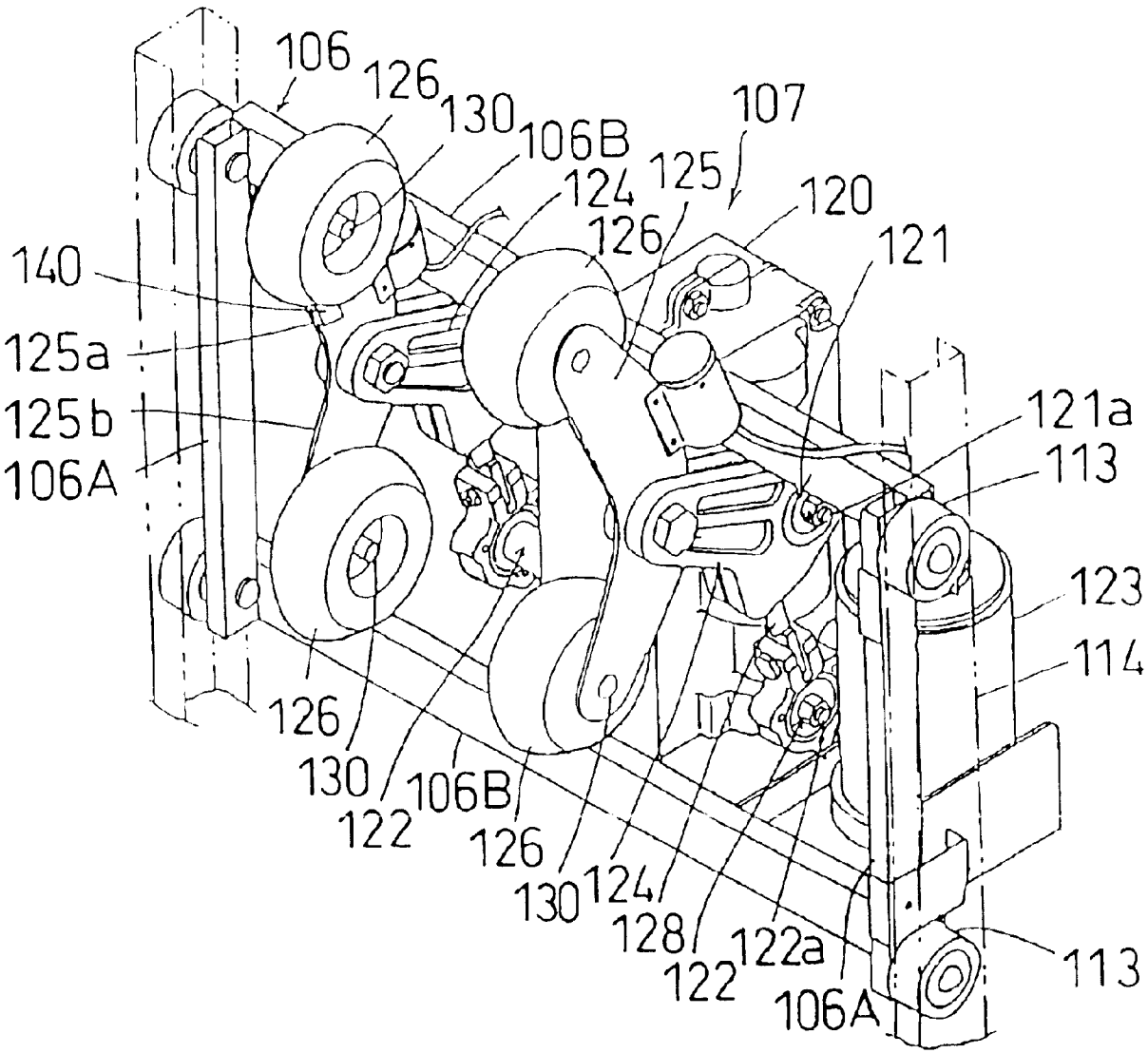
FIG. 22 is a perspective view of the massaging mechanism.

The locomotive drive 105 comprises a longitudinal-feed-thread-shaft 111 provided so as to rotate about the axis vertically extending along the seatback 103, and a power station 112 having a motor with a speed reducer for driving the longitudinal-feed-thread-shaft 111 in the forward and reverse direction, and the longitudinal-feed-thread-shaft 111 passes through suitable portions of the massaging mechanism 107 or the moving frame 106 into engagement therewith. The moving frame 106 is rectangular in shape formed by connecting the upper and the lower ends of the left and the right frame bodies 106A, 106A with the upper and the lower frame bodies 106B, 106B as shown in FIG. 21 and FIG. 22, and the left and the right frame bodies 106A, 106A are respectively provided with a pair of upper and lower traveling rollers 113 on the outsides thereof, which are rotatably attached to two guide rails 114 provided vertically in the seatback portion 103. In this arrangement, the massaging mechanism 107 can be moved along the back surface of the upper half of the user's body sitting on the seat portion 102 vertically toward the neck or toward the hip by the operation of the locomotive drive 105.

Figure 20:
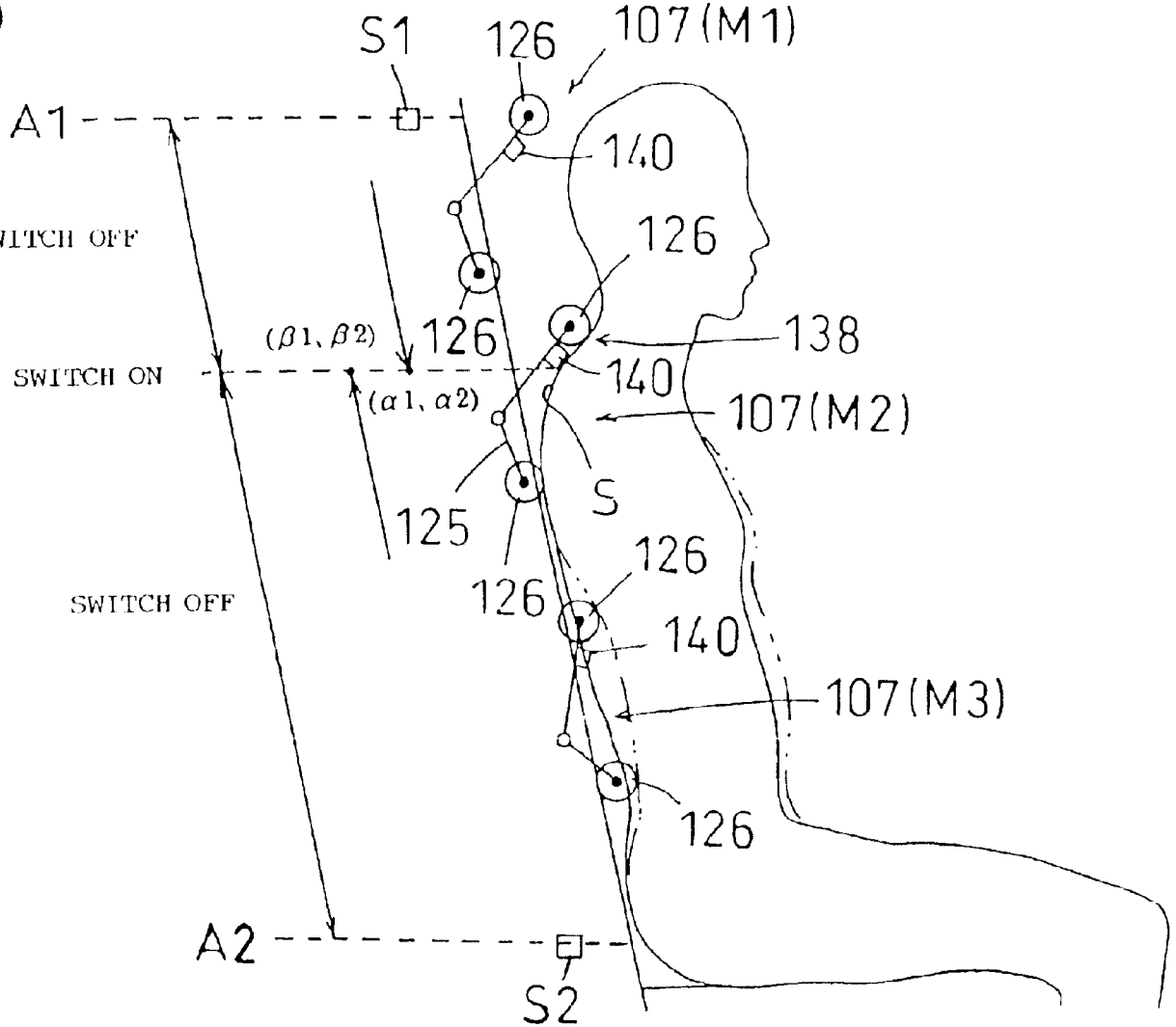
FIG. 20 is a view showing the principle of detection of the shoulder position according to an embodiment of the present invention.

The massaging mechanism 107 has a preset upper limit of the upward movement at the position saved upward the head of the user and a preset lower limit of the downward movement at the position below the hip, and as shown in FIG. 20, an upper limit switch S1 and the lower limit switch S2 at the upper limit A1 and the lower limit A2.

Therefore, when the massaging mechanism 107 moves vertically and reaches the upper limit Al or the lower limit A2, signals from the upper and the lower limit switches S1 and S2 is fed to the control element, not shown, and the control element performs the control of the vertical movement of the massaging mechanism 107 so as to stop or to reverse.

The position of vertical movement (quantity of movement) of the massaging mechanism 107 is detected by the vertical position detecting section, not shown, and the vertical position detecting section of this embodiment converts the number of revolution or the angle of revolution of the longitudinal-feed-thread-shaft 111 or the power station 112 into pulses by the means of rotary encoder or the like, and counts the number of pulses to detect the quantity of movement.

The locomotive drive 105 may be replaced by a wrapping driving mechanism, an engagement structure of the rack-and-pinion, or a hoist drive structure using a fluid pressure cylinder or the like, and the position detecting section may be replaced by suitable means such as a structure in which the vertical position of the massaging mechanism 107 is optically detected by a photoelectric sensor or the like.

The massaging mechanism 107 comprises a drive unit 120 having a kneading motion shaft 121 and a rapping motion shaft 122 projecting toward the left and the right sides, a power station 123 composed of an electric motor connected to the drive unit 120, a pair of drive arms 124 extending in the lateral direction (in the direction of the width of the user's body) held by the respective motion shafts 121, 122, a supporting arm 125 connected to the tip of the respective drive arms 124, and roller type therapeutic members 126 rotatably mounted on the upper and the lower ends of the supporting arm 125 via a lateral supporting shaft 130.

The kneading motion shaft 121 and the rapping motion shaft 122 are laterally disposed in parallel to each other with vertically spaced therebetween. The output from the power station 123 is fed to the transmission shaft in the drive unit 120 via a belt transmission mechanism or the like, so that the kneading motion shaft 121 and the rapping motion shaft 122 are selectively rotated via a gear or a clutch or the like in the same unit 120.

Both ends of the kneading motion shaft 121 are provided with inclined shaft portions 121*a* eccentrically inclined and angularly displaced with respect to the axis of rotation, and the rear end of the drive arm 124 is attached to the inclined shaft portion 121*a* via a bearing.

The supporting arm 125 is formed of a plate of V-shape rotated by 90 degrees to the right in side view comprising a first supporting portion 125*a* projecting toward the user in the diagonally upper front direction and the second supporting portion 125*b* projecting in the lower front direction to form an obtuse angle with respect to the first supporting portion 125*a,* and the vertical midpoint thereof is connected to the tip of the drive arm 124 via the lateral supporting shaft 124*a* so as to rotate about the axis thereof. There is provided a tension coil spring 127 between the supporting arm 125 and the drive arm 124 under the supporting shaft 124*a* so that a resiliency which urges the upper portion of the supporting arm 125 forward is provided.

There is formed a space X (a triangle region shown by dashed lines in FIG. 20) opening toward the user between the first and second supporting portions 125*a* and 125*b,* and this space X contributes to prevent the supporting arm 125 from touching the back or the shoulder of the user while the therapeutic member 126 is performing massaging motion.

On the left and the right ends of the rapping motion shaft 122, there are provided eccentric shaft portions 122*a* that are off-centered with respect to the axis of rotation in the opposite direction, to which the lower end of a connecting rod 128 is pivotally connected via a bearing, and the upper end of the connecting rod 128 is pivotally connected to the lower surface of the drive arm 124 via a ball bearing or the like.

In this arrangement, when the power station 123 rotates the kneading motion shaft 121, the inclined shaft portion 121*a* at the both ends of the kneading motion shaft 121 allow the therapeutic member 126 provided on the right and left sides correspondingly to perform circumferential movement including lateral movement toward and away from each other, thereby performing kneading motion.

When the rapping motion shaft 122 rotates, the eccentric shaft portions 122*a* on both ends thereof make the drive arm 124 reciprocate vertically via the connecting arm 128, whereby the therapeutic members 126 perform the rapping motion via the supporting arm 125 rotatably connected to the drive arm 124.

When the massaging mechanism 107 is moved vertically by the locomotive drive 105 with the rotation of the kneading motion shaft 121 and the rapping motion shaft 122 stopped, the therapeutic member 126 performs "rubbing" massage (rolling massage) while pushing the back of the upper half of the user's body.

While the kneading motion shaft 121 and the rapping motion shaft 122 are adapted so that a power from the power station 123 is selectively transmitted thereto via the clutch in the drive unit 120, separate special power stations may be provided for the motion shafts 121, 122 respectively.

The massaging apparatus 101 of the present invention comprises a position detecting means 138 for detecting the position of the specific portion of the user's body, and the control element has a feature to recognize the value detected accurately by the position detecting means 138 as the position of the specific portion of the body from a control viewpoint, which is recognized as a reference point of the massaging motion.

In other words, prior to the commencement of the massaging motion, the position detecting means 138 detects the position of the specific portion and determines whether or not the detected value is proper, and when it is determined to be proper, the detected value is recognized as the position of the specific portion and massage is performed with the position as a reference point, whereby effective massage is performed according to the physique of the user.

Specifically, the position detecting means 138 of this embodiment is adapted to detect the position of the user's shoulder S as a specific portion of the body, and thus a vertical position detecting section for detecting the vertical position of the therapeutic members 126 (massaging mechanism 107) and a detector 140 for detecting the shoulder S are provided.

A micro switch that is turned ON and OFF when it touches directly the shoulder S of the user is employed as the detector 140, and mounted and fixed to the lower side portion of the first supporting portion 125*a* of the supporting arm 125 with the contact 140*a* projected into the space X between the first and second supporting portions 125*a* and 125*b*.

When the shoulder S abuts against the contact 140*a* and the micro switch 140 is turned ON, the vertical position of the therapeutic member 126 at this moment corresponds to the position of the shoulder S, whereby the position detecting means 138 detects the vertical position of the therapeutic member 126 as a detected value.

Figure 24:
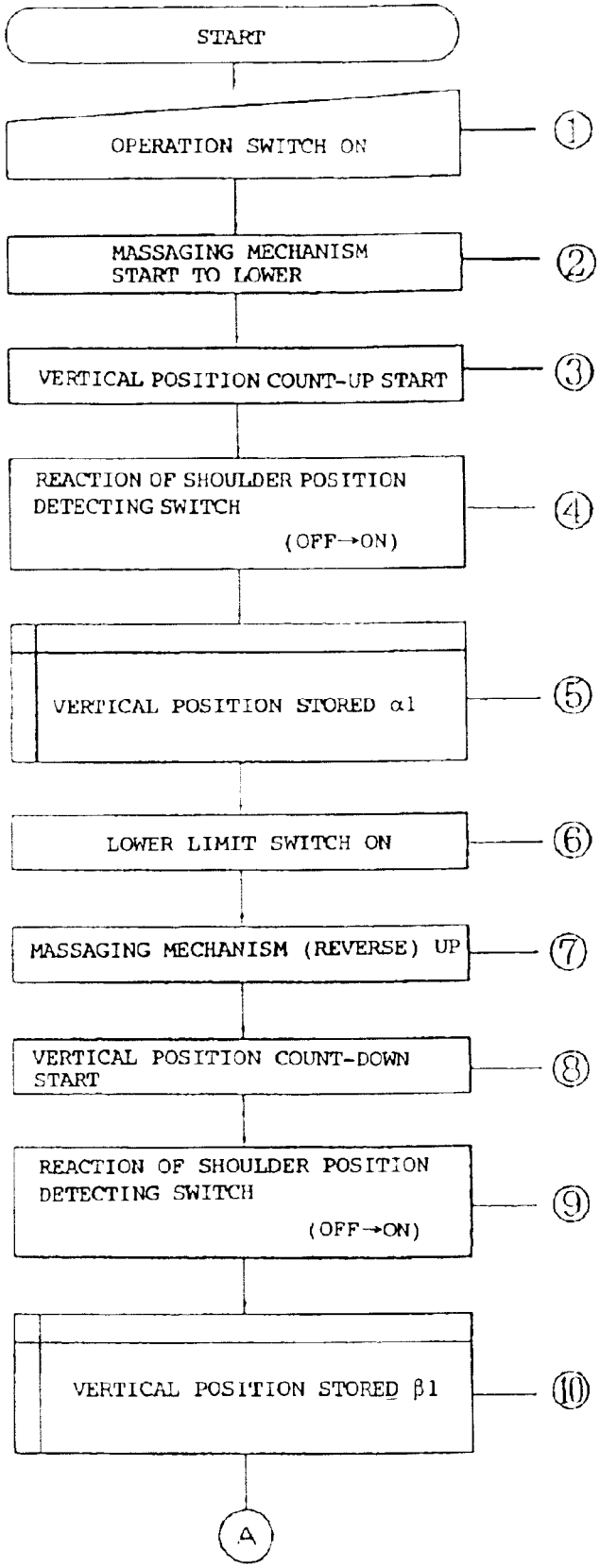
FIG. 24 is a flow chart showing the procedure of detection and determination of the shoulder position.
Figure 25:
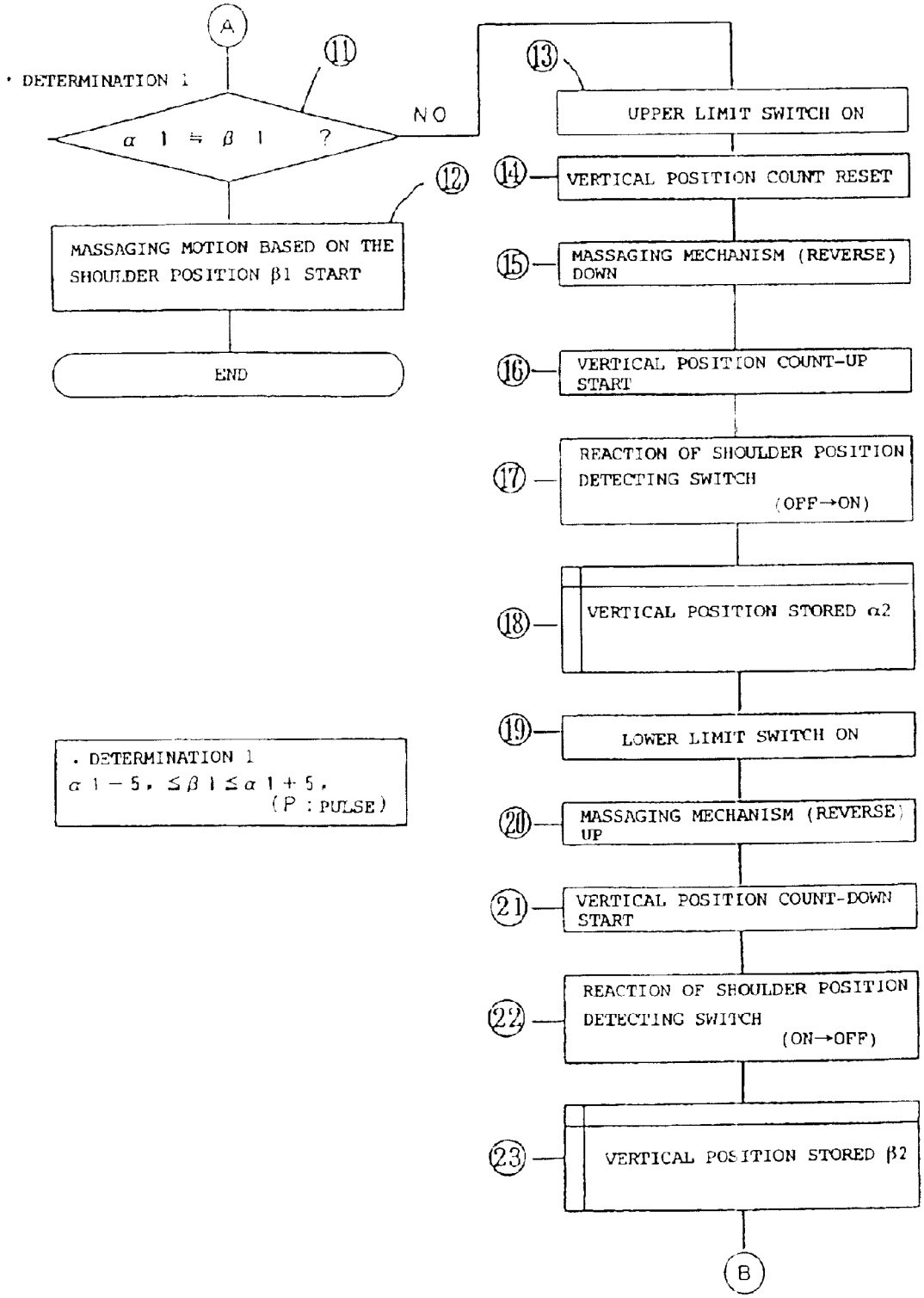
FIG. 25 is a flow chart showing the procedure of detection and determination of the shoulder position.
Figure 26:
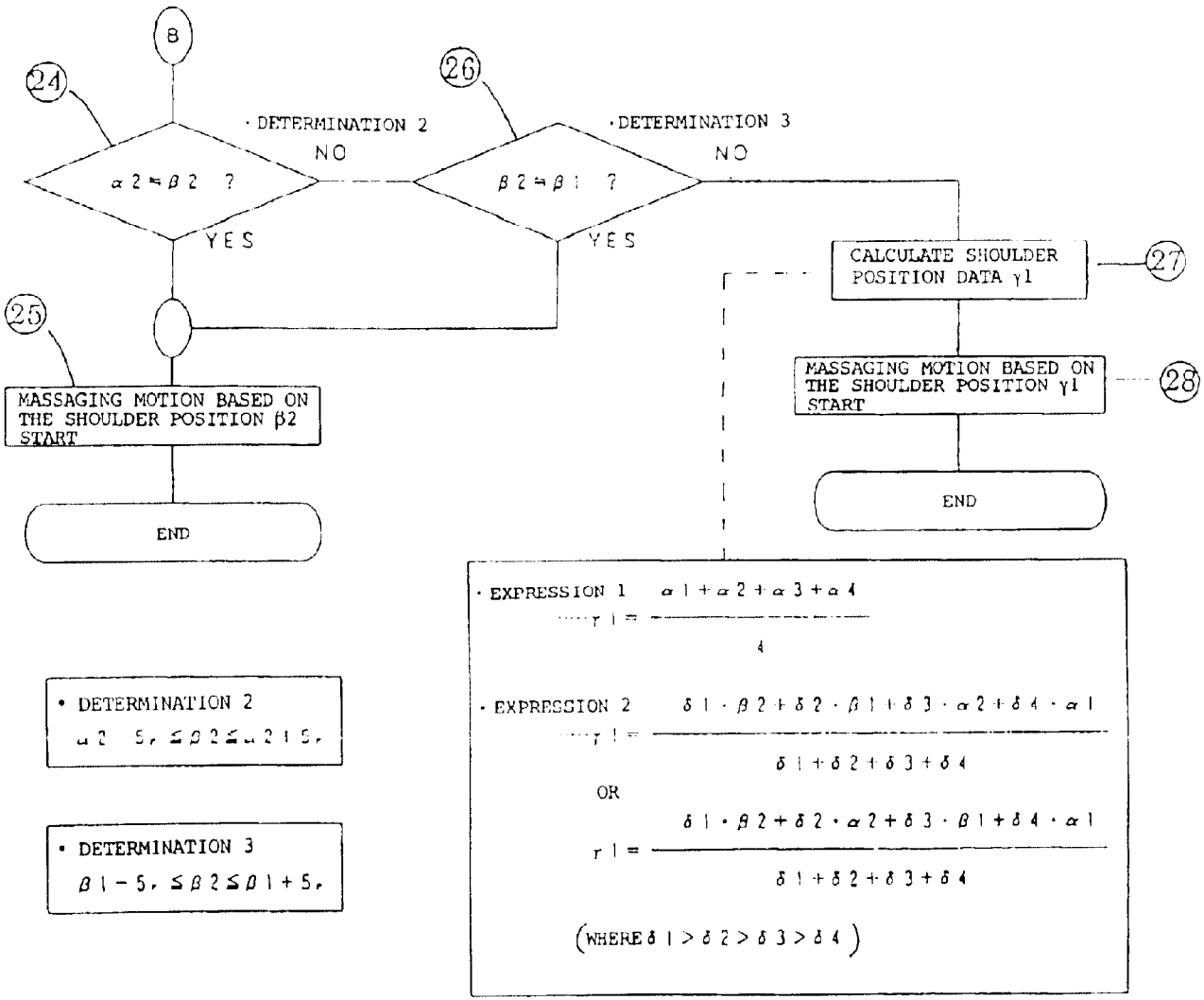
FIG. 26 is a flowchart showing the procedure of detection and determination of the shoulder position.
Figure 27:
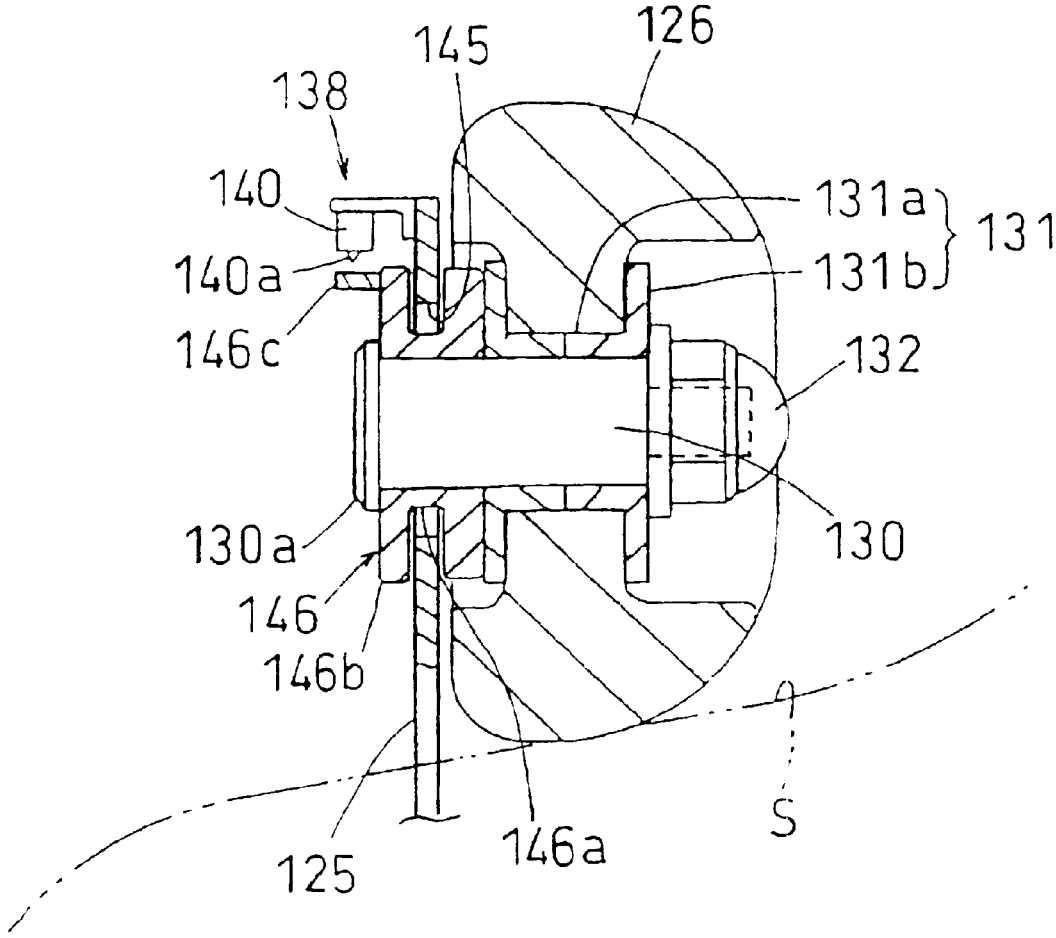
FIG. 27 is a front cross-sectional view showing another embodiment of the position detecting means.

The flow-charts shown in FIG. 24 to FIG. 26 show the procedure of detection of the specific portion and the determination of the detected value by the position detecting means 138. Referring now to FIG. 20 and FIG. 21 as well, these flow-charts are described.

In the initial state of the massaging apparatus 101, the massaging mechanism 107 is stored at the upper limit A1, and in this state, the pulse count is reset to zero at the vertical position detecting section. Since no load is applied to the therapeutic members 126 from the user, the upper therapeutic member 126 projects forward by the action of the tension coil spring 127, and in contrast to it, the lower therapeutic member 126 takes the retracted position.

When the operation switch of the massaging apparatus 101 is turned ON (step 1), the massaging mechanism 107 starts the downward movement actuated by the locomotive drive 105 (step 2), and the vertical position detecting section starts counting the vertical movement of the massaging mechanism 107 (step 3).

When the massaging mechanism 107 moves downward and the upper therapeutic member 126 approaches or abuts against the upper portion of the user's shoulder S, the user's shoulder is placed in the space X below the first supporting portion 125*a* and directly touches (substantially, directly via the covering member 115) the contact 140*a* of the micro switch 140, and the micro switch 140 is switched from OFF to ON (the state M2 in FIG. 20, and the state shown in FIG. 21. step 4).

The position detecting means 138 detects the position of the massaging mechanism 107 at the moment when the micro switch 140 is switched ON as a detected value (first detected value) $\alpha$1, which is to be stored in the memory in the control element (step 5).

The first detected value al obtained here is not the value recognized as the shoulder position from a control viewpoint that is considered as a reference point of the massaging motion, but used for reference purpose when comparing with the second detected value $\beta$1.

After the first detected value al is detected, the massaging mechanism 107 is moved downward to the lower limit A2, and this downward movement perform the "rubbing" massage on the upper half of the user's body (back). When the upper therapeutic member 126 comes into contact with the back, the supporting arm 125 pivots upward and thus the shoulder comes out from the space X, and the micro switch 140 is turned from ON to OFF (the state M3 in FIG. 20).

When the massaging mechanism 107 reaches the lower limit A2, the locomotive drive 105 makes the reverse motion by a signal from the lower limit switch S1 and thus the vertical movement of the massaging mechanism 107 is also reversed. When the upward movement of the massaging mechanism 107 starts, the vertical position detecting section starts counting the vertical position thereof (step 6 to step 8).

During the upward movement of the massaging mechanism 107, the therapeutic member 126 again performs "rubbing" massage on the back, and when the upper therapeutic member 126 reached the position coming off the back, the supporting arm 125 pivots downward by the pressure applied to the lower therapeutic member 126 from the back and a force urged by a tension coil spring 127 so that the upper therapeutic member 126 abuts against or approaches the upper portion of the shoulder S.

At this moment, the shoulder S is placed in the space X again and touches the contact 140*a* of the micro switch 140 to switch the micro switch 140 from OFF to ON (step 9), and the position detecting means 138 detects the position of the massaging mechanism 107 at the moment when the micro switch 140 is turned ON as a detected value (second detected value) $\beta$1. The second detected value $\beta$1 is stored in the memory in control element (step 10).

When the vertical reciprocating movement of the therapeutic member 126 provides "rubbing" massage on the user's back, the user's back is stretched, and especially when the therapeutic member 126 moves from the hip side, which is located at the position lower than the shoulder S, upward along the body, the posture of the user is corrected so that the back fits with the seatback 103 before the micro switch 140 detects the shoulder S.

In addition, when a "rubbing" massage is performed, the user's body fits with the chair body 104, and thus the back of the user leans against the seatback 103 naturally, thereby stabilizing the posture.

Therefore, since the second detected value $\beta$1 is detected in a state in which the posture is corrected, or in a stabilized state, it is considered to be more accurate as an indicator of the shoulder position in comparison with the first detected value $\alpha$1.

Here, since the second detected value $\beta$1 is recognized as the shoulder position from a control viewpoint, which is a reference point of the massaging motion, the physique of the user can be determined more accurately than that of the related art. However, in the present invention, in order to increase reliability, two detected values $\alpha$1 and $\beta$1 are compared with respect to each other and when the values $\alpha$1 and $\beta$1 are close agreement with each other, the second detected value $\beta$1, which is considered to be more accurate, is determined to be the shoulder position (determination 1, step 11).

Accordingly, the accurate shoulder position is obtained, and the massaging motion is performed with this position as a reference point, so that more effective massage can be performed according to the physique of the user.

The state in which the first and second detected values $\alpha$1 and $\beta$1 are close agreement with each other includes a state where both of the values $\alpha$1 and $\beta$1 are exact agreement with each other as a matter of course, and a state in which the second detected value $\beta$1 is within a prescribed range wherein the first detected value $\alpha$1 is included (approximated state).

Specifically, in this embodiment, when the second detected value $\beta$1 is within the range of the first detected value $\alpha$1±5P (P=number of pulses), the first and second detected values $\alpha$1 and $\beta$1 are determined to be close agreement with each other.

The comparative range is not limited to the range described above, but rather modifiable as appropriate. It is also possible to be constructed in such a manner that whether or not the first detected value al is contained within a prescribed range including the second detected value $\beta$1 is determined.

When the first and second detected values $\alpha$1 and $\beta$1 are close agreement with each other, the second detected value $\beta$1 is recognized as the shoulder position in a control view point, which is a reference point of the massaging motion, and the massage motion based on the shoulder position $\beta$1 starts and the step of detection and determination of the shoulder position terminates (step 12).

When the first and second detected values $\alpha$1 and $\beta$1 are not close agreement with each other, or when the position of the shoulder S could not be determined by the determination 1, in this embodiment, the detection and determination of the shoulder position are performed again by repeating the procedures described above.

In other words, by obtaining the second detected value β1, and then moving the massaging mechanism 107 upward to the upper limit A1, the pulse count at the vertical position detecting section is reset to zero again (steps 13, 14), and the downward movement of the massaging mechanism 107 is started by reverse motion of the locomotive drive 105, and simultaneously, the count of the position is started at the vertical position detecting section (steps 15, 16).

Then, in the same operation as described above, the first detected value α2 is obtained and stored in the memory (steps 17, 18), and the therapeutic member 126 applies a "rubbing" massage to the user's back from the top to the bottom.

When the massaging mechanism 107 reaches the lower limit A2, the locomotive drive 105 makes reverse motion by a signal from the lower limit switch S1, and the massaging mechanism 107 is reversed to start the upward movement. Simultaneously, the vertical position detecting section starts to count the vertical position (step 19 to step 21).

In the process that the therapeutic member 126 performs a "rubbing" massage on the hip and the back upwardly from the bottom, the position detecting means 138 detects the second value β2 and stores the same in the memory (steps 22, 23).

Then, whether or not the first and second detected values α2, β2 are close agreement with each other, or whether or not the second detected value β2 is contained within the prescribed range containing the first detected value α2 is determined (determination 2), and when they are close agreement with each other, the second detected value β2 is recognized as the shoulder position and the massaging motion is started based on that position as a reference point (steps 24, 25).

In the determination 2, as in the case of the determination 1 described above, when second detected values β2 are within the range of the first detected value α1±5P (P=number of pulses), the first and second detected values α1 and β1 are considered to be close agreement with each other. However, the condition is not limited thereto.

When the first and second detected values α2 and β2 are not close agreement with each other, or when the shoulder position could not be determined, the second detected value β1 obtained first in the process that the massaging mechanism 107 moves upward and the second detected value β2 detected for the second time (last time) are compared (determination 3), and when both of these values are close agreement with each other, the second detected value β2 last obtained is recognized as the shoulder position (step 26).

The second detected values β1 and β2 detected in the process of the upward movement of the massaging mechanism 107 are the values detected in a state where the posture is corrected or stabilized state as described above, and thus the provability that they represents the accurate position of the shoulder is considered to be high. Therefore, when these values are found to be exact agreement with each other by the comparison between these detected values β1, β2, it is considered that these detected values β1, β2 generally represent the accurate position of the shoulder S. The physique of the user can be determined accurately by recognizing the second detected value β2 obtained for the second time in a state in which the user's posture is positively corrected or stabilized by a plurality of times of upward and downward movements of the therapeutic member 125 is determined as the position of the shoulder S.

In this embodiment, the determination 3 determines whether or not the second detected value β2 last obtained is contained within a prescribed range including the second detected value β1 detected first, and more specifically, the second detected value β2 last obtained is within the range of the second detected value β1 detected first ±5P (P=number of pulses). In this case as well, the condition is not limited thereto, but rather modifiable as appropriate.

As is described thus far, in the present invention, the physique of the user is determined accurately by determining the accurate second detected values β1, β2 obtained in the process of the upward movement of the therapeutic member 126 as the position of the shoulder S from a control viewpoint, not the first detected value α1, α2 obtained in the process of downward movement of the same, thereby performing effective massage.

In the determination 3, when the second detected value β1 first obtained and the second detected value β2 last obtained are not close agreement with each other, or when the position of the shoulder could not recognized, the data of the shoulder position γ1 is calculated by substituting all the detected values α1, β1, α2, and β2 to a prescribed arithmetic equation in this embodiment (step 27).

As a method of calculating the data of the shoulder position γ1, for example, a method to take an average value of the detected values α1, β1, α2, and β2 (equation 1), or a method in which each detected values α1, β1, α2, and β2 is multiplied by "weight" (Γ1–Γ4) in the order that is considered to be accurate (62 2-β1-α2-α1, or β2-α2-β1-α1) and the sum of them is divided by the sum of "weight" (equation 2) may be employed, and some other statistical methods may be employed as appropriate.

After the data of the shoulder position γ1 is calculated, massaging motion is started based on the data of the shoulder position γ1 (step 28) and the step of detecting the shoulder position is terminated.

FIG. 22 to FIG. 34 show other embodiments of the position detecting means 138.

Especially the embodiments shown in FIG. 22 to FIG. 29 uses a contact-type sensor such as a micro switch or the like as the detector 140 of the position detecting means 138, as in the case of the above-described embodiment, but the mounting portion or the construction is different. The detector 140 shown in FIG. 30 to FIG. 34 detects the load applied to the therapeutic member 126 from the user's body, and the detector 140 shown in FIG. 35 (140A to 140D) uses a sensor of non-contact type.

Each embodiment will be described below.

In the embodiment shown in FIG. 22, the micro switch 140 is provided associated with the therapeutic members 126 on the upper side of the supporting arm 125, and a vertically elongated hole 145 is formed on the upper portion of the supporting arm 125, through which the proximal end of the supporting shaft 130 having a lateral axis is attached via a mounting member 146. The mounting member 146 comprises a cylindrical portion 146*a* inserted therein so as to be movable freely in the vertical direction with respect to the elongated hole 145, and a flange portion 146*b* formed on the both ends of the cylindrical portion 146*a*, so that the flange portion 146*b* prevents the cylindrical portion from being disconnected from the elongated hole 145.

The supporting arm 125 is provided with a micro switch 140 having a contact 140*a* facing downward on the upper end thereof, and there is provided a abutment strip 146*c* that can abut against the contact 140*a* at the upper end of the flange portion 146*b*.

At the center of the therapeutic member 126, there is provided a boss body 131 having a cylindrical portion 131*a* to be rotatably fitted on the supporting shaft 130 and flanges 131*b* formed on the left and the right sides for interposing the therapeutic member 126 therebetween, and a mounting nut 132 for preventing the therapeutic member 126 from being disconnected is fitted into engagement with the tip of the supporting shaft 130 via a washer or the like.

In the arrangement described above, when the therapeutic member 126 is moved downward from the head side of the user and comes into contact with the upper surface of the shoulder S, the therapeutic member moves upward along the elongated hole 145, whereby the abutment strip 146*c* abuts against the contact 140*a* to turn the micro switch 140 ON. Therefore, the position of the therapeutic member 126 at the moment when the micro switch 140 is turned on indicates the shoulder position and the position detecting means 138 detects this position as first detected values $\alpha 1$, $\alpha 2$.

When the therapeutic member 126 is moved upward from the hip side, the therapeutic member 126 is moved to the lower side of the elongated hole 145 due to the resistance applied by the back of the body or its own weight, and thus the micro switch 140 is turned OFF. On the other hand, when the shoulder S is placed under the therapeutic member 126, the therapeutic member 126 is moved upward, and thus the abutment strip 146*c* abuts against the contact 140*a* to turn the micro switch 140 ON. Therefore, the position of the therapeutic member 126 at the moment when the micro switch 140 is turned ON indicates the position of the shoulder S, and this position is detected as second values $\beta 1$, $\beta 2$.

Figure 28:
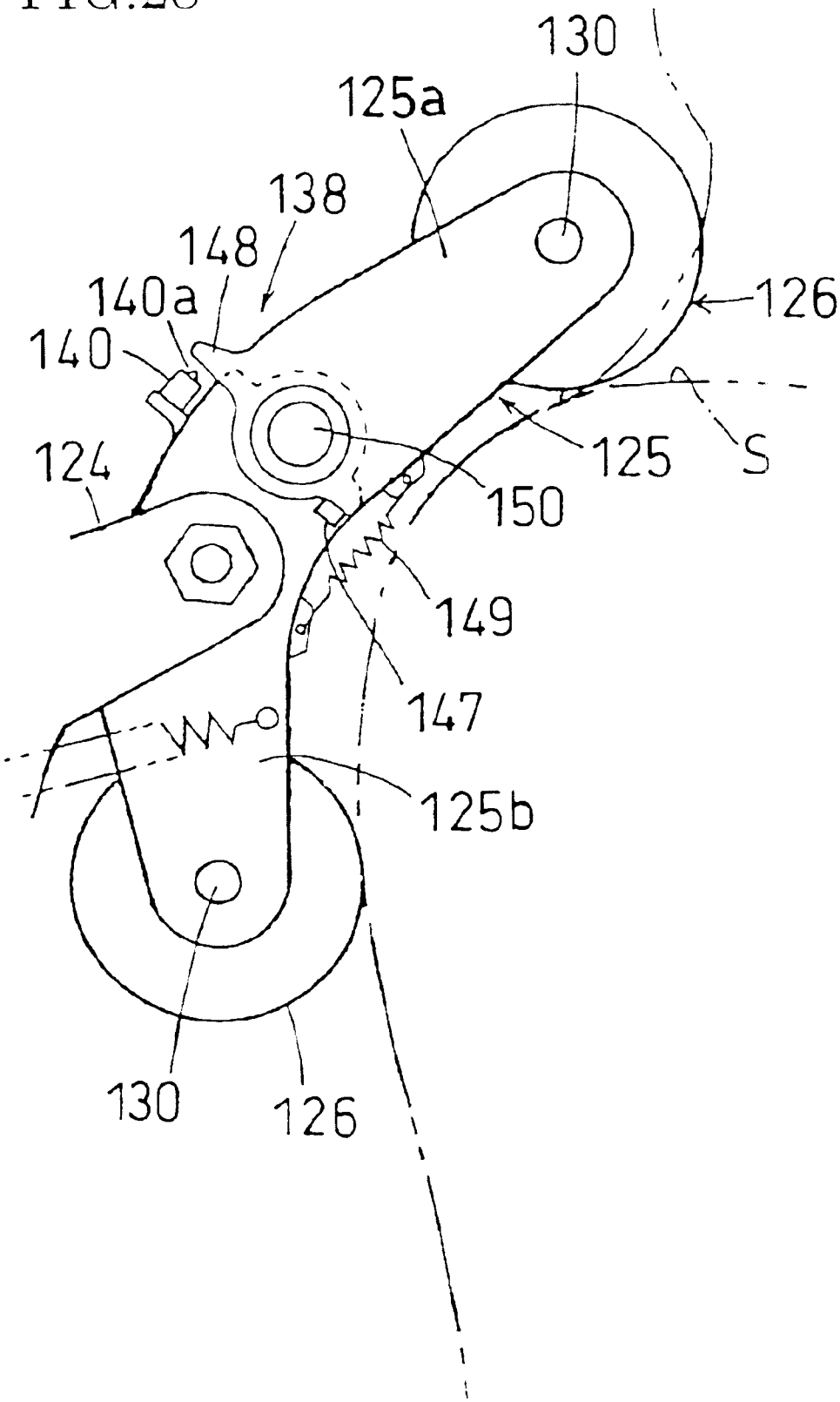
FIG. 28 is a side view showing another embodiment of the position detecting means.

In the embodiment shown in FIG. 28, the first supporting portion 125*a* and the second supporting portion 125*b* of the supporting arm 125 are divided at the position above the supporting shaft 124*a* and both of them are connected by the connecting shaft 150 so as to rotate about the lateral axis. There is provided a tension coil spring 149 on the front side of the supporting portions 125*a* and 125*b* so as to urge both portions in the direction that makes them to pivot forward and the stopper member 147 limits the pivotal movement thereof at a prescribed position.

A micro switch 140 having a contact 140*a* oriented upward is mounted on the upper rear end of the second supporting portion 125*b*, and a abutment strip 148 that can abut against the contact 140*a* is integrally formed on the lower rear end of the first supporting potion 125*a*.

In this arrangement, when both of the upper and the lower therapeutic members 126 is applied with the load from the user's body in the process of upward movement or the downward movement, the first and second supporting portions 125*a*, 125*b* pivot rearward against a force of the tension coil spring, and thus the abutment strip abuts against the contact 140*a* to turn the micro switch 140 ON. In contrast to it, when one of the therapeutic member 126 moves away from the body (when the upper therapeutic member 126 moves away from the shoulder), the first supporting portion 125*a* pivots forward by being urged by the tension coil spring 149 so that the micro switch 140 is turned OFF.

Therefore, the positions of the therapeutic member 126 at the moment when the micro switch 140 is switched from OFF to ON in the process of the downward movement of the therapeutic member 126, and at the moment when it is switched from ON to OFF in the process of the upward movement thereof are indicators of the position of the shoulder S, and the position detecting means 138 detects the positions as the first and second values $\alpha 1$, $\alpha 2$, $\beta 1$, and $\beta 2$.

Figure 29:
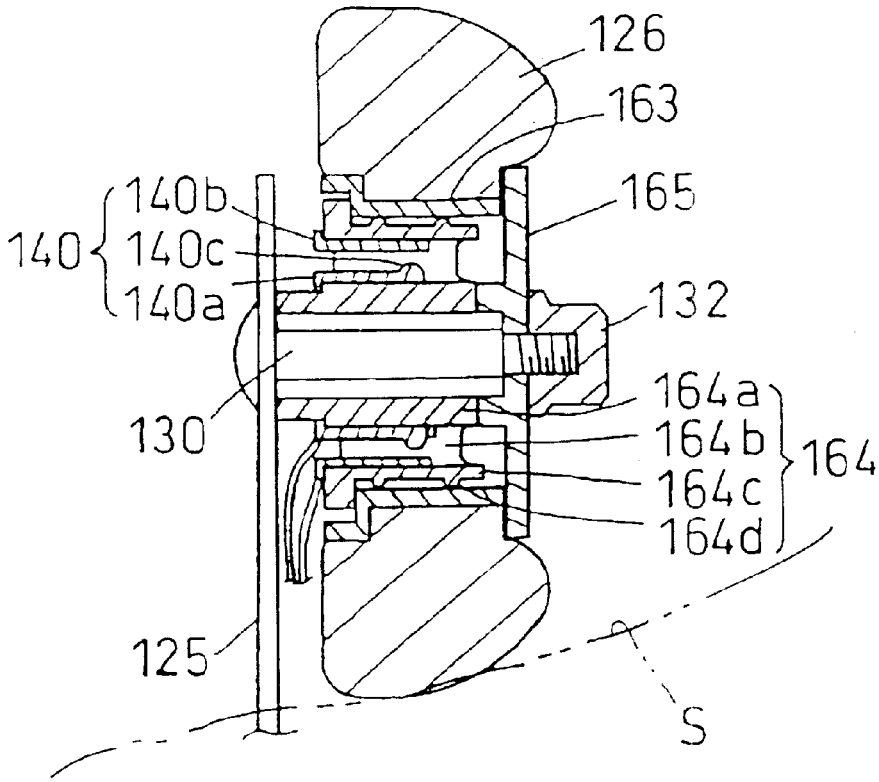
FIG. 29(*a*) is a front cross-sectional view showing another embodiment of the position detecting means (detector), and FIG. 29(*b*) is an exploded perspective view.
Figure 29:
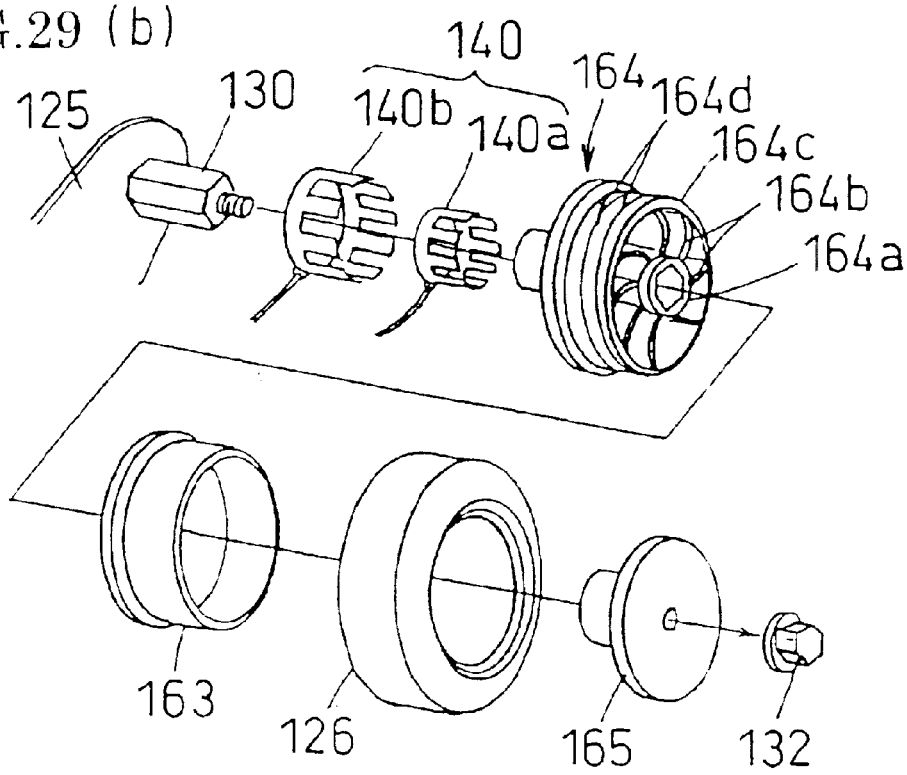

Shown in FIG. 29 is an embodiment including a contact type sensor 140 provided between the therapeutic member 126 and its supporting shaft 130. A cylindrical slip collar 163 is fitted to the inner periphery of the therapeutic member 126, and the slip collar 163 is adapted to be fitted on a boss body 164. The boss body 164 is formed of a synthetic resin or the like, and comprises an internal cylindrical body 164*a* through which the supporting shaft 130 is inserted, a plurality of resilient plates 164*b* radially outwardly projecting from the outer peripheral portion of the internal cylindrical body 164*a*, and a external cylindrical body 164*c* connected to the outer end portion of the resilient plate 164*b*, wherein the outer peripheral surface of the external cylindrical body 164*c* is formed with two projecting ridges 164*d* extending about the axis of the supporting shaft, and the slip collar 163 is adapted to be fitted on the outer periphery of the projecting ridge 164*d* so as to rotate about the axis of the supporting shaft.

The resilient plate 164 is shaped like a blade of arcuate in cross section, and the internal cylindrical body 164*a* and the external cylindrical body 164*c* are adapted to be moved closer to and away from each other owing to the resilient deformation of the resilient plate 164*b* when a load is applied to the therapeutic member 126 in the direction orthogonal to the axis, and when no load is applied, the internal and external cylindrical bodies 164*a* and 164*c* are held concentrically owing to the resilient restoration.

The sensor 140 has a inner electrode 140*a* to be fitted on the outer periphery of the internal cylindrical body 164*a* and the outer electrode 140*b* to be fitted in the inner peripheral portion of the external cylindrical body 164*c*, each electrode 140*a*, 140*b* is formed like a comb so that it can be inserted between the resilient plates 164*b*, and either one of the inner electrode 140*a* and the outer electrode 140*b* has a contact point 140*c* projecting toward the other electrode at the tip portion thereof.

The supporting shaft 130 is formed into a polygonal shaft such as a hexagonal shaft, and thus the inner surface of the internal cylindrical portion 164*a* is formed into a polygonal bore corresponding to the polygonal shape of the supporting shaft 130, thereby preventing rotation of the boss body 164 and the sensor 140 about the supporting shaft 130. The tip portion of the supporting shaft 130 is provided with a holding plate 165 fixed by means of the mounting nut 132 to prevent the therapeutic member 126, the boss body 164, or the like from falling off.

In this embodiment, when the upper therapeutic member 126 is applied with a load from the user's body in the process of upward movement or the downward movement thereof, the distance between the internal cylindrical body 164*a* and the external cylindrical body 164*c* is partially narrowed so that the contact point 140*c* formed on the inner or the outer electrode 140*a* comes into contact with the electrode 140*b* to turn the sensor 140 ON. On the other hand, when the upper therapeutic member 126 moves away from the body, the resilient restoration of the resilient plate 164*b* turns the sensor 140 OFF.

Therefore, the position of the therapeutic member 126 at the moment when the sensor 140 is switched from OFF to ON in the process of the downward movement of the therapeutic member 126, and at the moment when it is switched from ON to OFF in the process of the upward movement thereof represents the position of the shoulder S, and the position detecting means 138 detects this point as the first and second values $\alpha 1$, $\alpha 2$, $\beta 1$, and $\beta 2$.

Figure 30:
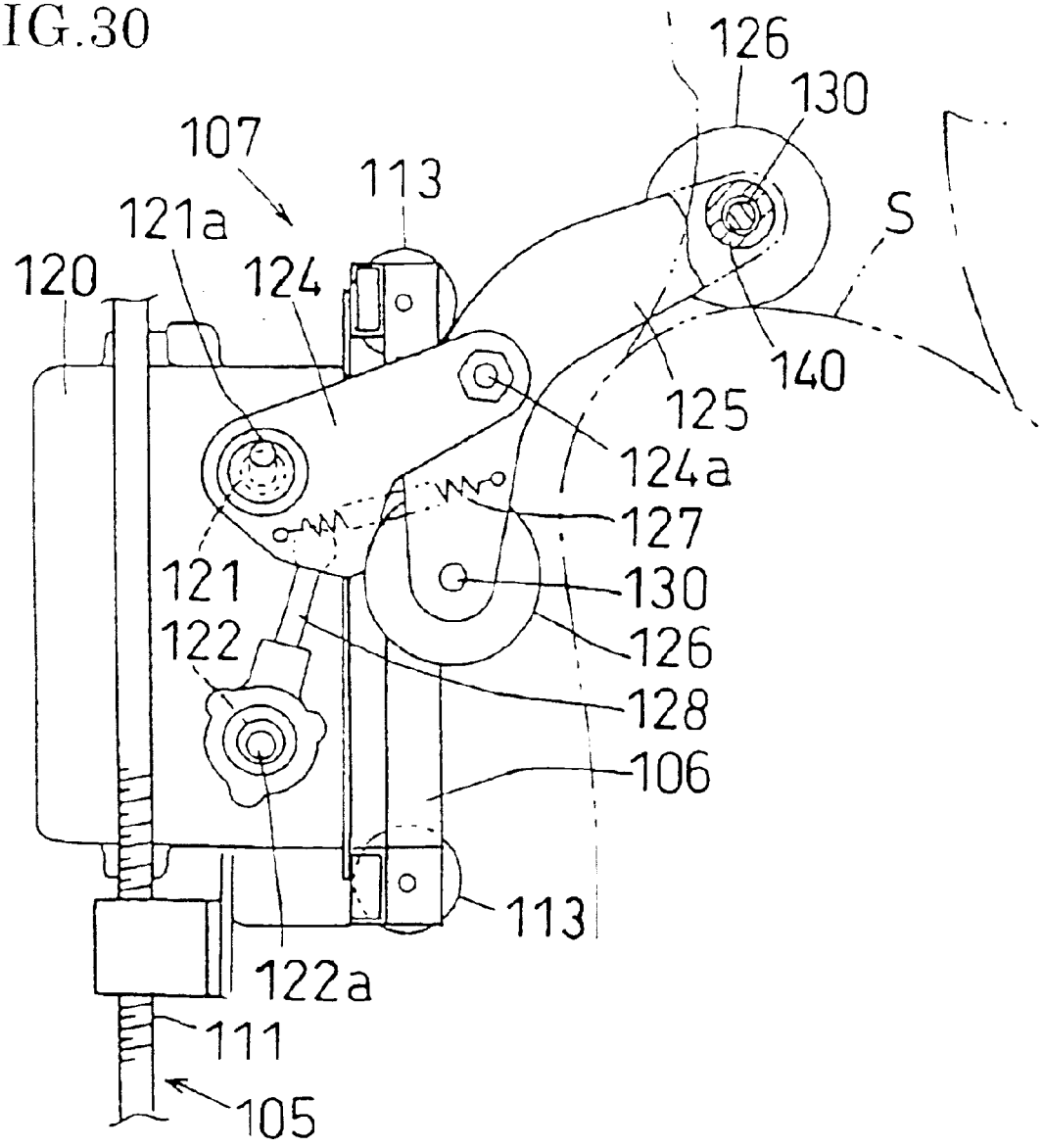
FIG. 30 is a side view showing another embodiment of the position detecting means (detector).
Figure 31:
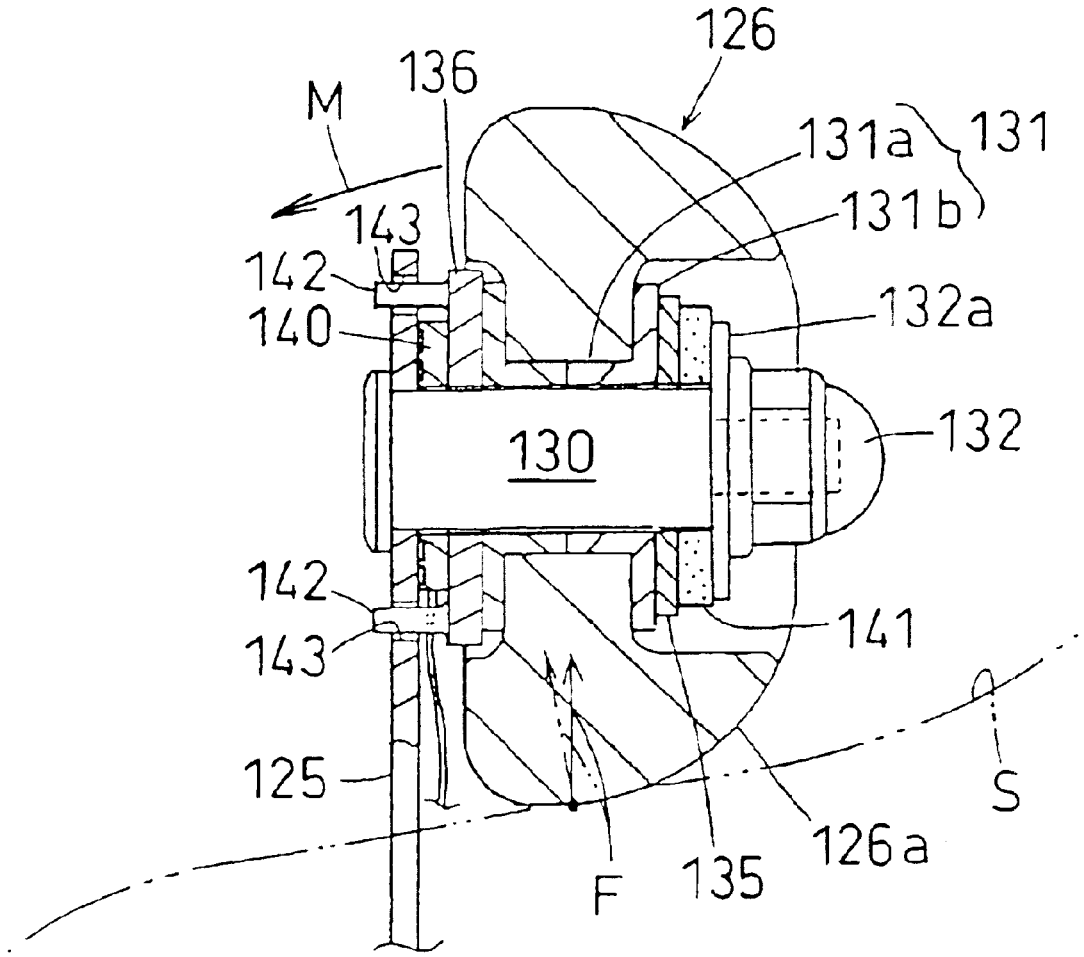
FIG. 31 is a front cross-sectional view showing the position detecting means (detector) shown in FIG. 30.
Figure 32:
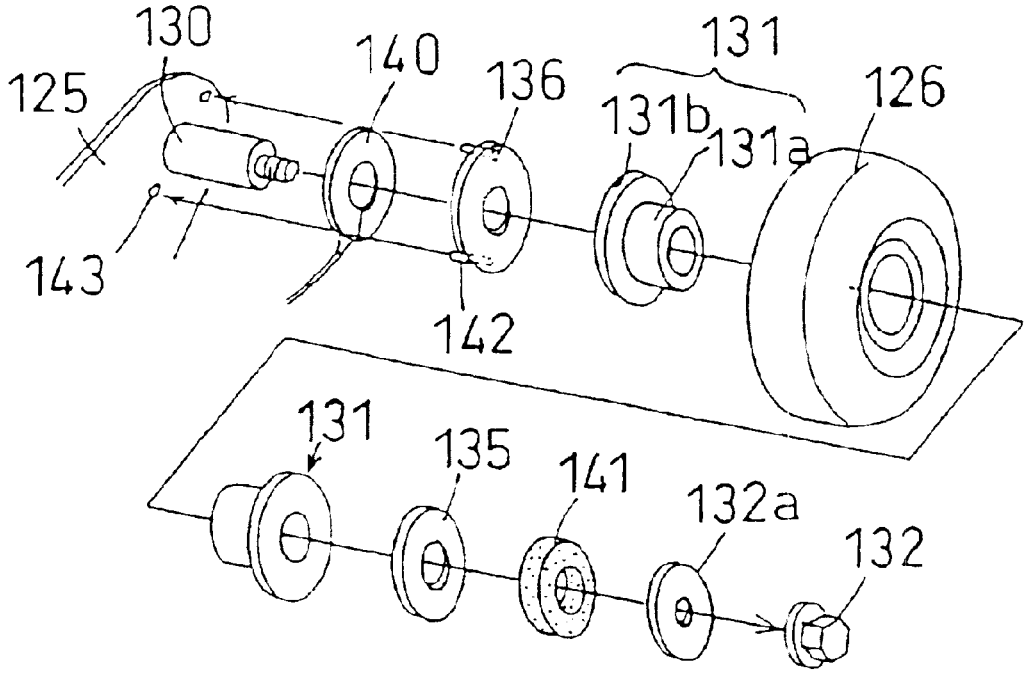
FIG. 32(*a*) is an exploded perspective view of the position detecting means shown in FIG. 30, and FIG. 32(*b*) is an exploded perspective view of the detector.
Figure 32:
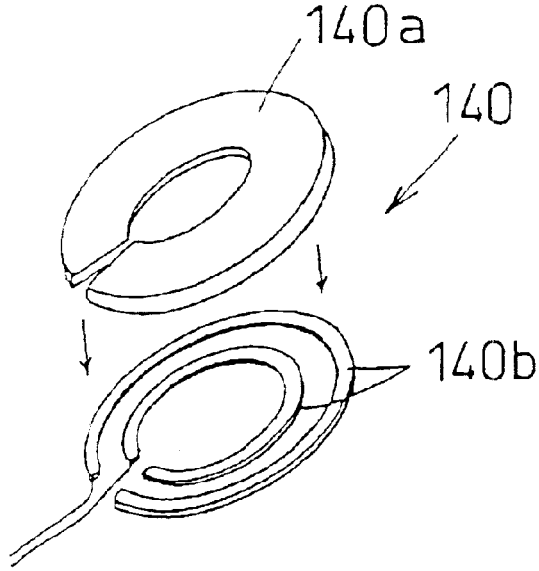

The embodiment shown from FIG. 30 to FIG. 32 includes a detector (pressure sensor) 140 for detecting the lateral load applied to the therapeutic member 126 provided between the supporting arm 125 and the therapeutic member 126 mounted on the upper side of the supporting arm 125.

In FIG. 31 and FIG. 32 showing the mounting structure of the therapeutic member 126, the supporting shaft 130 mounted to the supporting arm 125 is rotatably fitted with the boss body 131 of the therapeutic member 126 thereon, and the outer periphery of the therapeutic member 126 is formed in an arcuate inclined surface 126*a* curving inwardly toward the inner side in the lateral direction.

The detector 140 used here is a pressure (pressure-sensitive) sensor in which a pressure-sensitive conductive elastomer 140*a* including conductive particles is adhered on an elastic material such as rubber as an insulating material between a pair of electrodes 140*b*, and this pressure sensor 140 is formed into a doughnut disc shape so as to be fitted on the supporting shaft 130 between the supporting arm 125 and the boss body 131 of the therapeutic member 126 so that the laterally outer surface thereof is brought into contact with the laterally inner surface of the supporting arm 125.

The laterally inner surface of the pressure sensor 140 is covered with a doughnut disc shaped cover plate 136 and the laterally inner surface of the cover plate 136 comes into contact with the boss body 131. The outer surface of the cover plate 136 is provided with a plurality of detent projections 142 projected therefrom, which is inserted into an insertion hole 143 formed on the supporting arm 125 so as to move along the axis of rotation of the supporting shaft 130.

In this arrangement, the cover plate 136 can push the pressure sensor 140 outward in the lateral direction with the rotation about the supporting shaft 130 restrained.

The cover plate 136 has a function as a pressurizing member for pressurize the pressure sensor 140 as well as a function as a protecting member for preventing the direct contact between the rotating therapeutic member 126 and the pressure sensor 140 to protect the pressure sensor 140 from, for example, being worn.

There is provided spacer members 135, 141 fitted on the supporting shaft 130 for keeping the distance between the boss body 131 and the washer 132*a*.

These spacer members 135, 141 comprises a first member 135 formed of a synthetic resin such as polyethylene or the like into a doughnut disc shape, and a second member 141 formed of a resilient material such as polyethylene rubber, sponge rubber or the like, so that the laterally inner surface of the first member 135 is brought into contact with the boss body 131.

The second member 141 is axially compressed by tightening the mounting nut 132 with respect to the supporting shaft 130, and the resilient restoring force thereof presses the pressure sensor 140 via the first member 135, the boss body 131, and the cover plate 136, whereby the pressure sensor 140 is applied with a pre-load even when the therapeutic member 126 is not subjected to an external force in lateral direction.

The first member 135 and the cover plate 136 is preferably formed of a material of low frictional resistance or a structure to which a friction reduction process is applied to at least the surface that comes into contact with the boss body 131, whereby the rotation of the therapeutic member 126 about the supporting shaft 130 is performed smoothly.

In this arrangement, when the therapeutic member 126 is moved from the head side downwardly, and the therapeutic member 126 abuts against the upper surface of the shoulder S, the load F is applied to the therapeutic member 126 as a reaction force against the pressing force applied to the shoulder S.

Though the load F has mainly upward and downward components, since the therapeutic member 126 is supported in a overhanging state on the laterally outside thereof, a moment as shown by the arrow M is generated, and the moment M generates a force acting to incline the upper portion of the therapeutic member 126 laterally outwardly via the clearance between the supporting shaft 130 and the boss body 131.

The load F substantially includes a lateral component that press the therapeutic member 126 laterally outwardly as shown in a phantom line by factors such as a slight inclination provided to the inclined surface 126*a* on the outer periphery of the therapeutic member 126 or the supporting shaft 130, and the resilient deformation or the like of the therapeutic member 126 itself.

Since a force to incline the therapeutic member 126 or to press the same laterally outwardly is detected by the pressure sensor 140 via the cover plate 136 and the position of the massaging mechanism 107 (therapeutic member 126) at the moment of detection represents the position of the user's shoulder, the position detecting means 138 detects the position as the first value $\alpha 1$, $\alpha 2$.

When the therapeutic member 126 is moved upwardly from the hip side, the load applied to the therapeutic member 126 from the back or the like is detected by the pressure sensor 140, and when the therapeutic member 126 moves upward away from the shoulder S, the load applied toward the therapeutic member 126 is not detected by the pressure sensor 140.

Therefore, the position of the therapeutic member 126 at the moment when the load is not detected represents the shoulder position, and the position detecting means 138 detects the position as the second values $\beta 1$, $\beta 2$.

As shown above, pre-load is applied to the pressure sensor 140 so that impairment of the accuracy of detection of the lateral load applied to the therapeutic member 126 due to the rattling in the lateral direction between the supporting arm 125 and the therapeutic member 126 or the like is prevented, whereby detection of the pressure and the detection of the shoulder position can be performed accurately.

Though the pressure sensor 140 is formed into a doughnut shape and arranged along whole periphery of the supporting shaft 130 in this embodiment, the pressure sensor 140 may be provided partially under or over the supporting shaft 130.

Figure 33:
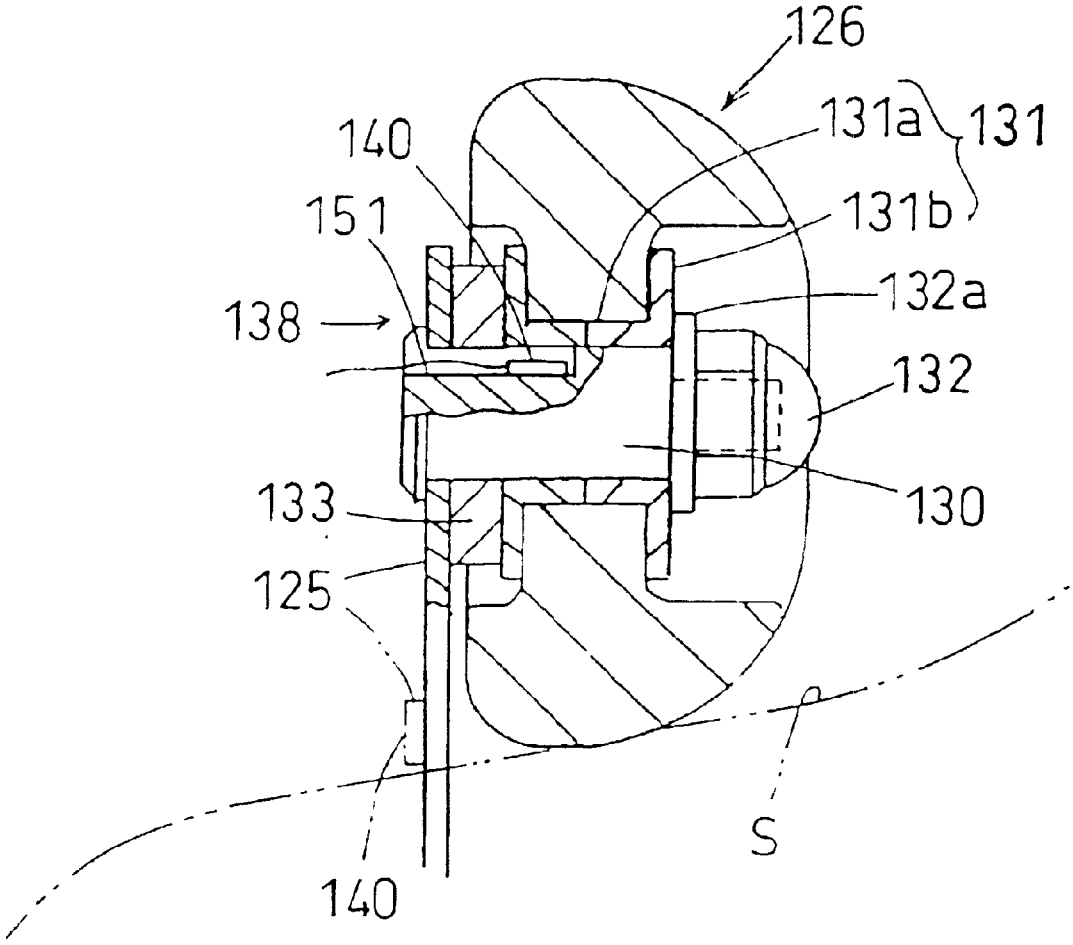
FIG. 33 is a front cross-sectional view showing another embodiment of the position detecting means (detector).

The embodiment shown in FIG. 33 comprises a groove 151 formed axially on the upper surface of the supporting shaft 130 supporting the upper therapeutic member 126 on the supporting arm 125, and a distortion sensor as a detector 140 provided in the grove 151, wherein distortion of the supporting shaft 130 generated by the load applied to the therapeutic member 126 is detected by the distortion sensor 140.

Therefore, since the load is detected by the distortion sensor 140 while the therapeutic member 126 abuts against the shoulder S or the back and is subjected to the load, and since the load is not detected when the therapeutic member 126 moves upward away from the shoulder S, the position of the therapeutic member 126 at the moment when the presence and absence of the load is switched represents the position of the shoulder S, and the position detecting means 138 detects the position as the values $\alpha 1$, $\alpha 2$, $\beta 1$, and $\beta 2$.

The distortion sensor 140 as described above may be provided on the side surface of the supporting arm 125 as shown in a phantom line.

Figure 34:
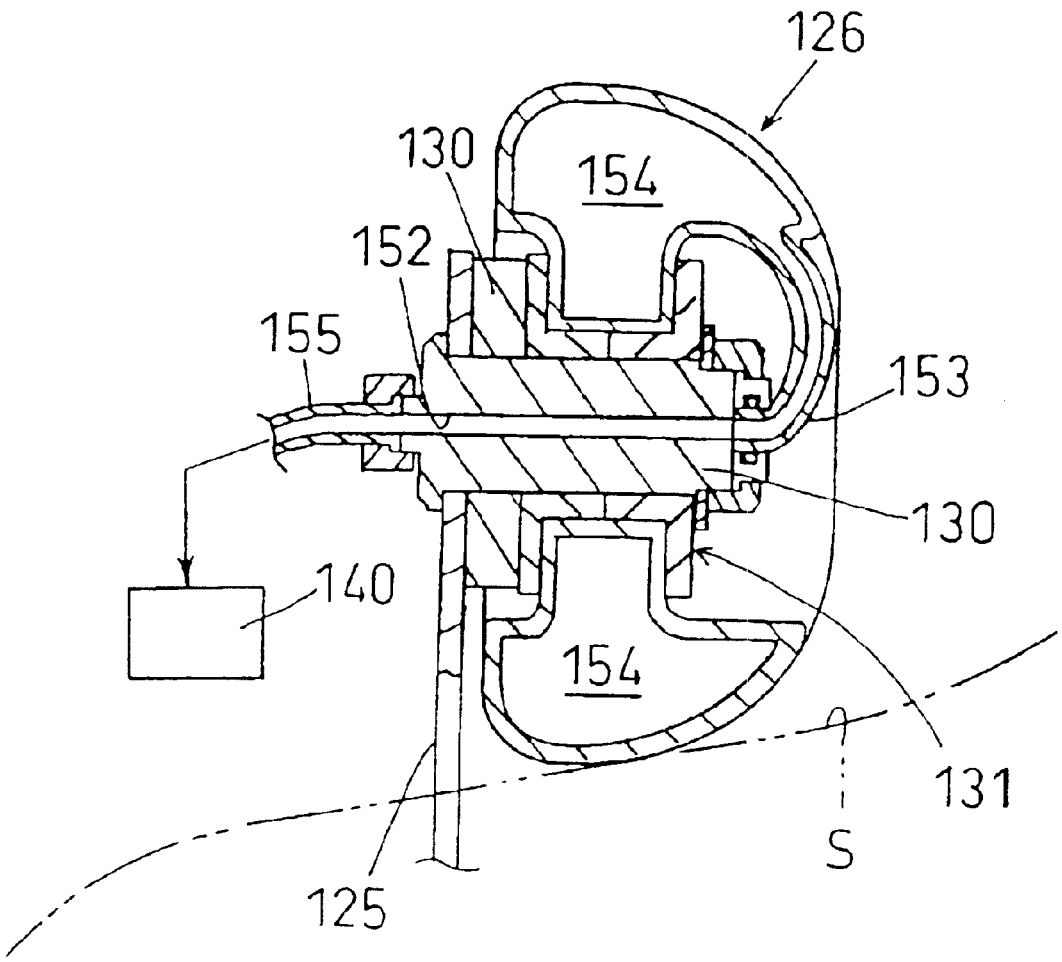
FIG. 34 is a front cross-sectional view showing another embodiment of the position detecting means (detector).

In FIG. 34, the therapeutic member 126 is formed of a hollow resilient member, a passage 152 extending through the supporting shaft 130 is formed in the axial direction, and a connecting pipe 153 formed integrally with the therapeutic member 126 is hermetically connected to the tip portion of the passage 152, so that the hollow portion 154 in the therapeutic member 126 is in communication with the passage 152 via the connecting pipe 153.

A hose 155 is connected to the proximal end of the passage 152 on one end thereof and to the pressure sensor, or a detector 140 for detecting the air pressure in the hollow portion 154 on the other end thereof.

In this arrangement, since the air pressure in the hollow portion 154 increases when the therapeutic member 126 abuts against the shoulder S or the back and is subjected to the load, and the air pressure in the hollow portion 154 decreases when the therapeutic member 126 is moved away from the shoulder S, the vertical position of the therapeutic member 126 at the moment when the increase and decrease of the pressure is switched represents the shoulder position and the position detecting means 138 detects the position as the values $\alpha 1$, $\alpha 2$, $\beta 1$, $\beta 2$.

The position detecting means 138 shown in FIG. 30 to FIG. 34 may be constructed in such a manner that the therapeutic member 126 detects the load applied from the back or the hip or the like by means of the detector 140 to obtain the pressure distribution in the vertical direction, so that the position of the hip as well as the position of the shoulder S are detected by analyzing the obtained pressure distribution.

Figure 35:
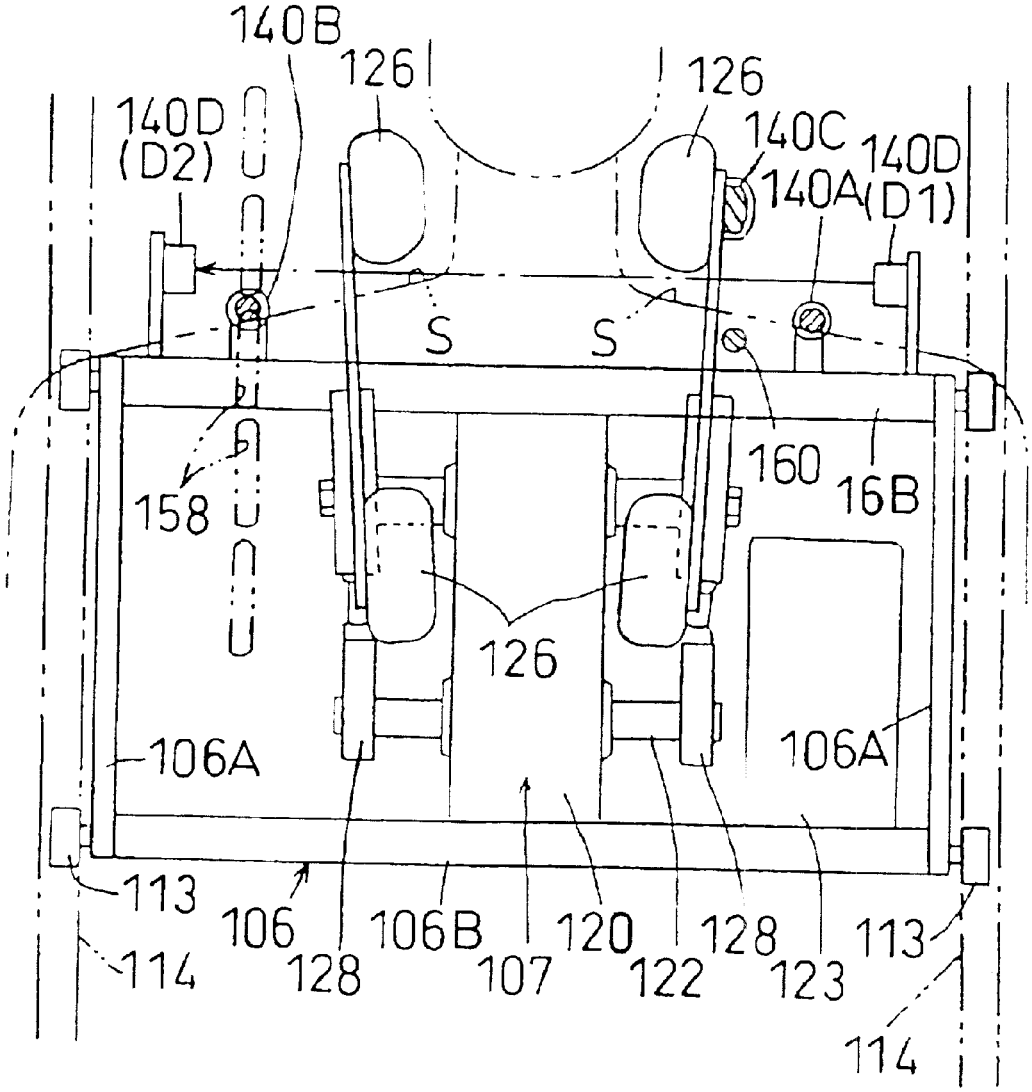
FIG. 35 is a front view showing another embodiment of the position detecting means (detector).

FIG. 35 shows a plurality of examples in the case where a non-contact sensor is used as the detector 140.

The detector shown by the reference numeral 140A is constructed of a pyroelectric infrared sensor for detecting infrared radiation emitted by heat from the user, or a reflection type ultrasonic sensor for receiving the ultrasonic wave emitted to and reflected from the body, and mounted on the moving frame 106 at an off-centered position toward one of the left side or the right side thereof so as to pass along the rear side of the shoulder portion of the user in the vertical direction.

In this arrangement, by moving the massaging mechanism 107 upward or downward, the detector 140A detects heat or the reflected wave from the body when it is positioned on the back side of the body, and the detector 140A does not detect heat or the reflected wave when it is positioned above the shoulder.

Therefore, the vertical position of the massaging mechanism 107 at the moment when the presence or absence of detection of heat or reflected wave is detected corresponds to the position of the shoulder S, and the position detecting means 138 detects the position as the values $\alpha 1$, $\alpha 2$, $\beta 1$, and $\beta 2$.

The detector shown by the reference numeral 140B is an optical sensor of light receiving type and mounted on the upper portion of the moving frame 106 off-centered toward one of the left and the right sides so as to pass along the rear side of the shoulder portion of the user in the vertical direction.

The covering member 115 provided on the seatback portion 103 comprises a number of slits 158 formed in the vertical direction so that light from the outside enters into the seatback portion 103.

With this configuration, while the massaging mechanism 107 moves upward or downward, light from the outside is blocked by the body when the detector 140B is positioned behind the body, and light entered into the seatback portion 103 via the slits 158 is detected by the detector 140B when the detector 140B is positioned above the shoulder.

Therefore, the position of the massaging mechanism 107 at the moment when the presence and the absence of detection of light from the outside is switched represents the position of the shoulder S, and the position detecting means 138 detects the position as the values $\alpha 1$, $\alpha 2$, $\beta 1$, and $\beta 2$.

The detector shown by the reference numeral 140C is a proximity sensor for detecting a marker 160 adhered at the specific portion of the body, and the proximity sensor 140C is mounted on the upper side surface of the supporting arm 125 so as to be placed as close to the user's body as possible.

As the proximity sensor 140C, a magnet sensor for detecting magnetism of the marker 160 constructed of a magnet or the like, a high-frequency coil antenna sensor for detecting the marker 160 formed of a dielectric coil sheet or the like are adopted.

With this arrangement, since the vertical position of the massaging mechanism 107 at the moment when the detector 140C detects the marker 160 represents the position of the specific portion of the body, the position detecting means 138 detects the position as the values $\alpha 1$, $\alpha 2$, $\beta 1$, and $\beta 2$.

In this embodiment, changing the position to adhere the marker 160 may change the specific portion freely, and thus the positions of the back, the hip and the like of the body as well as the shoulder S can be detected.

The detector shown by the reference numeral 140D is a transmission type photoelectric sensor comprising a light emitter D1 and a light receiver D2, which are mounted on the moving frame 106 facing toward each other so as to interpose the user's body therebetween.

With this configuration, when the photoelectric sensor 140D is positioned on the side of the user's neck, light travels through the indented portion of the back surface of the neck and thus it is turned ON, and when the photoelectric sensor 140D is positioned on the side below the shoulder, light is blocked by the body and thus it is turned OFF. Therefore, since the position of the massaging mechanism 107 at the moment when the photoelectric sensor 140D is switched between ON and OFF corresponds to the position of the shoulder S, the position detecting means 138 detects the position as the values $\alpha 1$, $\alpha 2$, $\beta 1$, and $\beta 2$.

The present invention is not limited to the embodiments described above, but rather modifiable as appropriate.

For example, in the flow-charts shown in FIG. 24 to FIG. 26, the step to detect the first and the second values and to compare and determine these values is performed twice, it is also possible to perform this process three times or more, and in this case, in the step of determination 3, whether or not three or more second detected values are close agreement with each other is determined.

It is also possible to omit the processes of determination 1 and 2 by omitting detection of the first value but detecting only the second values of a plurality of numbers, and to determine the position of the specific portion in the determination 3.

The detector is not limited to the one shown in the embodiments described above, but rather modifiable as appropriate. The drive mechanism of the therapeutic member may be replaced with the one that drives the supporting arm and the therapeutic member by an air cell that is inflated and deflated by supplying and discharging air, for example.

The massaging apparatus is not limited to the chair type, but rather modifiable to other configurations.

According to the present invention, as is described thus far, effective massage can be performed according to the physique of the user by recognizing the value detected accurately by the position detecting means as the position of the specific portion of the body in a control viewpoint.

11-255930

Referring now to FIG. 36 to FIG. 39, an embodiment of the present invention will be described.

Figure 39:
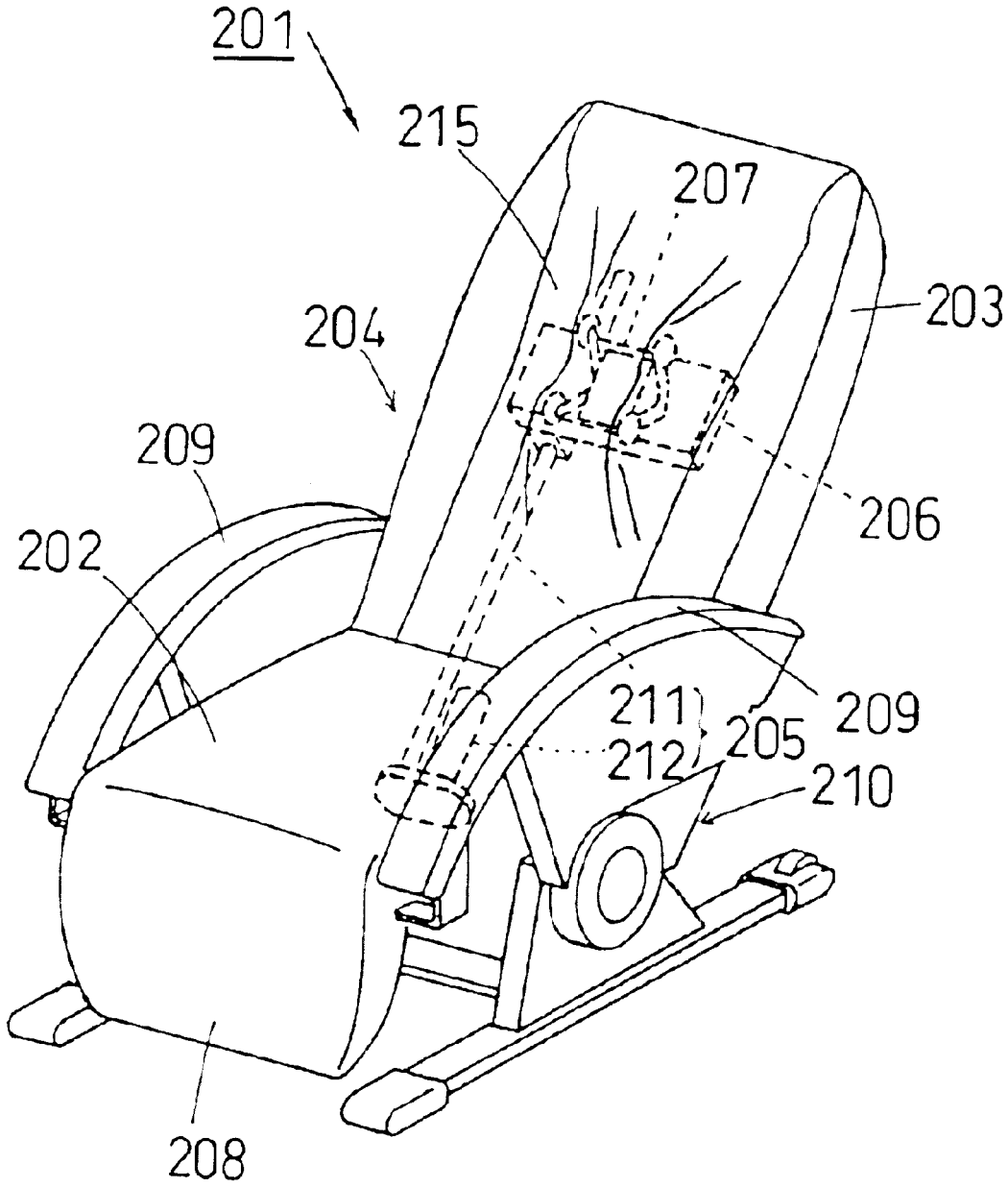
FIG. 39 is a general perspective view of the massaging apparatus.

FIG. 39 shows a massaging apparatus 201 according to the present invention which is a chair type massaging apparatus comprising a chair body (therapeutic bed) 204 having a seat portion 202 on which the user sits and a seatback portion 203 for supporting the user's back.

The seatback portion 203 of the chair body 204 is provided with a moving frame 206 mounted therein so as to be moved vertically by a locomotive drive 205, and a massaging mechanism 207 is mounted on the moving frame 206. The front surface of the massaging mechanism 207 is covered with a flexible covering member 215 formed, for example, of cloth or leather.

The chair body 204 comprises a footrest 208, and a leg body 210 having arm rests 209 on both sides of the seat portion 202 formed in one piece in addition to the seatback portion 203 and the seat portion 202. The seatback portion 203 and the footrest 208 are adapted to be angularly moved with respect to the seat portion 202 by means of a suitable electric driving mechanism, a fluid pressure driving mechanism, a manual structure or the like for reclining operation.

Figure 36:
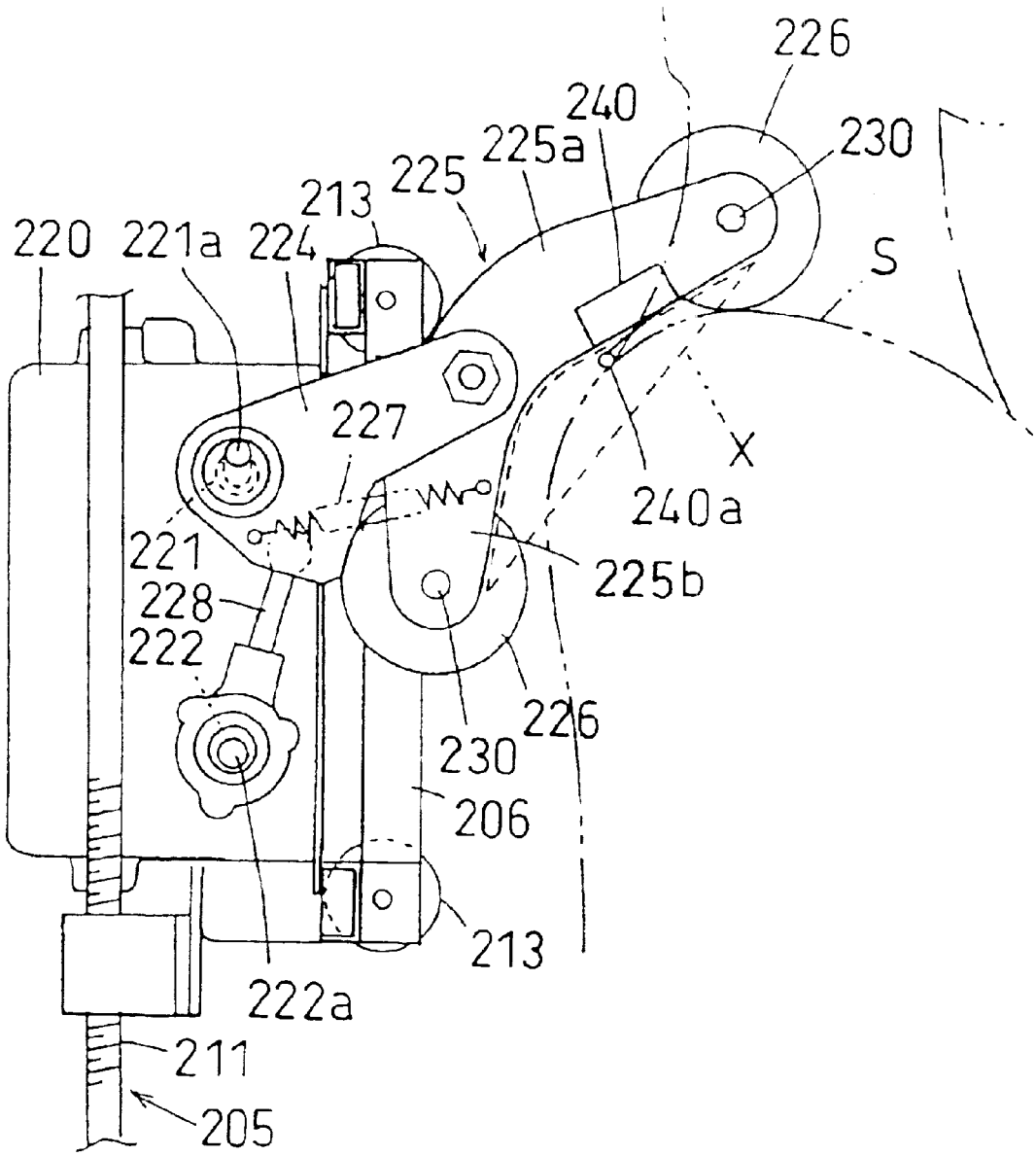
FIG. 36 is a side view of the massaging mechanism according to an embodiment of the present invention.
Figure 38:
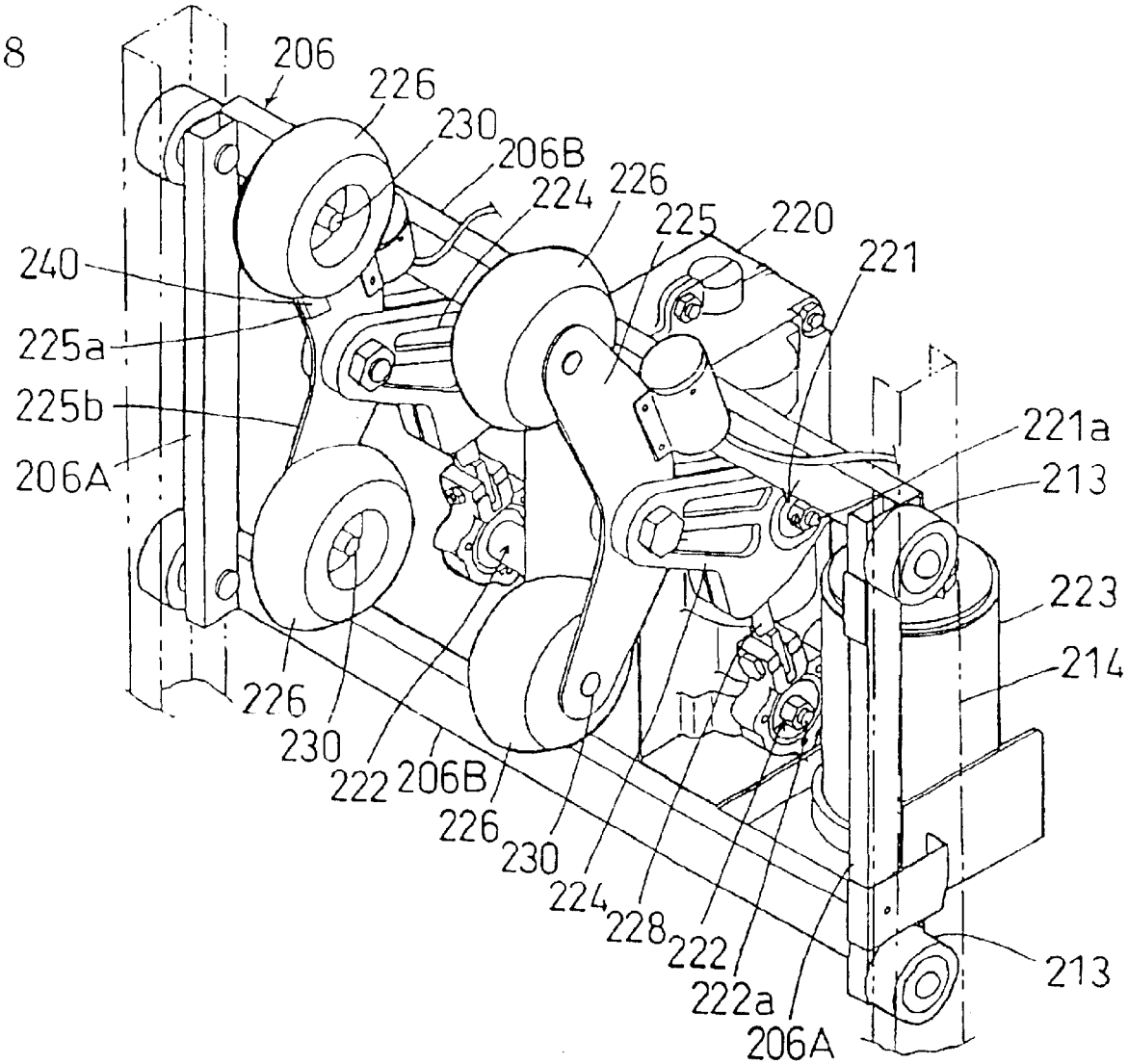
FIG. 38 is a perspective view of the massaging mechanism.

The locomotive drive 205 comprises a longitudinal-feed-thread-shaft 211 provided so as to rotate about the axis vertically extending along the seatback 203, and a power station 212 having a motor with a speed reducer for driving the longitudinal-feed-thread-shaft 211 in the forward and reverse direction, and the longitudinal-feed-thread-shaft 211 passes through suitable portions of the massaging mechanism 207 or the moving frame 206 into engagement therewith. As shown in FIG. 36 and FIG. 38, there is provided a pair of upper and lower traveling rollers 213 on the left and the right sides of the moving frame 206, and the traveling roller 213 is mounted on two guide rails 214 provided in the seatback portion 203 in the vertical direction so as to rotate freely. In this arrangement, the massaging mechanism 207 is moved toward the neck or toward the hip along the upper half of the user's body seated on the seat portion 202 by the operation of the locomotive drive 205.

The position of vertical movement (quantity of movement) of the massaging mechanism 207 is detected by the vertical position detecting means, not shown, and the vertical position detecting section of this embodiment includes appropriate means such as a structure to convert the number of revolution or the angle of revolution of the longitudinal-feed-thread-shaft 211 or the power station 212 into pulses by means of rotary encoder or the like and count the same, or a structure to detect the position of the massaging mechanism 207 optically by the photoelectric sensor or the like.

The locomotive drive 205 may be replaced by a wrapping driving mechanism, an engagement structure of the rack-and-pinion, or a hoist drive structure using a fluid pressure cylinder or the like.

The moving frame 206 is rectangular in shape formed by connecting the upper and the lower ends of the left and the right frame bodies 206A, 206A with the upper and the lower frame bodies 206B, 206B, and the massaging mechanism 207 comprises a drive unit 220 having a kneading motion shaft 221 and a rapping motion shaft 222 projecting toward the left and the right sides, a power station 223 composed of an electric motor connected to the drive unit 220, a pair of drive arms 224 extending in the lateral direction (in the direction of the width of the user's body) held by the respective motion shafts 221, 222, a supporting arm (supporting body) 225 connected to the tip of the respective drive arms 224, and roller type therapeutic members 226 rotatably provided on the upper and the lower ends of the supporting arm 225 via a lateral supporting shaft 230.

The kneading motion shaft 221 and the rapping motion shaft 222 are laterally disposed in parallel to each other with vertically spaced therebetween. The output from the power station 223 is fed to the drive unit 220 via a belt transmission mechanism or the like, so that the kneading motion shaft 221 and the rapping motion shaft 222 are selectively rotated via a transmission shaft, a gear, a clutch, or the like in the unit.

Both ends of the kneading motion shaft 221 are provided with inclined shaft portions 221*a* eccentrically inclined and angularly displaced with respect to the axis of rotation, and the rear end of the drive arm 224 is attached to the inclined shaft portion 221*a* via a bearing.

The supporting arm 225*b* is formed of a vertically elongated plate facing its surfaces toward the left and the right, and the vertical midpoint thereof is connected to the tip of the drive arm 224 rotatably about the lateral axis. Below the connecting portion between the supporting arm 225 and the drive arm 224, there is provided a tension coil spring 227 extending therebetween so that the resiliency which urges the upper portion 225*a* (first supporting portion) of the supporting arm 225 forward is provided.

On the left and the right ends of the rapping motion shaft 222, there is provided eccentric shaft portions 222*a* that are off-centered with respect to the axis of rotation in the opposite direction, to which the lower end of a connecting rod 228 is pivotally connected via a bearing, and the upper end of the connecting rod 228 is pivotally connected to the lower surface of the drive arm 224 via a ball bearing or the like.

In this arrangement, when the power station 223 rotates the kneading motion shaft 221, the inclined shaft portion 221*a* at the both ends of the kneading motion shaft 221 allow the therapeutic member 226 provided on the right and left sides correspondingly to perform circumferential movement including lateral movement toward and away from each other, thereby performing kneading motion.

When the rapping motion shaft 222 rotates, the eccentric shaft portions 222*a* on both ends thereof make the drive arm 225 reciprocate fore-and-aft (up-and-down) via the connecting arm 228, whereby the therapeutic member 226 performs the rapping motion.

While the kneading motion shaft 221 and the rapping motion shaft 222 are adapted so that a power from the power station 223 is selectively transmitted thereto via the clutch in the drive unit 220, separate special power stations may be provided for the motion shafts 221, 222 respectively so that both of them can rotate simultaneously.

The supporting arm 225 is formed of a plate of V-shape rotated by 90 degrees to the right in side view comprising a first supporting portion 225*a* projecting toward the user in the diagonally upper front direction and the second supporting portion 225*b* projecting in the lower front direction to form an obtuse angle with respect to the first supporting portion 225*a*, and a space X (a triangle region shown by dashed lines in FIG. 36) opening toward the user between the first and second supporting portions 225*a* and 225*b* is formed.

Therefore, it is contemplated that the space X prevents the supporting arm 225 from touching the back or the shoulder of the user while the therapeutic member 226 is performing massaging motion.

In the first supporting portion 225*a*, there is provided a detector 240 for directly detecting the existence of the user's shoulder S within the space X as a range of detection on the lower side of the portion thereof behind the front end portion of the therapeutic member 226 (end on the side of the user), so that the position of the shoulder S is determined based on the detection of the shoulder S by the detector 240.

In this embodiment, a micro switch that is turned ON and OFF by touching directly with the shoulder is shown as the detector 240, and it has a contact 240*a* projecting into the space X under the first supporting portion 225*a*.

Figure 37:
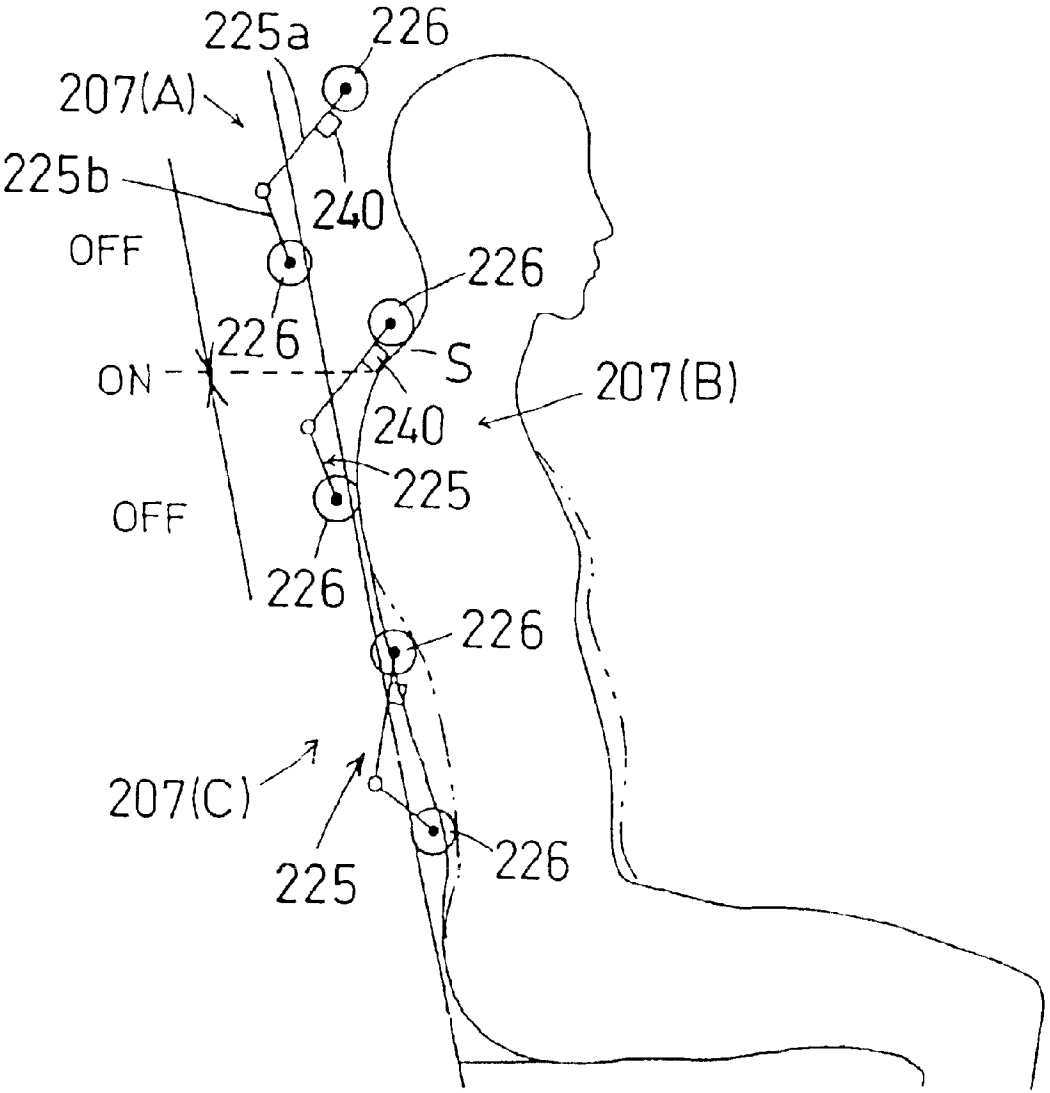
FIG. 37 is a view showing the principle of the detection of the shoulder position.

Referring now to FIG. 36 and FIG. 37, the procedure to detect the position of the user's shoulder S using the micro switch 240 will be described.

In the initial state, the massaging mechanism 207 is stored at the upper limit in the seatback portion 3, and in this case, the upper therapeutic member 226 projects forward by the action of the tension coil spring 227, and accordingly, the lower therapeutic member 226 is retracted since no load is applied to the therapeutic member 226 from the user (the state A in FIG. 37).

When the massaging mechanism 207 is lowered from this position, the upper therapeutic member 226 approaches or abuts against the upper portion of the user's shoulder S, the user's shoulder S is placed in the space X under the first supporting portion 225*a,* and directly touches (substantially, directly via the covering member 215) the contact 240*a* of the micro switch 240 to turn the micro switch 240 ON (the state in FIG. 36, the state B in FIG. 37).

Therefore, the shoulder position can be determined by the position of the massaging mechanism 207 (the value detected by the vertical position detecting means) at the moment when the micro switch 240 is turned from OFF to ON, and thus an appropriate massage according to the physique of the user can be performed by a massaging motion based on the detected shoulder position.

In this case, since the micro switch 240 detects the existence of the shoulder S directly without the medium of the load or the like with respect to the therapeutic member 226, accuracy of detection increases. In addition, since the therapeutic member 226 does not have to be made in a special shape, the simple and low-cost construction is realized.

When the massaging mechanism 207 is further moved downward, the upper therapeutic member 226 presses the back and thus the shoulder S comes out from the space X, and the micro switch 240 is turned OFF (the state C in FIG. 37).

In other words, since the micro switch 240 is provided behind the therapeutic member 226, it detects only the shoulder S but not the portions other than the shoulder S such as the back or the hip, and thus complex control for determining the shoulder position is not necessary. In addition, since the detector 240 makes no reaction during massaging motion on the back or the hip, lowering of durability or malfunction is prevented.

When the massaging mechanism 207 is moved downward as described above, the supporting arm 225 is adapted to rotate upward against the tension spring 227 so that the upper and the lower therapeutic members 226 abut against the back, which facilitates the shoulder S crawling out of the space X.

Detection of the shoulder S by means of the detector 240 may be performed in the process that the massaging mechanism 207 moves upward.

In such a case, the massaging mechanism 207 moves from position situated at the lower limit of the seatback portion 207 upwardly with the upper and the lower therapeutic members 226 abutting against the hip or the back. In this case, the detector 240 does not come into contact with the body since it is situated behind the therapeutic member 226, thereby being maintained in OFF-state.

When the upper therapeutic member 226 comes out from the back, a pressing force applied to the lower therapeutic member 226 from the back and an energy of the tension coil spring 227 pivot the supporting arm 225 downwardly, so that the upper therapeutic member 226 comes into contact with or approaches the upper portion of the shoulder S.

At this moment, the shoulder S comes into the space X and thus comes into contact with the detector 240, so that the shoulder S is detected.

In the construction in which the shoulder position is detected in the process that the therapeutic member 226 moves upward, even when the seated posture with respect to the chair body 204 is not correct, the therapeutic member 226 presses the hip or the like to stretch the back and correct the posture so that the back is fitted with the seatback portion 203, and thus subsequent detection of the shoulder S can be performed accurately.

The present invention is not limited to the embodiment described above, but rather modifiable as appropriate.

For example, the detector 240 is not limited to a micro switch, but a pressure sensor that comes into contact with the shoulder S and detects the pressing force thereof, or even a non-contact sensor is applicable. In case of the contact micro switch or the pressure sensor, a cover may be provided for covering the contact 240*a* in a state in which ON-OFF switching operation can be performed. The detector 240 may be provided on one of the left and the right supporting arms 225, or on both of them.

The position on the supporting arm 225 to mount the detector 240 may be changed to any position within the range of the space X for detection where it can detect the shoulder S appropriately depending on the type of the detector 240.

The first supporting portion 225*a* and the second supporting portion 225*b* of the supporting arm 225 do not have to be a single piece, and thus they may be constructed of separate members respectively. The supporting arm 225 may even be constructed only of a first supporting portion 225*a*.

The driving mechanism for the therapeutic member may be replaced by the one that drives the supporting arm and the therapeutic member by an air cell that is inflated and deflated by supplying and discharging air, for example, and the massaging apparatus is not limited to the chair type, but rather be modifiable to other configuration such as the bed type.

As described thus far in detail, according to the present invention, accurate detection of the shoulder position is realized in a simple construction.

2000-163289

Referring now to FIG. 40 to FIG. 46, an embodiment of the present invention will be described.

Figure 40:
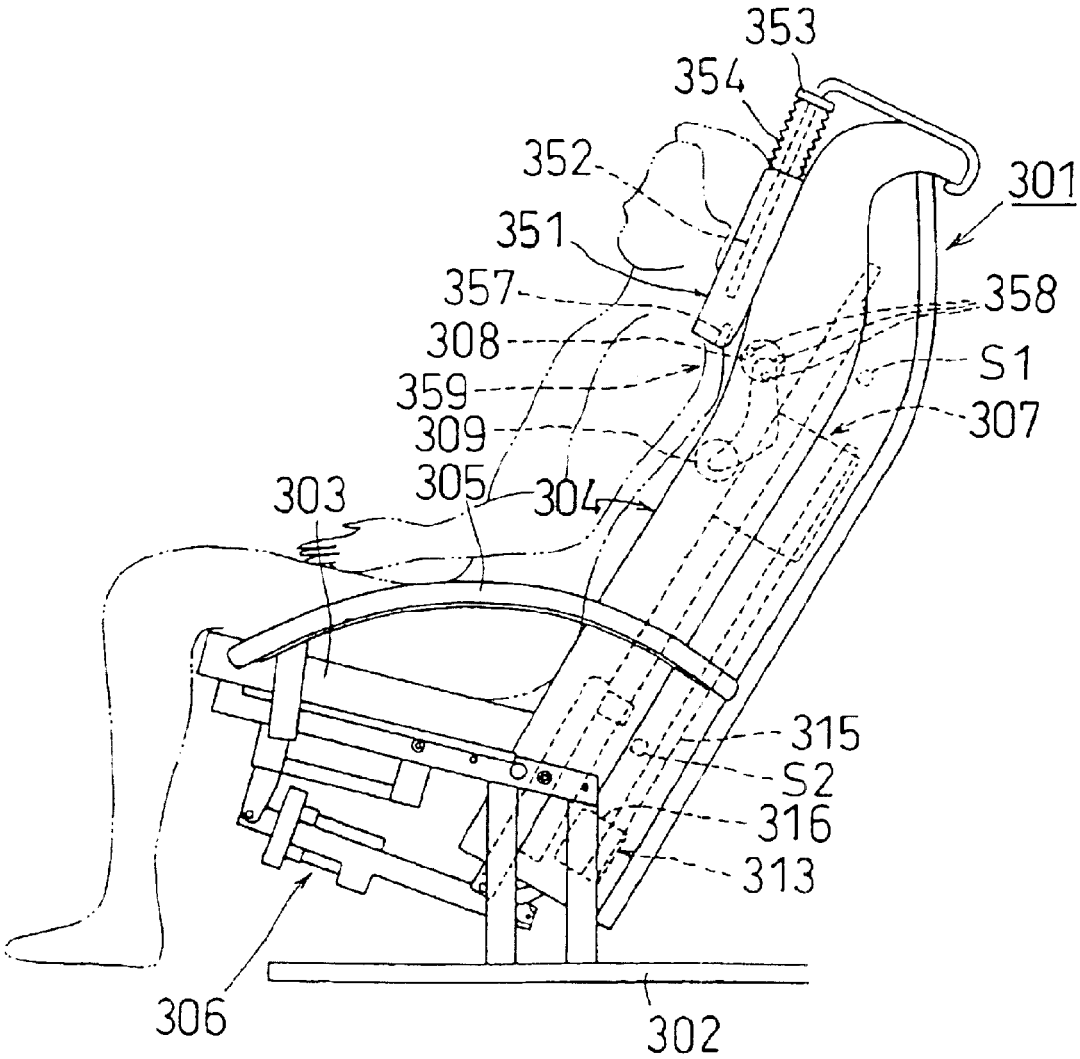
FIG. 40 is a general side view of the massaging apparatus showing an embodiment of the present invention.

FIG. 40 shows a general construction of a chair type massaging apparatus 301. In FIG. 40, the chair type massaging apparatus 301 comprises a seat portion 303 supported by a leg body 302, a seatback portion 304 provided on the back of the seat portion 303, and armrest portions 305 provided on the left and the right sides of the seat portion 303. The seatback portion 304 is adapted to be reclined by a reclining device 306 with the rear end side of the seat portion 303 as a fulcrum point.

A massaging unit 307 is integrated in the seatback portion 304. The massaging unit 307 comprises, as shown in FIG. 43 as well, a first therapeutic member (kneading ball, massaging roller) 308, a second therapeutic member (kneading ball, massaging roller) 309, a massage motor 310, a transmission mechanism 311 for transmitting the rotational power of the massage motor 310 to the therapeutic members 308, 309 to allow the respective therapeutic members 308, 309 to perform kneading motion or rapping motion, and a supporting frame 314, wherein the massaging unit 307 is constructed so as to move in the seatback portion 304 vertically by a hoist means 313.

The hoist means 313 employs a mechanism that moves the massaging unit 307 upward and downward by rotating a feed screw 315 engaged with the supporting frame 314 of the massaging unit 307 with the hoist motor 316.

The hoist means 313 may be replaced with means employing a wrapping drive mechanism, a rack-and-pinion engaging structure, or a hoist drive structure using a fluid pressure cylinder or the like.

Figure 43:
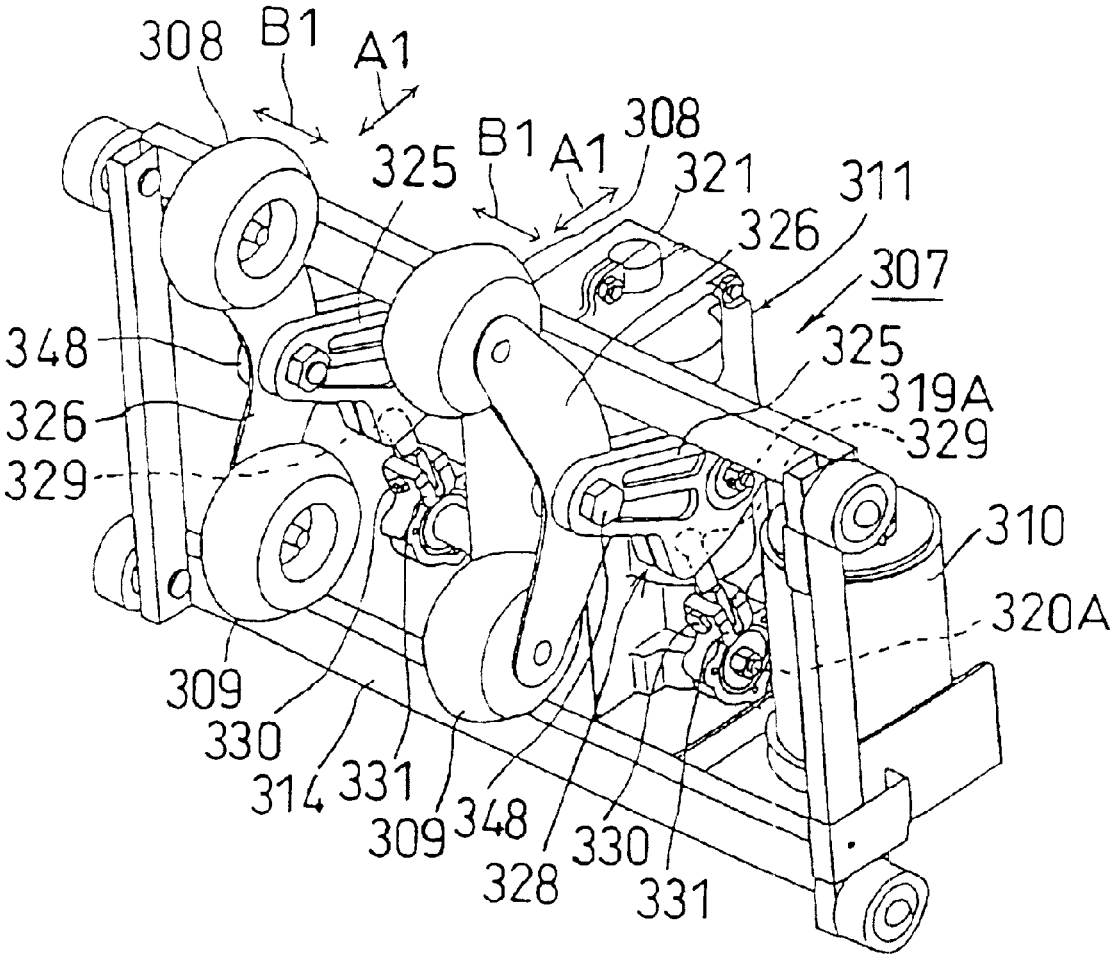
FIG. 43 is a perspective view of the massaging unit.
Figure 44:
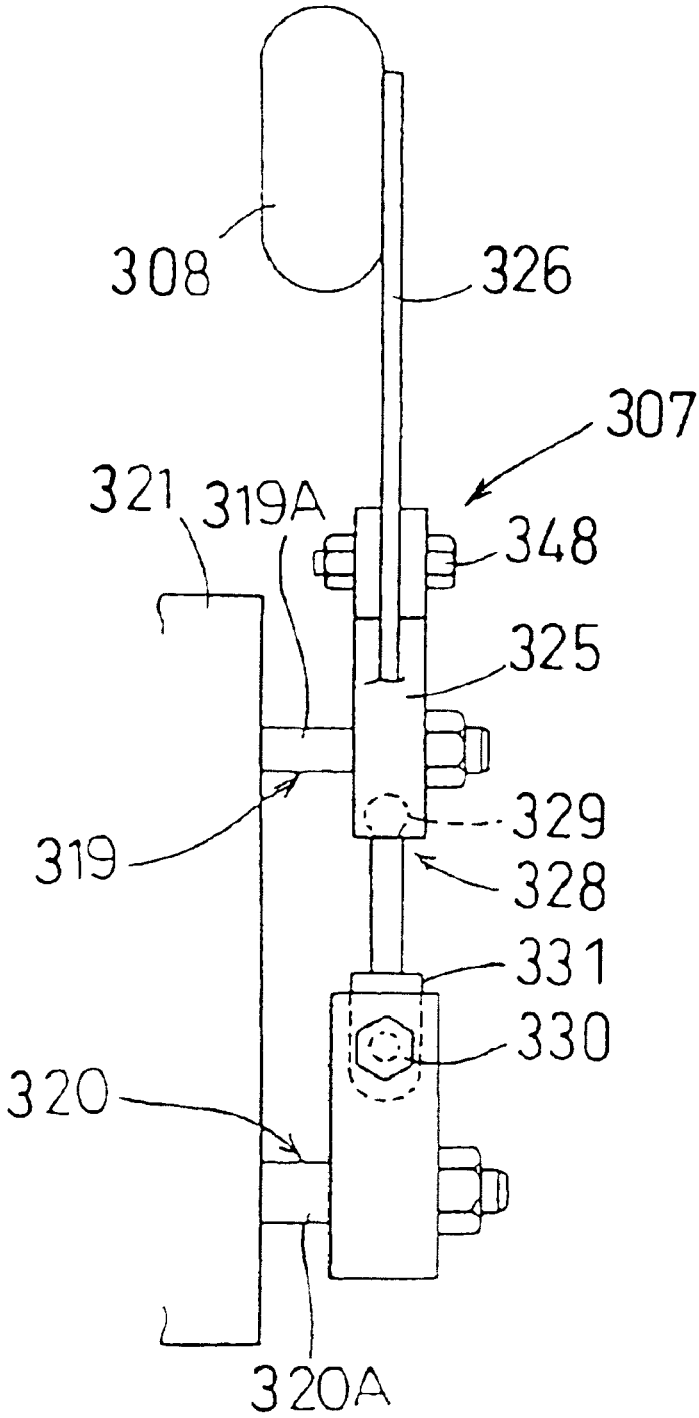
FIG. 44 is a front view showing a part of the massaging unit.
Figure 45:
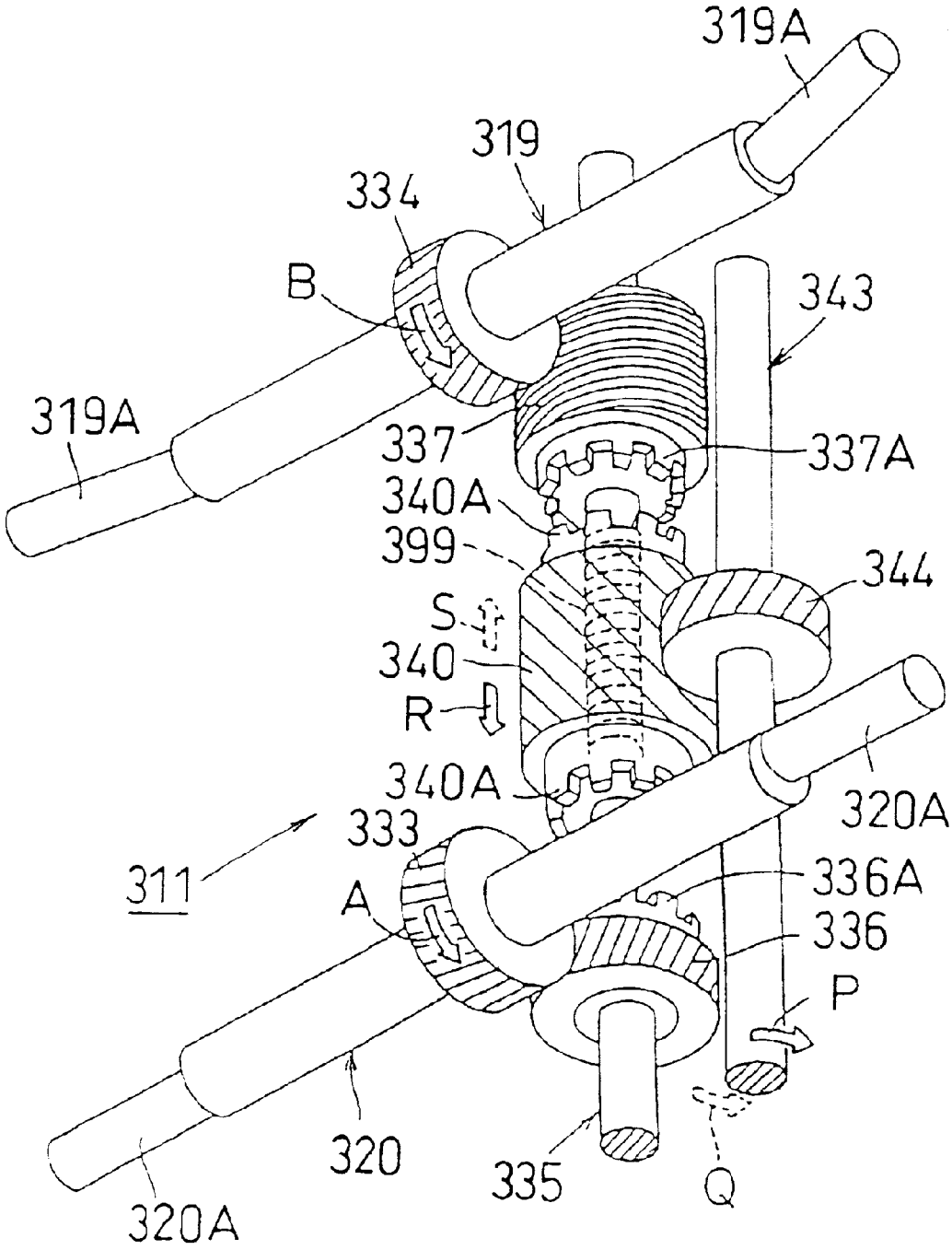
FIG. 45 is a perspective view of the transmission mechanism of the massaging unit.

The transmission mechanism 311 of the massaging unit 307 comprises, as shown in FIG. 43 to FIG. 45, a drive unit 321 having a kneading motion shaft 319 and a rapping motion shaft 320 projecting toward the left and the right sides, a pair of left and right drive arms 325 held by the motion shafts 319, 320, and a pair of left and right supporting arms 326 fixed on the tips of the respective drive arms 325.

The above-described drive unit 321 can be switched as desired between a state of allowing the drive arm 325 to take the components of lateral movement out from the rotating power of the massage motor 310 via the kneading motion shaft 319 to perform kneading motion, and a state of allowing the drive arm 325 to take components of fore-and-aft swinging motion out from the rotating power of the massage motor 310 via the rapping motion shaft 320 to perform rapping motion.

The motion shafts 319, 320 are laterally arranged in parallel with each other and rotatably supported on the case of the drive unit 321 via the bearings respectively. These motion shafts 319, 320 are adapted in such a manner that one of these two shafts is selected at a transmission mechanism 311 to receive rotational motion from the massage motor 310 to rotate in the directions shown by the arrows A or B in FIG. 46.

The rapping motion shaft 320 is provided with an eccentric shaft portions 320A, 320A that are off-centered in the opposite direction from each other on both ends, and the kneading motion shaft 319 is provided with a inclined shaft portions 319A, 319A on both ends. The eccentric shaft portion 320A of the rapping motion shaft 320 and the inclined shaft portion 319A of the kneading motion shaft 319 are connected by a linkage 328. The linkage 328 comprises a plate-shape drive arm 325, a ball joint 329 connected to the drive arm 325, and a connecting arm 331 connected to the shaft portion of the ball joint 329 by a pin 330. The drive arm 325 is rotatably supported on the inclined shaft portion 319A, and the connecting arm 331 is pivotally mounted on the eccentric shaft portion 320A.

In this arrangement, when the rapping motion shaft 320 rotates in the direction A, the eccentric shaft portion 320A of the rapping motion shaft 320 allows the therapeutic members 308, 309 to reciprocate in the direction A1 (fore-and-aft direction) via the connecting arm 331, the ball joint 329, the drive arm 325, and the supporting arm 326, and the therapeutic members 308, 309 make a rapping movement. Since one of the eccentric shaft portions 320A is off-centered in the opposite direction from the other one, the therapeutic members 308, 309 on the left side and the right side make rapping motion alternately.

When the kneading motion shaft 319 receives a rotational power, the inclined shaft portion 319A rotates along a conical surface, and thus the drive arm 325 reciprocates with the ball joint 329 as a fulcrum, and consequently, the therapeutic member 309 on the left side and the right side make reciprocated pivotal movement in the direction B1 (in the lateral direction) so as to move toward and away from each other, and perform a kneading motion.

The mechanism to select and rotate one of the kneading motion shaft 319 and the rapping motion shaft 320 is constructed for example as shown in FIG. 45.

In FIG. 45, a screw gear 333 is mounted on the rapping motion shaft 320, and a worm gear 334 is mounted on the kneading motion shaft 319. There is provided a guide shaft 335 vertically extending in front of, or behind the rapping motion shaft 320 and the kneading motion shaft 319, and a screw gear 336 to be engaged with the screw gear 333 and a worm 337 to be engaged with the worm gear 334 are provided on the guide shaft 335 rotatably with respect to the guide shaft 335.

On the end surfaces of the screw gear 336 and of the worm 337 on the guide shaft 335 facing toward each other, there are formed engagement tooth portions 336A, 337A that serve as clutches respectively. The guide shaft 335 is formed with a trapezoidal screw thread 339 on the portion between the screw gear 336 and the worm 337, on which a movable helical gear 340 is mounted in engagement with its inner surface. The both end surfaces of the movable helical gear 340 is formed with engagement tooth portions 340A, 340A to be engaged and disengaged with the engagement tooth portions 336A, 337A. A rotating drive shaft 343 is provided in parallel with the guide shaft 335 and adapted to be switched to rotate in the direction shown by the arrow P or Q by the massage motor 310 via a pulley or a belt.

A helical gear 344 is mounted on the rotating drive shaft 343 and engaged with the helical thread on the outer surface of the movable helical gear 340, so that when the rotating drive shaft 343 rotates in the direction P, the movable helical gear 340 in engagement with the helical gear 344 rotates and moves along the trapezoidal screw thread 339 of the guide shaft 335 in the direction R, and the engagement tooth portion 340A of the movable helical gear 340 engages with the engagement tooth portion 336A of the screw gear 336 to rotate the screw gear 336. As a consequent, the rapping motion shaft 320 provided with the screw gear 333 to be engaged with the screw gear 336 rotates in the direction A. In contrast to it, when the rotating shaft 343 is rotated in the direction Q, which is the opposite direction from the direction P, the movable helical gear 340 moves in the direction S, which is the opposite direction from the direction R, and engages with the worm 337 to rotate the kneading motion shaft 319 in the direction B.

Accordingly, when the rotating drive shaft 343 is rotated in the forward or reverse direction to move the movable helical gear 340 selectively in one of the directions R and S, one of the rapping motion shaft 320 and kneading motion shaft 319 is rotated to perform rapping motion or kneading motion with a plurality of therapeutic members 308, 309. Since the screw gears 333, 336 have almost the same number of teeth, rapping motion is performed relatively many times per unit time, but kneading motion is performed slowly since the turning effort is transmitted from the worm 337 to the worm gear 334 with significant speed reduction.

Figure 41:
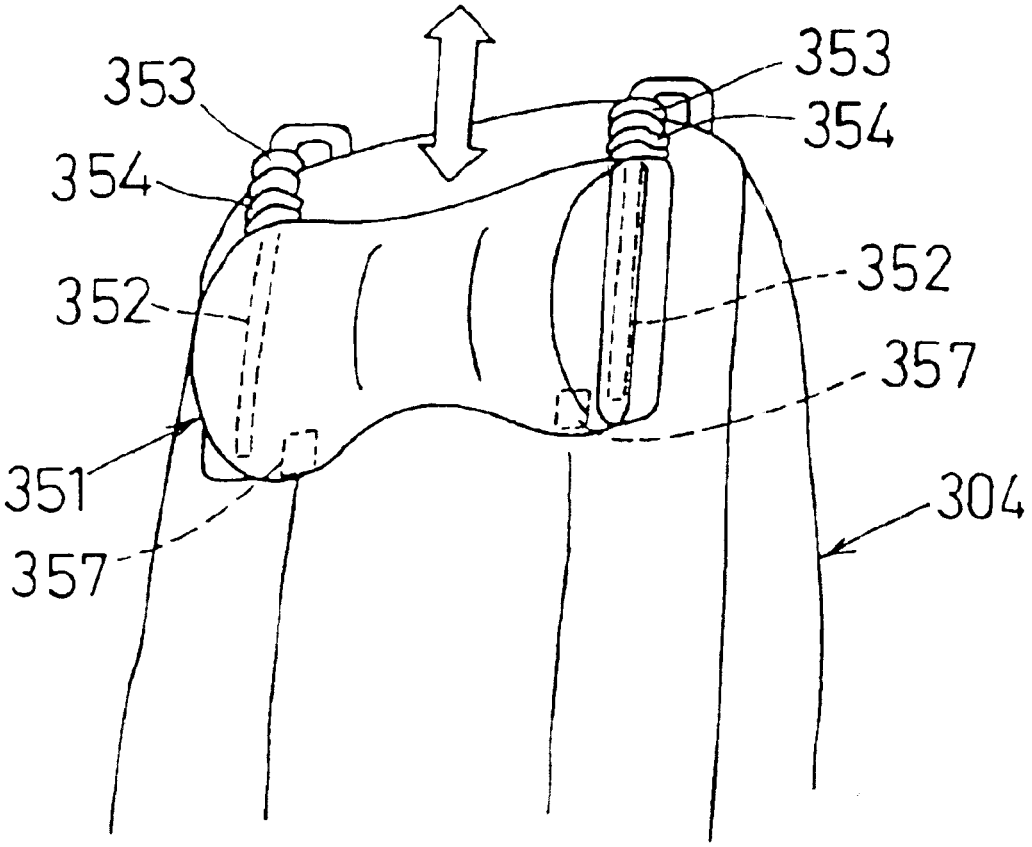
FIG. 41 is a perspective view of the upper portion of the massaging apparatus.

In FIG. 40 and FIG. 41, a pillow 351 is provided as equipment of the massaging apparatus 301 to be arranged at the specific portion of the user's body. The pillow 351 is provided on the massaging apparatus 301 because placing the head portion of the user slightly forward of back portion is more natural and relaxing when the user is seated on the massaging apparatus 301 to be massaged.

As means for supporting the pillow 351, a pair of the left and the right supporting beams 352 is vertically fixed on the upper front of the seatback portion 304, and both of the left and the right sides of the pillow 351 is fitted and held on the pair of left and right supporting beams 352 so as to be vertically slidable, so that the pillow 351 is vertically adjustably mounted on the front surface of the seatback portion 304. Between a receiving body 353 fixed on the upper end of the supporting beam 352 and the pillow 351, there is provided an accordion member 354 fitted on the supporting beam 352. When the user sits on the massaging apparatus 301 while moving the pillow 351 upward, the pillow 351 moves automatically downward by its own weight or the biasing force of the accordion member 354 and stops when the lower end of the pillow 351 abuts against the user's shoulder, so that the pillow 351 is arranged at the head portion of the user. It is also possible to fit the coil sprig on the supporting beam 352 instead of the accordion member 354.

A pair of the left and the right magnetic bodies 357 are provided corresponding to the pair of the left and the right first therapeutic members 308 at the lower end on the rear side of the pillow 351, and a plurality of magnetic sensors 358 composed of the Hall elements or the like are provided at regular intervals on the outer peripheral portions of the pair of the left and the right first therapeutic members 308 of the massaging unit 307, so that the first therapeutic member 308 approaches the magnetic body 357 in the pillow 351 most to turn any one of the magnetic sensors 358 ON when the first therapeutic member 308 reaches the position corresponding to the shoulder of the user. A detecting means 359 for detecting the position of the pillow 351 with respect to the massaging apparatus 301 is constructed of the magnetic body 357 and the magnetic sensor 358 on the massaging unit 307.

Figure 42:
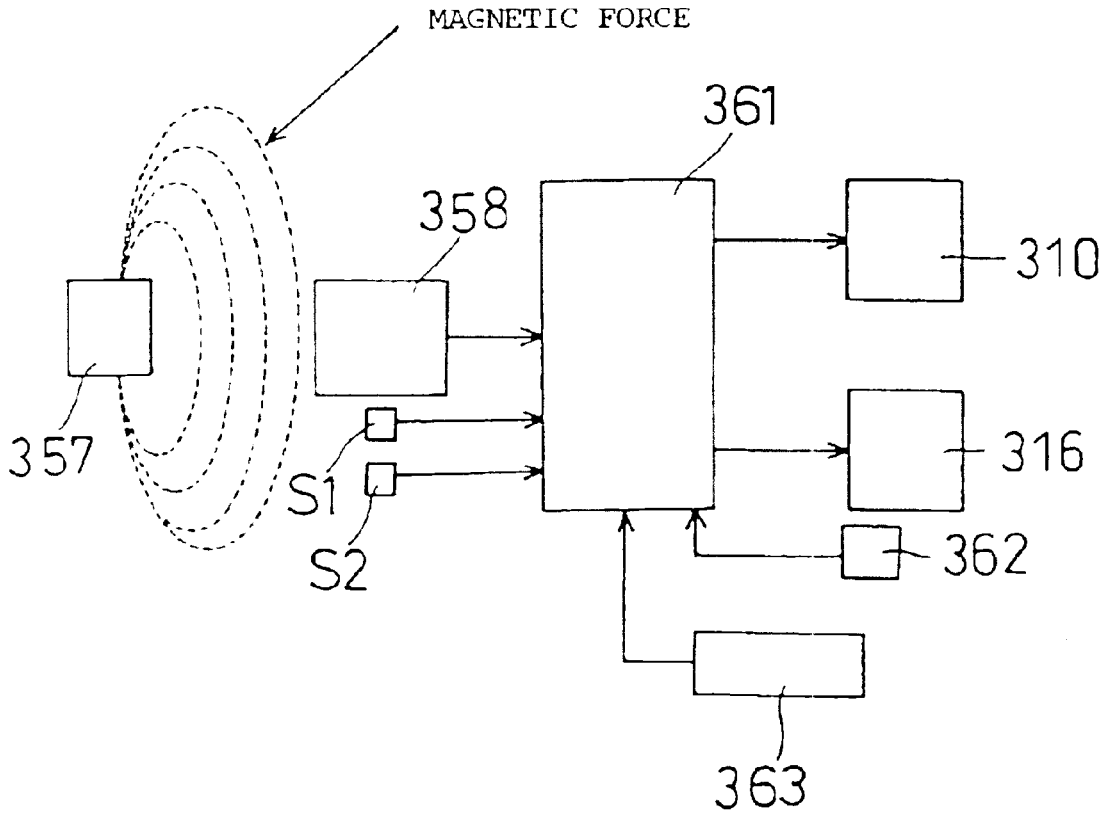
FIG. 42 is a block diagram of the control system.

The controlling system of the massaging apparatus 301 shown in FIG. 42 is now described. The detected signals indicating that the pillow 351 and the massaging unit 307 are in the vicinity with respect to each other and detected (turned ON) by the magnetic sensor 358 are fed to the control section 361 constructed of a microcomputer or the like.

As shown in FIG. 40, an upper limit switch S1 is provided at the uppermost position of the vertical movement of the massaging unit 307 (supporting arm 326) and a lower limit switch S2 is provided at the lowermost position, and the massaging unit 307 is controlled by the control element 361 so as to move vertically between the uppermost position and the lowermost position. A position detector 362 for detecting the vertical position of the massaging unit 307 from the number of revolutions of the hoist motor 316 is provided, and the detected signals detected by the position detector 362 are fed to the control element 361.

The control element 361 constructed of a microcomputer or the like is adapted to control the massage motor 310 and the hoist motor 316 according to the program of an automatic course.

The control element 361 makes the massaging unit 307 reciprocate vertically along the user's body (performs a rolling motion by the massaging unit 307) with the first therapeutic member 308 and the second therapeutic member 309 abutted against the user as an initial action when the automatic course is selected by the remote controller 363 or the like. In this case, the specific portion of the user's body, or the position of the shoulder, with respect to the massaging apparatus 301 is determined from the relation with respect to the position of the massaging unit 307 at the moment when any of the magnet sensors 358 is turned ON. In other words, when the magnetic sensor 358 is turned ON, the detecting means 359 detects that the pillow 351 and the massaging unit 307 are in the vicinity with respect to each other, and the specific portion of the user, or the position of the shoulder, with respect to the massaging apparatus 301 is determined by the control element 361 from the position of the massaging unit 307 detected by the position detector 362.

More specifically, the massaging unit 307 is moved upward and downward with the first therapeutic member 308 and the second therapeutic member 309 abutted against the user and the supporting arm 326 is moved vertically along the user's body together with the drive arm 325. When the first therapeutic member 308 reaches the position of the user's shoulder, the pillow 358, which is equipment of the massaging apparatus 301, and the massaging unit 307 comes closer to each other to turn the magnet sensor 358 ON, so that the detecting means 359 detects the position of the pillow 358 with respect to the massaging apparatus 301. The detected signal of the magnet sensor 358 (detecting means 359) is fed to the control element 361, and then the control element 361 determines the shoulder position of the user with respect to the massaging apparatus 301 from the position of the massaging unit 307 at this time.

The rolling motion here means the effective massaging action that the therapeutic member 308, 309 stimulate the vertical linear portion so called meridian along which the meridian points, or the pressure points, are aligned at intervals of about 70 mm on the back along the backbone of the human body. Therefore, it normally means the massaging action that is considered to be effective when it is performed prior to the kneading and rapping motion.

According to the embodiment descried above, when the user sets the pillow 358 to his/her shoulder position prior to performing the therapeutic course, selects a desired therapeutic course by operating the remote controller 363 or the like, and presses the start button for example on the remote controller 363 or the like, the massaging unit 307 starts to move vertically from the uppermost position as a point of origin. When moving the massaging unit 307 vertically along the user's body, the first therapeutic member 308 and the second therapeutic member 309 of the pair of the left and the right supporting arm 326 move upward and downward while being abutted against the shoulder, back and hip of the user. When the first therapeutic member 308 reaches the position corresponding to the user's shoulder by the upward movement of the massaging unit 307, the first therapeutic member 308 reaches the position corresponding to the lower end portion of the pillow 358, and a magnetic force of the magnetic body 357 in the pillow 358 turns the magnetic sensor 358 ON, thereby ensuring that the detecting means 359 easily detects the position of the pillow 358 with respect to the massaging apparatus 301. The position of the massaging unit 307 detected by the position detector 362 (vertical position of the massaging unit 307) is determined as the position of the user's shoulder with respect to the massaging apparatus 301 and stored in the memory of the control element 361, and then the specific portion of the user, or the position of the user's shoulder, with respect to the massaging apparatus 301 is accurately recognized by the control element 361 from the position of the massaging unit 307 (vertical position of the massaging unit 307) at the moment when the magnetic sensor 358 is turned ON. The stored information can be called up when processing the position to be treated in the therapeutic course as needed.

As is described thus far, by determining the shoulder position of the user with respect to the massaging apparatus 301 accurately, the position of the desired portion of the user's body can be calculated accurately from the shoulder position of the user, and thus the first therapeutic member 308 or the second therapeutic member 309 is moved accurately to the desired portion to make a massage on that desired portion. In addition, by selecting an automatic massage course, more effective massage can be performed. In case of stimulating pressure points, which is well on its way to becoming a boom recent years, the positions of the pressure points can be determined from the position of the user's shoulder accurately to some extent, and thus a massage by stimulating pressure points can be performed effectively.

Figure 46:
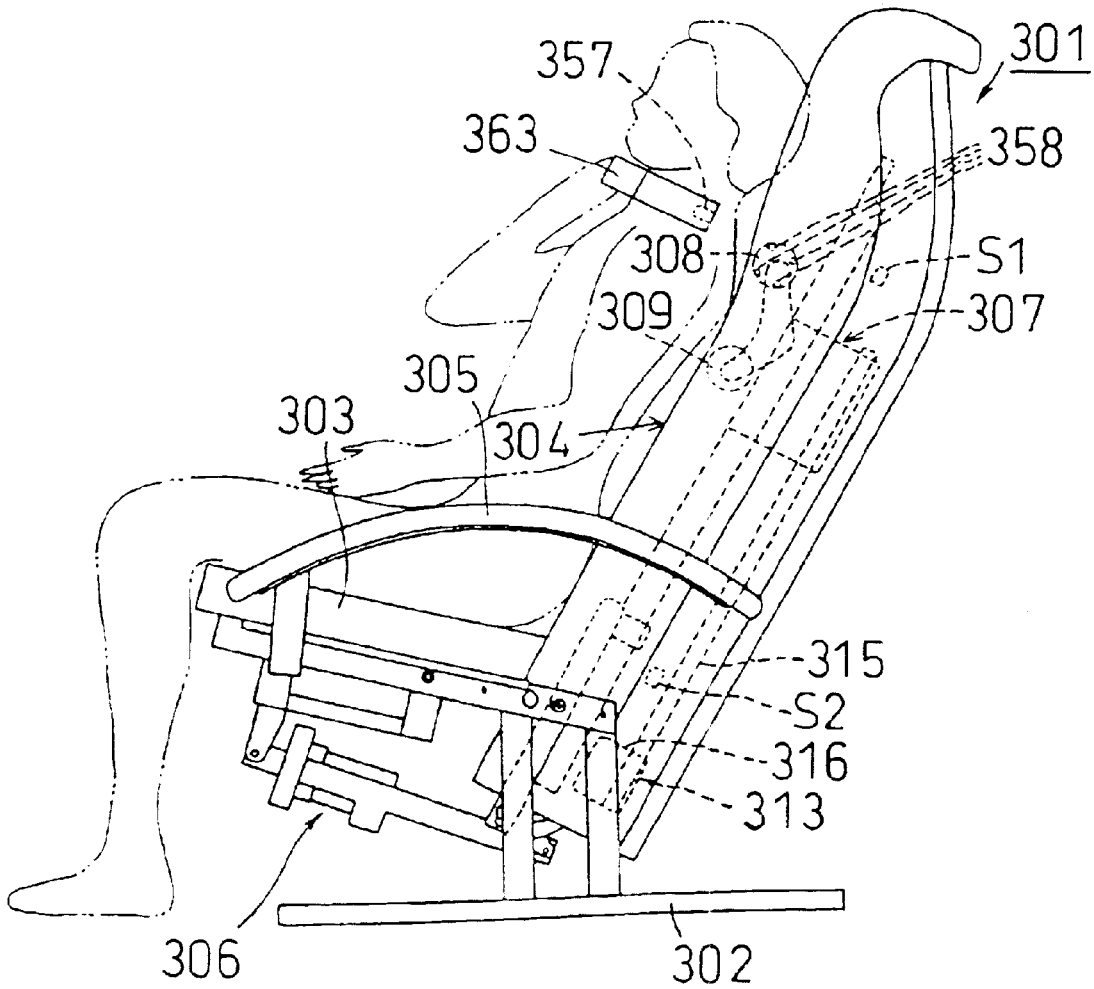
FIG. 46 is a general side view of the massaging apparatus showing another embodiment.

FIG. 46 shows another embodiment, in which the massaging apparatus 301 is provided with a remote controller 363 for controlling the massaging apparatus 301 instead of the pillow 358, and a magnetic body 357 is integrated on one end of the remote controller 363. As in the case of the above-described embodiment, a plurality of magnetic sensors 358 constructed of the Hall elements or the like are provided at regular intervals on the outer peripheral portions of the pair of the left and the right first therapeutic members 308 of the massaging unit 307, and a detecting means 359 for detecting the position of the remote controller 363 with respect to the massaging apparatus 301 is constructed by the magnetic body 357 in the remote controller 363 and the magnetic sensor 358 in the massaging unit 307. Other constructions are the same as the above-described embodiment.

In this case, as shown in FIG. 46, when the user placed the remote controller 363 at his/her shoulder position, the magnetic sensor 358 is turned ON and then the detecting means 359 detects the position of the remote controller 363 with respect to the massaging apparatus 301, so that the control element 361 determines the position of the specific portion of the user with respect to the massaging apparatus 301 as in the above-described embodiment.

According to this embodiment, when the therapeutic massage course, for example, is selected by the remote controller 363 or the like, and then the start button is pressed, the massaging unit 307 starts the vertical movement. In this case, the user places the remote controller 363 on his/her shoulder to inform the position of his/her shoulder to the massaging apparatus 301. In this case, when the first therapeutic member 308 reaches a position corresponding to the position of his/her shoulder during the upward and downward movement of the massaging unit 307, the first therapeutic member 308 on the massaging unit 307 is placed to a position corresponding to the position of the remote controller 363, and a magnetic force of the magnetic body 357 of the remote controller 363 turns the magnetic sensor 358 ON, thereby ensuring that the detecting means 359 easily detects the position of the pillow 358 with respect to the massaging apparatus 301. The position of the massaging unit 307 (vertical position of the massaging unit 307) detected at this moment by the position detector 362 is determined as the position of the user's shoulder with respect to the massaging apparatus 301 and stored in the control element 361 or the like, and then the specific portion of the user, or the position of the user's shoulder, with respect to the massaging apparatus 301 is accurately recognized by the control element 361 from the position of the massaging unit 307 (vertical position of the massaging unit 307) at the moment when the magnetic sensor 358 is turned ON. The vertical position is stored in the memory in the control element 361.

In the above-described embodiment, while a plurality of magnetic sensors 358 constructed of the Hall elements or the like are provided at regular intervals on the outer peripheral portions of the pair of the left and the right first therapeutic members 308 of the massaging unit 307, it is also possible to provide only one magnetic sensor 358 constructed of the Hall element or the like on the outer peripheral portion of each of the pair of the left and the light first therapeutic members 308 of the massaging unit 307, or to provide the magnetic sensor 358 on one of the pair of the left and the right first therapeutic member 308. It is also possible to provide the magnetic sensor 358 on the second therapeutic member 309 instead of the first therapeutic member 308, or to provide the magnetic sensor 358 on the position other than the first therapeutic member 308 and the second therapeutic member 309 of the massaging unit 307.

While the magnetic body 357 is provide in the pillow 351 or the remote controller 363 and the magnetic sensor 358 is provided on the massaging unit 307 in the above-described embodiment, in contrast to it, it is also possible to provide the magnetic sensor 358 is provided in the pillow 351 or the remote controller 363, and the magnetic body 351 on the massaging unit 307.

While the detecting means 359 for detecting the position of the pillow 351 or the remote controller 363 with respect to the massaging apparatus 301 is constructed of the magnetic body 357 on the pillow 351 or the remote controller 363 and the magnetic sensor 358 on the massaging unit 307 in the previous embodiment, it is also possible to construct the detecting means 359 for detecting the position of the pillow 351 or the remote controller 363 with respect to the massaging apparatus 1 of an optical sensor having a light emitting element and a light receiving element alternatively. It is further possible to arrange a limit switch 363, lead switch 366 or the like vertically on the upper front portion of the seatback portion 4, so that equipment of the massaging apparatus 301 such as the pillow 351 is directly detected by these limit switch 363 and the lead switch 366, and then the position of the pillow 351 or the like with respect to the massaging apparatus 301 is detected according to the position or the number of the limit switch 363 and the lead switch 366 turned ON, whereby the control element 361 determines the shoulder position of the user.

While the present invention is applied to the chair type massaging apparatus in the previous embodiments, the massaging apparatus to which the present invention is applied is not limited to the chair type massaging apparatus, but rather be applicable to other types of massaging apparatuses such as a bed type massaging apparatus. It is also possible to apply the present invention to the massaging apparatus for massaging the leg portions of the human body, in which the knee position or the ankle position of the user is detected instead of the shoulder position.

Alternatively, it is also possible to employ an alarm means such as a sound, a display on the screen, a light indicator, or a voice to inform the user of the fact that the shoulder position is detected when the control element 361 detected the shoulder position of the user with respect to the massaging apparatus 301.

According to the present invention, the position of the specific portion of the user's body such as the shoulder position with respect to the massaging apparatus can easily and accurately determined in a simple construction.

Figure 47:
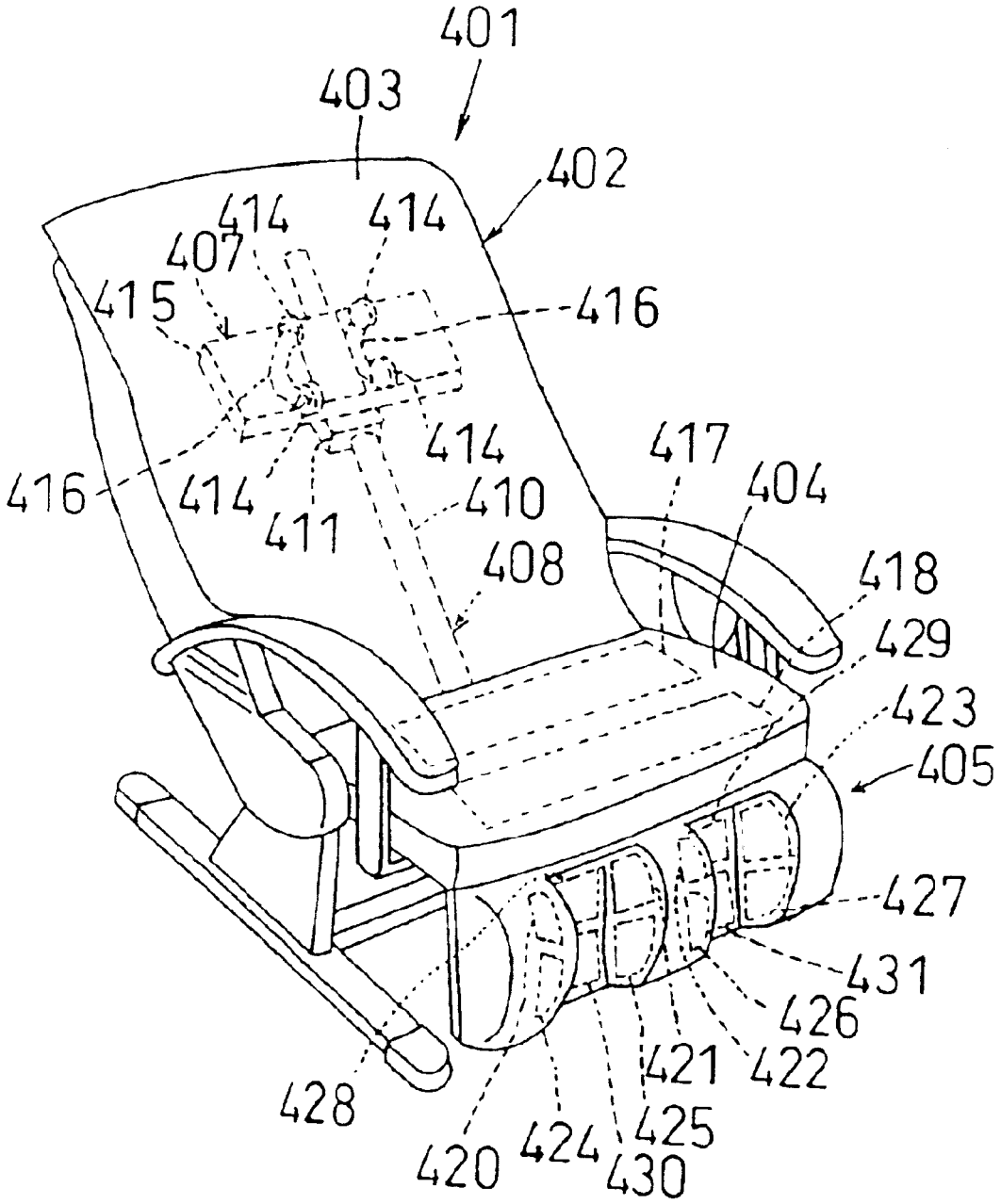
FIG. 47 is a perspective view of the massaging apparatus according to the present invention.

Referring to FIG. 47 to FIG. 52, an embodiment of the present invention will now be described. FIG. 47 shows the appearance of a massaging apparatus 401 according to the present invention, which includes a main body 402 of the massaging apparatus of the chair type.

The main body 402 of the massaging apparatus comprises a seatback portion 403, a seat portion 404, and a footrest 405. The seatback portion 403 can be reclined manually or automatically by a reclining mechanism, not shown. The footrest 405 is connected to the seat portion 404 so as to be pivotable about a lateral axis, and upwardly movable by a footrest hoisting mechanism, not shown.

In the seatback portion 403, there is provided a massaging motion unit 407 that can freely movable in the vertical direction (in the direction of the height of the user) along the seatback portion 403. The massaging motion unit 407 is moved vertically in the seatback portion 403 by means of a locomotive drive 408 and can stop at arbitrary positions in the range from the neck to the hip.

The locomotive drive 408 mainly comprises a screw locomotive mechanism and a hoist motor 409. The screw locomotive mechanism is constructed in such a manner that a nut portion 411 provided on the rear side of the motion unit 407 is engaged with a screw shaft 410 extending vertically in the seatback portion 403. The hoist motor 409 is arranged at the lower end of the screw shaft, and the rotation of the hoist motor 409 rotates the screw shaft 410, thereby moving the motion unit 407 upward and downward. The left and the right sides of the motion unit 407 are guided by a hoist rail, not shown.

The motion unit 407 comprises a massage drive motor 413, a therapeutic member 414, and a massaging mechanism 415 for converting the rotation of the motor 413 into a massaging motion of the therapeutic member 414. The massaging mechanism 415 in this embodiment generates a rapping motion and a kneading motion.

The therapeutic members 414 are provided as a pair of upper and lower therapeutic members arranged on the left side and the right side respectively, that is, four pieces in total. The pair of upper and lower therapeutic members 414, 414 are held at both ends of a boomerang shaped supporting arm 416 respectively, and the vertical midpoint (bent point) of the supporting arm 416 is pivotally held about a lateral shaft 416*a*. Since the shaft 416*a* constitutes a part of the massaging mechanism 415, and the supporting arm 416 is mounted eccentrically and angularly displaced with respect to the shaft 416*a,* rotation of the shaft 416*a* generates a kneading motion of the therapeutic member 414.

The rapping motion is generated by the supporting arm 1 moved forward and rearward about the shaft 416*a* by a mechanism, which is not shown in the figure.

The seat portion 404 and the footrest 405 are provided with air cells 417, 418, 420–431 as therapeutic members for applying massaging motion. These air cells are inflated and deflated by supplying and discharging air, and inflation thereof gives a pressure massage to the body. Air is supplied to the air cells by an air pump arranged under the seat portion 404, and the air supply/discharge is controlled by switching a solenoid valve provided between each of the air cells and the air pump.

The air cell provided in the seat portion 404 is intended to give a massage to the part of the body from the hip to the femoral region, and in this embodiment, there are provided two air cells; the first air cell 417 provided on the rear side of the seat portion 404 and the second air cell 418 provided on the front side thereof.

The air cells provided in the footrest 405 are intended to give a massage to the range from the calves to the ankles, and in this embodiment, twelve air cells 420–431 are provided on the bottom surface and both side walls of two grooves 433 for accommodating the left and the right legs respectively.

Figure 48:
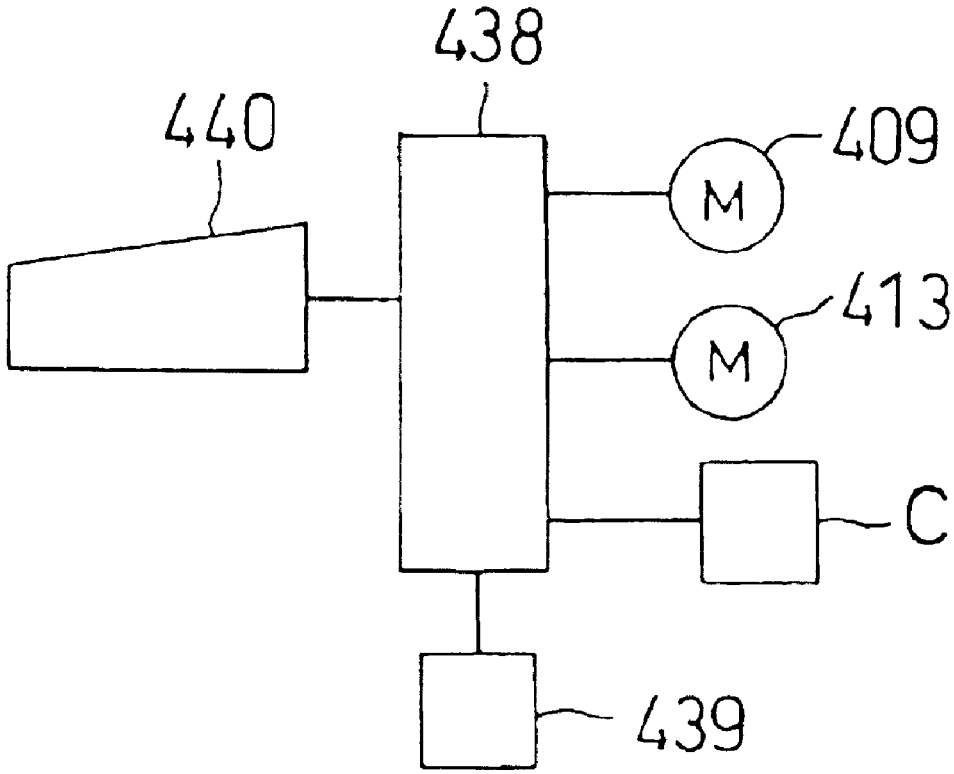
FIG. 48 is a control block diagram of the massaging apparatus.

As shown in FIG. 48, control of the hoist motor 409, the massage drive motor 413, and an air circuit C is performed by the instruction from a control element 438 constructed of a micro computer or the like. The positional control of the drive unit 407 (therapeutic member 414) is performed by detecting the number of revolution of the motor 409 with the rotation detector such as a pulse encoder or the like provided on the hoist motor 409, and recognizing the position of the drive unit 407 from the quantity of movement per revolution.

The control element 438 is provided with a memory portion 439 for performing a process required for the setting of the shoulder position described later. In addition, the control element 438 receives required instructions from the operating unit 440 shown in FIG. 49 as well.

Figure 49A:
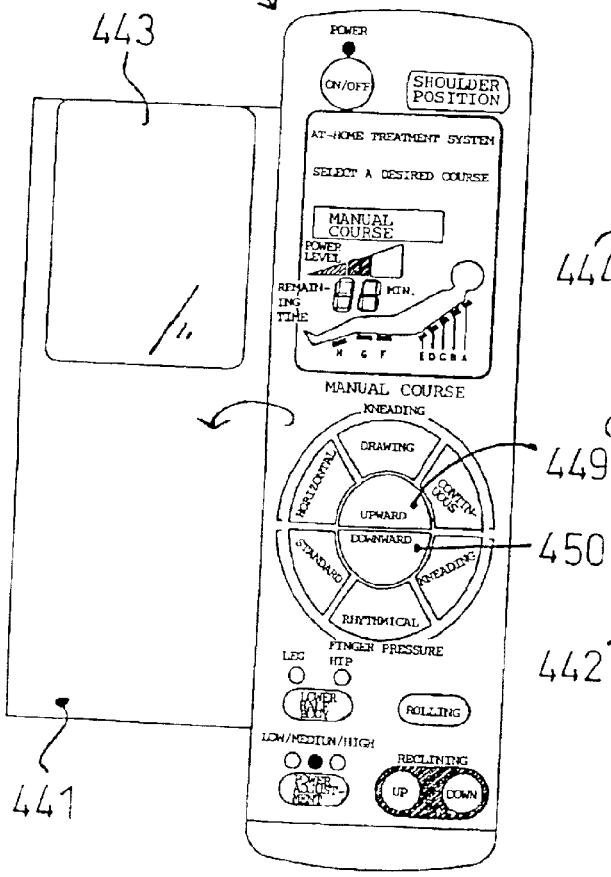
FIG. 49 is a controlling apparatus, wherein (*a*) shows a state in which the cover is opened, and (*b*) shows a state in which the cover is closed.
Figure 49B:
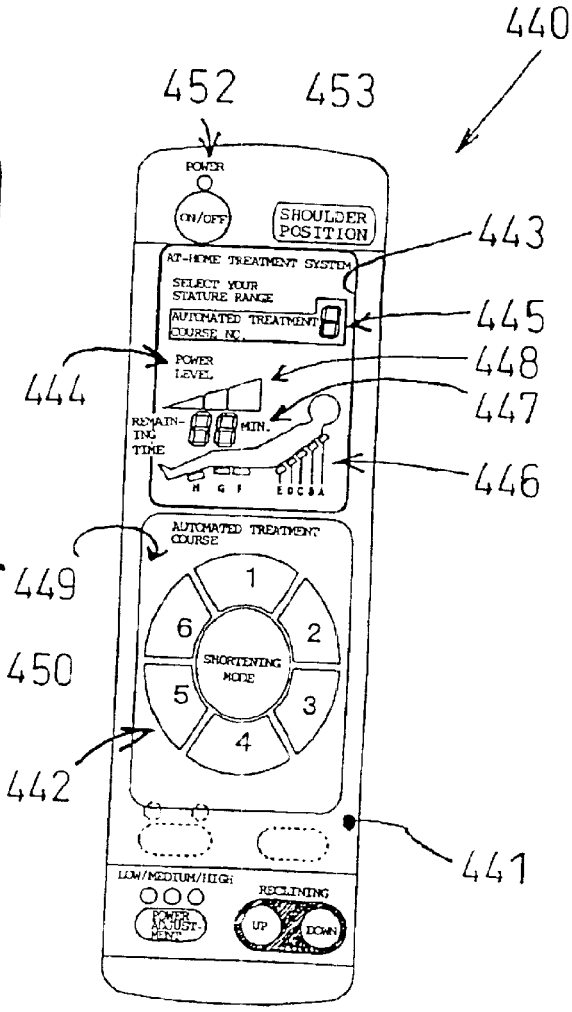
Figure 50:
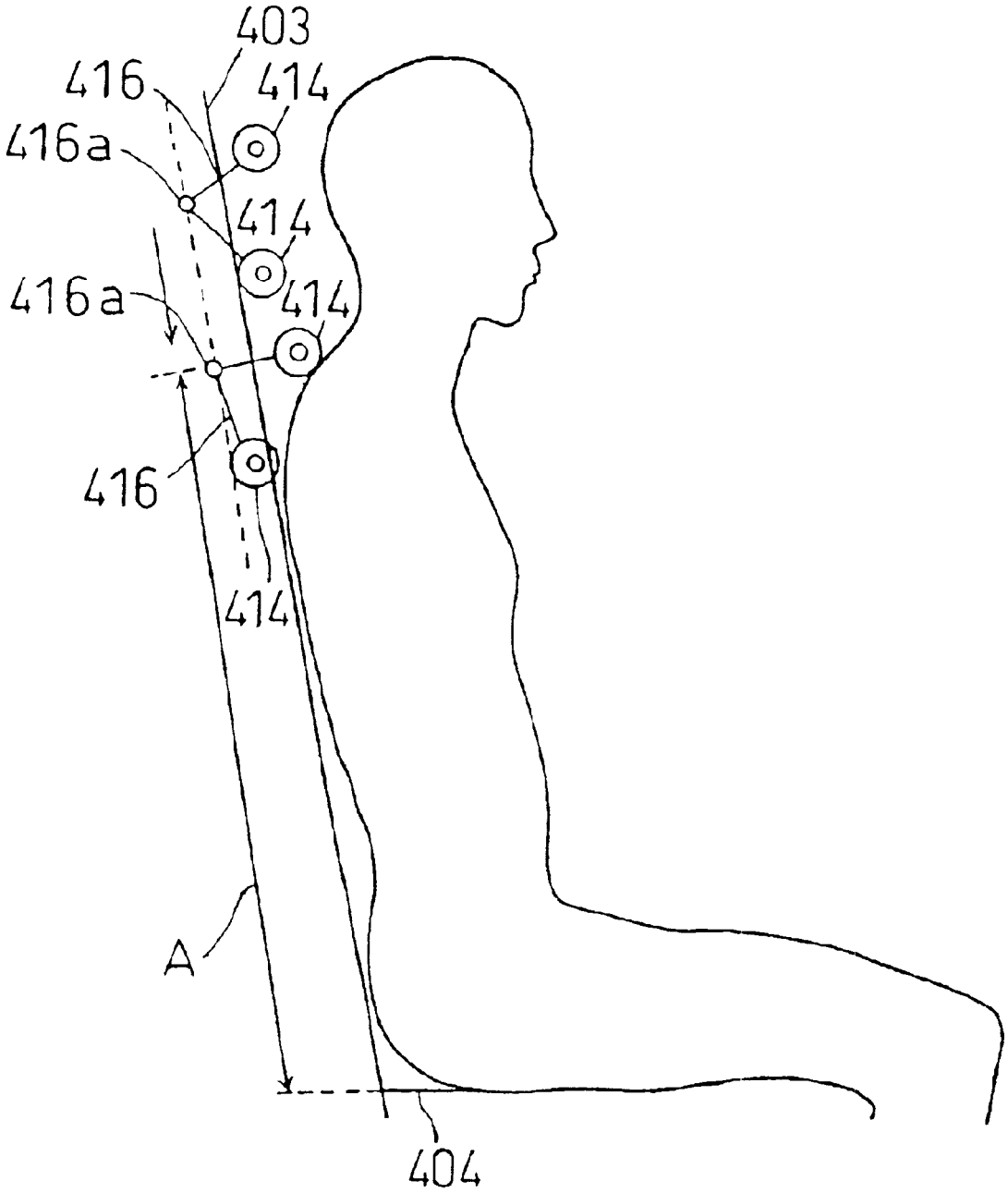
FIG. 50 is a schematic drawing showing the positioning of the therapeutic member to the shoulder.
Figure 51:
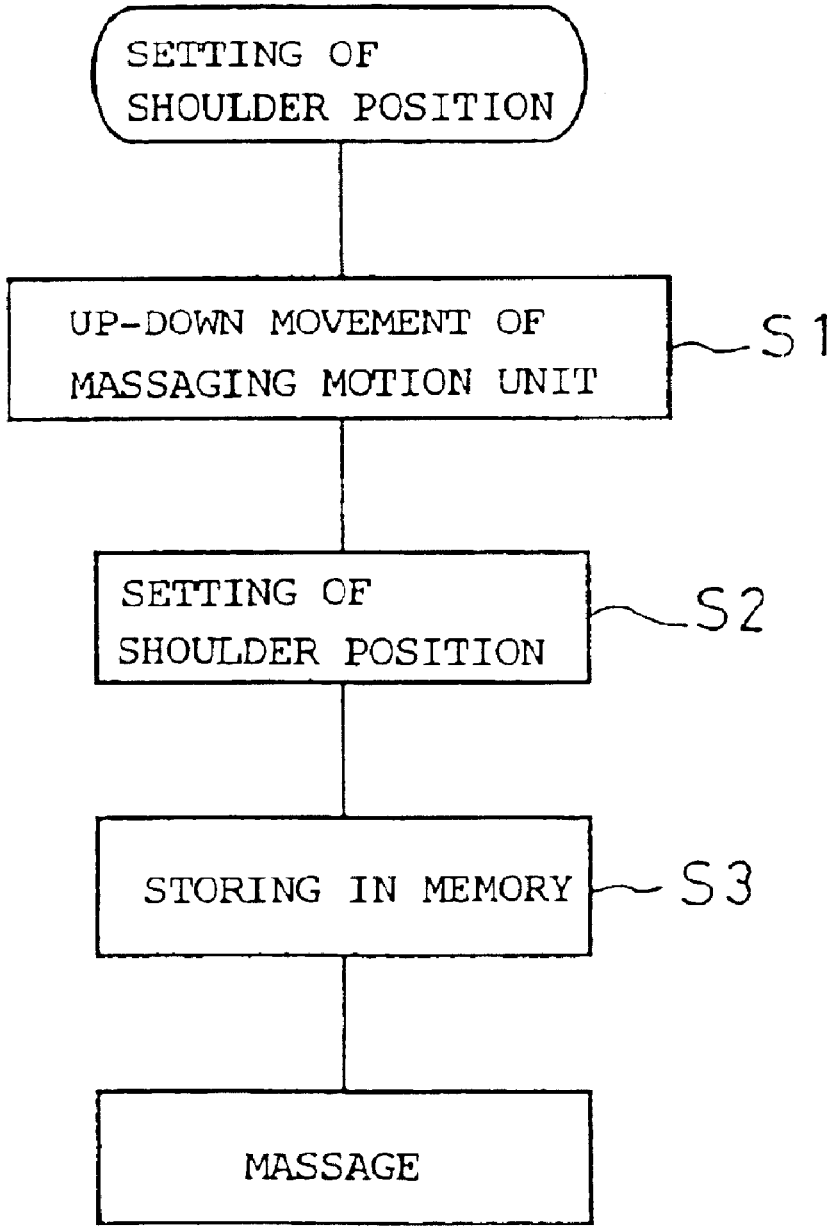
FIG. 51 is a flow chart showing the procedure for setting the shoulder position.

The operating unit 440 is provided with a cover 441 to be opened and closed on the operating surface. In a state in which the cover 441 is opened as shown in FIG. 49(*a*), various manual operations according to the preference of the user can be performed, and in a state in which the cover 441 is closed as shown in FIG. 49(*b*), one of the automatic therapeutic courses can be selected. Hereinafter, the state in which the cover 441 is closed will be mainly described.

The lower half portion of the surface of the cover 441 is provided with a course selecting element 442, and the upper half portion thereof is provided with a transparent portion 443 so as to see the display panel 444 therethrough. In the course selecting element 442, 406 patterns of standard courses can be selected as an execution pattern of the automatic therapy course only with the number keys from 1 to 6 arranged in circle and additional 6 patterns of short course can be selected by operating the short mode key disposed in the center of the number keys in combination with the respective number keys.

The each course will now be described. The course 1, for example, is the fatigue-recovering course, in which a massage at a normal pressure is given in the order of Kenchu-yu, Shin-yu, and Hai-yu, and then to Jin-yu at a gentle pressure. The course 2 is the gastrointestinal condition improvement course; the course 3 is the aperient course; the course 4 is the hepatic disorder remedy course; the course 5 is the lumber pain remedy course; and the course 6 is the neuralgia remedy course, and in each course, the pressure points according to the therapeutic purpose are massaged with a prescribed massaging touch.

On the other hand, the display panel 444 includes a course display field 445 for displaying that the automatic therapy course is selected or which course is selected, a position display field 446 for displaying the current position of the therapeutic member 414 as a light emitted point, an elapsed time display field 447 for displaying the remaining operation time, a strength display field 448 for displaying a massaging force between strong and gentle, and the like.

When the cover 441 of the operating unit 440 is opened, the course display field 445 is turned off, the display of "manual course" is illuminated instead. In the portion hidden behind the cover 441 (the part corresponding to the course selecting element 442), an elevation switch 449 and a lowering switch 450 are provided. The elevation switch 449 and the lowering switch 450 are the position control element for the therapeutic member 414 and serve to move the locomotive drive 408 as long as they are being pressed, and thus the therapeutic member 414 can be moved to an arbitrary extent.

In the upper portion of the cover 441 of the control unit 440 there are provided a power switch 452 and a shoulder position determining switch 453 as the reference position determination section.

In order to determine the shoulder position and perform a massaging operation with such a massaging apparatus 401, the following steps are to be carried out. Since the massaging apparatus 401 is constructed in such a manner that when the operation to turn the power OFF is carried out, the therapeutic member 414 is returned to the uppermost position (point of origin) of its range of movement before the power is turned OFF, when the power is turned ON, the therapeutic member 414 is at the uppermost position of its range of movement. From this state, the lowering switch 450, which is the position control element, is pressed to lower the therapeutic member 414 (See FIG. 50). Then the hoisting switch 449 and the lowering switch 450 are operated as appropriate to bring the upper therapeutic member 414 to the position where it abuts the shoulder (step S1).

After completion of positioning of the therapeutic member 414, when the shoulder position determining switch 443 is pressed (step S2), the position of the therapeutic member 414 (position of the motion unit 407) is detected as the distance A from the seat portion 404, and stored in the memory as information about the shoulder position (step S3). With these steps, the shoulder position setting operation reaches completion.

By performing the shoulder position setting operation before operating the course selecting element 442 to perform the automatic therapy course, the accurate position of the pressure points to be massaged in the therapeutic course based on the preset shoulder position, thereby performing adequate therapy.

The pressure points to be massaged are determined in the following manner.

Though the distribution of the pressure points varies from individual to individual depending on the figure, the positions of the pressure points in the upper half of the body can be determined with reference to the positions of the thoracic vertebrae, lumbar vertebrae, and sacral vertebrae even when the physique is different. Therefore, if the positions of the thoracic vertebrae, lumbar vertebrae, and sacral vertebrae are obtained, the positions of the pressure points can be obtained accurately. The position of the thoracic vertebrae, lumbar vertebrae, and sacral vertebrae of the user can be obtained by determining the shoulder position.

Figure 52:
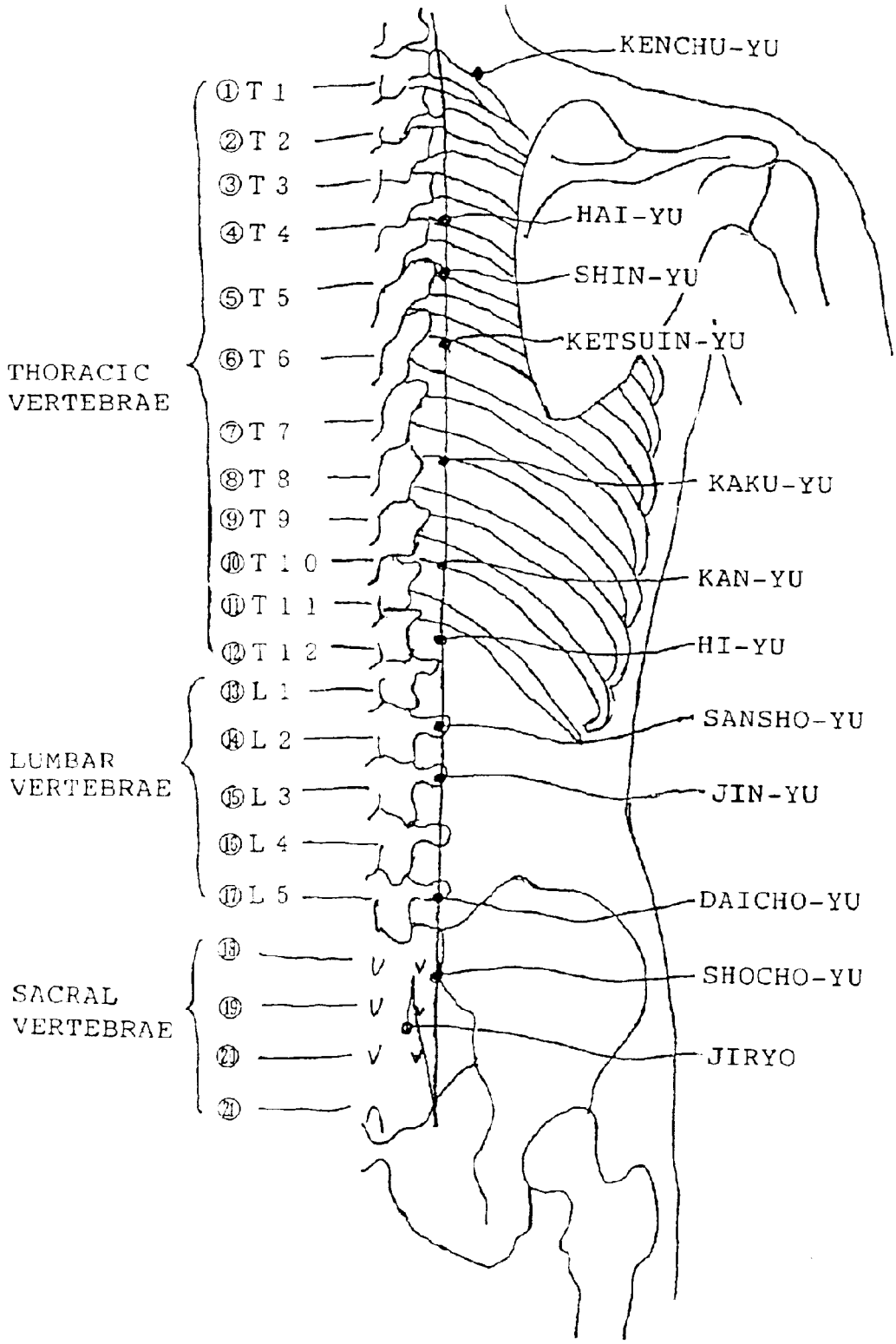
FIG. 52 is a back view of the trunk showing thoracic vertebrae, lumbar vertebrae, and sacral vertebrae of columna vertebralis and the pressure points.
Figure 53:
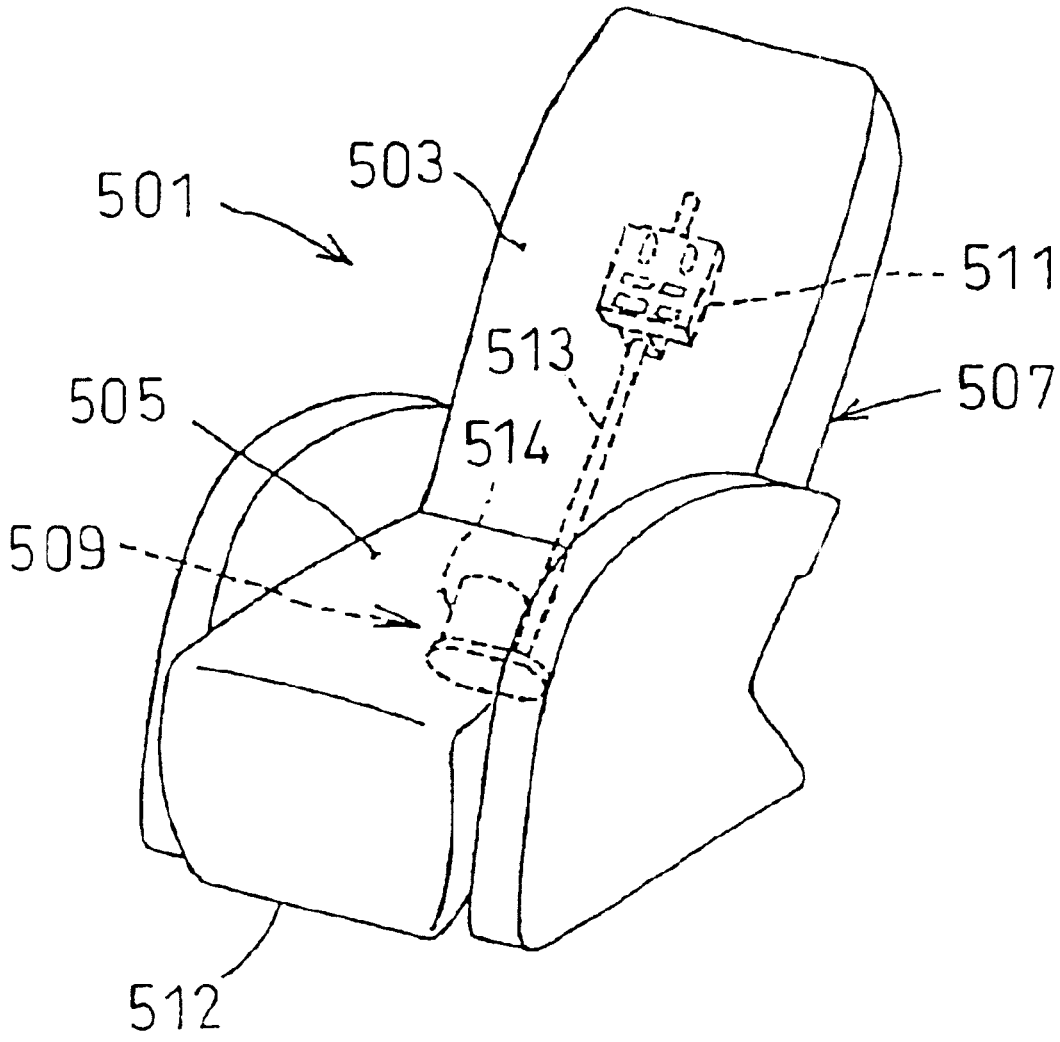
FIG. 53 is a perspective view showing the massaging apparatus according to the present invention.

In other words, as shown in FIG. 52, the columna vertebralis of the human body includes twelve thoracic vertebrae, five lumber vertebrae, and four sacral vertebrae are aligned generally at regular intervals, and the preset shoulder position is located at the upper end of the first thoracic vertebra T1. The shoulder position can be obtained as the distance A from the seat portion 404 to the shoulder position of the user.

The distance D from the seat portion 404 to the lower end of the fifth lumber vertebra L5 in a state in which the user is seated on the main body 402 of the massaging apparatus is constant irrespective of the figure of the user such as the difference of the height of the user, and is considered to be about 15 cm. Therefore, it means that twelve thoracic vertebrae and five lumber vertebrae are aligned at regular intervals over the distance B from the shoulder position to the fifth lumber vertebra L5 (=distance [A−D]).

Therefore, if the distance A is known as the shoulder position, the vertical length of one piece of the user's thoracic vertebra, lumber vertebra L5, or sacral vertebra ΔB can be obtained by first subtracting the distance D (15 cm) from the distance A to obtain the distance B, and then calculating [B+(12+5)=ΔB].

The positions of. the respective pressure points (Kenchu-yu to Jiryo) of the upper half of the body, for example, the position of Hai-yu is in the vicinity of the fourth thoracic vertebra T4, and thus the position of Hai-yu can be calculated from the shoulder position and ΔB.

The control element 440 moves the massaging motion unit 407 upward and downward based on the calculated value, and the therapeutic member 414 is positioned to the pressure points to perform a massaging motion.

Another example to obtain the position of the pressure points when the shoulder position is known is disclosed in Japanese Patent Laid-Open No.243982/1998. The shoulder position can be used not only for obtaining the positions of the pressure points, but also for controlling the therapeutic member 414, for example, so as not to move above the preset position of the shoulder because a massaging motion does not have to be made for the portion above the shoulder position. In addition, information about the shoulder position can be used for various controls as needed.

The present invention is not limited to this embodiment. For example, the main body of the massaging apparatus is not limited to the chair type, but rather be applicable to the mat or the bed type.

According to the present invention, the reference position such as a shoulder position can be set accurately, thereby performing a massaging motion more adequately.

Referring now to FIG. 53 to FIG. 60, an embodiment of the present invention will be described.

FIG. 53 to FIG. 59 show a massaging apparatus 501 according to the present invention. The massaging apparatus 501 is a chair type massaging apparatus comprising a main body 7 of the chair having a seatback portion 503 and a seat portion 505. The seatback portion 503 is provided with a massage drive 511 provided therein which is moved upward and downward by a locomotive drive 509.

The main body 507 of the chair comprises a footrest 512 in addition to the seatback portion 503 and the seat portion 505. The seatback portion 503 and the footrest 512 can be angularly adjustable with respect to the seat portion 505 by means of an appropriate electric driving mechanism or a fluid pressure driving mechanism or the like for reclining operation.

The locomotive drive 509 comprises a longitudinal-feed-thread-shaft 513 provided so as to rotate about the axis vertically extend along the seatback 503, and a power station 514 having a motor with a speed reducer for driving the longitudinal-feed-thread-shaft 513 so as to rotate in the forward and reverse direction about the axis. The longitudinal-feed-thread-shaft 513 passes vertically through a nut portion 515 provided at the rear portion of the massage drive 511 into engagement therewith.

With the locomotive drive 509, the massage drive 511 is moved in the seatback portion 503 vertically (linearly) toward the neck or the hip along the user's body, and is able to stop at the arbitrary positions.

Figure 54:
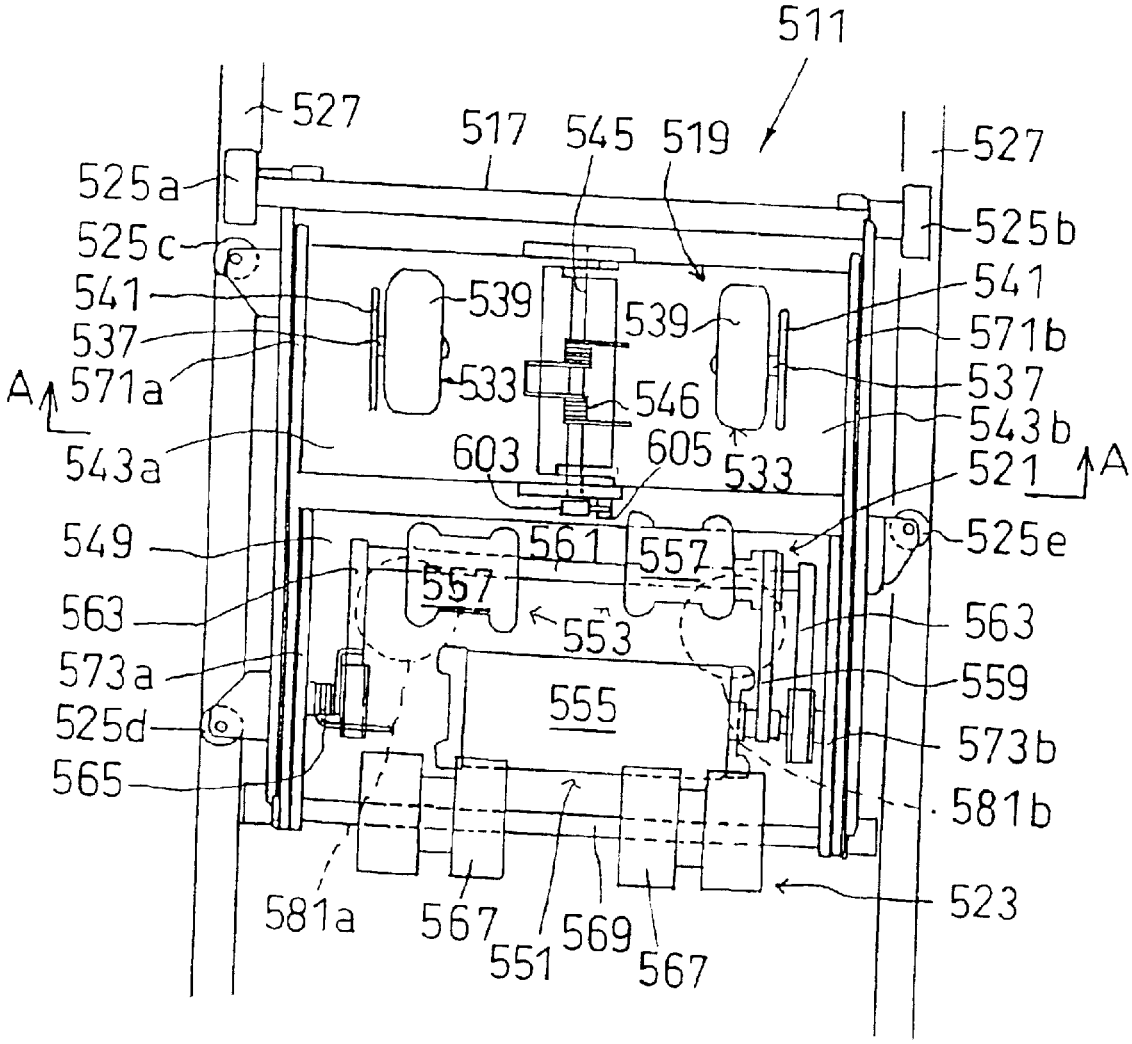
FIG. 54 is a plan view of the massage drive.
Figure 55:
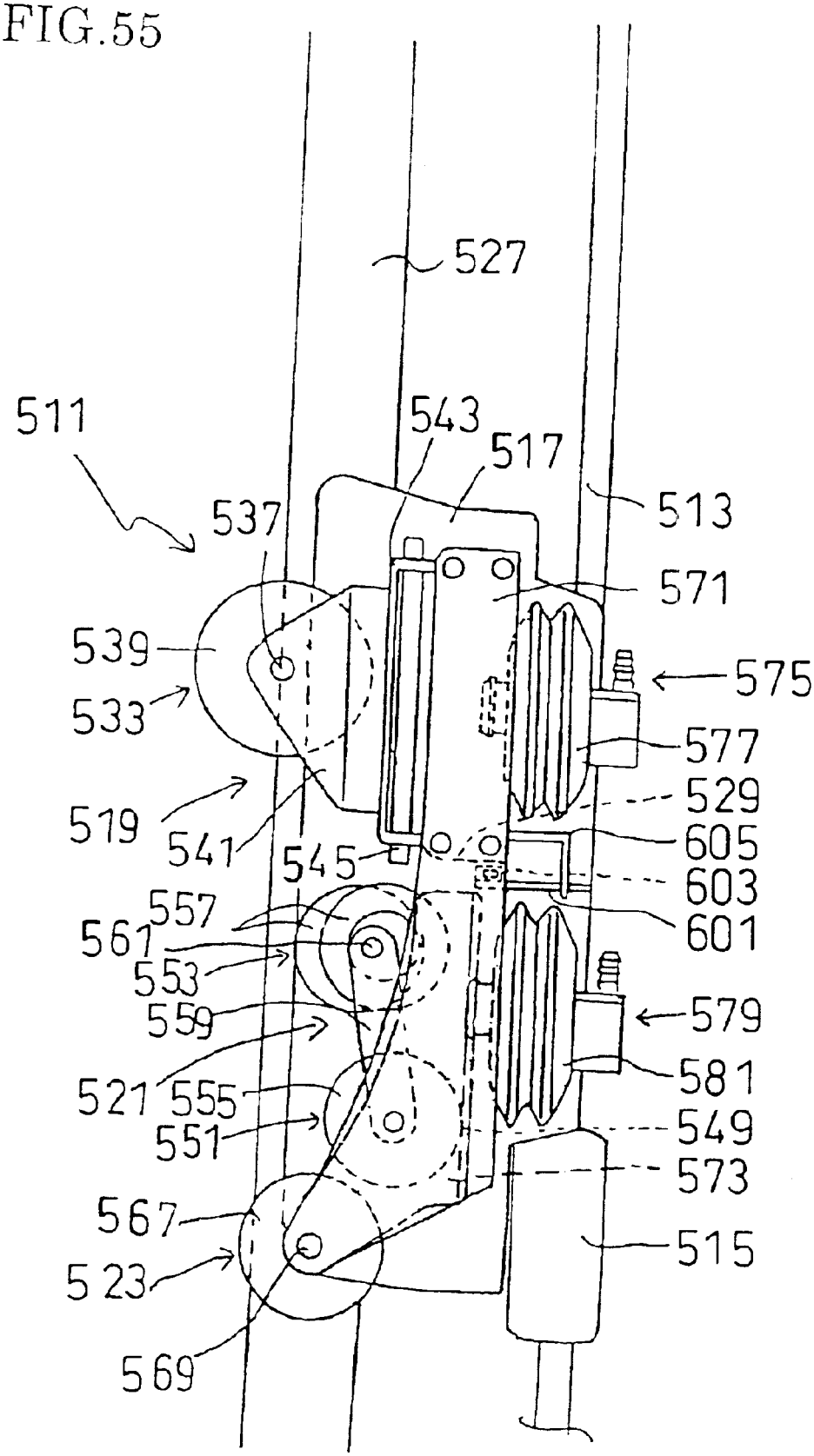
FIG. 55 is a side view of the massage drive.

The massage drive 511 mainly comprises, as shown in FIG. 54 and FIG. 55, a kneading/acupressure drive 519 for performing a kneading or an acupressure massage in the upper portion of the housing 517, a rapping drive 521 for performing a rapping massage provided below the kneading/acupressure drive 519, and a rubbing therapeutic member 523 for performing a rubbing massage provided below the rapping drive 521.

The housing 517 is formed into a box shape so that it can accommodate the kneading/acupressure drive 519 and so on therein. On the left and the right sides thereof, there are provided traveling wheels 525*a*, 525*b*, 525*c*, 525*d*, and 525*e*. These traveling wheels are mounted so that they can travel along two guide rails 527 provided in the vertical direction in the seatback portion 503, and the massage drive 511 moves upward and downward along the guide rails.

Figure 56:
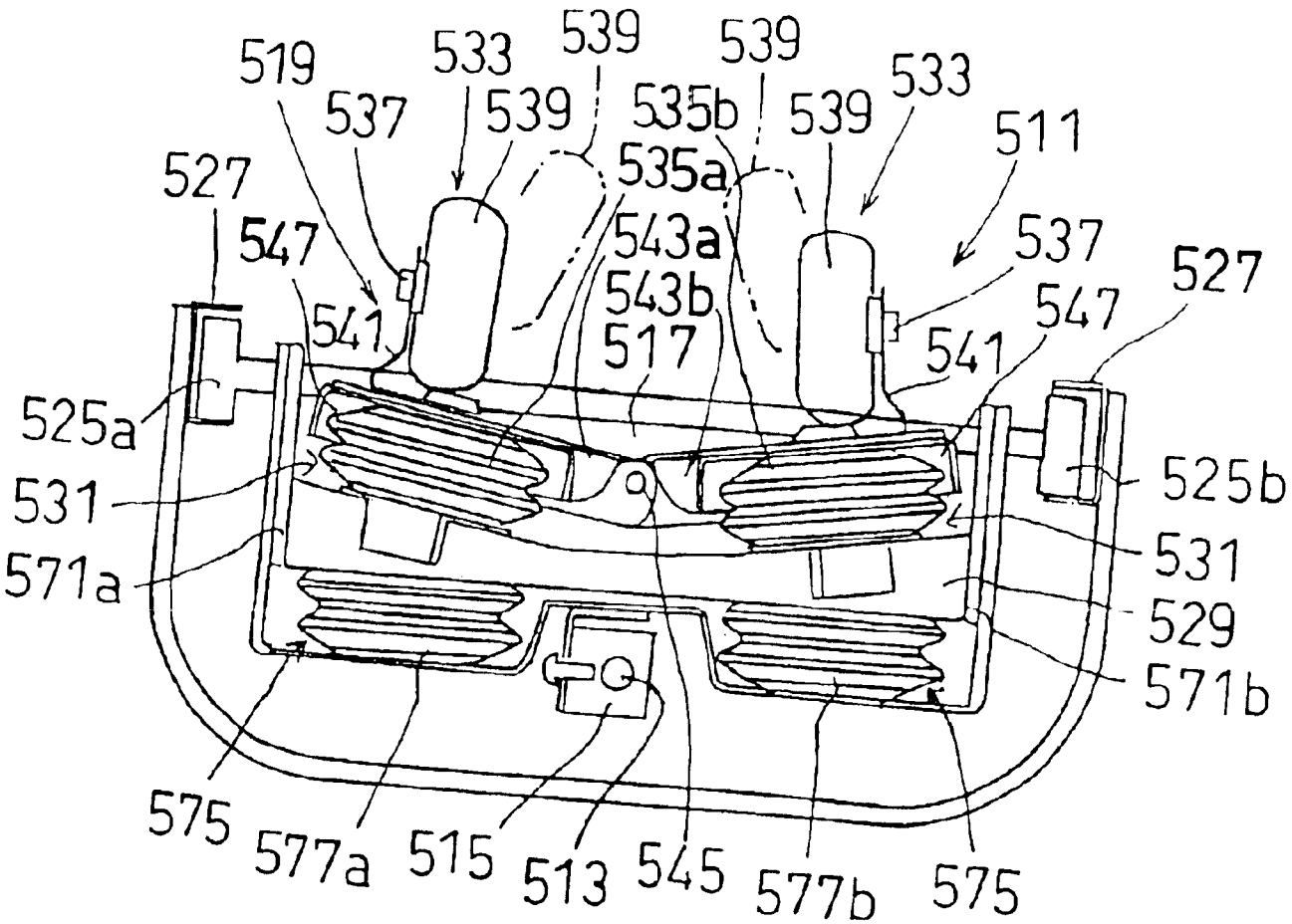
FIG. 56 is a cross-sectional view of FIG. 54 taken along the line A—A.

The kneading/acupressure drive 519 mainly comprises, as shown in FIG. 56, a kneading/acupressure actuator 531 provided on a kneading/acupressure base plate (base portion) 529, and a kneading/acupressure therapeutic member 533 as a massaging member to be operated by the kneading/acupressure actuator 531.

The front face of the kneading/acupressure base plate 529 is, as shown in FIG. 56, formed so that the more it approaches the left and the right ends, the more it projects forward (upward in FIG. 56), and forms inclined surfaces of V-shape in cross section.

The kneading/acupressure actuator 531 is constructed of a pair of the left and the right air cells 535*a* and 535*b* of the bellows type that is inflated and deflated by supplying and discharging of compressed air. These air cells 535 are arranged on the front side of the kneading/acupressure base plate 529 on the left and the right, so that the directions of expansion of the respective air cells 535 incline laterally inwardly.

The kneading/acupressure therapeutic member 533 is constructed of a kneading/acupressure roller 539 of a resilient material that is rotatable about a rotating shaft 537 having its axis in the lateral direction. The rollers 539 are mounted on a pair of left and right therapeutic member mounts 543*a*, 543*b* respectively via arm members 541 of a resilient material for holding the rotating shafts 537. The respective therapeutic member mounts 543 are mounted pivotally with respect to the kneading/acupressure base plate 529 via a hinge shaft 545 provided between the left and the right air cells 535 on the kneading/acupressure base plate 529 (bottom of the V-shaped surface) with the axis oriented vertically. The hinge shaft 545 is fitted with a spring 546 to urge the therapeutic member mounts 543*a,* 543*b* in the direction that closes the same with respect to the kneading/acupressure base plate 529.

The arm member 541 is deformable in the lateral directions to adequately alleviate a force of the kneading/acupressure.

The distal ends of the left and the right air cells 535 is connected to the respective therapeutic member mounts 543 via cylindrical cap bodies 547. In other words, the air cells 535 are interposed between the kneading/acupressure base plate 529 and the therapeutic member mounts 543.

When compressed air is supplied from the air supply. (described later) to the air cells 535 so that the left and the right air cells 535 expand, the left and the right therapeutic member mounts 543 pivot forward as shown in FIG. 56, and the left and the right kneading/acupressure therapeutic members 533 are moved forward so as to approach with each other to perform a massage. When only one of the left and right air cells 535 is extended, one of the kneading/acupressure therapeutic members 533 is moved forward to perform an acupressure massage.

The rapping drive 521 mainly comprises a rapping actuator 551 mounted on a rapping base plate 549 and a rapping therapeutic member 553 as a massaging member to be operated by the rapping actuator 551.

The rapping actuator 551 is constructed of a motor 555, and the rapping therapeutic member 553 is constructed of a pair of left and light cylindrical rapping rollers 557. These rapping rollers 557 is mounted eccentrically with respect to a rapping shaft 561 to be rotated by a motor 555 via an endless belt 559. The rapping shaft 561 is laterally extending between rapping arms 563 provided on a rapping base plate 549, and rotatably held about the axis thereof. When the rapping shaft 561 rotates, the eccentric left and the right rapping rollers 557 perform a rapping motion on the body alternately.

In order to ensure that the rapping roller 557 is pressed against the body at a constant force, a torsion spring 565 is interposed between the rapping arm 563 and the rapping base plate 549 in a state in which the rapping roller 557 is urged toward the body.

The motor 555 may be adapted to be variable in speed of rotation so that the speed of rapping motion can be changed.

In this way, since the kneading/acupressure drive 519 and the rapping drive 521 are provided separately, optimal massaging motion is realized at the respective drives. In other words, in the kneading/acupressure drive 519, the air cell 535 is employed as an actuator 531 and thus the optimal kneading or acupressure by the action of air, which is slow and strong, is realized. On the other hand, in the rapping drive 521, the eccentric rotary motion of the rapping therapeutic member 553 provides a reliable rapping motion.

It is also possible to perform a kneading/acupressure motion, and rapping motion simultaneously, and thus an increased variety of massaging motions available is obtained in comparison with the massaging apparatus having one type of therapeutic member of the related art.

The rubbing therapeutic member 523 comprises a pair of the left and the right rubbing rollers 567. The rubbing rollers 567 is rotatably provided on a rubbing shaft 569 extending laterally at the lower end of the housing 517.

When the massage drive 511 moves upward and downward with the rubbing therapeutic member 523 abutted against the body, the rubbing roller 567 rotates as if it rubs the body, thereby giving a rubbing massage.

Figure 57:
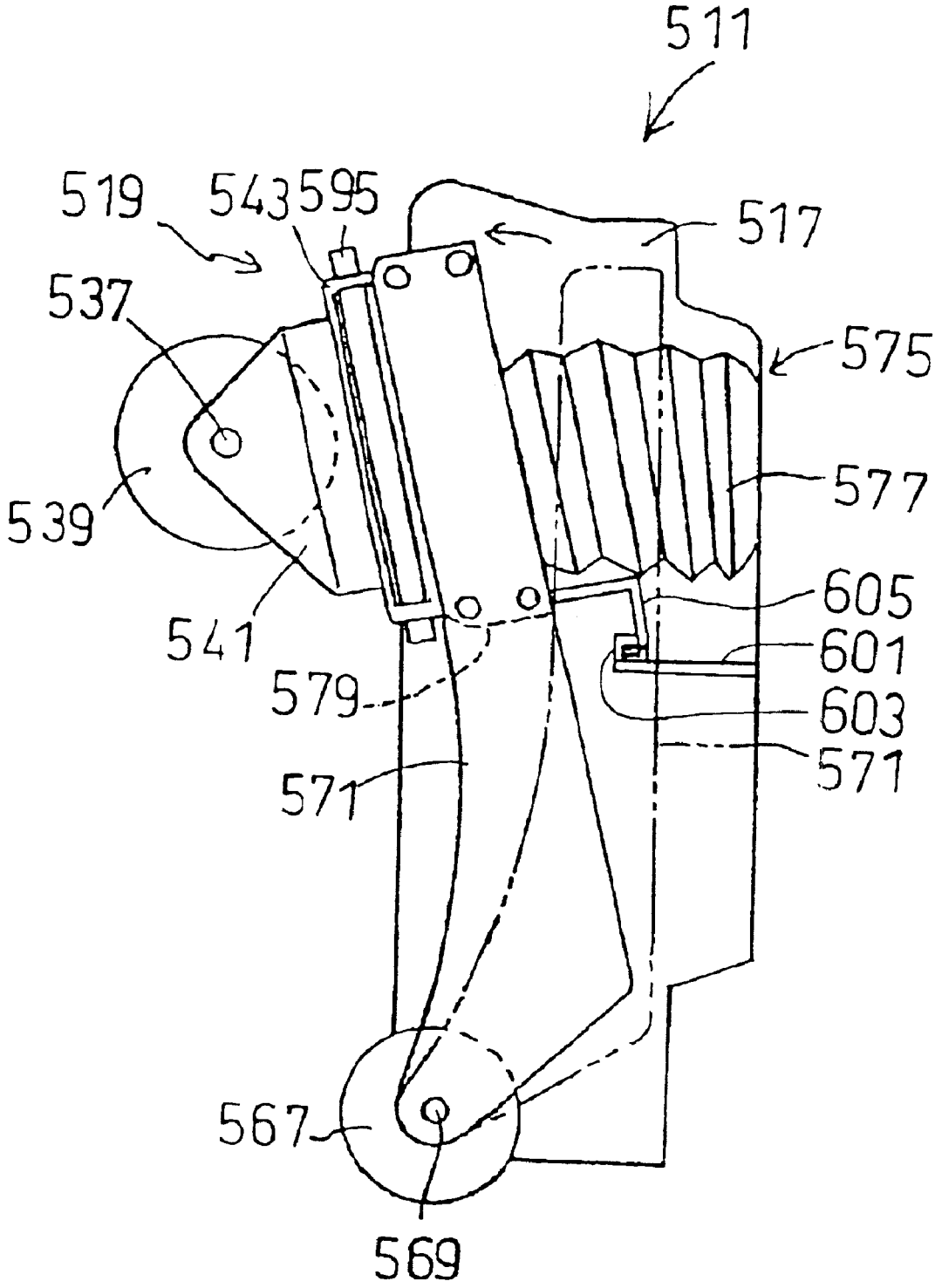
FIG. 57 is a schematic side view showing a state in which the kneading/acupressure drive is advanced toward the body (tilted forward).

The both ends of the rubbing shaft 569 are each connected to one end of each of first links 571*a,* 571*b* having the other ends connected to the left and the right sides of the kneading/acupressure base plate 529 respectively, so as to rotate about the axis of the rubbing shaft 569. The kneading/acupressure drive 521 is mounted on the housing 517 via the first links 571, so that the entire kneading/acupressure drive 521 rotates about the axis of the rubbing shaft 569 and can be forwardly tilted toward the body as shown in FIG. 57.

Each of the both ends of the rubbing shaft 569 are further connected one end of each of second links 573*a,* 573*b* having the other ends connected to the left and the right sides of the rapping base plate 549 respectively, so as to rotate about the axis of the rubbing shaft 569, and the rapping drive 523 is mounted on the housing 517 via the second links 573. The first links 571 and the second links 573 are rotatable separately, and the rapping drive 523 rotates about the axis of the rubbing shaft 569 independently of the kneading/acupressure drive 521 and can be forwardly tilted toward the body as show in FIG. 58.

The second links 573 are mounted laterally insides of the first links 571.

The forwardly tilting movement of the kneading/acupressure drive 521 is carried out by a first forwardly tilting drive 575 disposed between the housing 517 and the kneading/acupressure base plate 529. The first forwardly tilting drive 575 is constructed of a pair of left and right bellows shaped air cells 577*a,* 577*b* that is inflated and deflated by supplying and discharging compressed air, and these air cells 577 is connected to the housing 517 at the distal ends thereof and to the kneading/acupressure base plate 529 on the proximal ends thereof. When compressed air is supplied to the air cells 577 from the air supply, the air cells 577 expand as shown in FIG. 57, and thus the entire kneading/acupressure drive 521 is forwardly tilted to project toward the body. When air in the air cells 577 is discharged, the air cells 577 are deflated and the kneading/acupressure drive 521 retracts from the body.

Figure 58:
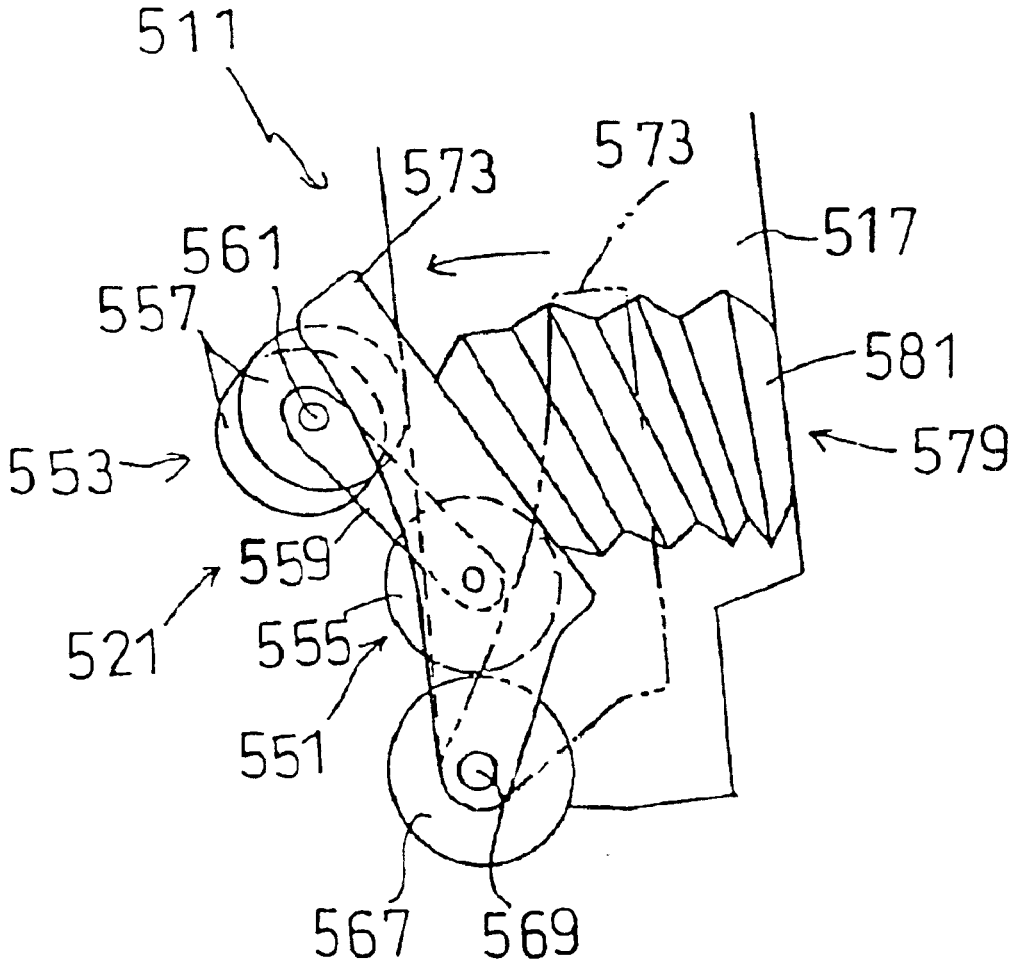
FIG. 58 is a schematic side view showing a state in which a rapping motion drive is advanced toward the body (tilted forward).

The forwardly tilting movement of the rapping drive 523 is performed by a second forwardly tilting drive 579 disposed between the housing and the rapping base plate 549. The second forwardly tilting drive 579 is constructed of a pair of left and right bellows shaped air cells 581*a,* 581*b* that are inflated and deflated by supplying and discharging compressed air, and the distal ends of the pair of the left and the right air cells 581*a,* 581*b* are connected to the housing 517 and the proximal ends are connected to the rapping base plate 549. When compressed air is supplied from the air supply to these air cells 581, the air cells 581 are expanded as shown in FIG. 58, and the rapping drive 523 is forwardly tilted and projects toward the body. When air in the air cells 581 is discharged, the air cells 581 are deflated and the rapping drive 523 retracts from the body.

In this way, since the kneading/acupressure drive 519 and the rapping drive 523 can move toward and retract from the body respectively, a massage can positively be applied to the portions that are away from the seatback portion such as the neck and the back of the body by forwardly tilting the kneading/acupressure drive 519 and the rapping drive 523.

Figure 59:
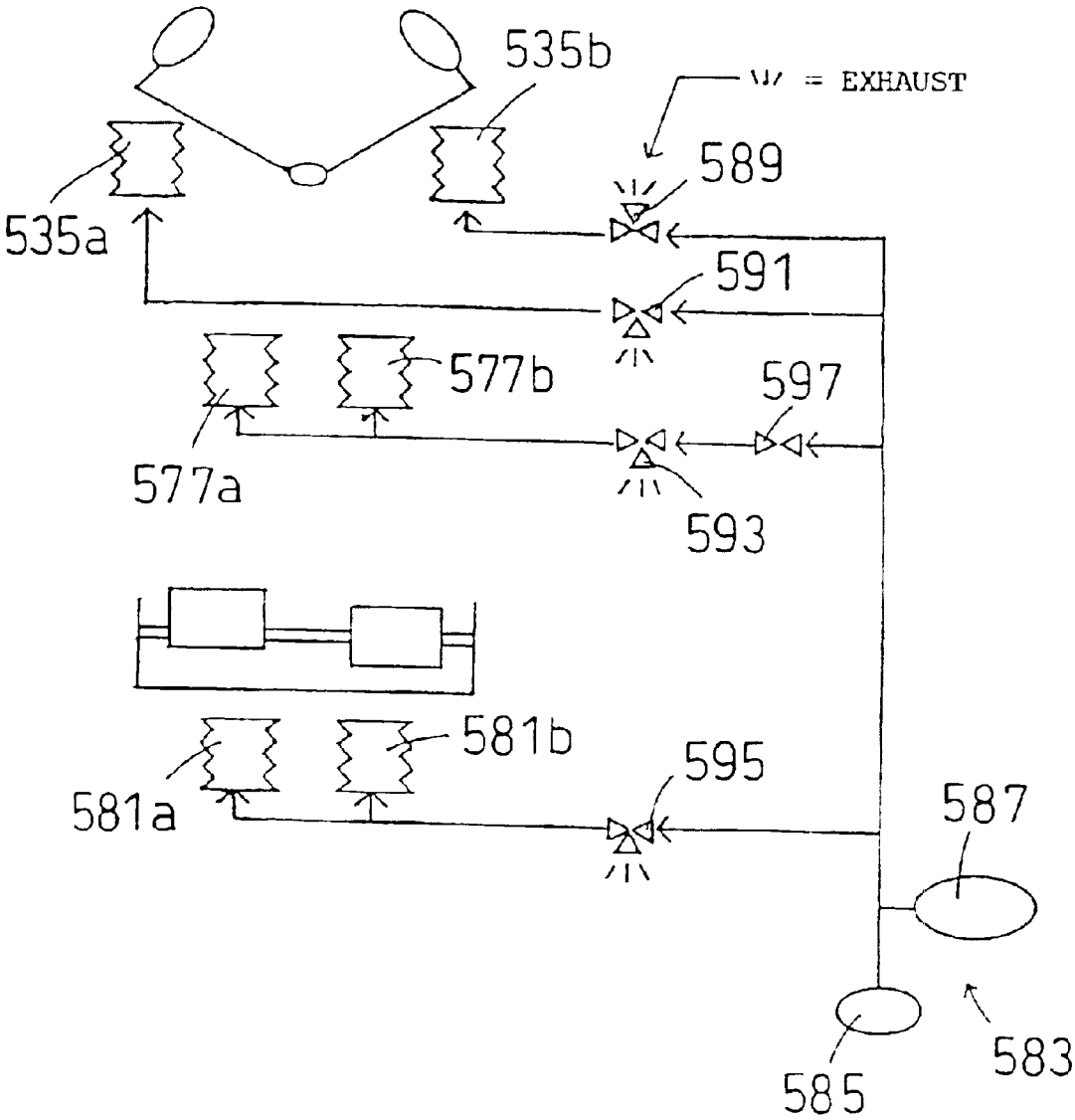
FIG. 59 is a drawing showing an air circuit of the massaging apparatus.

FIG. 59 shows an air circuit diagram for supplying air to the respective air cells 535*a,* 535*b,* 577*a,* 577*b,* 581*a,* 581*b*. The air circuit is provided with an air pump 585 and an accumulator 587 as air supplies 583, so that compressed air is supplied to each air cells. The air pump 585 and the accumulator 587 are stored and disposed in the seat portion 505 at the lower portion thereof.

The respective air cells are connected to the air supply 583 via three-way valves 589, 591, 593, and 595 for switching among a state in which air is being supplied, a holding state after air is supplied, and a state in which air is being discharged. More specifically, the air cells 535*a, b* for kneading/acupressure are connected to the air supply 583 via the separate three-way valves 589, 591, and thus the air cells 535*a, b* on the left and the right are separately and independently inflatable.

The air cells 577*a, b* for the first forwardly tilting drive 575 (for kneading/acupressure drive) are connected to the air supply 583 via the common three-way valve 593, so that supply/discharge of air is performed simultaneously for the air cells 577*a* and *b,* and the kneading/acupressure drive 521 is forwardly tilted by these two air cells 577*a* and *b.* There is provided a two-way valve 597 between the three-way valve 593 and the air supply 583, and the two-way valve 509 can also switch the states of air supply.

The air cells 581*a, b* for the second anteversio drive 579 (for rapping drive) are also connected to the air supply 583 via the common three-way valve 595, and thus the supply/discharge of air is performed simultaneously for the air cells 581*a* and *b,* and rapping drive 523 is forwardly tilted by these air cells 581*a, b.*

The forwardly tilting movement of the kneading/acupressure drive 519 is also used for detecting the shoulder position of the user. As shown in FIG. 54 and FIG. 55, there is provided a limit switch 603 at the bottom of the housing 517 via the mounting stay 601. The limit switch 603 is for detecting whether the kneading/acupressure drive 519 is in the forwardly tilted state or in the retracted state, more specifically, for detecting whether or not a body 605 to be detected mounted at the bottom of the kneading/acupressure drive 529 is in contact with the limit switch 603.

As shown in FIG. 55, when the kneading/acupressure drive 519 is in the retracted and stored state, the limit switch 603 and the body 605 to be detected are away from each other, and thus the limit switch 603 is in OFF-state. As shown in FIG. 57, when the air cell 577 is inflated and thus the kneading/acupressure drive 519 moves toward the user, the body 605 to be detected is brought into contact with the limit switch 603 to turn the limit switch 603 ON.

Figure 60:
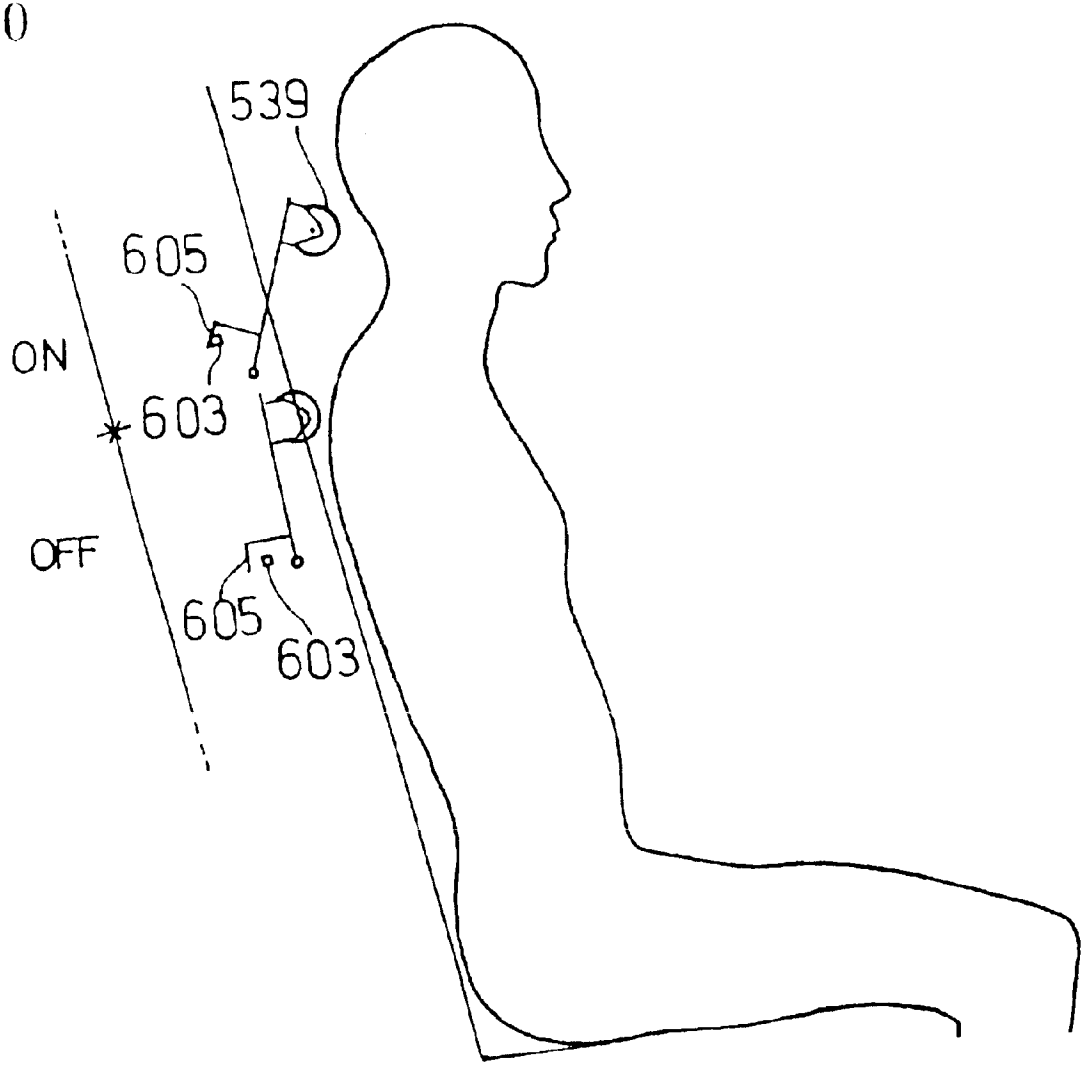
FIG. 60 is a drawing showing the principle of detection of the shoulder position.

Referring now to FIG. 60, the procedure for detecting the position of the user's shoulder by using the limit switch 603 will be described. As an initial state, the massage drive 511 is located at the uppermost position in the seatback portion 503. The air cells 577*a,* 577*b* are supplied with air to be inflated and the kneading/acupressure drive 519 projects toward the user. In other words, the kneading/acupressure therapeutic member 533 projects toward the user. At this time, the body 605 to be detected is brought into contact with the limit switch 603 to turn the limit switch 603 ON.

In this case, air is supplied so that the pressure in the air cells 577*a,* 577*b* is lower than that of the case where the kneading acupressure drive 519 is forwardly tilted for a normal massage. In other words, the pressure in the air cells 577*a,* 577*b* is set to the extent that is enough to inflate the air cell 577*a,* 577*b* to forwardly tilt the kneading/acupressure drive 519, and that the air cells 577*a,* 577*b* can be deflated when a load in the direction that pushes the kneading/acupressure drive 519 back is applied.

When the massage drive 511 is moved downward with the kneading/acupressure drive 519 in the forwardly tilted state, the kneading/acupressure drive 519 is kept in the forwardly tilted state as far as the kneading/acupressure therapeutic member 533 is located above the shoulder of the user. When the massage drive 511 moves further downward, and the kneading/acupressure therapeutic member 533 is brought into contact with the user's shoulder, the kneading/acupressure drive 519 is pushed backward to be retracted. At this time, since the internal pressure of the air cells 577*a,* 577*b* is relatively low, it can be compressed by a slight load, whereby the user is prevented from being excessively pressurized.

Then, the body 605 to be detected moves away from the limit switch 603, and thus the limit switch 603 is turned OFF. Therefore, the position at the moment when the limit switch 603 is switched from ON to OFF is recognized as the shoulder position is performed.

The massaging apparatus 501 then determines the physique of the user and the positions of the pressure points corresponding thereto according to information of the shoulder position, whereby a massage that positively stimulates the pressure points is performed.

The present invention is not limited to this embodiment. For example, the detecting means can be constructed in such a manner that the inflation and deflation of the air cell 581 in the rapping drive 521 is detected.

In the present invention, the position of the user's shoulder with respect to the massaging apparatus can be determined automatically and accurately in a simple construction.

Referring now to FIG. 61 to FIG. 67, an embodiment of the present invention will be described.

Figure 65:
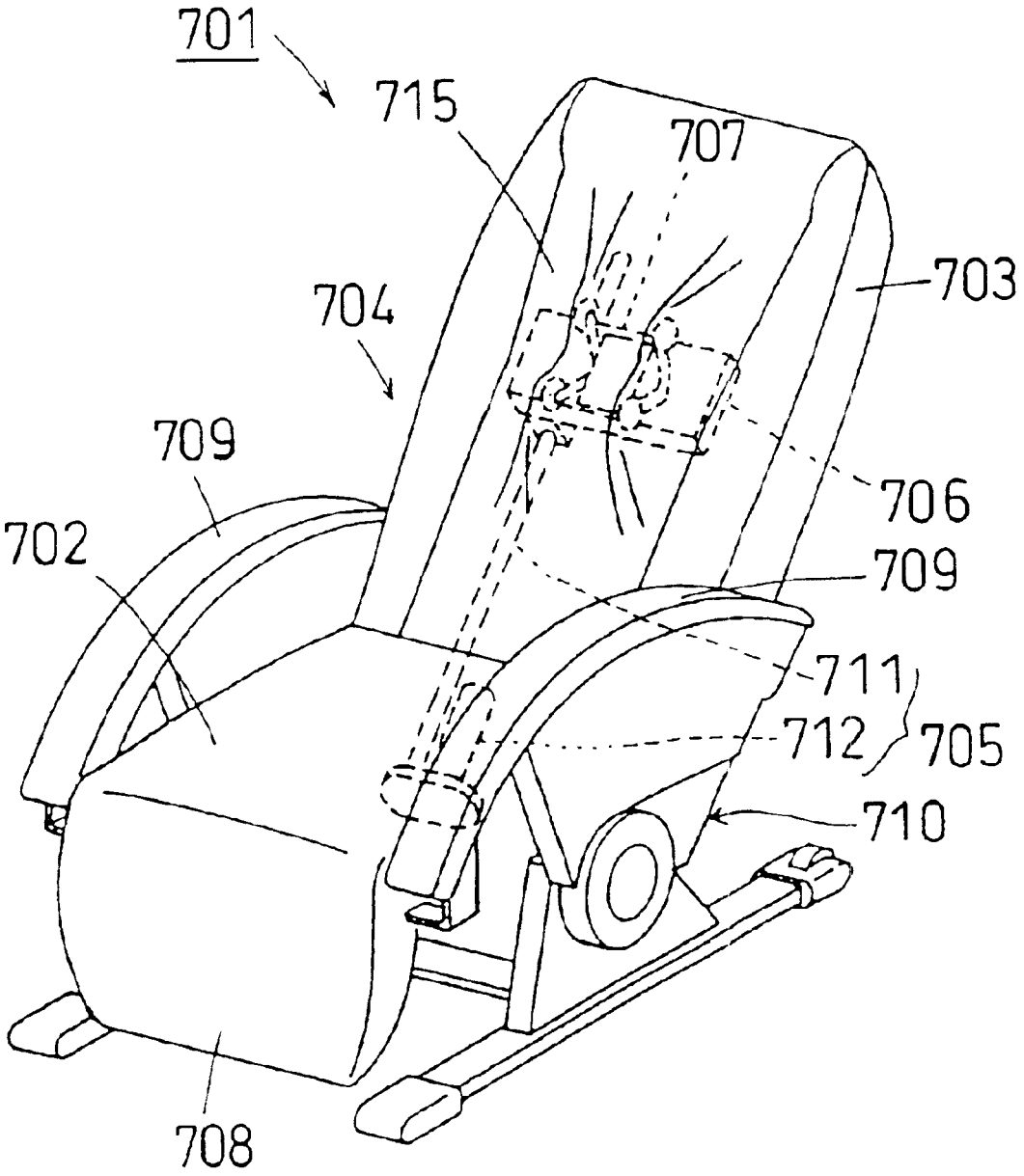
FIG. 65 is a perspective view of the massaging apparatus.

FIG. 65 shows an massaging apparatus 701 of the present invention, and the massaging apparatus 701 is a chair type massaging apparatus comprising a main body 704 of the chair (therapeutic bed) including a seat portion 702 on which the user seats, and a seatback portion 703 for supporting the back of the user.

In the seatback portion 703 of the main body 704 of the chair, there are provided a moving frame 706 being movable vertically by a locomotive drive 705, and a massaging mechanism 707 on the moving frame 706. The front side of the massaging mechanism 707 is covered with a flexible covering member 715 formed of cloth or leather.

The main body 704 of the chair includes a footrest 708, and a leg body 710 having arm rests 709 on both sides of the seat portion 702 formed in one piece in addition to the seatback portion 703 and the seat portion 702. The seatback portion 703 and the footrest 708 are adapted to be angularly moved with respect to the seat portion 702 by means of a suitable electric driving mechanism, a fluid pressure driving mechanism, a manual structure, or the like for reclining operation.

Figure 63:
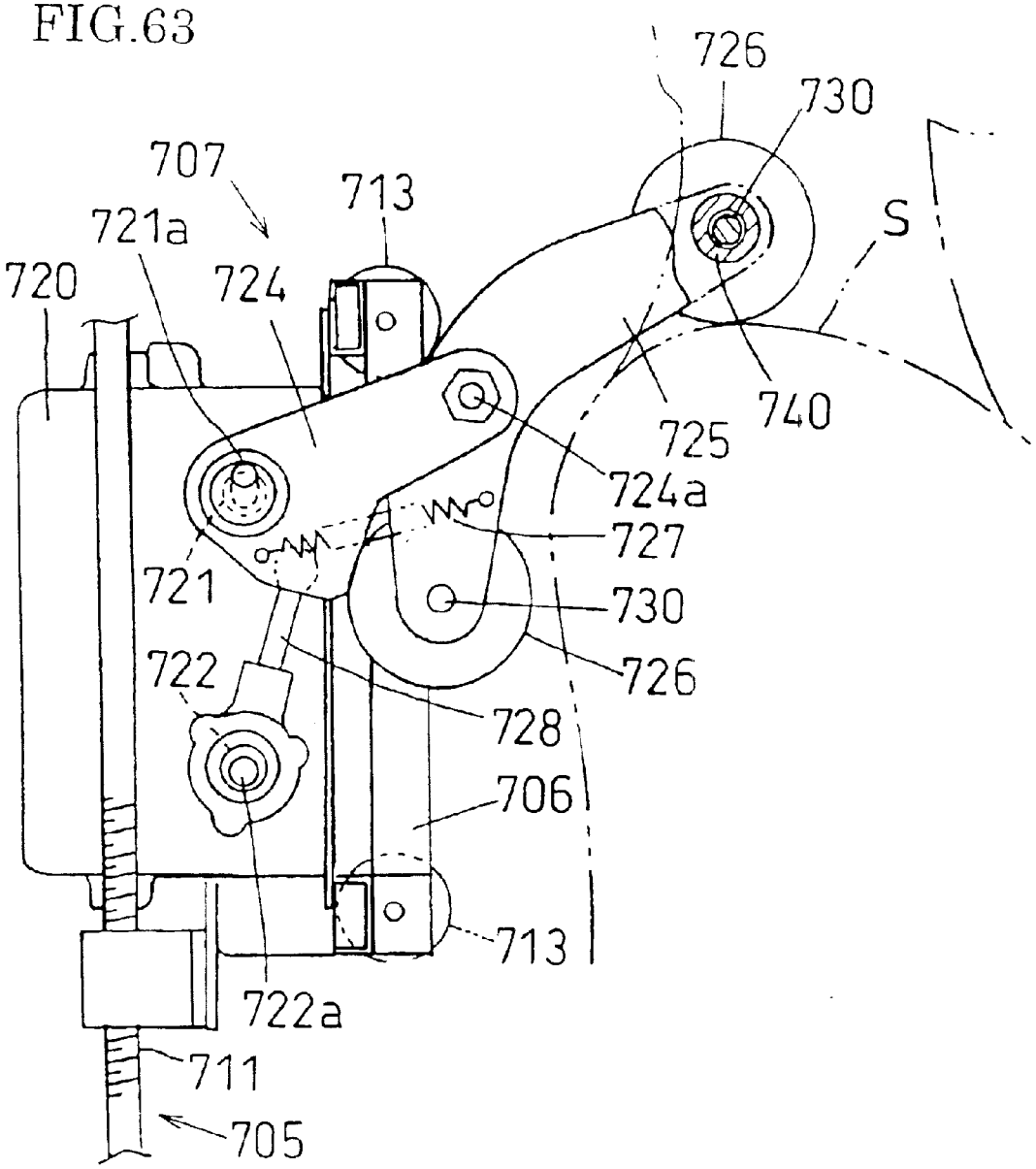
FIG. 63 is a side view of the massaging mechanism.
Figure 64:
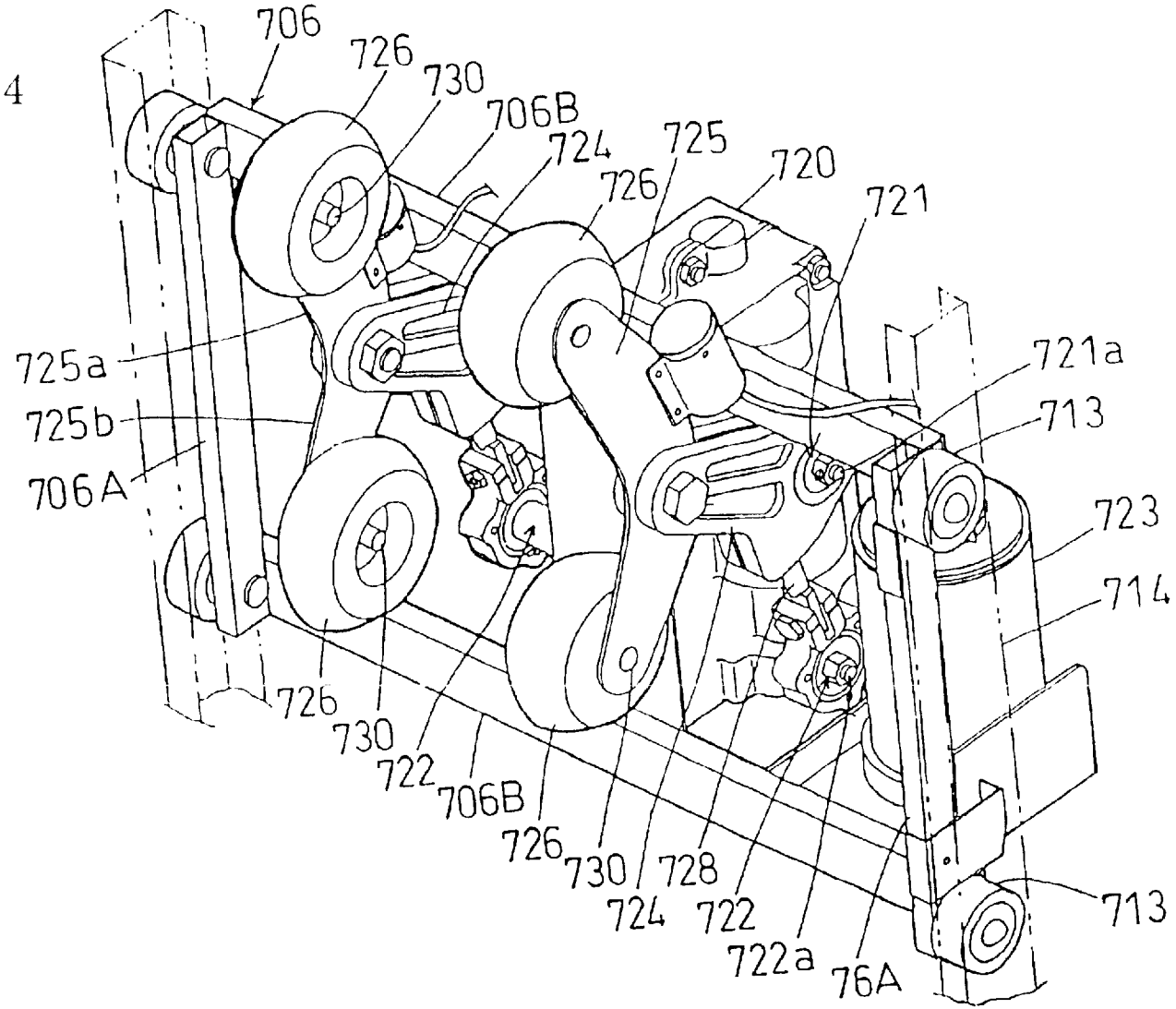
FIG. 64 is a perspective view of the massaging mechanism.

The locomotive drive 705 comprises a longitudinal-feed-thread-shaft 711 rotatably provided vertically along the seatback portion 703, and a power station 712 having a motor with a speed reducer for driving the longitudinal-feed-thread-shaft 711 in the forward and reverse direction, and the longitudinal-feed-thread-shaft 711 passes through suitable portions of the massaging mechanism 707 or the moving frame 706 into engagement therewith. As shown in FIGS. 63 and 64, on the left and right sides of the moving frame 706, there are provided a pair of upper and lower traveling roller 713, which are rotatably attached to two guide rails 714 provided vertically in the seatback portion 703. In this arrangement, the massaging mechanism 707 can be moved along the back surface of the upper half of the user's body sitting on the seat portion 702 vertically toward the neck or toward the hip by the operation of the locomotive drive 705.

The vertical position (quantity of movement) of the massaging mechanism 707 is detected by the vertical position detecting means, not shown. As the vertical position detecting means, appropriate means such as a construction in which the number of rotation or the angle of revolution of the longitudinal-feed-thread-shaft 711 or the power station 712 are converted into pulses by means of a rotary encoder or the like, and that converted pulses are counted, or a construction in which the vertical position of the massaging mechanism 707 is optically detected by the photoelectric sensor or the like is employed.

The locomotive drive 705 may be replaced by a wrapping driving mechanism, an engagement structure of the rack-and-pinion, or a hoist drive structure using a fluid pressure cylinder or the like.

The moving frame 706 is rectangular in shape formed by connecting the upper and the lower ends of the left and the right frame bodies 706A, 706A with the upper and the lower frame bodies 706B, 706B, and the massaging mechanism 707 comprises a drive unit 720 having a kneading motion shaft 721 and a rapping motion shaft 722 projecting toward the left and the right sides, a power station 723 composed of an electric motor connected to the drive unit 720, a pair of drive arms 724 extending in the lateral direction (in the direction of the width of the user's body) held by the respective motion shafts 721, 722, a supporting arm (supporting body) 725 connected to the tip of the respective drive arms 724, and roller type therapeutic members 726 rotatably provided on the upper and the lower ends of the supporting arm 725 via lateral supporting shafts 730.

The kneading motion shaft 721 and the rapping motion shaft 722 are laterally disposed in parallel to each other with vertically spaced therebetween. The output from the power station 723 is fed into the drive unit 720 via a belt transmission mechanism or the like so that the kneading motion shaft 721 and the rapping motion shaft 722 are selectively rotated via a gear, a clutch the transmission shaft or the like in the same unit 720.

Both ends of the kneading motion shaft 721 are provided with inclined shaft portions 721*a* eccentrically inclined and angularly displaced with respect to the axis of rotation, and the rear end of the drive arm 724 is attached to the inclined shaft portion 721*a* via a bearing.

The supporting arm 725 is formed of a plate of vertically long V-shape rotated by 90 degrees to the right in side view facing its surfaces toward the left and the right, and the vertical midpoint thereof is connected to the tip of the drive arm 724 via the lateral supporting shaft 724*a* so as to rotate about the axis thereof. Under the supporting shaft 724*a*, there is provided a tension coil spring 727 between the supporting arm 725 and the drive arm 724 so that a resiliency which urges the upper portion of the supporting arm 725 forward is provided.

On both ends of the rapping motion shaft 722, there are provided eccentric shaft portions 722*a* that are off-centered with respect to the axis of rotation in the opposite direction, to which the lower end of a connecting rod 728 is pivotally connected via a bearing, and the upper end of the connecting rod 728 is pivotally connected to the lower surface of the drive arm 724 via a ball bearing or the like.

In this arrangement, when the power station 723 rotates the kneading motion shaft 721, the inclined shaft portion 721*a* at the both ends of the kneading motion shaft 721 allow the therapeutic member 726 provided on the right and left sides correspondingly to perform circumferential movement including lateral movement toward and away from each other, thereby performing kneading motion.

When the rapping motion shaft 722 rotates, the eccentric shaft portions 722*a* on both ends thereof make the drive arm 724 reciprocate vertically via the connecting arm 728, whereby the therapeutic members 726 perform the rapping motion via the supporting arm 725 rotatably connected to the drive arm 724.

While the kneading motion shaft 721 and the rapping motion shaft 722 are adapted so that a power from the power station 723 is selectively transmitted thereto via the clutch in the drive unit 720, separate special power stations may be provided for the motion shafts 721, 722 respectively.

The massaging apparatus 701 of the present invention comprises a detector 740 for detecting the lateral load applied to both or one of the therapeutic members 726 mounted on the upper sides of the left and right supporting arm 725.

Figure 61:
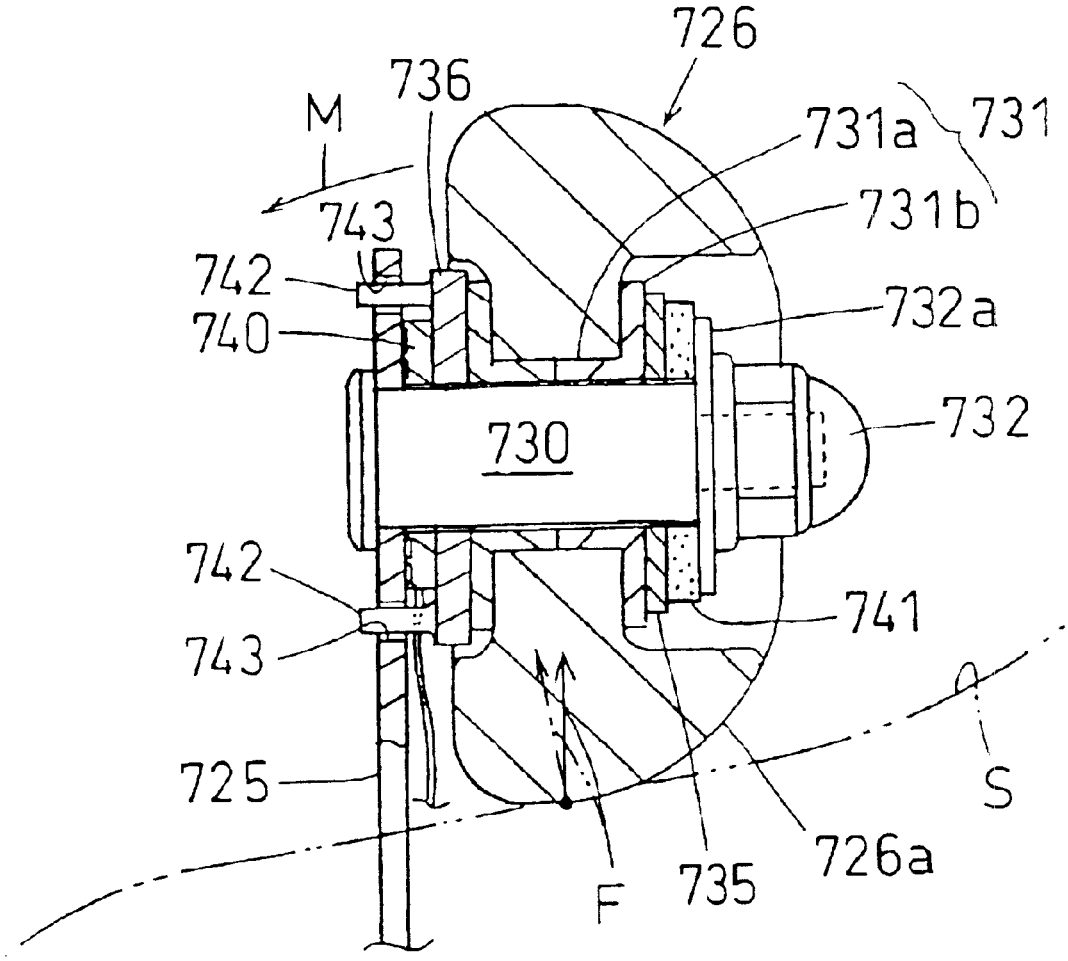
FIG. 61 is a massaging apparatus according to an embodiment of the present invention, specifically a front cross-sectional view showing the mounting portion of the therapeutic member.
Figure 62:
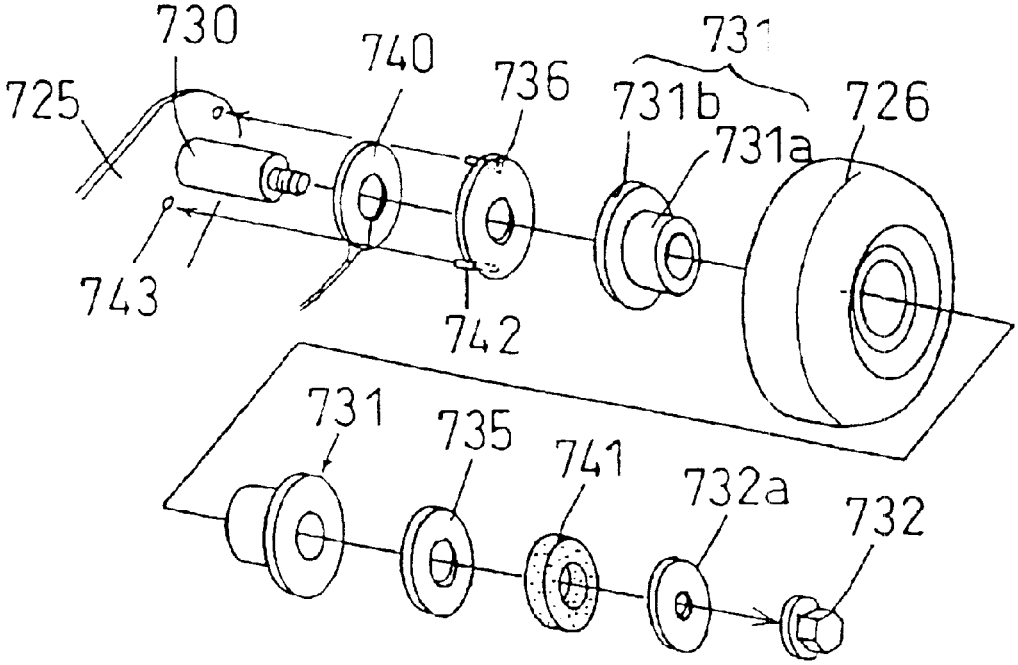
FIG. 62(*a*) is an exploded perspective view showing the mounting portion of the therapeutic member, and FIG. 62(*b*) is an exploded perspective view of the pressure sensor.
Figure 62:
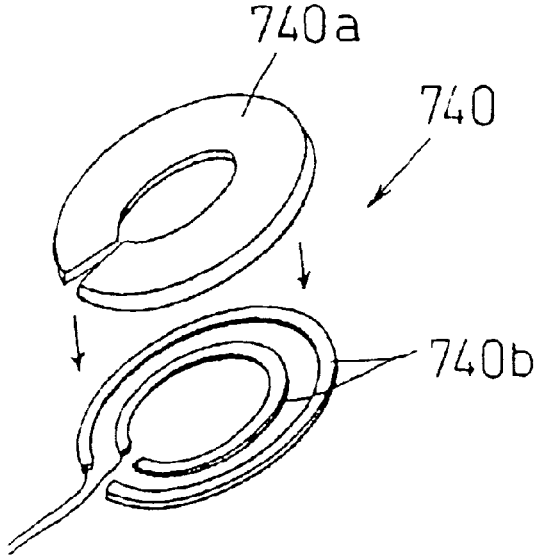

In FIG. 61 and FIG. 62 that show the mounting construction of the therapeutic member 726, the supporting arm 725 is provided with the supporting shaft 730 having its axis in the lateral direction so as to project laterally inwardly, the therapeutic member 726 comprises a boss body 731 at the center thereof, and the boss body 731 is rotatably fitted on the supporting shaft 730. On the tip of the supporting shaft 730, a mounting nut 732 for preventing the therapeutic member 726 from falling off is engaged via a washer (holding member) 732*a*.

The boss body 731 comprises a cylindrical potion 731*a* to be fitted in the inner periphery of the through hole formed at the center of the therapeutic member 726, and a flange portion 731*b* provided on the left side and the right side of the cylindrical portion 731*a* for interposing the therapeutic member 726 therebetween, and the midsection of the cylindrical portion 731*a* is divided into two portions on the left and the right sides. The outer peripheral surface of the therapeutic member 726 is formed into an arcuate inclined surface 726*a* curving inwardly toward the inner side in the lateral direction.

The detector 740 used here is, for example, as shown in FIG. 62(*b*), a pressure (pressure-sensitive) sensor in which a pressure-sensitive conductive elastomer 740*a* including conductive particles is adhered on an elastic material such as rubber as an insulating material between a pair of electrodes 740*b*. The pressure sensor 740 is formed into a doughnut disc shape so as to be fitted on the supporting shaft 730 between the supporting arm 725 and the boss body 731 so that the laterally outer surface thereof is brought into contact with the laterally inner surface of the supporting arm 725.

The laterally inner surface of the pressure sensor 740 is covered with a doughnut disc shaped cover plate 736 and the laterally inner surface of the cover plate 736 comes into contact with the boss body 731. The outer surface of the cover plate 736 is provided with a plurality of detent projections 742 projected therefrom, which is inserted into an insertion hole 743 formed on the supporting arm 725 so as to be movable along the axis of rotation of the supporting shaft 730.

In this arrangement, the cover plate 736 can push the pressure sensor 740 outward in the lateral direction with the rotation about the supporting shaft 730 restrained.

The cover plate 736 has a function as a pressurizing member for pressurizing the pressure sensor 740 as well as a function as a protecting member for preventing the direct contact between the rotating therapeutic member 726 and the pressure sensor 740 to protect the pressure sensor 740 from, for example, being worn.

There is provided spacer members 735, 741 fitted on the supporting shaft 730 for keeping the distance between the boss body 731 and the washer 732*a*.

These spacer members 735, 741 comprises a first member 735 formed of a synthetic resin such as polyethylene or the like into a doughnut shape, and a second member 741 formed of a resilient material such as polyethylene rubber, sponge rubber or the like, so that the lateral inner surface of the first member 735 is brought into contact with the boss body 731.

The second member 741 is axially compressed by tightening the mounting nut 732 with respect to the supporting shaft 730, and the resilient restoring force thereof presses the pressure sensor 740 via the first member 735, the boss body 731, and the cover plate 736, whereby the pressure sensor 740 is applied with a pre-load even when the therapeutic member 726 is not subjected to an external force in lateral direction.

The first member 735 and the cover plate 736 is preferably formed of a material of low frictional resistance or a structure in which a friction reduction process is applied to at least the surface that comes into contact with the boss body 731, whereby the rotation of the therapeutic member 726 about the supporting shaft 730 is performed smoothly.

In this arrangement, when allowing the therapeutic member 726 to perform a kneading motion, a reaction force from the user against its lateral movement provides a lateral load to the therapeutic member 726. In this case, since the therapeutic member 726 presses the pressure sensor 740 via the cover plate 736, the pressure sensor 740 detects the pressure.

The pressure thus detected is proportional to the strength of a kneading force, and thus adequate control of the kneading motion (for example, the control that reduces the speed when the detected value is large) can be performed by feeding the detected value back to the control element, thereby realizing more effective kneading motion.

Since pre-load is applied to the pressure sensor 740, the impairment of the accuracy of detection of the load applied to the therapeutic member 726 due to the rattling or the play between the therapeutic member 726 and the supporting arm 725 in the axial direction is prevented, thereby realizing the accurate pressure detection.

Since the pressure sensor 740 is provided on the side of the supporting arm 725 (substantially on the supporting shaft 730), not on the side of the therapeutic member 726 rotating about the supporting shaft 730, and the cover plate 736 is prevented from rotating about the supporting shaft 730, the position of the pressure sensor 740 is also controlled so as not to be rotated by the rotation of the therapeutic member 726, whereby the wiring of the pressure sensor 740 is facilitated and increase in complexity of the configuration of the therapeutic member 726 may be prevented.

The pressure sensor 740 is adapted to be used for determination of the vertical position of the user's shoulder S so that a massaging motion according to the physique of the user can be performed.

In other words, when a massaging motion is started and the therapeutic member 726 is moved from a position beside the head of the user downward until the upper therapeutic member 726 of the supporting arm 725 abuts against the shoulder S, a load F is applied to the therapeutic member 726 as a reaction force against the pressing force applied on the shoulder S.

Though the load F mainly has a vertical component, since the therapeutic member 726 is supported in a overhanging state on the lateral outside thereof, a moment as shown by the arrow M is generated and the moment M generates a force acting to incline the upper portion of the therapeutic member 726 laterally outwardly via the clearance between the supporting shaft 730 and the boss body 731.

The load F includes the lateral components that presses the therapeutic member 726 laterally outwardly as shown in a phantom line by the factors such as the inclined surface 726*a* on the outer periphery of the therapeutic member 726, a slight inclination provided to the supporting shaft 730, and the resilient deformation of the therapeutic member 726 itself.

The force that inclines the therapeutic member 726 and pushes the same outwardly is detected by the pressure sensor 740 via the cover plate 736, so that the vertical position of the user's shoulder S can be determined from the vertical position (height) of the massaging mechanism 707 (therapeutic member 726) at the moment when the force is detected. Therefore, by setting the height of the shoulder S as a reference position of the massaging motion, a massage according to the physique of the user is realized.

In other words, the pressure sensor 740 according to the present invention is used for detection of the load during the kneading motion, and for determination of the height of the shoulder, whereby cost reduction and miniaturization can be realized in comparison with the case where the separate pressure sensors are used.

While the vertical position of the shoulder S is determined by detecting the load applied from the user's shoulder S by means of the pressure sensor 740 in this embodiment, it is also possible to detect the load applied from the user's back or the hip by the pressure sensor 740 and to determine the vertical position of the hip or the like by analyzing the pressure distribution.

It is also possible to construct in such a manner that the vertical position of the shoulder is determined in the process of moving the therapeutic member 726 upward from the side of the user's hip, and in this case, the shoulder position can be determined from the position of the therapeutic member 726 at the moment when the therapeutic member 726 moves away from the shoulder upwardly and the load is not detected any more.

Figure 66:
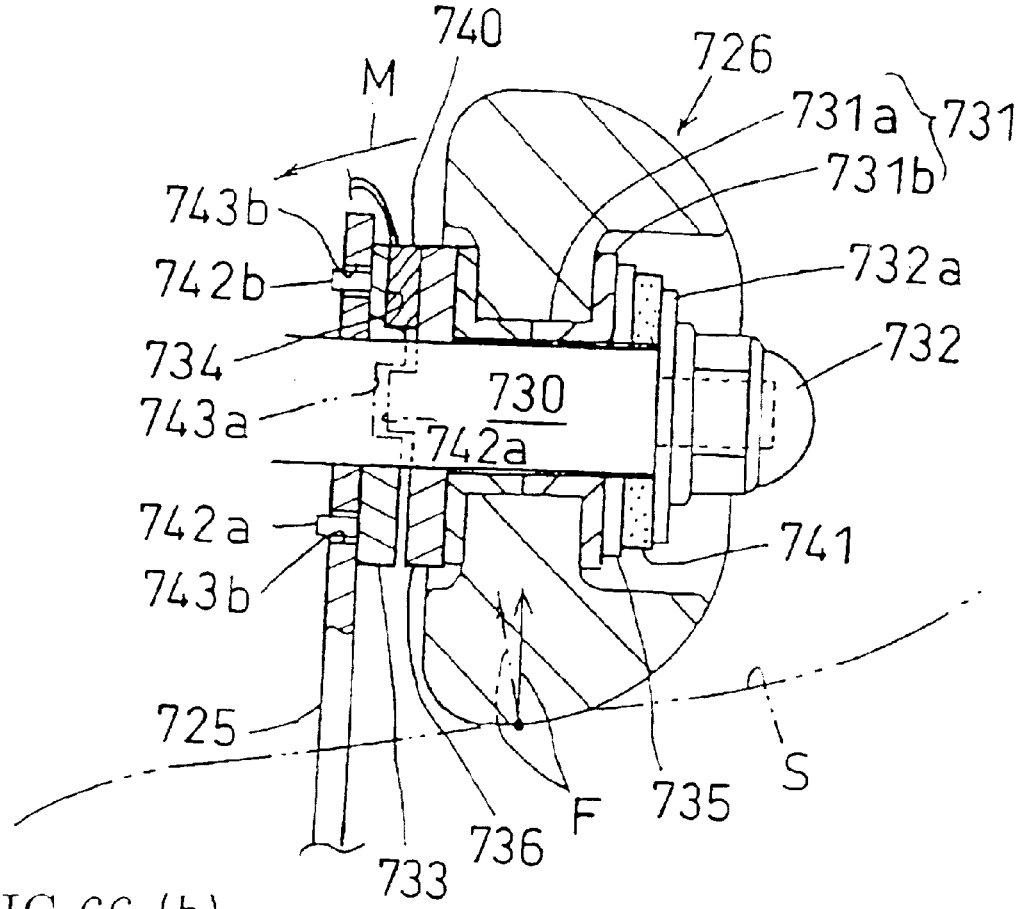
FIG. 66 shows a massaging apparatus according to another embodiment of the present invention, wherein (*a*) is a front cross-sectional view of the mounting portion of the therapeutic member, and (*b*) is an exploded perspective view of the same.
Figure 66:
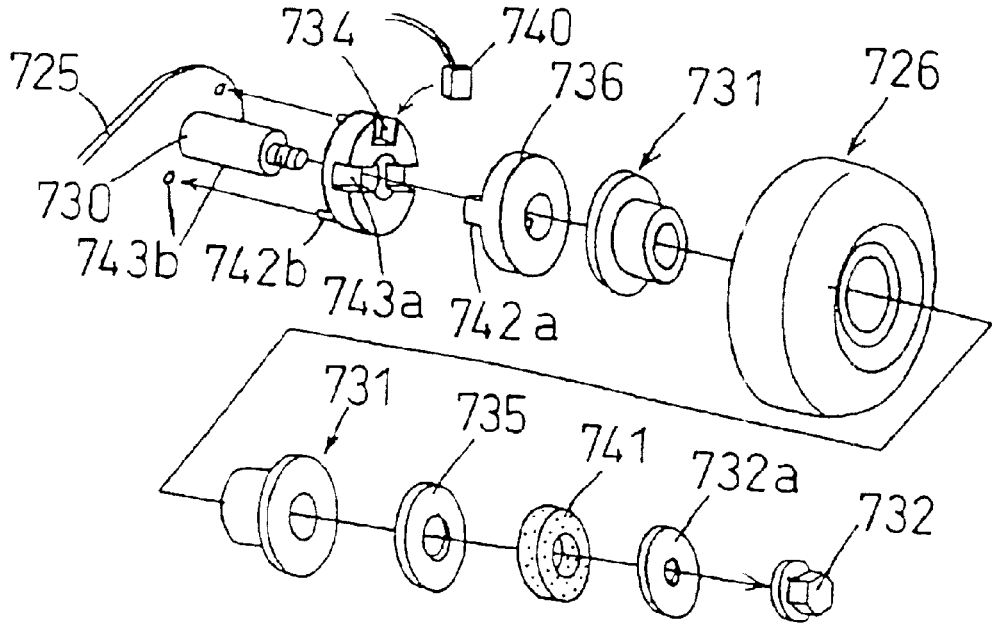

FIG. 66 shows another embodiment of the present invention.

In this embodiment, the pressure sensor 740 is provided not around the circumference of the supporting shaft 730, but partially at a portion corresponding to the upper portion of the therapeutic member 726, and the pressure sensor 740 is mounted to the side of the supporting arm 725 via the mount 733 mounted on the supporting shaft 730.

The mount 733 is formed into a doughnut shape and fitted on the supporting shaft 730, and formed with a recessed storing portion 734 for fitting the pressure sensor 740 therein on the upper portion of the laterally inner surface. In addition, recessed portions 743*a* are formed at the front and rear portions of the same surface, so that the detent projections 742*a* formed at the front and rear portions of the laterally outer surface of the cover plate 736 is fitted therein to prevent the relative rotation between the mount 733 and the cover plate 736.

The laterally outer surface of the mount 733 is formed with a plurality of second detent projections 742*b* projecting therefrom, which are inserted into through holes 743*b* formed on the supporting arm 725, so that the rotation of the mount 733 about the supporting shaft 730 is prevented.

When the pressure sensor 740 is fitted into the storing portion 743, a slight gap is formed between the mount 733 and the cover plate 736, so that the pressure sensor 740 can be pressed within the range of the gap.

In this embodiment, since the pressure sensor 740 is provided partially about the supporting shaft 730, the range of the load to be detected decreases in comparison with FIG. 61 to FIG. 65. However, since the pressure sensor 740 is provided corresponding to the upper portion of the therapeutic member 726, a force that is generated by contact between the therapeutic member 726 and the shoulder S for inclining the upper side of the therapeutic member 726 laterally outward can reliably be detected.

Since the pressure sensor 740 is small and simple in construction, cost reduction can be realized, and rotation about the supporting shaft 730 of the pressure sensor 740 is prevented as the above-described embodiment described in conjunction with FIG. 61 to FIG. 65, wiring can easily be performed.

Since the pressure sensor 740 is pressed only within the range of the gap between the mount 733 and the cover plate 736, even when excessive load is applied to the therapeutic member 726, no overload acts upon the pressure sensor 740, thereby preventing damage of the pressure sensor 740.

The mount 733 may be formed integrally with the supporting arm 725, or formed separately and bonded to the supporting arm 725 by welding or the like. The supporting shaft 730 may be formed integrally with the supporting arm 725 or formed separately and bonded by the welding or the like.

Figure 67:
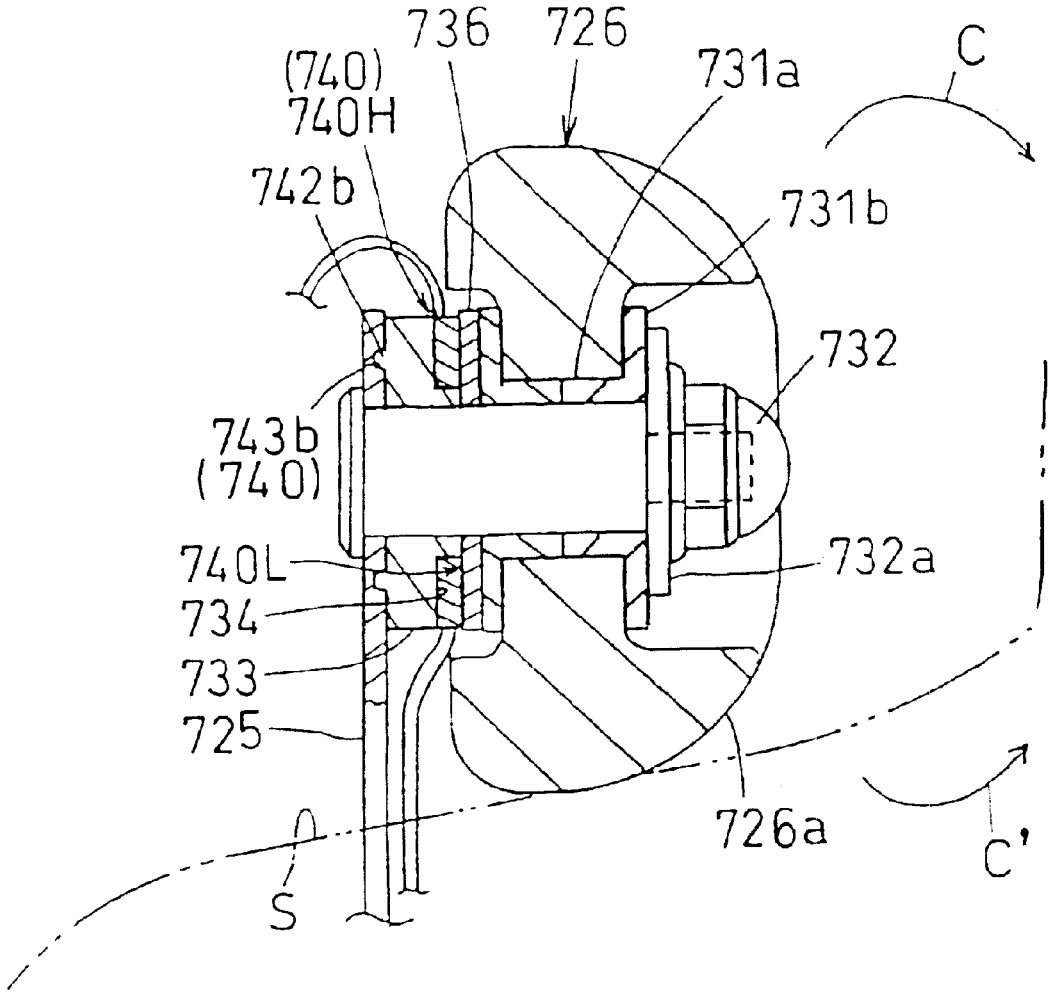
FIG. 67 shows a massaging apparatus according to another embodiment of the present invention, wherein (*a*) is a front cross-sectional view of the mounting portion of the therapeutic member, and (*b*) is a perspective view of the supporting bed and the pressure sensor.
Figure 67:
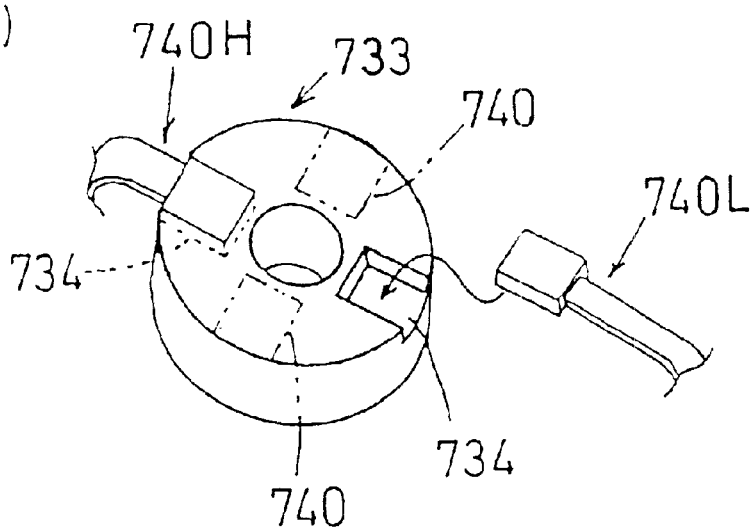

FIG. 67 shows another embodiment of the present invention.

In this embodiment, the pressure sensors 740 (740H, 740L) are provided not only at the upper position of the mount 733, but also at the lower portion thereof via the storing portions 734, and the cover plate 736 is formed of a resilient material such as polyethylene rubber or the like, and the spacer member between the boss body 731 and the washer 732*a* is omitted.

In this embodiment, since the cover plate 736 is formed of a resilient member, tightening the mounting nut 732 with respect to the supporting shaft 730 compresses the cover plate 736 between the boss body 731 and the mount 733, and its resilient restoring force presses the pressure sensor 740 to provide pre-load.

The cover plate 736 can enter into the storing portion 734 by being resiliently deformed, and thus it can press the pressure sensor 740 when the surface of the pressure sensor 740 is projecting from the surface of the mount 733 as a matter of course, even when the surface of the pressure sensor 740 is in the same level as or lower than the surface of the mount 733. However, since there is a limit to the amount of entrance of the cover plate 736 into the storing portion 734, even when excessive load is applied to the therapeutic member 726, overload onto the pressure sensor 740 can be prevented.

In this embodiment, since the pressure sensors 740 are provided at the upper and lower positions of the mount 733, the lateral load applied toward the upper portion or the lower portion of the therapeutic member 726 can be detected independently when performing a kneading motion or the like.

In other words, a kneading motion by the therapeutic member 726 performs circulating movement having components not only in the lateral direction, but also in the vertical direction as shown by the arrow C, C', and thus the different loads are applied respectively to the upper portion and the lower portion of the therapeutic member 726 in a complex manner depending on the orientation (kneading down C and kneading up C') or the portion to be massaged (shoulder, back). In this case, detail kneading control can be performed by detecting the extent of the load applied to each portion every time in detail by the upper and lower pressure sensors 740H, 740L, and feeding detected information back to the control element.

In this embodiment, as shown in a phantom line, the pressure sensor 740 may be provided also on the front portion and the rear portion of the mount 733 so that further detail pressure detection can be made. In this embodiment, there is preferably provided a spacer member (first member) 735 as shown in the embodiment described in conjunction with FIG. 61 to FIG. 65 or FIG. 66 between the cover plate 736 and the boss body 731, whereby rotation of the therapeutic member 726 can be performed smoothly and the cover plate 736 can be prevented from being involved in the rotation thereof.

The present invention is not limited to this embodiment, but rather be modifiable as needed.

For example, the spacer member 735, 741 in the embodiment shown in FIG. 61 to FIG. 65 or FIG. 66 may be omitted, and in this case, it is preferable to provide pre-load to the pressure sensor 740 with the boss body 731 of the therapeutic member 726 by tightening the mounting nut 732.

It is also possible to omit the mount 733 of this embodiment shown in FIG. 66 or FIG. 67, and mount the pressure sensor 740 directly to the plate surface of the supporting arm 25.

The therapeutic member 726 may be mounted to the supporting shaft 730 so as not to be rotated, and in this case, the pressure sensor 740 may be mounted on the therapeutic member 726 on the side surface thereof facing the supporting arm 725.

The massaging mechanism 707 may be adapted not to perform a rapping motion, but to perform a kneading motion only, or may be adapted to perform other massaging motions. Alternatively, the therapeutic member 726 may be driven by fluid pressure with using an air cell or the like. The left and the right therapeutic members 726 may be constructed so that the lateral distance therebetween is adjustable, or the massaging mechanism 707 may be arranged to be movable to the left and to the right as a whole.

Detailed configurations of the supporting arm, the drive arm, the therapeutic member, or detailed construction of the detector (the pressure sensor) can be modified as appropriate. In addition, the therapeutic bed of the massaging apparatus is not limited to the chair type, but it may be other configurations.

As is described thus far, in the present invention, the load applied to the therapeutic member can be detected accurately in a simple structure.

Since the detector for detecting the lateral load applied on the therapeutic member is used for detecting the strength of a kneading motion, and also for determining the vertical position of the shoulder or the like, cost reduction and miniaturization can be realized.

INDUSTRIAL APPLICABILITY

The present invention is useful as a massaging apparatus, and more specifically it is useful as a chair type massaging apparatus.

What is claimed is:

1. A massaging apparatus comprising:

a supporting arm directly connected to a therapeutic member by a supporting shaft, the supporting arm being pivotally supported on the massaging apparatus and the supporting arm being movable along a body of a user; and a pivotal-position-detecting sensor configured to detect that the supporting arm has reached a prescribed range of pivotal positions; and a control element configured to determine a position of a specific portion of the body of the user with respect to the massaging apparatus from a vertical position of the supporting arm at a moment when a pivotal position of the supporting arm has reached the prescribed range of pivotal positions.

2. The massaging apparatus as set forth in claim 1, wherein the pivotal-position-detecting sensor comprises an optical sensor having a light emitting element and a light receiving element, and whether or not the supporting arm has reached the prescribed range of pivotal positions is detected by determining if light from the light emitting element has been received by the light receiving element.

3. A massaging apparatus as set forth in claim 1, wherein the pivotal-position-detecting sensor comprises a limit switch, and the supporting arm reached the prescribed range of pivotal positions is detected by switching of the limit switch between ON and OFF.

4. A massaging apparatus as set forth in claim 1, wherein the pivotal-position-detecting sensor comprises a lead switch, and the lead switch is switched between ON and OFF by a change of a magnetic field at the moment when the supporting arm has reached the prescribed range of pivotal positions.

5. The massaging apparatus as set forth in claim 1, wherein the position of the specific portion of the body of the user to be determined is a position of a shoulder of the body of the user.

6. The massaging apparatus as set forth in claim 1, further comprising a second supporting arm and a second pivotal-position-detecting sensor, wherein the supporting arm and the second supporting arm constitute a pair of left and right supporting arms, and wherein the pivotal-position-detecting sensor is associated with the supporting arm and the second pivotal-position-detecting sensor is associated with the second supporting arm.

7. A massaging apparatus comprising:

a supporting arm directly connected to a therapeutic member by a supporting shaft, the supporting arm being pivotally supported on the massaging apparatus and the supporting arm being movable along a body of a user;

a pivotal-position-detecting sensor means for detecting a prescribed range of pivotal positions of the supporting arm; and a control element configured to determine a position of a specific portion of the body of the user with respect to the massaging apparatus from a vertical position of the supporting arm at a moment when a pivotal position of the supporting arm has reached the prescribed range of pivotal positions.

8. A massaging apparatus as set forth in claim 7, wherein the pivotal-position-detecting sensor comprises a variable resistor or an encoder of which an output varies according to the pivotal position of the supporting arm.

9. A massaging apparatus as set forth in claim 7, wherein the pivotal-position-detecting sensor comprises a magneto-electric converting element, and an output of the magneto-electric converting element varies with a variation in magnetic field due to the pivotal position of the supporting arm.

10. The massaging apparatus as set forth in claim 7, wherein the position of the specific portion of the body of the user to be determined is a position of a shoulder of the body of the user.

11. The massaging apparatus as set forth in claim 7, further comprising a second supporting arm and a second pivotal-position-detecting sensor, wherein the supporting arm and the second supporting arm constitute a pair of left and right supporting arms, and wherein the pivotal-position-detecting sensor is associated with the supporting arm and the second pivotal-position-detecting sensor is associated with the second supporting arm.

* * * * *